US011686109B2

(12) United States Patent
Charitou et al.

(10) Patent No.: US 11,686,109 B2
(45) Date of Patent: Jun. 27, 2023

(54) PANEL ASSEMBLY FOR FORMING A FLOOR OF A CONSTRUCTION COMPONENT

(71) Applicant: George Charitou, King City (CA)

(72) Inventors: George Charitou, King City (CA); Mubashir Choudhry, Oakville (CA)

(73) Assignee: George Charitou, Ontario (CA)

( * ) Notice: Subject to any disclaimer, the term of this patent is extended or adjusted under 35 U.S.C. 154(b) by 0 days.

(21) Appl. No.: 17/825,342

(22) Filed: May 26, 2022

(65) Prior Publication Data

US 2022/0282503 A1 Sep. 8, 2022

Related U.S. Application Data

(63) Continuation of application No. 17/410,291, filed on Aug. 24, 2021, which is a continuation of application (Continued)

(51) Int. Cl.
*E04G 11/38* (2006.01)
*E04G 9/02* (2006.01)

(Continued)

(52) U.S. Cl.
CPC ..... *E04G 11/38* (2013.01); *E04G 9/02* (2013.01); *E04G 11/48* (2013.01); *E04G 11/483* (2013.01); *E04G 11/50* (2013.01)

(58) Field of Classification Search
CPC ..... E04C 2009/026; E04C 2/38; E04C 2/384; E04C 2/388; E04G 2009/026;

(Continued)

(56) References Cited

U.S. PATENT DOCUMENTS 2,049,925 A * 8/1936 Rafter ..... E04C 2/384 52/657
2,805,506 A * 9/1957 Thompson ..... A47G 1/08 40/792

(Continued)

FOREIGN PATENT DOCUMENTS

CN 201043354 Y 4/2008
CN 202031172 U 11/2011

(Continued)

OTHER PUBLICATIONS

Translation of DE 102015223764 A1. (Year: 2017).*

(Continued)

*Primary Examiner* — Michael Safavi
(74) *Attorney, Agent, or Firm* — Carter, DeLuca & Farrell LLP; George Likourezos

(57) ABSTRACT

A prop head assembly is configured to be fixedly connected to a vertically-extending construction column, and also configured to support a horizontal construction beam assembly once the prop head assembly is fixedly connected to the vertically-extending construction column. The prop head assembly includes a first beam-locating feature and a second beam-locating feature. The first beam-locating feature is configured to selectively receive, at least in part, a beam-reference portion. The second beam-locating feature is also configured to receive the beam-reference portion once the beam-reference portion is inadvertently displaced away from the first beam-locating feature and from the vertically-extending construction column and toward the second beam-locating feature.

19 Claims, 53 Drawing Sheets

Related U.S. Application Data

No. 16/640,564, filed as application No. PCT/CA2018/050994 on Aug. 16, 2018, now Pat. No. 11,105,105, which is a continuation of application No. 15/730,820, filed on Oct. 12, 2017, now Pat. No. 11,225,802.

(51) Int. Cl.
*E04G 11/48* (2006.01)
*E04G 11/50* (2006.01)

(58) Field of Classification Search
CPC ... E04G 2009/028; E04G 11/38; E04G 11/48; E04G 11/50; E04G 9/02; E04G 11/483
USPC ..... 52/656.9
See application file for complete search history.

(56) References Cited

U.S. PATENT DOCUMENTS

| | | | | | |
|---|---|---|---|---|---|
| 3,127,926 | A * | 4/1964 | Adelt | E04C 2/54 | 160/381 |
| 3,592,289 | A * | 7/1971 | Aysta | F21V 33/0028 | 160/381 |
| 4,558,968 | A | 12/1985 | Meickl | | |
| 4,831,804 | A * | 5/1989 | Sayer | E06B 3/5842 | 52/204.593 |
| 5,062,733 | A | 11/1991 | Cholid et al. | | |
| 5,479,733 | A * | 1/1996 | Kusina | G09F 15/0012 | 403/403 |
| 5,579,621 | A * | 12/1996 | Fang | G09F 7/10 | 403/231 |
| 5,614,122 | A | 3/1997 | Schworer | | |
| 5,683,609 | A * | 11/1997 | Schworer | E04G 11/38 | 249/19 |
| 7,201,541 | B2 | 4/2007 | Barmann | | |
| 7,530,545 | B2 | 5/2009 | Gillespie et al. | | |
| 7,571,888 | B2 | 8/2009 | Arozena Bergaretxe | | |
| 7,640,871 | B2 * | 1/2010 | Arozena Bergaretxe | E04G 11/38 | 108/150 |
| 7,971,395 | B1 | 7/2011 | Vigil et al. | | |
| 8,051,626 | B2 | 11/2011 | Ubinana Felix | | |
| 8,262,056 | B2 | 9/2012 | Schwoerer | | |
| 8,327,596 | B2 * | 12/2012 | Bratton | E04C 3/28 | 403/255 |
| 10,053,875 | B1 | 8/2018 | Baron | | |
| 10,487,521 | B2 | 11/2019 | Baron et al. | | |
| 11,105,105 | B2 | 8/2021 | Charitou et al. | | |
| 2007/0137134 | A1 * | 6/2007 | Plagemann | E04C 3/28 | 52/656.9 |
| 2007/0200049 | A1 | 8/2007 | Coday | | |
| 2014/0059961 | A1 * | 3/2014 | Yin | B32B 13/04 | 52/426 |
| 2019/0010716 | A1 | 1/2019 | Baron et al. | | |
| 2019/0010717 | A1 | 1/2019 | Baron et al. | | |
| 2019/0063086 | A1 * | 2/2019 | Uribeetxebarria Zubia | E04G 11/52 | |
| 2019/0071885 | A1 | 3/2019 | Faresin | | |
| 2019/0078340 | A1 | 3/2019 | Faresin | | |

FOREIGN PATENT DOCUMENTS

| | | | | | |
|---|---|---|---|---|---|
| CN | 102587647 | A | | 7/2012 | |
| CN | 212897537 | U | * | 4/2021 | E04G 9/04 |
| CN | 113152878 | A | * | 7/2021 | E04G 17/02 |
| CN | 114482519 | A | * | 5/2022 | E04G 2009/028 |
| DE | 3004245 | A1 | | 8/1981 | |
| DE | 3316557 | C1 | | 10/1984 | |
| DE | 3921064 | A1 | | 1/1991 | |
| DE | 4204773 | A1 | | 8/1993 | |
| DE | 4305302 | A1 | | 8/1994 | |
| DE | 19636091 | A1 | | 3/1998 | |
| DE | 102010001042 | A1 | | 7/2011 | |
| DE | 102011082841 | A1 | | 3/2013 | |
| DE | 102015223764 | A1 | * | 6/2017 | E04G 11/483 |
| EP | 235069 | A | * | 9/1987 | E04B 1/2403 |
| EP | 0380149 | A1 | | 8/1990 | |
| EP | 1251222 | A2 | | 10/2002 | |
| EP | 1314835 | A1 | | 5/2003 | |
| EP | 1617013 | A1 | | 1/2006 | |
| EP | 2570568 | A2 | | 3/2013 | |
| EP | 2679744 | A1 | | 1/2014 | |
| EP | 2749713 | A1 | | 7/2014 | |
| EP | 2789768 | A1 | * | 10/2014 | B29D 99/001 |
| EP | 3112556 | A1 | | 1/2017 | |
| EP | 3176349 | A1 | | 6/2017 | |
| EP | 3202998 | A1 | | 8/2017 | |
| FR | 2760482 | A1 | | 9/1998 | |
| FR | 3021985 | B1 | | 5/2018 | |
| GB | 1561377 | A | | 2/1980 | |
| GB | 2265654 | A | | 10/1993 | |
| GB | 2265655 | A | | 10/1993 | |
| GB | 2287487 | A | * | 9/1995 | E04B 9/064 |
| KR | 100454787 | B1 | * | 11/2004 | E04G 2009/028 |
| KR | 200448085 | Y1 | * | 3/2010 | E04G 2009/028 |
| KR | 20100009969 | U | * | 10/2010 | E04G 2009/028 |
| KR | 20150116373 | A | * | 10/2015 | E04G 2009/028 |
| KR | 20180119830 | A | * | 11/2018 | E04G 2009/028 |
| KR | 20200071648 | A | * | 6/2020 | E04G 2009/028 |
| KR | 102151343 | B1 | * | 9/2020 | E04G 2009/208 |
| MX | 2018009142 | A | | 11/2018 | |
| WO | WO-9106730 | A | * | 5/1991 | E04G 9/02 |
| WO | 0169014 | A1 | | 9/2001 | |
| WO | 02084050 | A1 | | 10/2002 | |
| WO | 2006100694 | A1 | | 9/2006 | |
| WO | 2011089148 | A1 | | 7/2011 | |
| WO | WO-2017093221 | A1 | * | 6/2017 | E04G 11/483 |
| WO | 2019156958 | A1 | | 8/2019 | |
| WO | WO-2020122597 | A1 | * | 6/2020 | E04G 9/02 |

OTHER PUBLICATIONS

Translation of KR 20150116373 A. (Year: 2015).*
Translation of KR 200448085 Y1. (Year: 2010).*
Indian Office Action including English translation, dated Jan. 14, 2021, issued in corresponding Indian Application No. 202017008149, 6 pages.
Extended European Search Report dated Apr. 23, 2021, issued in corresponding European Appln. No. 18/866,931, 10 pages.
Simon Webster, International Search Report for PCT/CA2018/050994, dated Nov. 7, 2018.
Simon Webster, Written Opinion of the ISA for PCT/CA2018/050994, dated Nov. 7, 2018.
Chinese Office Action dated Aug. 4, 2021 (10 pages), issued in corresponding CN Appln. No 201880055640 including English translation (12 pages), total of 22 pages.
Japanese Office Action issued by the Japanese Patent Office in connection with Japanese Patent Application No. 2020-514717, dated Feb. 13, 2023. (English Translation Attached).

* cited by examiner

PANEL ASSEMBLY FOR FORMING A FLOOR OF A CONSTRUCTION COMPONENT

CROSS-REFERENCE TO RELATED APPLICATIONS

This application is a continuation application of U.S. patent application Ser. No. 17/410,291, filed on Aug. 24, 2021, which is a continuation application of U.S. patent application Ser. No. 16/640,564, filed on Feb. 20, 2020 (now U.S. Pat. No. 11,105,105), which is a National Stage Entry of PCT/CA2018/050994, filed on Aug. 16, 2018, which claims the benefit of and priority to U.S. patent application Ser. No. 15/730,820, filed on Oct. 12, 2017.

TECHNICAL FIELD (Associated with or Relates to Prop-Head Assembly)

This document relates to (and is not limited to) the technical field of a construction component with reference to the embodiments of FIG. 1 to FIG. 81, and the construction component may include and is not limited to (with reference to FIG. 1 to FIG. 30) a prop-head assembly, and/or a prop-head assembly for a vertically-extending construction column and for a horizontal construction beam assembly, and/or a structure (such as a building, a bridge, etc.) having a prop-head assembly, and/or a method associated with a construction component (such as, a prop-head assembly), etc.

BACKGROUND

Shoring is a process of temporarily supporting a structure (such as, a building, a vessel, a trench, etc.) with shores (also called props or supports) when there is a danger of collapse of the structure or during construction, repairs or alterations (of the structure). Shoring may be vertical, angled, or horizontal. For instance, a building component (such as, a prop, a prop assembly, etc.) is an object (also called a support) placed beneath and/or against a structure (or part of the structure) configured to keep (prevent) the structure from falling or shaking, etc.

SUMMARY (Associated with or Relates to Prop-Head Assembly)

It will be appreciated that there exists a need to mitigate (at least in part) at least one problem associated with the existing props (also called the existing technology). After much study of the known systems and methods with experimentation, an understanding (at least in part) of the problem and its solution has been identified (at least in part) and is articulated (at least in part) as follows:

A horizontal construction beam assembly is supportable (configured to be supported) by a beam-locating feature of a prop-head assembly. The prop-head assembly is fixedly attachable to (configured to be fixedly connected to) a vertically-extending construction column. Once the horizontal construction beam assembly is received or supported by the first beam-locating feature of the prop-head assembly, the horizontal construction beam assembly, in use, remains stationary relative to the vertically-extending construction column (and also remains stationary relative to the prop-head assembly).

However, inadvertent (unwanted) lateral movement of the horizontal construction beam assembly (away from the first beam-locating feature and the vertically-extending construction column) leads to (causes) a dangerous condition in which the horizontal construction beam assembly may fall (drop) away from the prop-head assembly to the working surface. It is a potentially dangerous case where the horizontal construction beam assembly becomes inadvertently or accidentally displaced from (moved away from) the first beam-locating feature of the prop-head assembly, which may lead to unwanted injury to workers, damage to the construction site and/or delay in construction scheduling.

In view of the foregoing, to mitigate the above problem, what may be needed is an assembly providing (configured to provide) a fail-safe feature. The fail-safe feature reduces (is configured to reduce) (at least in part) inadvertent displacement of a beam assembly once the beam assembly is placed in a relatively stationary position (in which the beam assembly may be utilized as part of a structure).

In view of the foregoing, to mitigate the above problem, what may be needed is a prop-head assembly including (and is not limited to) a first beam-locating feature and a second beam-locating feature, in which the second beam-locating feature is receivable of (is configured to receive) the beam-reference portion of the horizontal construction beam assembly once the horizontal construction beam assembly is inadvertently displaced (moved) away from the first beam-locating feature and toward the second beam-locating feature.

To mitigate, at least in part, at least one problem associated with the existing technology, there is provided (in accordance with a major aspect) an apparatus. The apparatus is provided for a column, and for a horizontal construction beam assembly having a beam-reference portion. The apparatus includes and is not limited to (comprises) a prop-head assembly fixedly connectable (configured to be fixedly connected) to the column. The prop-head assembly also supports (is also configured to support), at least in part, the horizontal construction beam assembly once the prop-head assembly is fixedly connected to the column. The prop-head assembly includes (and is not limited to) a first beam-locating feature selectively receives (is configured to selectively receive), at least in part, the beam-reference portion. The prop-head assembly also includes (and is not limited to) a second beam-locating feature that is spaced apart from the first beam-locating feature. The second beam-locating feature selectively receives (is configured to selectively receive), at least in part, the beam-reference portion. The second beam-locating feature receives (is configured to receive) the beam-reference portion of the horizontal construction beam assembly once the beam-reference portion of the horizontal construction beam assembly is inadvertently displaced away from the first beam-locating feature and from the column and toward the second beam-locating feature.

To mitigate, at least in part, at least one problem associated with the existing technology, there is provided (in accordance with a major aspect) an apparatus. The apparatus is provided for a column, and for a horizontal construction beam assembly having a beam-reference portion. The apparatus includes and is not limited to (comprises) a prop-head assembly that is fixedly connectable to (configured to be fixedly connected to) the column. The prop-head assembly also supports (is also configured to support), at least in part, the horizontal construction beam assembly once the prop-head assembly is fixedly connected to the column. The prop-head assembly includes (and is not limited to) a first beam-locating feature selectively receives (configured to selectively receive) the beam-reference portion of the horizontal construction beam assembly (this is done in such a way that the first beam-locating feature, in use, locates the beam-reference portion of the horizontal construction beam assembly at a first stationary position relative to the column once the first beam-locating feature, in use, selectively receives the beam-reference portion). The prop-head assembly also includes (and is not limited to) a second beam-locating feature spaced apart from the first beam-locating feature. The second beam-locating feature selectively receives (is configured to selectively receive) the beam-reference portion of the horizontal construction beam assembly (this is done in such a way that the second beam-locating feature, in use, locates the beam-reference portion of the horizontal construction beam assembly at a second stationary position relative to the column once the second beam-locating feature, in use, selectively receives the beam-reference portion). The second beam-locating feature also receives (is also configured to receive) the beam-reference portion of the horizontal construction beam assembly once the beam-reference portion of the horizontal construction beam assembly is inadvertently displaced away from the first beam-locating feature and also displaced away from the column.

To mitigate, at least in part, at least one problem associated with the existing technology, there is provided (in accordance with a major aspect) a method. The method is for the operating a prop-head assembly provided for a column, and for a horizontal construction beam assembly having a beam-reference portion. The method includes and is not limited to (comprises) fixedly connecting the prop-head assembly to the column. The method also includes (and is not limited to) using the prop-head assembly to support, at least in part, the horizontal construction beam assembly once the prop-head assembly is fixedly connected to the column. The method also includes (and is not limited to) selectively receiving, at least in part, the beam-reference portion at a first beam-locating feature of the prop-head assembly. The method also includes (and is not limited to) selectively receiving, at least in part, the beam-reference portion at a second beam-locating feature, in which the second beam-locating feature is spaced apart from the first beam-locating feature. The method also includes (and is not limited to) receiving the beam-reference portion at the second beam-locating feature once the beam-reference portion is inadvertently displaced away from the first beam-locating feature and from the column and toward the second beam-locating feature.

To mitigate, at least in part, at least one problem associated with the existing technology, there is provided (in accordance with a major aspect) an apparatus. The apparatus includes and is not limited to (comprises) a structure. The structure may include a home, a building, a vessel, a bridge, a trench, a man-made formation, etc., and any equivalent thereof. The structure includes (and is not limited to) a synergistic combination of assemblies, etc., such as a vertically-extending construction column is positionable (configured to be positionable) on a working surface (this is done in such a way that the vertically-extending construction column, in use, extends vertically above the working surface once the vertically-extending construction column, in use, is positioned on the working surface). The structure also includes (and is not limited to) a horizontal construction beam assembly having a beam-reference portion. The structure also includes (and is not limited to) a prop-head assembly fixedly connectable (configured to be fixedly connected) to the vertically-extending construction column. The prop-head assembly supports (is also configured to support), at least in part, the horizontal construction beam assembly once the prop-head assembly is fixedly connected to the vertically-extending construction column.

Other aspects are identified in the claims. Other aspects and features of the non-limiting embodiments may now become apparent to those skilled in the art upon review of the following detailed description of the non-limiting embodiments with the accompanying drawings. This Summary is provided to introduce concepts in simplified form that are further described below in the Detailed Description. This Summary is not intended to identify key features or essential features of the disclosed subject matter, and is not intended to describe each disclosed embodiment or every implementation of the disclosed subject matter. Many other novel advantages, features, and relationships will become apparent as this description proceeds. The figures and the description that follow more particularly exemplify illustrative embodiments.

BRIEF DESCRIPTION OF THE DRAWINGS

For Prop-Head Assembly Including Other Construction Components

The non-limiting embodiments may be more fully appreciated by reference to the following detailed description of the non-limiting embodiments when taken in conjunction with the accompanying drawings, in which:

FIG. 1 to FIG. 30 specifically depict (relate to or are associated with) views of embodiments of a construction component including a prop-head assembly; FIG. 54 to FIG. 81 specifically depict (relate to or are associated with) views of embodiments of a construction component including any one or more of (A) an infill beam; (B) a prop-head assembly; (C) a beam-end-support bracket; (D) a construction beam; (E) a premade panel; (F) a panel-frame assembly; (G) a beam-safety feature; and/or (H) a structure (such as a building, a bridge, etc.) having any one or more of the above listed items; and FIG. 1 and FIG. 2 depict a perspective view (FIG. 1) and a close-up perspective view (FIG. 2) of embodiments of a prop-head assembly; and FIG. 3, FIG. 4 and FIG. 5 depict a side view (FIG. 3), a side view (FIG. 4), and an end view (FIG. 5) of embodiments of a beam configured to be utilized with an embodiment of the prop-head assembly of FIG. 1 and/or FIG. 2; and FIG. 6 and FIG. 7 depict perspective views of embodiments of a beam end support of the embodiments of the beam of any one of FIG. 3, FIG. 4 and FIG. 5; and FIG. 8 and FIG. 9 depict a side view (FIG. 8) and a side view (FIG. 9) of embodiments of the prop-head assembly of any one of FIG. 1 and FIG. 2; and FIG. 10, FIG. 11 and FIG. 12 depict side views of embodiments of the prop-head assembly of FIG. 8; and FIG. 13 depicts a perspective view of an embodiment of the prop-head assembly of FIG. 8; and FIG. 14 depicts an exploded perspective view of an embodiment of the prop-head assembly of FIG. 8; and FIG. 15 and FIG. 16 depict perspective views of embodiments of the prop-head assembly of FIG. 8; and FIG. 17 depicts a partial perspective view of an embodiment of the prop-head assembly of FIG. 16; and FIG. 18 depicts a perspective view of an embodiment of the prop-head assembly of FIG. 8; and FIGS. 19-22 depict cross-sectional views of embodiments of the prop-head assembly of FIG. 19; and FIG. 23 depicts a cross-sectional view of an embodiment of the prop-head assembly of FIG. 19; and FIG. 24 depicts a side view of an embodiment of the prop-head assembly of FIG. 9; and FIG. 25 depicts a perspective view of an embodiment of the prop-head assembly of FIG. 9; and FIG. 26 depicts an exploded perspective view of an embodiment of the prop-head assembly of FIG. 9; and FIG. 27 and FIG. 28 depict perspective views of embodiments of the prop-head assembly of FIG. 25; and FIG. 29 depicts a cross-sectional view of an embodiment of the prop-head assembly of FIG. 28; and FIG. 30 depicts a cross-sectional view of an embodiment of the prop-head assembly of FIG. 28; and FIG. 31 and FIG. 32 depict a perspective view (FIG. 31) and a side view (FIG. 32) of embodiments of an apparatus configured for the construction, and support, of a building structure; and FIG. 33 depicts an end view of an embodiment of the apparatus of FIG. 31; and FIG. 34 and FIG. 35 depict top views of embodiments of the apparatus of FIG. 31, in which the apparatus includes a first construction beam assembly, a prop-head assembly, and a first concrete-slab frame assembly; and FIG. 36, FIG. 37, FIG. 38, FIG. 39, FIG. 40 and FIG. 41 depict side views (FIG. 36, FIG. 37, FIG. 40 and FIG. 41), a top view (FIG. 38) and a cross-sectional view (FIG. 39) of embodiments of the apparatus of FIG. 35, in which the first construction beam assembly is horizontally aligned while the first construction beam assembly is pivotally mounted to the prop-head assembly; and FIG. 42, FIG. 43, FIG. 44, FIG. 45, FIG. 46 and FIG. 47 depict side views (FIG. 42, FIG. 43, FIG. 46 and FIG. 47), a top view (FIG. 44) and a cross-sectional view (FIG. 45) of embodiments of the apparatus of FIG. 35, in which the first construction beam assembly is pivoted downwardly relative to the prop-head assembly, and the first construction beam assembly has a non-horizontal alignment while the first construction beam assembly is pivotally mounted to the prop-head assembly; and FIG. 48, FIG. 49, FIG. 50, FIG. 51, FIG. 52 and FIG. 53 depict side views (FIG. 48, FIG. 49, FIG. 52 and FIG. 53), a top view (FIG. 50) and a cross-sectional view (FIG. 51) of embodiments of the apparatus of FIG. 35, in which the first construction beam assembly is pivoted upwardly relative to the prop-head assembly, and the first construction beam assembly has a non-horizontal alignment while the first construction beam assembly is pivotally mounted to the prop-head assembly; and FIG. 54 depicts a perspective view of an embodiment of the apparatus including an infill beam; and FIG. 55 depicts a perspective view of an embodiment of a prop-head assembly, which may be used with the infill beam of FIG. 54; and FIG. 56 and FIG. 57 depict perspective views of embodiments of a beam-end-support bracket, which may be used with the infill beam of FIG. 54; and FIG. 58, FIG. 59 and FIG. 60 depict side views (side elevation views) of embodiments of the beam-end-support bracket of FIG. 56, which may be used with the prop-head assembly of FIG. 55; and FIG. 61 depicts a perspective view of an embodiment of the infill beam of FIG. 54; and FIG. 62 depicts a side view (side elevation view) of an embodiment of the infill beam of FIG. 54; and FIG. 63 depicts a perspective view of an embodiment of the infill beam of FIG. 54; and FIG. 64 depicts a perspective view (close-up perspective view) of an embodiment of the infill beam of FIG. 63; and FIG. 65 and FIG. 66 depict perspective views of embodiments of the beam-end-support bracket of FIG. 56; and FIG. 67 depicts a perspective view of an embodiment of the infill beam of FIG. 54; and FIG. 68 depicts a close-up perspective view of an embodiment of the infill beam of FIG. 67; and FIG. 69 and FIG. 70 depict a perspective view (FIG. 69) and a side view (FIG. 70) of an embodiment of the infill beam of FIG. 54; and FIG. 71 and FIG. 72 depict a perspective view (FIG. 71) and a close-up perspective view (FIG. 72) of embodiments of the infill beam of FIG. 54; and FIG. 73 depicts a perspective view (isometric view) of an embodiment of a panel-frame assembly (which may be utilized with, for instance, the infill beam depicted in FIG. 54, if so desired); and FIG. 74 depicts a cross-sectional view of a perimeter wall of the panel-frame assembly of FIG. 73; and FIG. 75 depicts an exploded view of the panel-frame assembly of FIG. 73; and FIG. 76 and FIG. 77 depict cross-sectional views of the panel-frame assembly of FIG. 75; and FIG. 78, FIG. 79 and FIG. 80 depict perspective views (FIG. 78 and FIG. 79) and a side elevation view (FIG. 80) of embodiments of a beam-safety feature of a construction beam; and FIG. 81 depicts a side view of an embodiment of the construction beam arranged in a vertically-stacked formation, one beam positioned over another.

Figure 1:
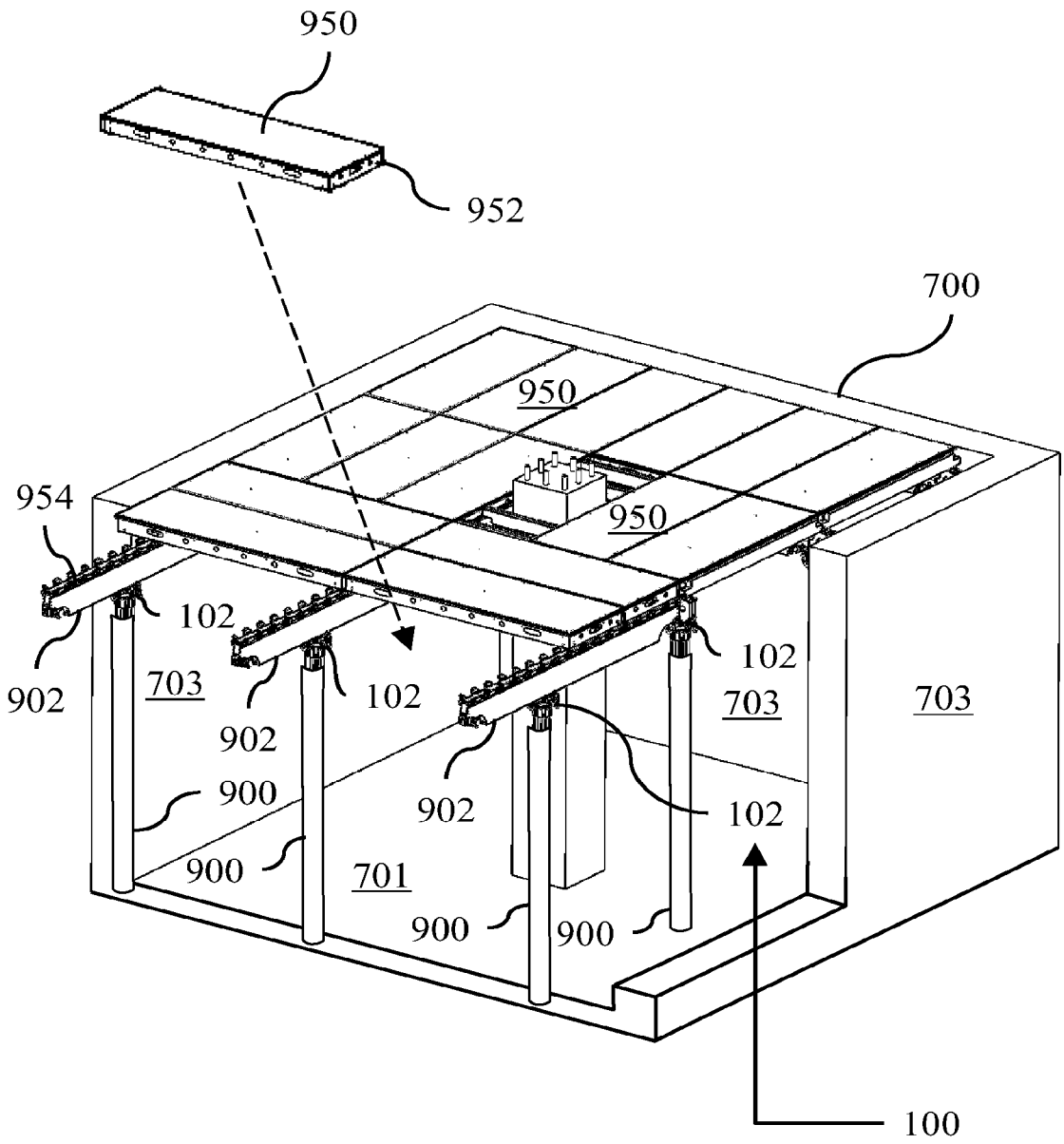
FIG. 1 to FIG. 81 generally depict (relate to or are associated with) views of embodiments of a construction component.

The drawings are not necessarily to scale and may be illustrated by phantom lines, diagrammatic representations and fragmentary views. In certain instances, details unnecessary for an understanding of the embodiments (and/or details that render other details difficult to perceive) may have been omitted. Corresponding reference characters indicate corresponding components throughout the several figures of the drawings. Elements in the several figures are illustrated for simplicity and clarity and have not been drawn to scale. The dimensions of some of the elements in the figures may be emphasized relative to other elements for facilitating an understanding of the various disclosed embodiments. In addition, common, but well-understood, elements that are useful or necessary in commercially feasible embodiments are often not depicted to provide a less obstructed view of the embodiments of the present disclosure.

LISTING OF REFERENCE NUMERALS USED IN THE DRAWINGS (ASSOCIATED WITH OR RELATES TO PROP-HEAD ASSEMBLY

100 apparatus
102 prop-head assembly
104 first beam-locating feature
105 first stationary position
106 second beam-locating feature
107 second stationary position
110 shackle assembly
112 prop base

114 load-receiving feature
202 first prop-head assembly
250 height
302 second prop-head assembly
304 first support element
306 second support element
308 lower portion
310 upper portion
350 height
502 first locator plate assembly
504 second locator plate assembly
700 structure
701 working surface
703 structural wall
802 primary beam, or first horizontal construction beam assembly
804 cross beam, or second horizontal construction beam assembly
900 vertically-extending construction column, or column
901 stability wire
902 beam, or horizontal construction beam assembly
903 column portion
904 beam-reference portion
905 beam-terminus receiver
906 beam end support
907 beam lock assembly
907A first beam lock assembly
907B second beam lock assembly
908 guide feature
909 lock receiver
912 angle
914 lock device
916 lock retainer
918 cavity
920 prop receiver
922 sidewall
950 concrete slab
952 frame assembly
954 frame-engagement device

DETAILED DESCRIPTION OF THE NON-LIMITING EMBODIMENT(S) (ASSOCIATED WITH OR RELATES TO PROP-HEAD ASSEMBLY

The following detailed description is merely exemplary and is not intended to limit the described embodiments or the application and uses of the described embodiments. As used, the word "exemplary" or "illustrative" means "serving as an example, instance, or illustration." Any implementation described as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure. The scope of the claim is defined by the claims (in which the claims may be amended during patent examination after the filing of this application). For the description, the terms "upper," "lower," "left," "rear," "right," "front," "vertical," "horizontal," and derivatives thereof shall relate to the examples as oriented in the drawings. There is no intention to be bound by any expressed or implied theory in the preceding Technical Field, Background, Summary or the following detailed description. It is also to be understood that the devices and processes illustrated in the attached drawings, and described in the following specification, are exemplary embodiments (examples), aspects and/or concepts defined in the appended claims. Hence, dimensions and other physical characteristics relating to the embodiments disclosed are not to be considered as limiting, unless the claims expressly state otherwise. It is understood that the phrase "at least one" is equivalent to "a". The aspects (examples, alterations, modifications, options, variations, embodiments and any equivalent thereof) are described regarding the drawings. It should be understood that the invention is limited to the subject matter provided by the claims, and that the invention is not limited to the particular aspects depicted and described. It will be appreciated that the scope of the meaning of a device configured to be coupled to an item (that is, to be connected to, to interact with the item, etc.) is to be interpreted as the device being configured to be coupled to the item, either directly or indirectly. Therefore, "configured to" may include the meaning "either directly or indirectly" unless specifically stated otherwise.

Figure 2:
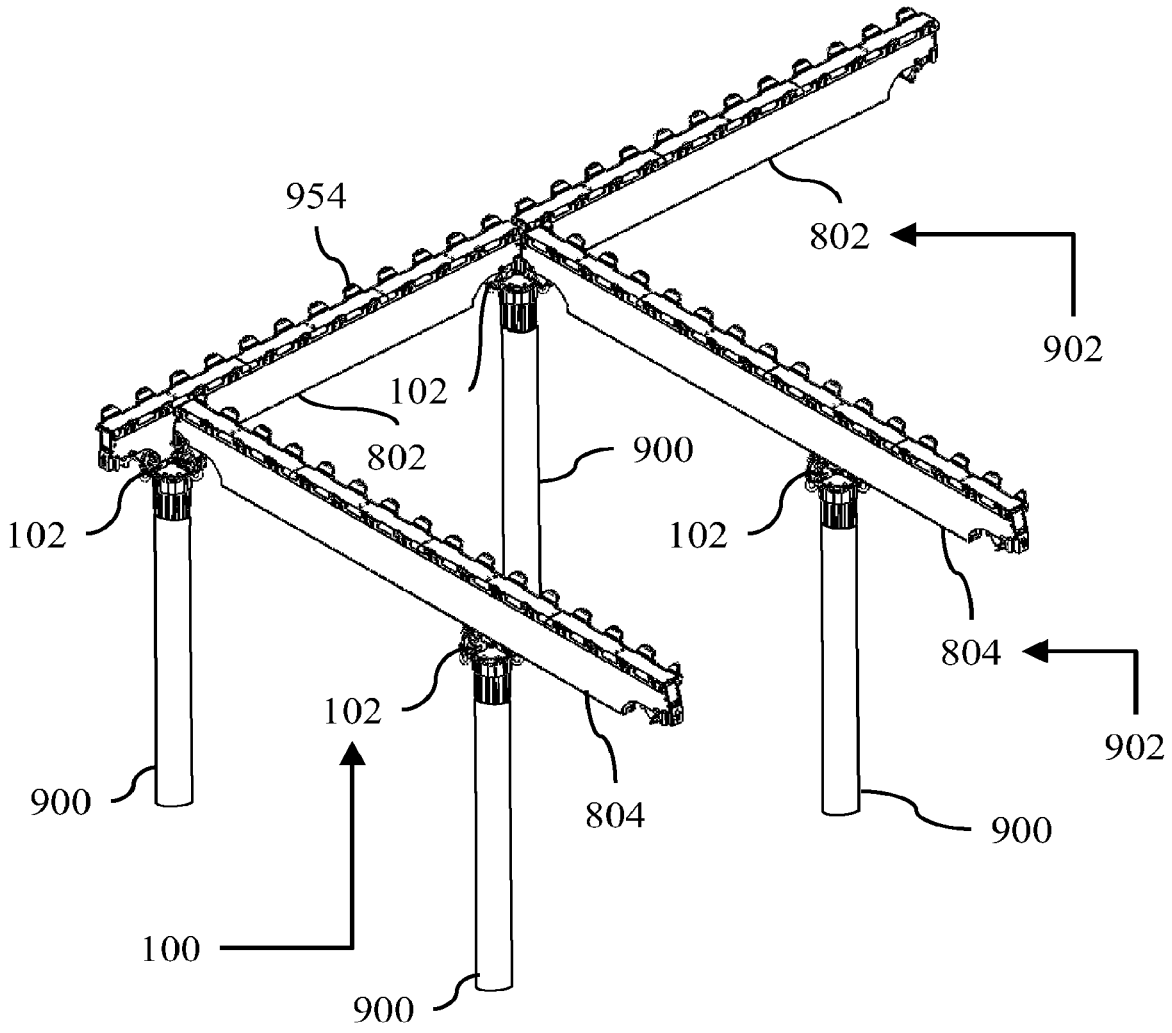

FIG. 1 and FIG. 2 depict a perspective view (FIG. 1) and a close-up perspective view (FIG. 2) of embodiments of a prop-head assembly 102. The prop-head assembly 102 is supportive of (is configured to support) (at least in part) a structure 700, and/or to provide assistance for the support of the weight of (or an aspect of) the structure 700 (or an aspect of the structure 700).

In accordance with the embodiment as depicted in FIG. 1 and FIG. 2, an apparatus 100 is provided for a vertically-extending construction column 900 (hereafter referred to as the column 900), and any equivalent thereof. The apparatus 100 is also provided for a horizontal construction beam assembly 902 and any equivalent thereof) having a beam-reference portion 904 (and any equivalent thereof, such as a beam pin, etc.). For the sake of easing the detailed description of the embodiments, the horizontal construction beam assembly 902 will be referred to as the beam 902. The beam-reference portion 904 may be called a beam-terminus location, a pin, or a beam pin, etc., and any equivalent thereof. The apparatus 100 includes and is not limited to (comprises) a prop-head assembly 102. The prop-head assembly 102 is utilized (configured to be utilized) (for construction) and/or installed (in combination with the column 900 and beam 902) in a structure 700 to be constructed (such as, a building, a bridge, etc., and any equivalent thereof). An embodiment of the structure 700 is partially depicted (under construction) in the embodiment of FIG. 1. The structure 700 may include (and is not limited to) a home, a building, a vessel, a bridge, a trench, a man-made formation, etc., and any equivalent thereof.

It will be appreciated that the apparatus 100 may be utilized as a temporary structure for forming a floor (poured concrete floor) of the structure 700; once the floor is formed, the apparatus 1100 may be removed, and relocated on the newly formed floor, so that, in this manner, the apparatus 1100 may be further utilized in the formation of another new floor to be located over the newly formed floor of the structure 700.

Referring to the embodiment as depicted in FIG. 1, the prop-head assembly 102, preferably, is provided for the column 900. An embodiment of the column 900 is partially depicted in the embodiment of FIG. 1. The column 900 is to be utilized or installed in the structure 700. For the sake of easing the detailed description of the embodiments, the vertically-extending construction column 900 is hereafter referred to as the column 900.

The structure 700 includes a working surface 701 (such as, a horizontal structural floor) on which the column 900 is positioned and extends therefrom. The structure 700 includes at least one instance of a structural wall 703 (also called a vertically extending wall). The vertically-extending construction column 900 is positionable (configured to be positionable) on the working surface 701 (this is done in such a way that the vertically-extending construction column 900, in use, extends vertically above the working surface 701 once the vertically-extending construction column 900, in use, is positioned on the working surface 701).

Referring to the embodiment as depicted in FIG. 1, the prop-head assembly 102, preferably, is provided for the beam 902 having the beam-reference portion 904. The beam 902 is to be utilized (in the construction of), or installed in, the structure 700.

Referring to the embodiment as depicted in FIG. 1, the prop-head assembly 102, preferably, is fixedly connectable (configured to be fixedly connected) to (an upper portion of) the column 900. The prop-head assembly 102 supports (is also configured to support), at least in part, the beam 902 (once the prop-head assembly 102 is fixedly connected to the column 900). Preferably, the prop-head assembly 102 is fixedly connectable (configured to be fixedly connectable) to a top section (distal end section) of the column 900. More preferably, the prop-head assembly 102 is fixedly connectable (configured to be fixedly connected) to the column 900 in such a way that the prop-head assembly 102 is not selectively movable along a length of the column 900.

Referring to the embodiment as depicted in FIG. 1, a concrete slab 950 is formed (positioned) in a frame assembly 952 (for instance, this is done by pouring cement into the frame assembly 952, and allowing the cement to harden to form the concrete slab 950). The beam 902 includes a frame-engagement device 954. The frame-engagement device 954 may be called or include upstanding ribs, a row of ribs, a double row of spaced apart ribs, etc., and any equivalent thereof. The frame-engagement device 954 extends, at least in part, along a length of the top section of beam 902. The frame-engagement device 954 selectively and securely engages (is configured to selectively and securely engage) with a lower section of the frame assembly 952. Preferably, the frame assembly 952 defines spaced apart channels for receiving (configured to receive) the ribs of the frame-engagement device 954. This is done in such a way that the frame assembly 952, in use, securely spans across and between (and selectively engages with) spaced apart instances of the beam 902 (which are aligned parallel with each other). In this way, a horizontal floor section may be constructed for the structure 700.

Referring to the embodiment as depicted in FIG. 1, the prop-head assembly 102, the beam 902 and the column 900 include strength components, such as metal components, made with a suitable material or materials (such as, a metal alloy, etc.) having sufficient strength characteristics needed to support the structure 700 (once the structure 700 is built). For instance, the strength component may include steel, wood, and/or reinforced concrete, etc.

Referring to the embodiment as depicted in FIG. 2, the beam 902 includes (or is) a primary beam 802 (also called a first horizontal construction beam assembly, construction beam assembly, or beam assembly). The primary beam 802 includes (is) a beam used as (configured as) a main horizontal support in a structure. The primary beam 802 may also be called (or is) a first primary beam, a first primary beam support, a girder, etc., and any equivalent thereof. For the sake of easing the detailed description of the embodiments, the primary beam 802 will be referred to as the primary beam 802 (for consistency of description).

The beam 902 includes (or is) a crossbeam 804 (also called a second horizontal construction beam assembly, etc.). The crossbeam 804 includes (is) a horizontal structural beam that runs (is aligned) perpendicular to the primary beam 802. The crossbeam 804 may also be called (or is) a secondary beam, a secondary girder, a crossbeam, a transverse beam, etc., and any equivalent thereof. For the sake of easing the detailed description of the embodiments, the crossbeam 804 will be referred to as the crossbeam 804 (for consistency of description).

The primary beam 802 (the primary beam) and the crossbeam 804 (the secondary beam or the cross beam) are to be positioned orthogonal relative to each other on a horizontal plane (forming a matrix pattern having matrix junctions as depicted in the embodiments of FIG. 1 and/or FIG. 2), on which the horizontal structural floor (as depicted in the embodiment of FIG. 1), which is formed by a plurality of the frame assembly 952 and the concrete slab 950, is positioned (securely positioned) thereon.

Referring to the embodiment as depicted in FIG. 2, the prop-head assembly 102 may be utilized or deployed for at least three scenarios or cases.

Figure 10:
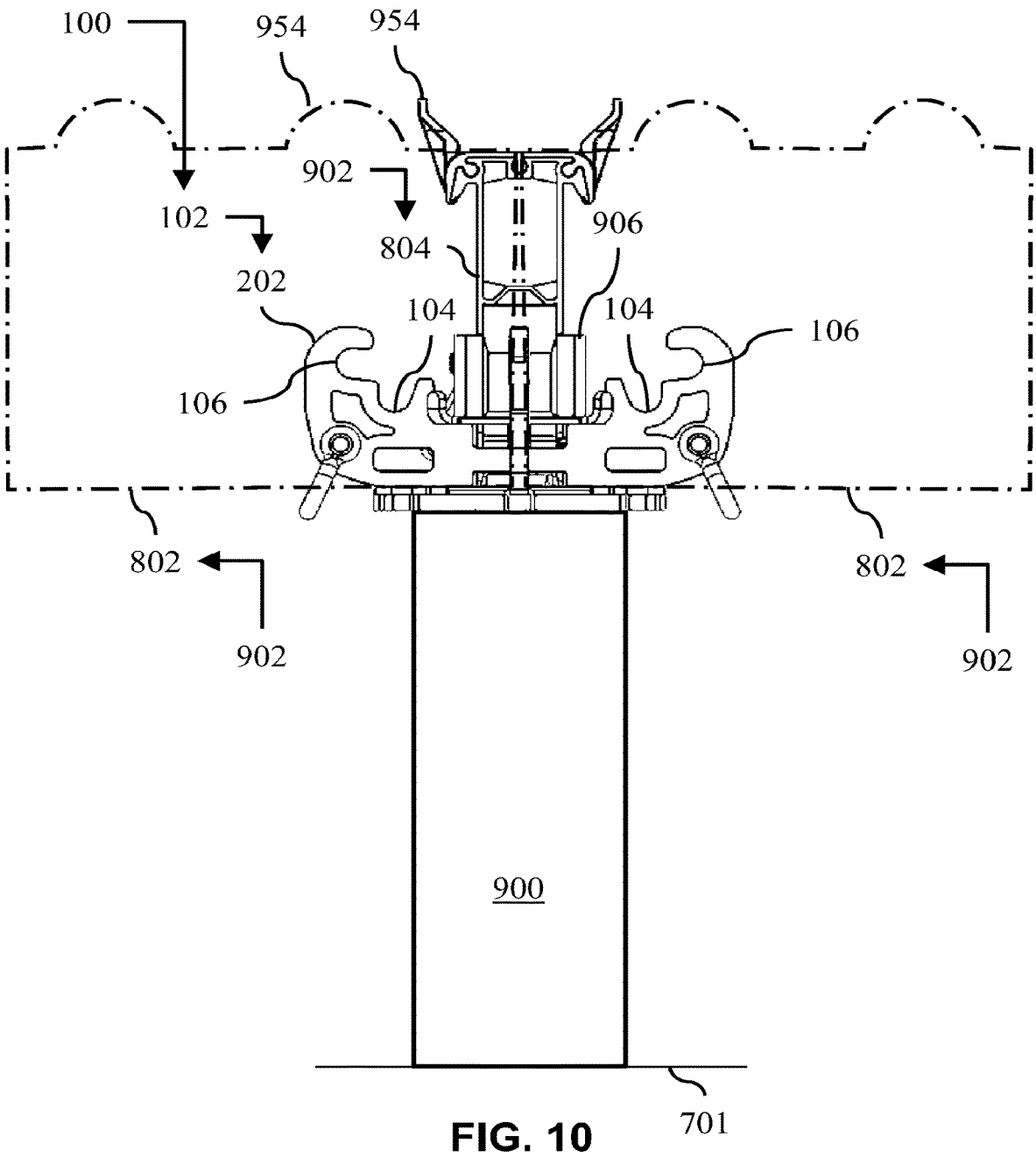

For instance, in accordance with a first deployment scenario (which is depicted in the embodiment of FIG. 10 and/or the embodiment of FIG. 12), the prop-head assembly 102 is positioned underneath a junction zone (matrix junction), in which the junction zone is positioned below (and supports) the end portions of end-to-end facing instances (the end portions) of the beam 902 (or the primary beam 802 or the crossbeam 804, as the case may be) are positioned to face each other in an end-to-end relationship (preferably at about 90 degrees relative to each construction beam in an orthogonal relationship). Preferably, the end portions of the instance of the beam 902 are positioned adjacent to each other in a close relationship (a proximate relationship or adjacent spatial position).

Figure 11:
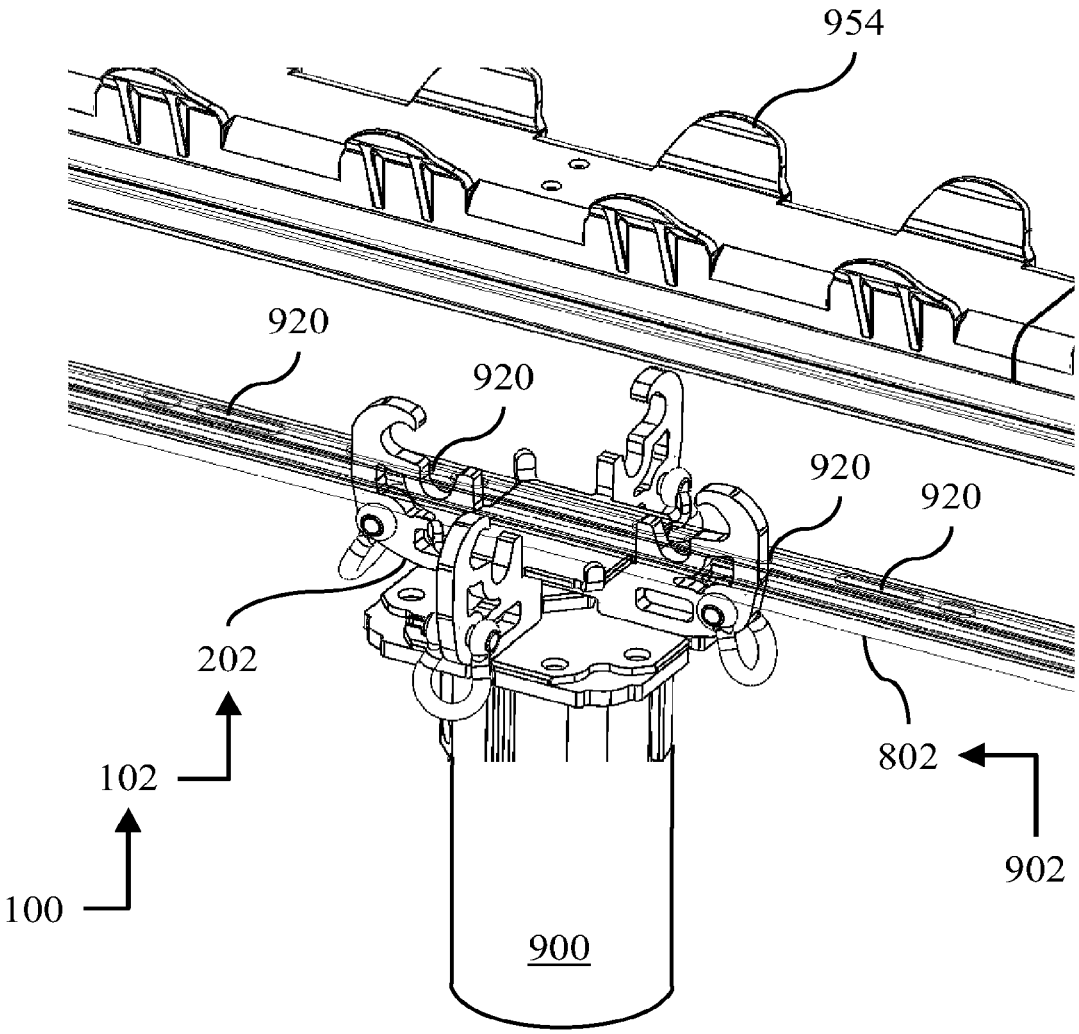

For instance, in accordance with a second deployment scenario (which is depicted in the embodiment of FIG. 11), the prop-head assembly 102 is positioned underneath (and contacts and supports) the bottom section of the beam 902, such as midway between the end sections of the beam 902 (or the primary beam 802 or the crossbeam 804, as the case may be).

Figure 24:
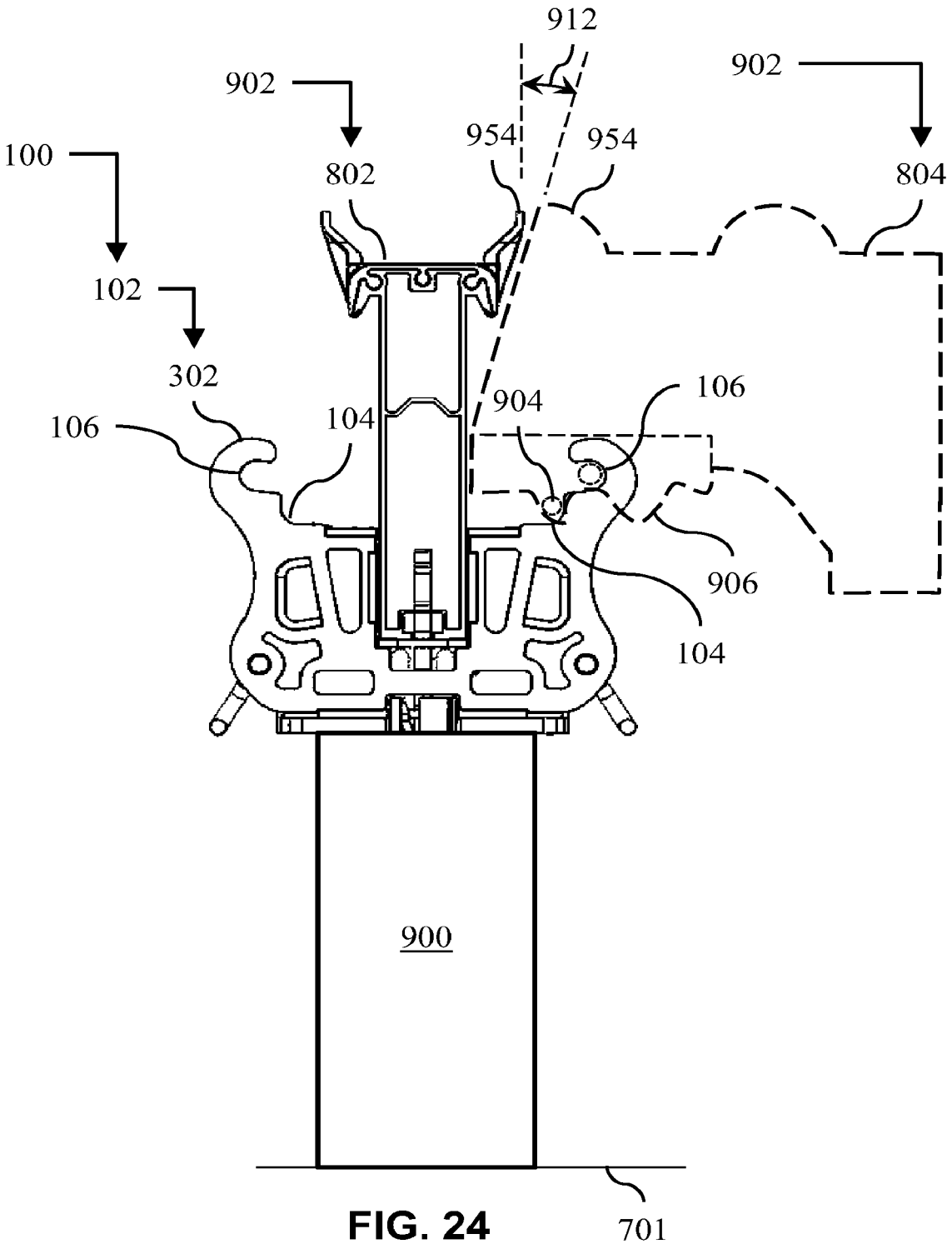

For instance, in accordance with a third deployment scenario (which is depicted in the embodiment of FIG. 24 and/or the embodiment of FIG. 27), the prop-head assembly 102 is positioned underneath (and supports) a junction zone, in which the junction zone is positioned below (and supports) the end portion of the crossbeam 804, and the end portion of the crossbeam 804 is positioned to face a sidewall of the primary beam 802. Preferably, the end portion of the crossbeam 804 is positioned adjacent to the sidewall of the primary beam 802 in a close relationship or a proximate relationship.

Figure 3:
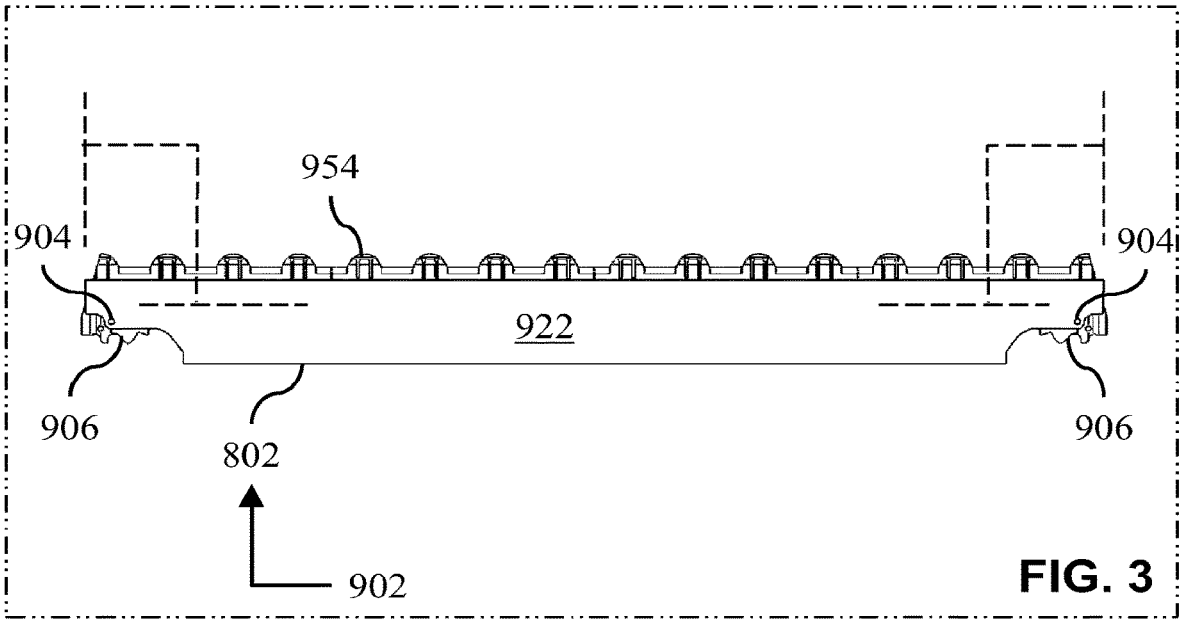
Figure 4:
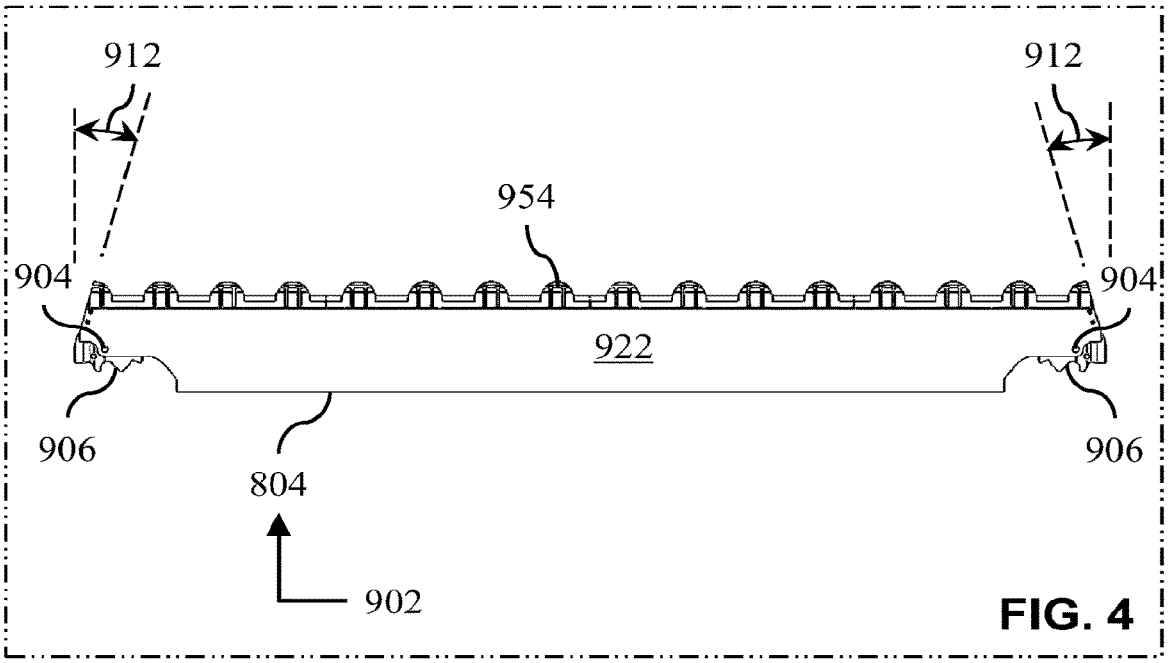
Figure 5:
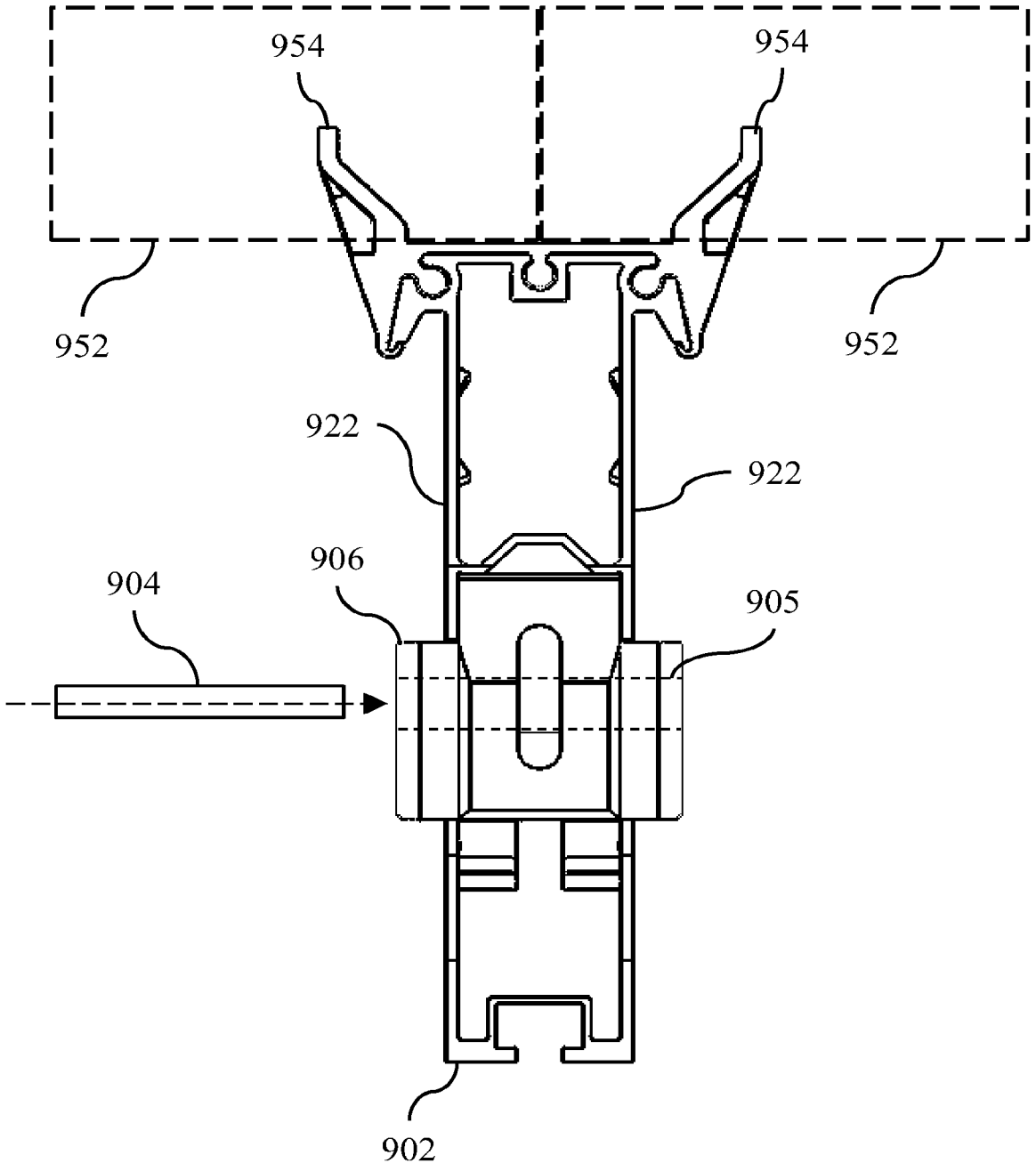

FIG. 3, FIG. 4 and FIG. 5 depict a side view (FIG. 3), a side view (FIG. 4), and an end view (FIG. 5) of embodiments of a beam 902 usable (configured to be utilized) with (or installed to) an embodiment of the prop-head assembly 102 of FIG. 1 and/or FIG. 2.

Figure 8:
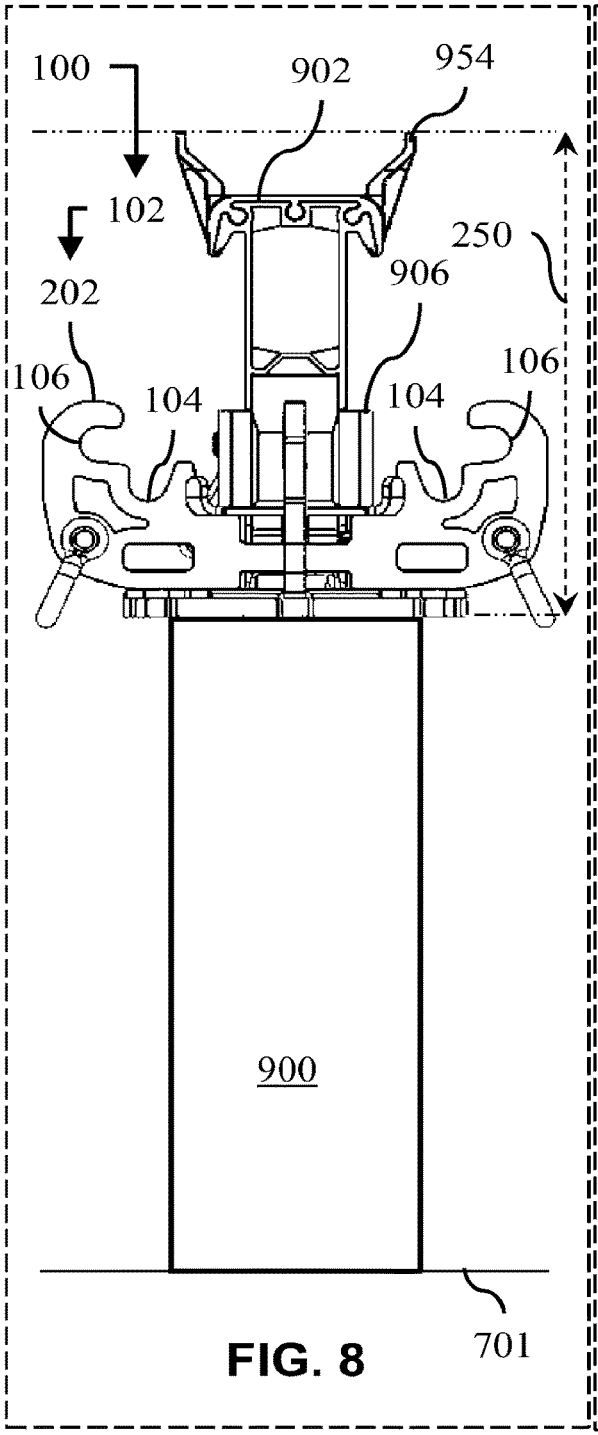

Referring to the embodiments as depicted in FIG. 3 and/or FIG. 4, the beam 902 has (includes) opposite end portions. Each of the opposite end portions includes a beam-reference portion 904 and a beam end support 906. The beam-reference portion 904 is selectively spatially located proximate (configured to be selectively spatially located proximate) to any one of the first beam-locating feature 104 and the second beam-locating feature 106 of the prop-head assembly 102 (which are depicted in the embodiment of FIG. 8 and/or the embodiment of FIG. 9). The beam end support 906 is affixed to the end portions of beam 902. The beam-reference portion 904 is positioned (located) in the beam end support 906. The beam end support 906 is positioned at the opposite end sections (opposite end portions) of beam 902. The beam end support 906 receives and supports (is configured to receive and support) the beam-reference portion 904. The beam 902 securely receives and holds (is configured to securely receive and hold) the beam end support 906 at the spaced apart distal end sections of beam 902. The weight of the beam 902 is to be transferred (at least in part) to the opposite ends of the beam 902 to the beam end support 906 (which is positioned at the opposite ends of beam 902). The weight of the beam 902 is transferred (at least in part) to the prop-head assembly 102 via the beam end support 906 (which is positioned at the opposite ends of beam 902).

Preferably, the weight of the horizontal construction beam assembly 902 is transferred, at least in part, to the prop-head assembly 102 via the beam end support 906, in which the beam end support 906 is positioned at the opposite ends of the horizontal construction beam assembly 902 (once the beam end support 906 of the horizontal construction beam assembly 902, in use, contacts, at least in part (either directly or indirectly), the prop-head assembly 102).

Referring to the embodiment as depicted in FIG. 3, the beam 902 includes a primary beam 802. The primary beam 802 includes a beam-reference portion 904 and a beam end support 906. The primary beam 802 has, preferably, a flat end portion that is aligned parallel to the vertical direction (once the primary beam 802 is positioned horizontally or along a horizontal direction).

Referring to the embodiment as depicted in FIG. 4, the beam 902 includes a crossbeam 804 (also called a cross beam). In accordance with an option, the end sections of the primary beam 802 (as depicted in the embodiment of FIG. 3) and the crossbeam 804 may be the same shape or profile, etc., if so desired. The crossbeam 804 includes a beam-reference portion 904 and a beam end support 906. The crossbeam 804 has, preferably, a tapered end portion that is aligned at an angle 912 that intersects the vertical direction (once the crossbeam 804 is positioned horizontally or along the horizontal direction).

Figure 12:
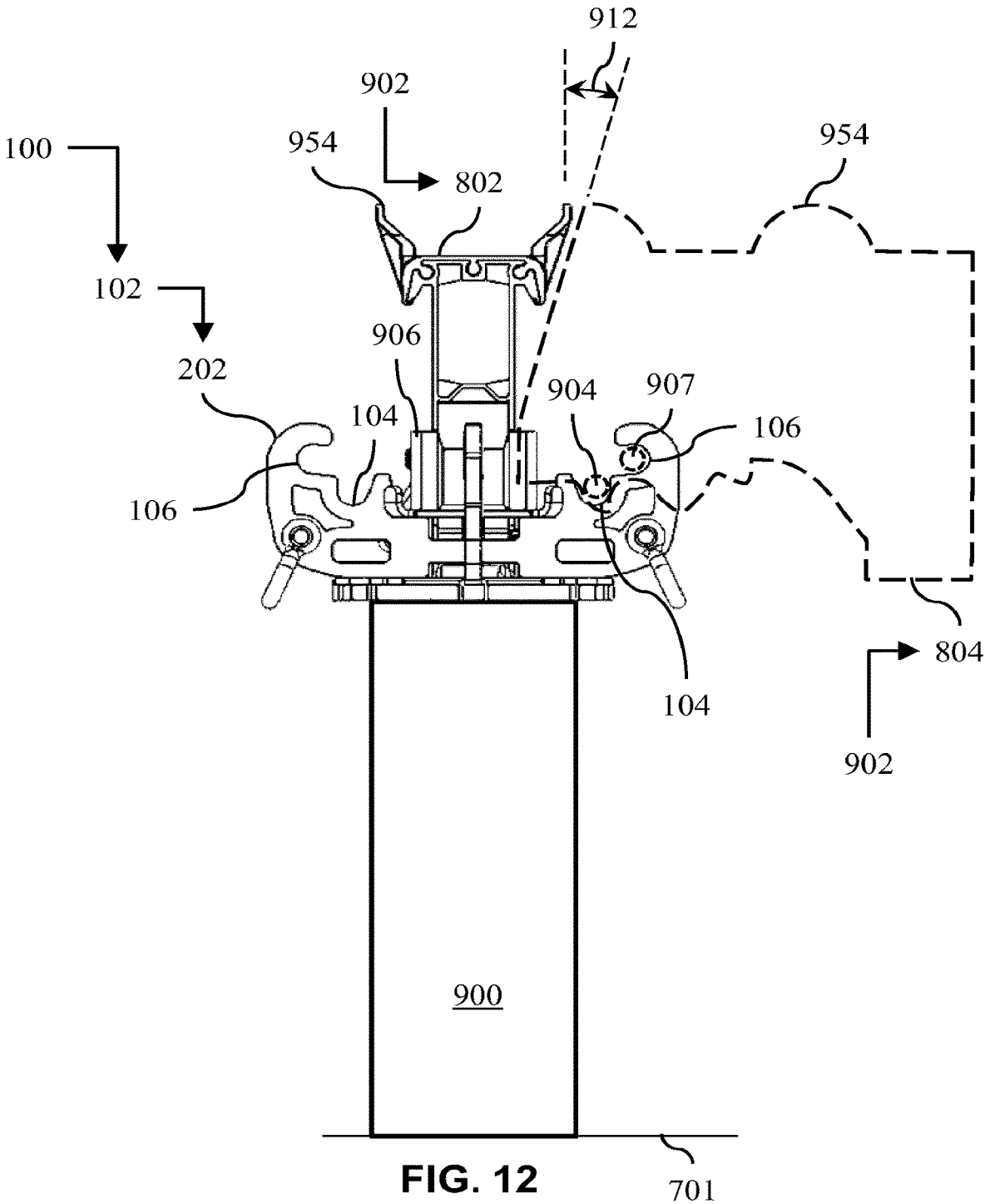

Referring to the embodiments as depicted in FIG. 3 and/or FIG. 4, a preferred difference between the primary beam 802 (as depicted in the embodiment of FIG. 3) and the crossbeam 804 (as depicted in the embodiment of FIG. 4) is that the primary beam 802 has, preferably, a flat end portion (for the opposite end sections of the primary beam 802), while the crossbeam 804 has, preferably, a tapered end portion (for the opposite end sections of the crossbeam 804). The reason for the tapered end section of the crossbeam 804 is evident in view of the embodiment as depicted in FIG. 12, in which case the end portion of the crossbeam 804 is tapered to avoid physical interference with the primary beam 802 once the crossbeam 804 and the primary beam 802 are mounted to the prop-head assembly 102 (or the first prop-head assembly 202).

Referring to the embodiments as depicted in FIG. 3 and/or FIG. 4, the description for the embodiments of beam 902, the primary beam 802 and/or the crossbeam 804 is applicable (at least in part) to beam 902, the primary beam 802, and the crossbeam 804, if so desired to suit a specific requirement or configuration.

Referring to the embodiment as depicted in FIG. 5, the beam end support 906 defines (provides) a beam-terminus receiver 905 (also called a channel, a groove, and any equivalent thereof). The beam-terminus receiver 905 receives (is configured to receive, slidably receive), at least in part, the beam-reference portion 904 into the interior of the beam end support 906. The beam 902 includes a sidewall 922 (oppositely positioned sidewalls).

Referring to the embodiment as depicted in FIG. 5, the beam 902 includes the frame-engagement device 954. The frame-engagement device 954 of the beam 902 (and/or the primary beam 802 and/or the crossbeam 804, as the case may require) is engageable (configured to engage) with the bottom portion or bottom section of the frame assembly 952 having the concrete slab 950.

Referring to the embodiment as depicted in FIG. 5, the beam 902 (the primary beam 802 and the crossbeam 804) has a rectangular cross-sectional profile. The beam 902 receives and supports (is configured to receive and support the beam end support 906. The beam-reference portion 904 receives (is configured to be received) in the interior of the beam end support 906 (preferably via the beam-terminus receiver 905 defined by the beam end support 906).

Referring to the embodiments as depicted in FIG. 3, FIG. 4 and/or FIG. 5, the beam end support 906 is affixed (is configured to be affixed) to the end portion of beam 902. For instance, the beam end support 906 may be welded to the end portion of beam 902, etc.

Figure 6:
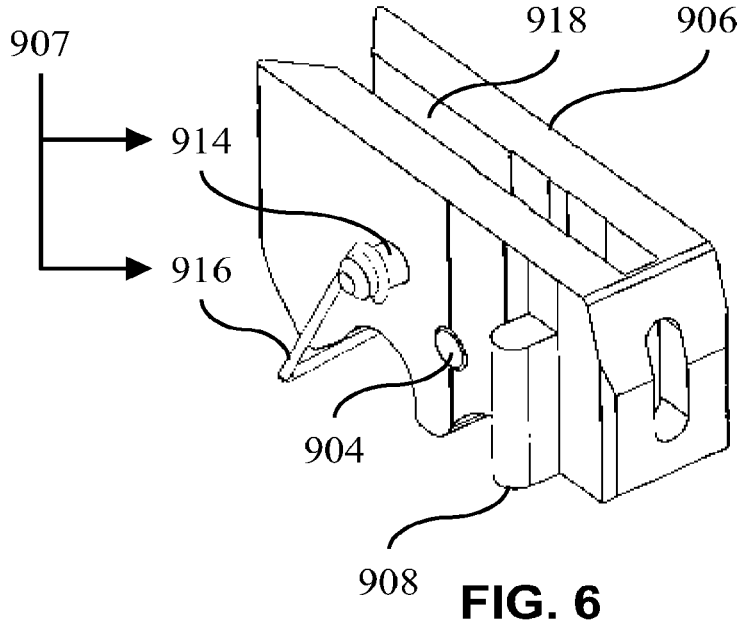
Figure 7:
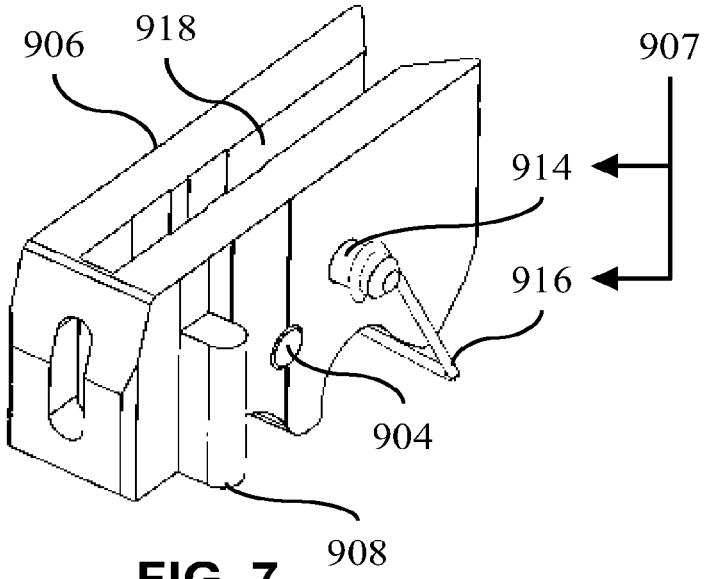

FIG. 6 and FIG. 7 depict perspective views of embodiments of a beam end support 906 of the embodiments of the beam 902 of any one of FIG. 3, FIG. 4 and FIG. 5.

Referring to the embodiments as depicted in FIG. 6 and FIG. 7, the beam end support 906 provides (defines) a cavity 918 (hollow interior that is accessible from the exterior). This is done in such a way that the cavity 918, in use, exposes the beam-reference portion 904 to the exterior once the beam-reference portion 904 is received by the beam end support 906. In this manner, the beam-reference portion 904 may make contact with a portion of the prop-head assembly 102 (or with the first prop-head assembly 202 or the second prop-head assembly 302, as the case may be, with reference to the embodiments as depicted in FIG. 8 and FIG. 9, which depict embodiments of the prop-head assembly 102).

The beam end support 906 may be integrated with (to) the beam 902 (as depicted in the embodiment of FIG. 3). For convenience, the beam end support 906 is machined with specific features for interacting with the beam-reference portion 904 and the beam lock assembly 907. The beam lock assembly 907 selectively locks or unlocks (is configured to selectively lock or unlock) the beam 902 to the prop-head assembly 102. The beam lock assembly 907 includes a lock device 914 (such as a pin, etc., and any equivalent thereof) and a lock retainer 916 (such as a spring assembly, etc., and any equivalent thereof). The beam end support 906 provides a guide feature 908 form mating (that is configured to mate) with a groove or a portion of beam 902, etc.

Figure 9:
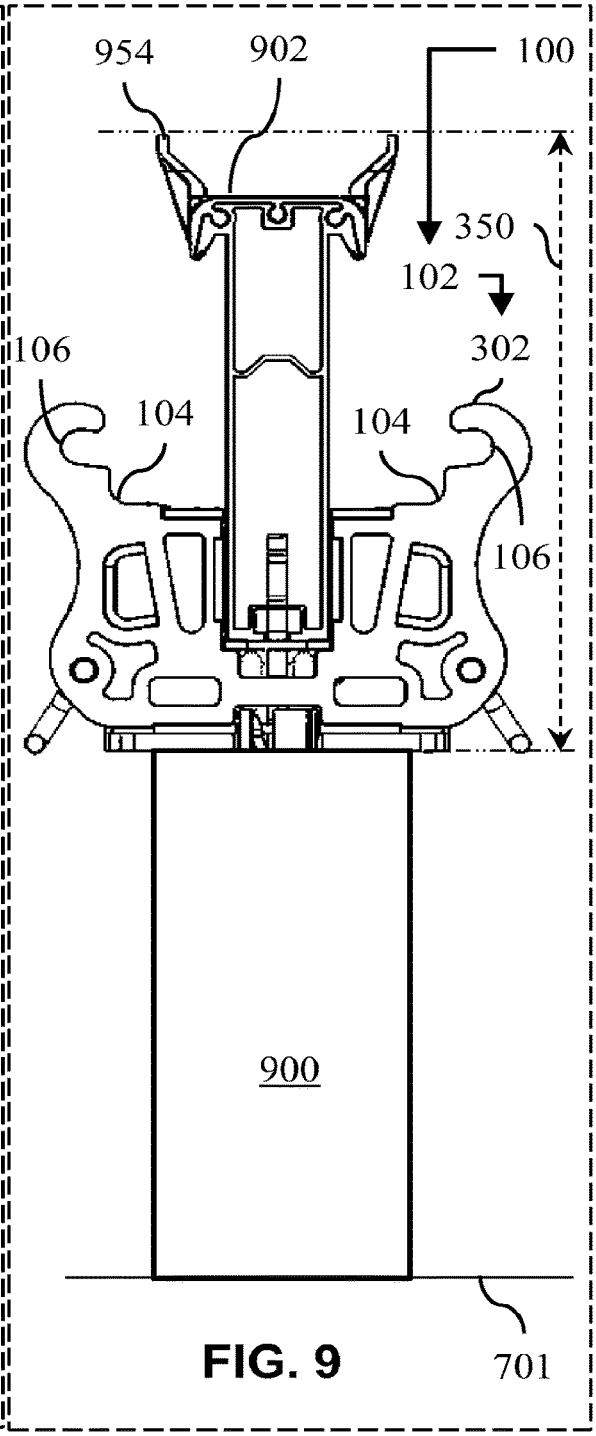

FIG. 8 and FIG. 9 depict a side view (FIG. 8) and a side view (FIG. 9) of embodiments of the prop-head assembly 102 of any one of FIG. 1 and FIG. 2.

Referring to the embodiments as depicted in FIG. 8 and FIG. 9, the prop-head assembly 102 may be configured or classified as two types of prop-head assemblies, depending on the design requirements.

Referring to the embodiment as depicted in FIG. 8, the prop-head assembly 102 may be called (includes) a first prop-head assembly 202. FIG. 8 and FIG. 10 to FIG. 23 depict the embodiments of the first prop-head assembly 202. The first prop-head assembly 202 receives (is configured to receive), at least in part, the weight of the beam 902 from (via the beam end support 906). Preferably, the first prop-head assembly 202 receives (is configured to receive), at least in part, the weight of at least one instance of the beam 902 from (via the beam end support 906). Preferably, the first prop-head assembly 202 receives (is configured to receive), at least in part, the weight of one instance, two instances, three instances or four instances of the beam 902 from (via the beam end support 906 of the beam 902).

Referring to the embodiment as depicted in FIG. 9, the prop-head assembly 102 may be called (includes) a second prop-head assembly 302. FIG. 9 and FIG. 24 to FIG. 30 depict the embodiments of the second prop-head assembly 302. A portion or a section of the second prop-head assembly 302 receives (is configured to receive), at least in part, the weight of the beam 902 from a section of the beam 902 that is located between the opposite end portions of the beam 902 (and the beam end support 906 does not contact the second prop-head assembly 302, for this case). Another portion or section of the second prop-head assembly 302 receives (is configured to receive), at least in part, the weight of the beam 902 from (via the beam end support 906), if so desired or required (depending on the formation of the support matrix as depicted in the embodiment of FIG. 2). Preferably, the second prop-head assembly 302 receives (is configured to receive), at least in part, the weight of (A) at least one or more instances (one instance or two instances) of the beam 902 from (via the beam end support 906), and (B) an instance (at least one or more instances) of the beam 902 from a section (a portion) of the beam 902 that is located between the opposite end portions of the beam 902.

Referring to the embodiments as depicted in FIG. 8 and FIG. 9, the first prop-head assembly 202 and the second prop-head assembly 302 are positionable at selected junctions of a matrix pattern having matrix junctions formed (as depicted in FIG. 2) by the primary beam 802 (the primary beam) and the crossbeam 804 (the secondary beam or the cross beam), which are positionable orthogonal relative to each other on a horizontal plane forming the matrix pattern having the matrix junctions, on which the horizontal structural floor (as depicted in FIG. 1), which is formed by a plurality of the frame assembly 952 and the concrete slab 950, is positioned (securely positioned) thereon.

Referring to the embodiment as depicted in FIG. 8, the first beam-locating feature 104 forms (provides or is configured to form) a U-shaped formation that opens vertically upwardly (along an axial direction relative to the longitudinal axis extending through the column 900). The second beam-locating feature 106 forms (provides or is configured to form a U-shaped formation that opens horizontally sideways (along a radial direction relative to the longitudinal axis extending through the column 900).

Referring to the embodiment as depicted in FIG. 9, the first beam-locating feature 104 forms (provides or is configured to form) an L-shaped formation that faces the column 900 (that opens vertically upwardly and radial toward the column 900). The second beam-locating feature 106 forms (provides or is configured to form) a U-shaped formation that opens horizontally sideways (along a radial direction relative to the longitudinal axis extending through the column 900).

Referring to the embodiments as depicted in FIG. 8 and FIG. 9, the first prop-head assembly 202 has a height 250. The second prop-head assembly 302 has a height 350. Preferably, the height 250 of the first prop-head assembly 202 and the height 350 of the second prop-head assembly 302 are such that the top section of the beam 902 (or the primary beam 802 or the crossbeam 804, as the case may be) is at the same vertical height above the working surface 701 (once the beam 902 is mounted to the prop-head assembly 102, the first prop-head assembly 202, or the second prop-head assembly 302, as the case may be).

FIG. 10, FIG. 11 and FIG. 12 depict side views of embodiments of the prop-head assembly 102 of FIG. 8.

Referring to the embodiments as depicted in FIG. 10 and FIG. 12, a first deployment scenario includes the case where the prop-head assembly 102 is positioned underneath a junction zone (a matrix junction), in which the junction zone is positioned below (and supports) the end portions of end-to-end facing instances of the primary beam 802 or the crossbeam 804, as the case may be) that are positioned to face each other in an end-to-end relationship. Preferably, the end portions of the primary beam 802 are positioned adjacent to each other in a close relationship or a proximate relationship.

Referring to the embodiment as depicted in FIG. 11, a second deployment scenario includes the case where the prop-head assembly 102 is positioned underneath (contacts and supports) the bottom section of the beam 902 between the end portions or end sections of the beam 902 (such as midway between the end sections of the beam 902 (or the primary beam 802 or the crossbeam 804, as the case may be). For this case, the beam 902 defines a prop receiver 920 (channel, groove, etc.). The prop receiver 920 receives (is configured to receive), at least in part, a portion of the prop-head assembly 102 (or the first prop-head assembly 202 or the second prop-head assembly 302, as the case may be).

Referring to the embodiment as depicted in FIG. 11, the beam 902 defines a prop receiver 920 (cavity, groove, channel) that is located along the bottom side of beam 902. The prop receiver 920 of the beam 902 receives (is configured to receive), at least in part, the prop-head assembly 102 (so that the prop-head assembly 102 is positioned between the end portions (end terminals) of the beam 902 once the prop receiver 920, in use, receives, at least in part, the prop-head assembly 102).

Referring to the embodiment as depicted in FIG. 12, the end section of the crossbeam 804 forms a tapered section at the angle 912. The tapered end section or portion of the crossbeam 804 prevents (is configured to prevent) physical conflicts or interference for the case where the crossbeam 804 is positioned proximate to the primary beam 802. The reason for the tapered end section of the crossbeam 804 is evident in view of the embodiment as depicted in FIG. 12, in which case the end portion of the crossbeam 804 is tapered to avoid physical interference with the primary beam 802 once the crossbeam 804 and the primary beam 802 are mounted to the prop-head assembly 102 (or the first prop-head assembly 202).

Referring to the embodiment as depicted in FIG. 12, the beam lock assembly 907 is installed (installable or is configured to be installed) to (received by) the second beam-locating feature 106 of the prop-head assembly 102. The beam lock assembly 907 selectively securely locks (is configured to selectively securely lock) the beam 902 to the prop-head assembly 102 (at the second beam-locating feature 106). The beam-reference portion 904 of the beam 902 is received (located) at the first beam-locating feature 104 of the prop-head assembly 102.

Figure 13:
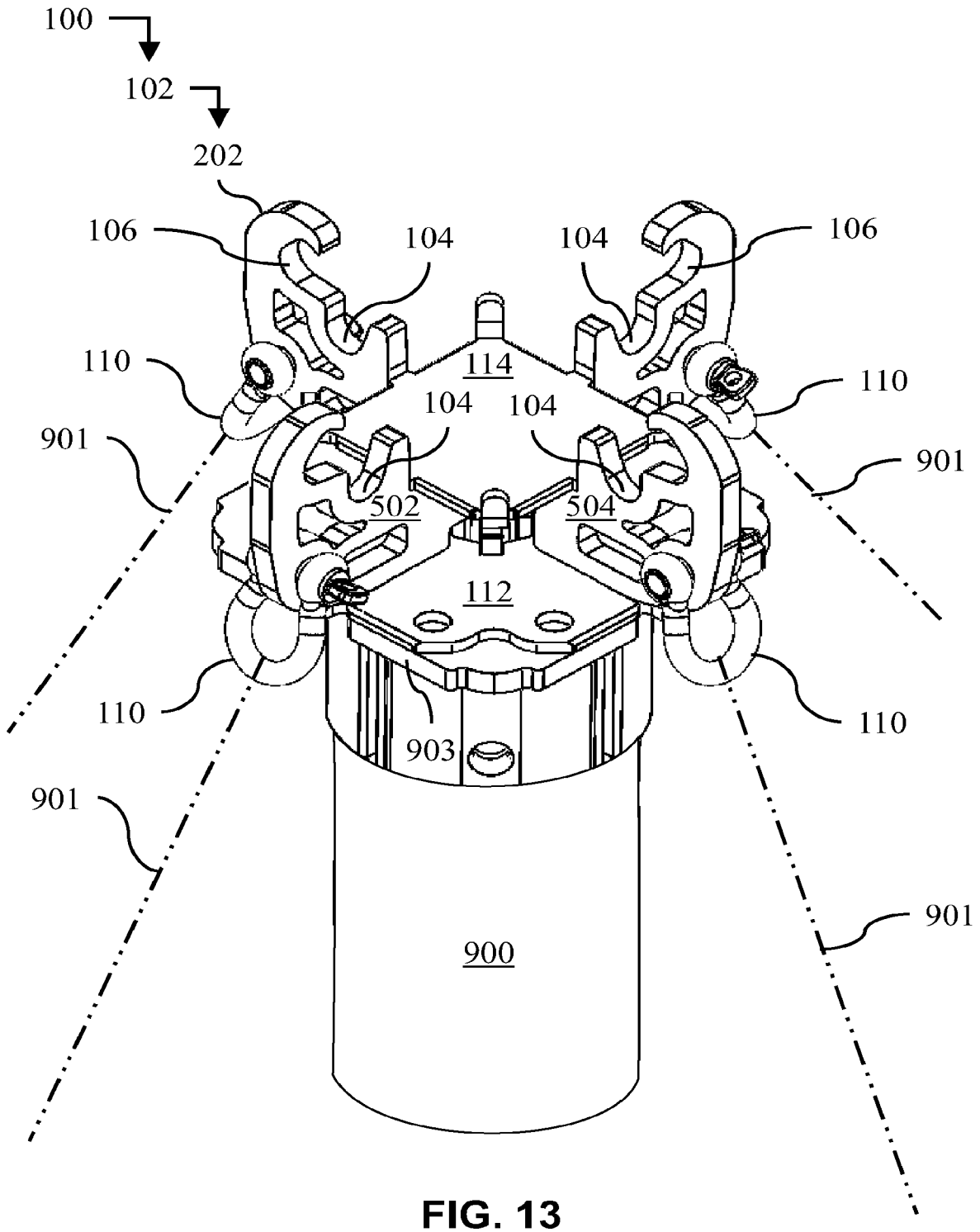

FIG. 13 depicts a perspective view of an embodiment of the prop-head assembly 102 of FIG. 8.

Figure 14:
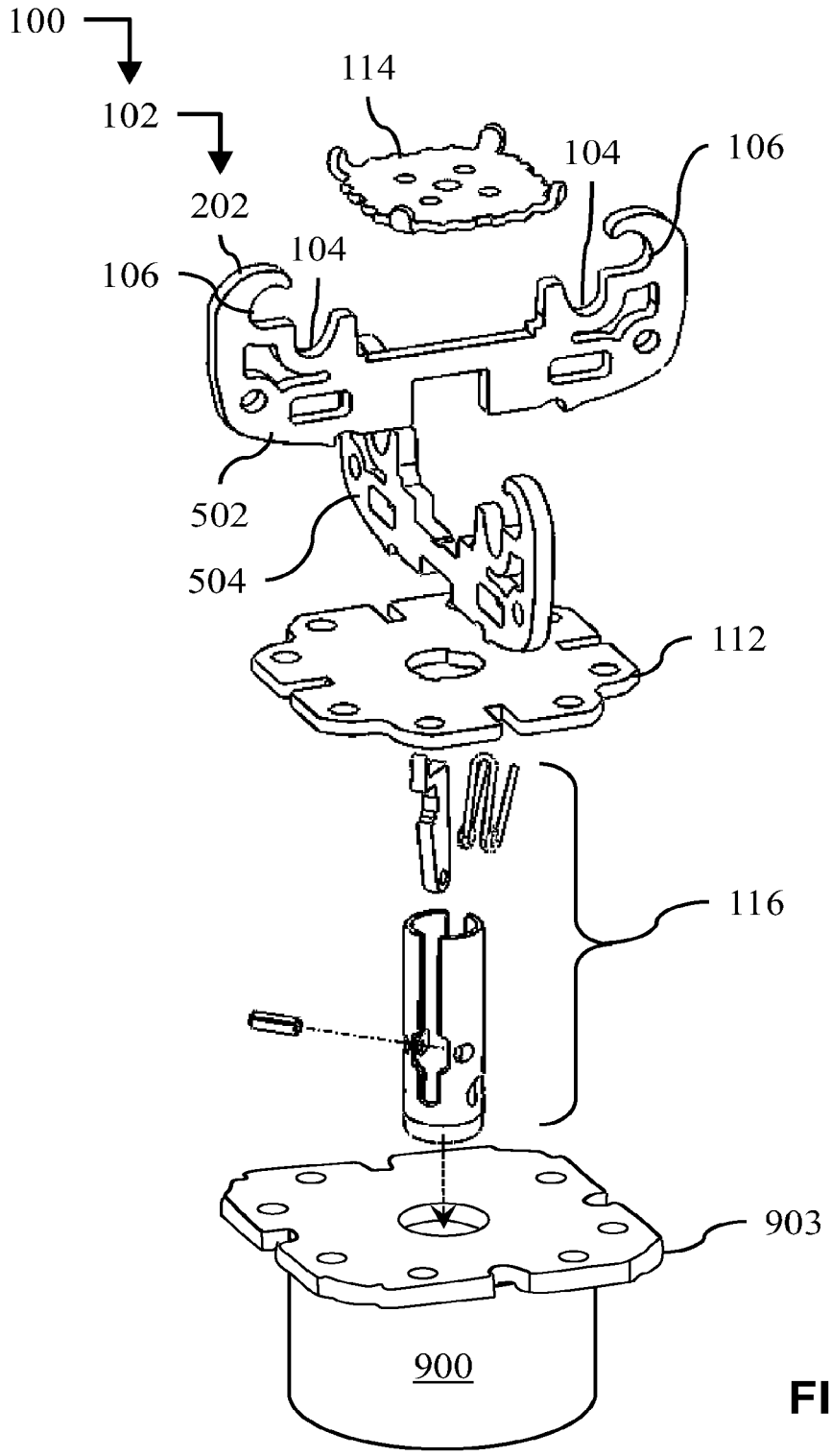

FIG. 14 depicts an exploded perspective view of an embodiment of the prop-head assembly 102 of FIG. 8.

Referring to the embodiment as depicted in FIG. 13, the first beam-locating feature 104 may be called a first locator, and any equivalent thereof. The second beam-locating feature 106 may be called a second locator, a safety catch, a hook formation, and any equivalent thereof.

Referring to the embodiment as depicted in FIG. 13, the prop-head assembly 102 connectable to (is configured to be coupled to) a shackle assembly 110 (and any equivalent thereof). Preferably, the corner portions of the prop-head assembly 102 connectable to (are configured to couple to) a shackle assembly 110. A stability wire 901 is affixed to each shackle assembly 110 in such a way that the stability wire 901 stabilizes the position of the prop-head assembly 102 (once the prop-head assembly 102 is affixed to the top section of the column 900, and the stability wire 901 is affixed to each shackle assembly 110).

Referring to the embodiments as depicted in FIG. 13 and FIG. 14, the prop-head assembly 102 (or the first prop-head assembly 202) includes a prop base 112, and a load-receiving feature 114 (also called a reference plate or a reference feature). The prop base 112 is connectable to or affixable to (is configured to be affixed to) a column portion 903 (also called a column plate) of beam 902. The column portion 903 is affixed to the top portion of beam 902. The load-receiving feature 114 is positioned above the prop base 112. The load-receiving feature 114 is coupled (either directly or indirectly) to the prop base 112. The load-receiving feature 114 receives and supports (is configured to receive and support) the load (the weight) of beam 902, preferably at a central zone of the load-receiving feature 114. The load-receiving feature 114 supports (is configured to support, at least in part), in use, the weight of the beam 902 or the beams to be placed and received by the prop-head assembly 102, etc.

Referring to the embodiments as depicted in FIG. 13 and FIG. 14, the prop-head assembly 102 (or the first prop-head assembly 202) includes a first locator plate assembly 502 and a second locator plate assembly 504 that is positioned relative to the first locator plate assembly 502. Preferably, the first locator plate assembly 502 and the second locator plate assembly 504 are positioned at right angles to each other in an orthogonal relationship (relative to each other). The first locator plate assembly 502 and the second locator plate assembly 504 are (or include) formed plates. The shackle assembly 110 is connectable to (is configured to connect to) (the lower sections of) the first locator plate assembly 502 and the second locator plate assembly 504. The first locator plate assembly 502 and the second locator plate assembly 504 each extends across, at least in part, the prop base 112. The load-receiving feature 114 is positioned centrally on the first locator plate assembly 502 and the second locator plate assembly 504. The first locator plate assembly 502 and the second locator plate assembly 504 are positioned on the prop base 112. Preferably, the components of the prop-head assembly 102 are welded together (securely affixed together in a fixed relationship).

Referring to the embodiments as depicted in FIG. 13 and FIG. 14, the prop-head assembly 102 includes (or is) the first prop-head assembly 202. The first prop-head assembly 202 includes a first locator plate assembly 502, and a second locator plate assembly 504. The first beam-locating feature 104 and the second beam-locating feature 106 provided by the first locator plate assembly 502 are positioned at the same level as the first beam-locating feature 104 and the second beam-locating feature 106 provided by the second locator plate assembly 504.

Referring to the embodiment as depicted in FIG. 14, a lock assembly 116 is connectable to (is configured to couple, securely connect, to) the prop base 112 (also called a prop base plate) to the column portion 903 and the vertically-extending construction column 900. The lock assembly 116 includes a cylindrical tube (also called a cylindrical tube retainer or elongated tube). The cylindrical tube has an outer diameter that is sized to be received (at least in part) in the central hole defined in the column portion 903 (also called a column plate) of the vertically-extending construction column 900 (for preferably close fit there between). The cylindrical tube improves the fit between the lock assembly 116 and the column portion 903. The cylindrical tube defines a vertically extending slot that is configured to receive the retainer clip. The vertically extending slot extends between opposite sides of the cylindrical tube. An elongated lock pin connects (couples) the retainer clip to a central portion of the cylindrical tube (once the retainer clip is received, at least in part, in the elongated slot of the cylindrical tube). The lock pin permits pivotal movement of the retainer clip relative to the cylindrical tube (once the retainer clip is received, at least in part, in or by the cylindrical tube). The lock pin also couples the spring member with the retainer clip. The spring member biases the retainer clip so that the teeth (provided by the retainer clip) engage the side (edge) of the central hole defined by the prop base 112 (once the lock pin couples the spring member with the retainer clip, and the lock pin couples the retainer clip with the cylindrical tube). The action of the spring member is (the spring member is biased) to keep or maintain the engagement between the teeth of the retainer clip and the edge (side edge) of the central hole defined by the prop base 112 (in this manner, the prop-head assembly 102 may remain attached to the column portion 903 of the vertically-extending construction column 900). It will be appreciated that the retainer clip may be moved (by a user, to oppose the action of the spring member) to thereby release the engagement between the teeth of the retainer clip and the edge of the central hole defined by the prop base 112 (in this manner, the prop-head assembly 102 may be selectively detached from the column portion 903 of the vertically-extending construction column 900).

Figure 15:
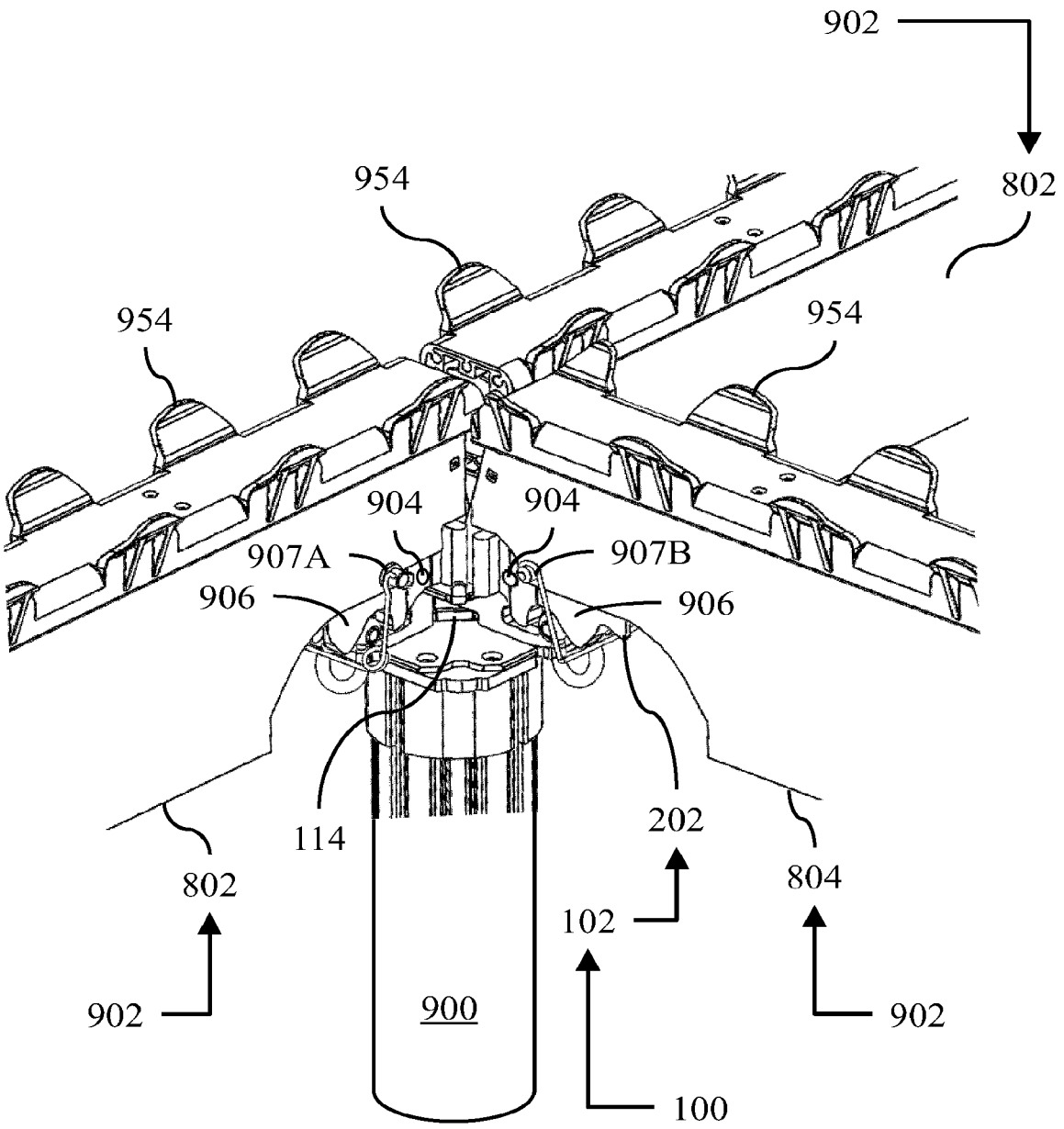
Figure 16:
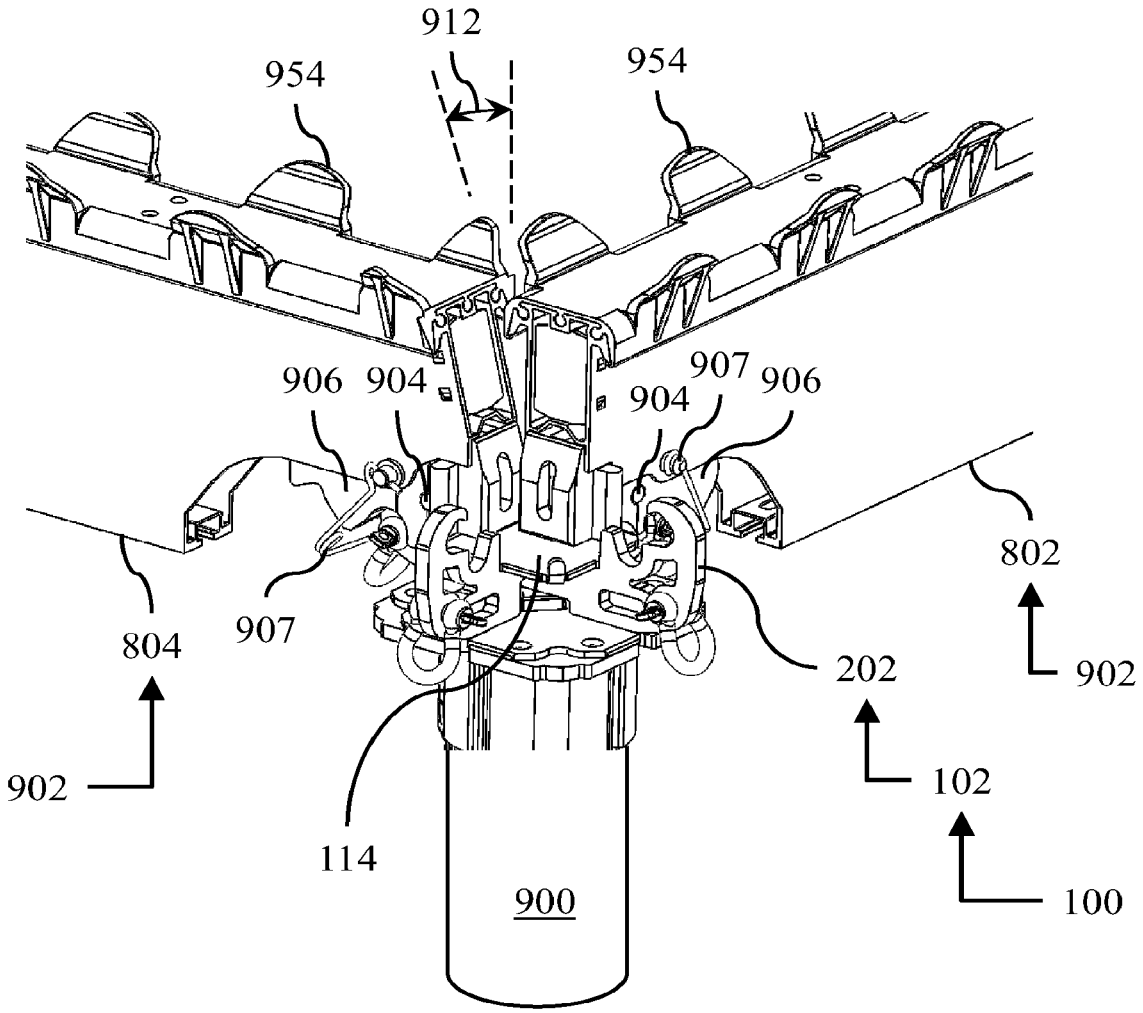

FIG. 15 and FIG. 16 depict perspective views of embodiments of the prop-head assembly 102 of FIG. 8.

Referring to the embodiments as depicted in FIG. 15 and FIG. 16, the ends (distal ends or opposite end portions) of each the primary beams 802 are positioned at an end-to-end relationship (relative to each other), and an end portion of the crossbeam 804 faces the end portions of the primary beam 802. In this manner, the primary beam 802 and the crossbeam 804 are aligned orthogonally relative to each other. The prop-head assembly 102 receives (is configured to receive) the end portions (more specifically, the beam-reference portion 904 that is mounted to the beam end support 906) of the primary beam 802 and the crossbeam 804. More specifically, the prop-head assembly 102 receives (is configured to receive) the beam-reference portion 904 of the primary beam 802 and the beam-reference portion 904 of the crossbeam 804. The first beam lock assembly 907A is received by the primary beam 802, and the first beam lock assembly 907A, in use, locks the position of the primary beam 802 relative to the prop-head assembly 102. The second beam lock assembly 907B is received by the crossbeam 804, and the second beam lock assembly 907B, in use, locks the position of the crossbeam 804 relative to the prop-head assembly 102.

Referring to the embodiments as depicted in FIG. 16, the load-receiving feature 114, in use, supports (the weight of)

the crossbeam 804. A lower portion of the beam end support 906 of the crossbeam 804, in use, contacts the load-receiving feature 114 (once the beam-reference portion 904 of the crossbeam 804 is placed on the first beam-locating feature 104 of the first prop-head assembly 202). The first beam-locating feature 104 is hidden in this view (the embodiment of FIG. 8 depicts the first beam-locating feature 104).

Referring to the embodiments as depicted in FIG. 16, the load-receiving feature 114, in use, supports (the weight of) the primary beam 802. A lower portion of the beam end support 906 of the primary beam 802, in use, contacts the load-receiving feature 114 (once the beam-reference portion 904 of the primary beam 802 is placed on the first beam-locating feature 104 of the first prop-head assembly 202). The first beam-locating feature 104 is hidden in this view (the embodiment of FIG. 8 depicts the first beam-locating feature 104).

Figure 17:
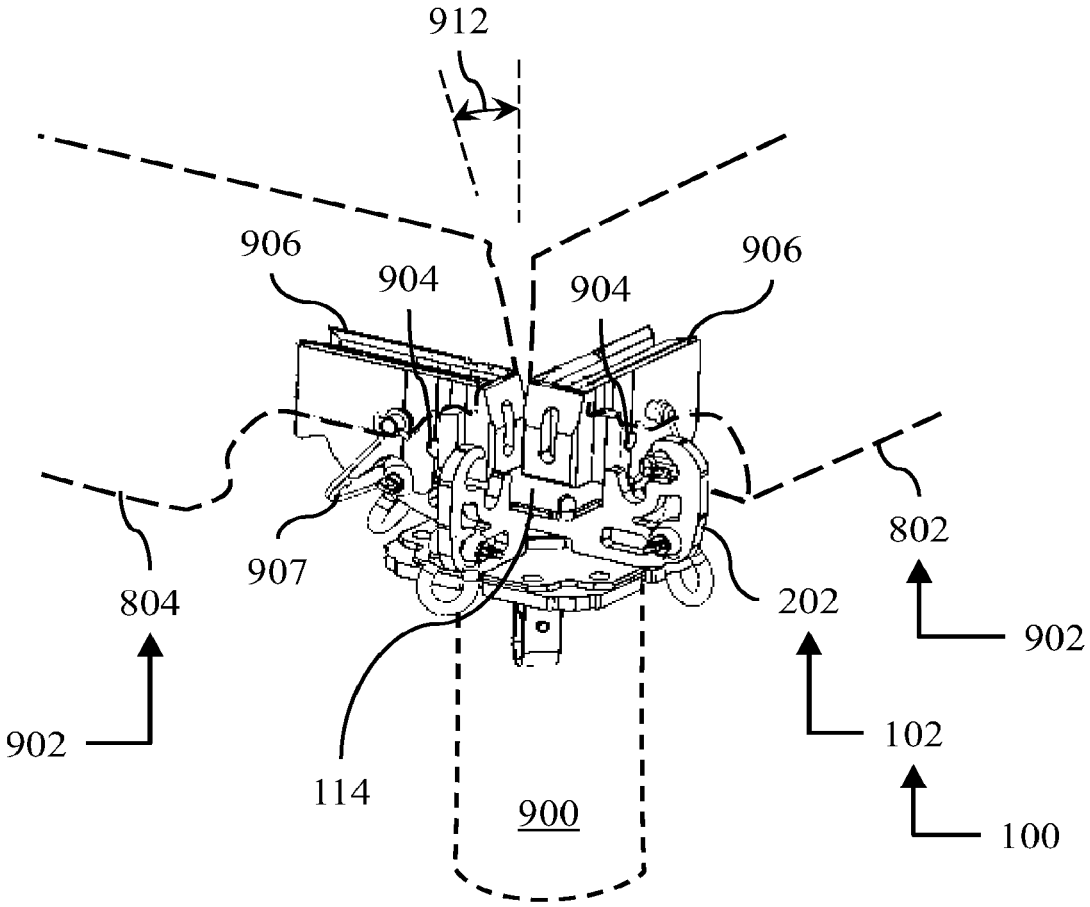

FIG. 17 depicts a partial perspective view of an embodiment of the prop-head assembly 102 of FIG. 16.

Referring to the embodiment as depicted in FIG. 17, the beam end support 906 of the primary beam 802, in use, receives the beam-reference portion 904. The beam-reference portion 904 is received in the first beam-locating feature 104 of the prop-head assembly 102 (or the first prop-head assembly 202, as the case may be). The first beam-locating feature 104 is hidden in this view of FIG. 17 (the embodiment of FIG. 9 depicts the first beam-locating feature 104). The beam end support 906 of the crossbeam 804, in use, receives the beam-reference portion 904, and the beam-reference portion 904 is received in the first beam-locating feature 104 of the prop-head assembly 102 (or the first prop-head assembly 202, as the case may be). The first beam-locating feature 104 is hidden in this view of FIG. 17 (the embodiment of FIG. 9 depicts the first beam-locating feature 104).

Figure 18:
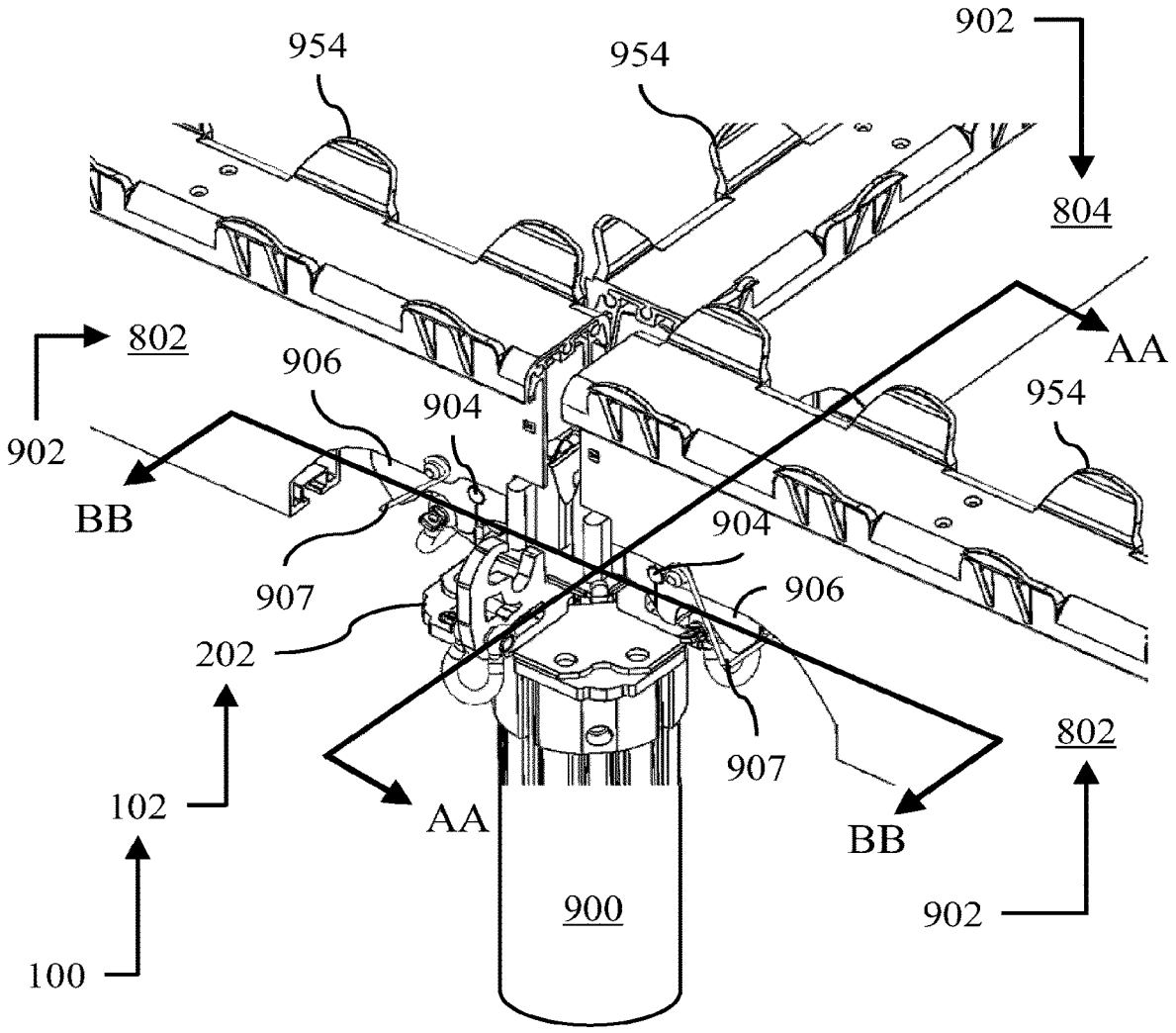

FIG. 18 depicts a perspective view of an embodiment of the prop-head assembly 102 of FIG. 8.

Referring to the embodiment as depicted in FIG. 18, two instances of the end portions (end sections) of the primary beam 802 are positioned on the respective first beam-locating features 104 of the prop-head assembly 102 (or the first prop-head assembly 202). One instance of the end section of the crossbeam 804 is positioned on a first beam-locating feature 104 of the prop-head assembly 102 (or the first prop-head assembly 202). It will be appreciated that the first beam-locating feature 104 as depicted in the embodiment of FIG. 18 is hidden from view. The primary beam 802 is positioned end-to-end, and the crossbeam 804 is orthogonally oriented to the primary beam 802. The end sections of the primary beam 802 and the crossbeam 804 are placed on the prop-head assembly 102.

Figure 19:
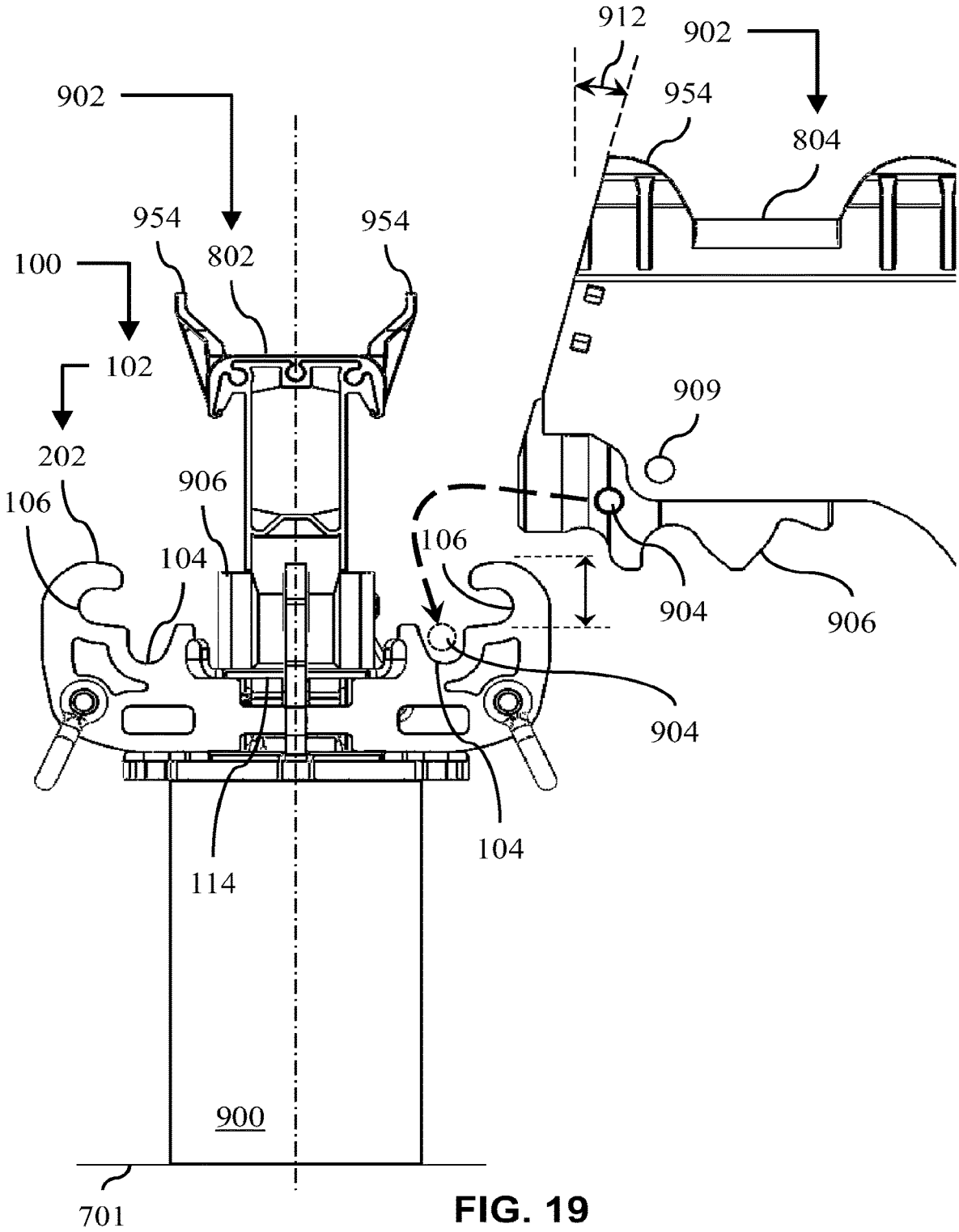

FIGS. 19-22 depict cross-sectional views of embodiments of the prop-head assembly 102 of FIG. 19. The cross-sectional views of FIGS. 19-22 are taken along a cross-sectional line AA-AA of FIG. 18.

Referring to the embodiments of FIG. 19 to FIG. 22, the details are depicted regarding the crossbeam 804 (such as, the positions of the crossbeam 804, etc.). It will be appreciated that the description, which is associated with FIG. 19 to FIG. 22 and directed to the crossbeam 804, is equally applicable to the beam 902 and the primary beam 802.

Referring to the embodiment as depicted in FIG. 19, the crossbeam 804 is being moved toward the first beam-locating feature 104 of the prop-head assembly 102, so that the crossbeam 804 may be selectively placed on the first beam-locating feature 104 of the prop-head assembly 102.

Referring to the embodiment as depicted in FIG. 19, a lock receiver 909 is provided for beam lock assembly 907. The beam lock assembly 907 is not depicted in the embodiment of FIG. 19 (the lock receiver 909 is shown ready to receive the beam lock assembly 907).

Figure 20:
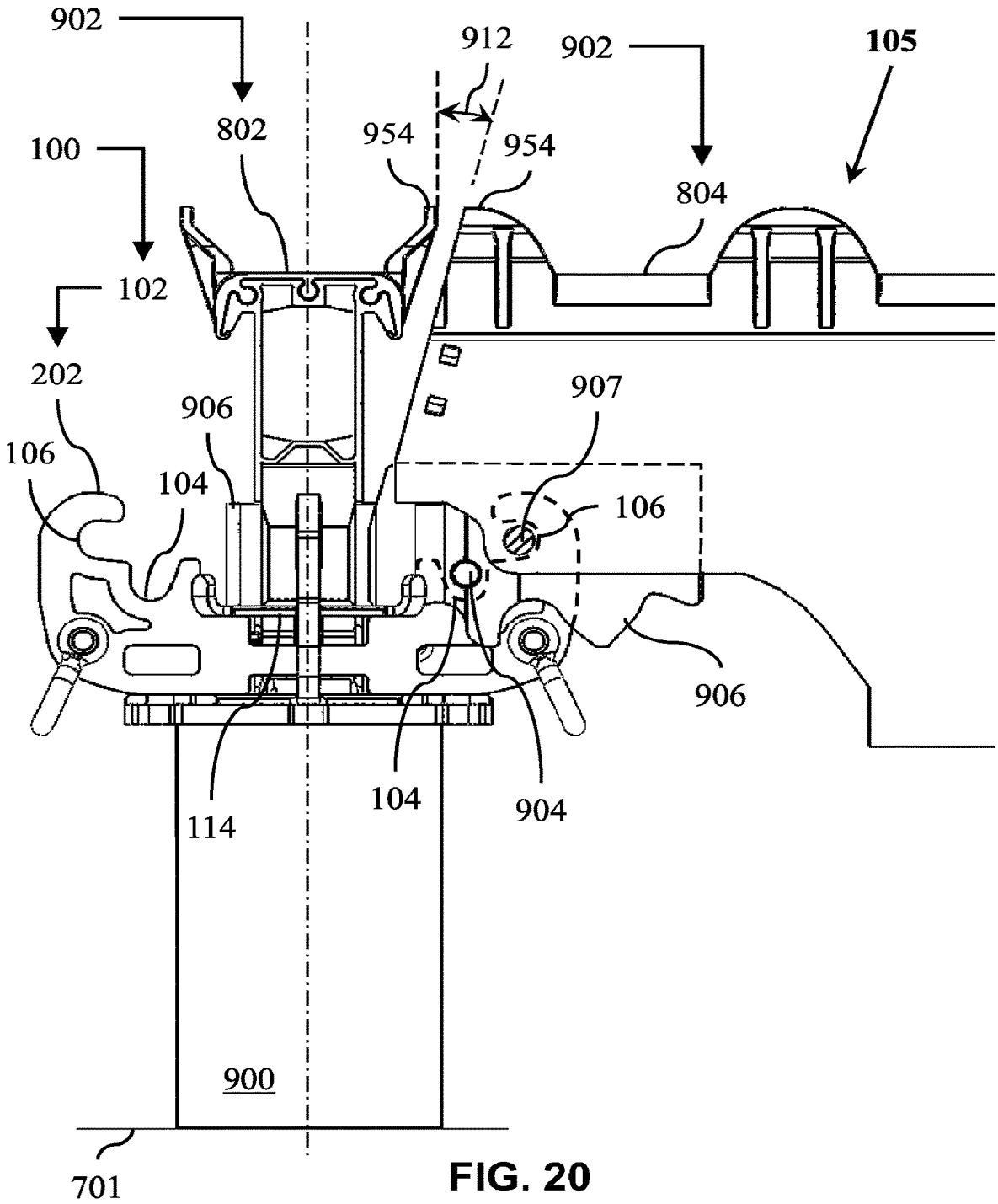

Referring to the embodiment as depicted in FIG. 20, there is depicted the first stationary position 105 of the crossbeam 804, in which the crossbeam 804 is received by (placed on) the first beam-locating feature 104 of the prop-head assembly 102 (or the first prop-head assembly 202). It will be appreciated that this case is equally applicable to the beam 902 and the primary beam 802, etc.

Referring to the embodiment as depicted in FIG. 20, the beam lock assembly 907 is received by the lock receiver 909 (depicted in the embodiment of FIG. 19) of the crossbeam 804 (or the primary beam 802 or beam 902, as the case may require).

Figure 21:
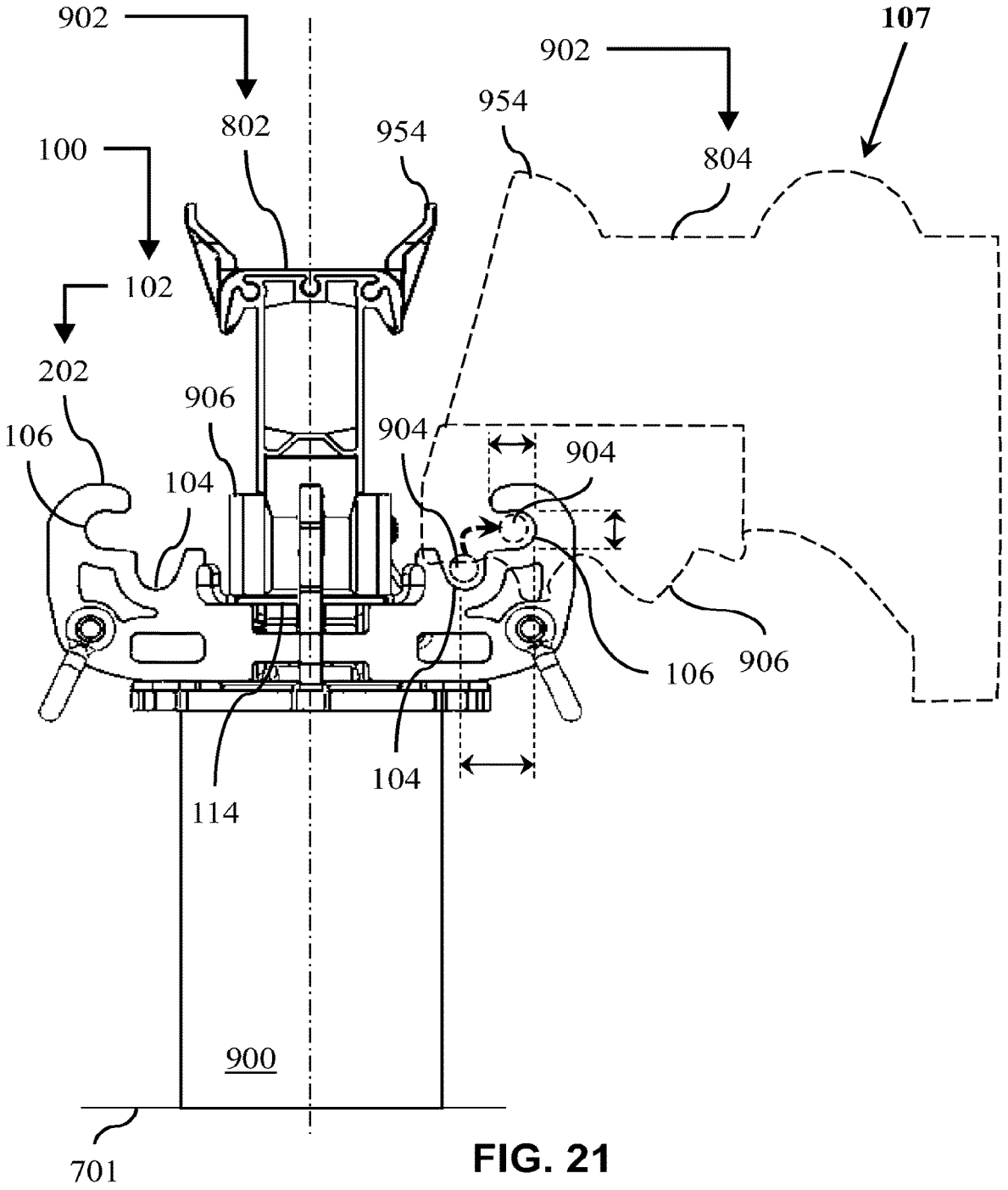

Referring to the embodiment as depicted in FIG. 21, there is depicted the second stationary position 107 of the crossbeam 804, in which the crossbeam 804 is received by (placed on) the second beam-locating feature 106 of the prop-head assembly 102 (or the first prop-head assembly 202). It will be appreciated that this case is equally applicable to the beam 902 and the primary beam 802.

Referring to the embodiment as depicted in FIG. 21, the beam lock assembly 907 is removed from the lock receiver 909 (depicted in the embodiment of FIG. 19) of the crossbeam 804 (or the primary beam 802 or beam 902, as the case may require), so that the crossbeam 804 may be permitted to move from the first beam-locating feature 104 to the second beam-locating feature 106 (as the case may require for an accidental movement or inadvertent movement of the crossbeam 804).

Figure 22:
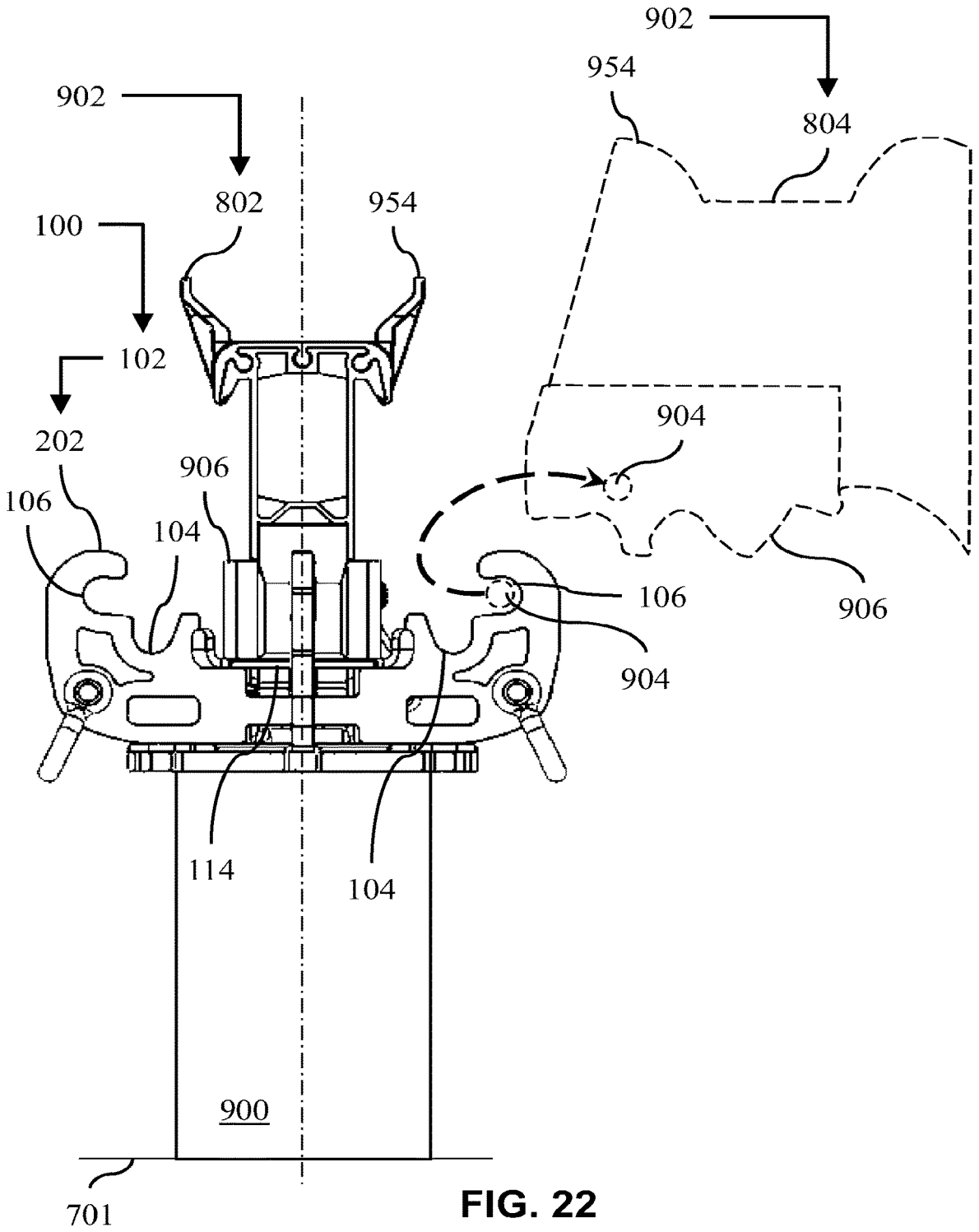

Referring to the embodiment as depicted in FIG. 22, the crossbeam 804 is removed away from the second beam-locating feature 106 of the prop-head assembly 102 (or generally away from the prop-head assembly 102).

Referring to the embodiment as depicted in FIG. 22, the beam lock assembly 907 is removed away from the lock receiver 909 (depicted in the embodiment of FIG. 19) of the crossbeam 804.

Referring to the embodiments as depicted in FIG. 19 to FIG. 22, the apparatus 100 is provided for the column 900. The apparatus 100 is also provided for the beam 902 (such as either for the primary beam 802 and/or the crossbeam 804). The beam 902 has the beam-reference portion 904. The apparatus 100 includes and is not limited to (comprises) a prop-head assembly 102.

Referring to the embodiments as depicted in FIG. 19 to FIG. 22, the prop-head assembly 102 is fixedly connected or connectable to (is configured to be fixedly connected to) the column 900. Preferably, the prop-head assembly 102 is fixedly connected or connectable to (is configured to be fixedly connectable to) a top end section of the column 900. The prop-head assembly 102 supports (is also configured to support), at least in part, the beam 902 once the prop-head assembly 102 is fixedly connected to the column 900. The prop-head assembly 102 includes (and is not limited to) a synergistic combination of a first beam-locating feature 104 and a second beam-locating feature 106.

Referring to the embodiments as depicted in FIG. 19 to FIG. 22, the first beam-locating feature 104 may be called a first terminus-locating feature). As depicted, the first beam-locating feature 104 selectively receives (is configured to selectively receive), at least in part, the beam-reference portion 904 of the crossbeam 804. It will be appreciated that the first beam-locating feature 104 selectively receives (is configured to selectively receive), at least in part, the beam-reference portion 904 of any one of the beam 902, the primary beam 802 and/or the crossbeam 804 (as the case may be).

Referring to the embodiments as depicted in FIG. 19 to FIG. 22, the second beam-locating feature 106 may be called a second terminus-locating feature. The second beam-locating feature 106 is spaced apart from the first beam-locating feature 104. As depicted, the second beam-locating feature 106 selectively receives (is configured to selectively receive), at least in part, the beam-reference portion 904 of the crossbeam 804. It will be appreciated that the second beam-locating feature 106 selectively receive (is configured to selectively receive), at least in part, the beam-reference portion 904 of any one of beam 902, the primary beam 802 and/or the crossbeam 804 (as the case may be). The second beam-locating feature 106 selectively receives (is configured to selectively receive) the beam-reference portion 904 of the beam 902 once the beam-reference portion 904 of the beam 902 is inadvertently displaced (moved) away from the first beam-locating feature 104 and from the column 900 and toward the second beam-locating feature 106.

Referring to the embodiments as depicted in FIG. 19 to FIG. 22 (with a more specific detailed description), the apparatus 100 is provided for the column 900, and for the beam 902 having a beam-reference portion 904. The apparatus 100 includes and is not limited to (comprises) a prop-head assembly 102. The prop-head assembly 102 is fixedly connected (fixedly connectable, configured to be fixedly connected) to the column 900. Preferably, the prop-head assembly 102 is fixedly connected (fixedly connectable, configured to be fixedly connected) to a top section (end section) of the column 900. The prop-head assembly 102 also supports (is also configured to support), at least in part, the beam 902 once the prop-head assembly 102 is fixedly connected to the column 900. The prop-head assembly 102 includes (and is not limited to) a synergistic combination of a first beam-locating feature 104 and a second beam-locating feature 106.

Referring to the embodiments as depicted in FIG. 19 to FIG. 22, the first beam-locating feature 104 may be called a first terminus-locating feature. The first beam-locating feature 104 selectively receives (is configured to selectively receive) the beam-reference portion 904 of the beam 902 (such as the crossbeam 804 as depicted and/or the primary beam 802). This is done in such a way that the first beam-locating feature 104, in use, locates (positions) the beam-reference portion 904 of the beam 902 at a first stationary position 105 (depicted in the embodiment of FIG. 20) relative to the column 900 (once the first beam-locating feature 104, in use, receives (at least in part) the beam-reference portion 904 of the beam 902 at the first stationary position 105.

Referring to the embodiments as depicted in FIG. 19 to FIG. 22, the second beam-locating feature 106 may be called a second terminus-locating feature. The second beam-locating feature 106 is spaced apart from the first beam-locating feature 104. The second beam-locating feature 106 selectively receives (is configured to selectively receive) the beam-reference portion 904 of the beam 902 (such as the crossbeam 804 as depicted and/or the primary beam 802). This is done in such a way that the second beam-locating feature 106, in use, locates (positions) the beam-reference portion 904 of the beam 902 at a second stationary position 107 (as depicted in the embodiment of FIG. 21) relative to the column 900 (once the second beam-locating feature 106, in use, receives the beam-reference portion 904). The second beam-locating feature 106 selectively receive (is configured to receive) the beam-reference portion 904 of the beam 902 once the beam-reference portion 904 of the beam 902 is inadvertently displaced (moved) away from the first beam-locating feature 104 and also displaced away from the column 900.

Referring to the embodiment as depicted in FIG. 20, the first beam-locating feature 104 selectively receives (is configured to selectively receive or receive) the beam-reference portion 904 of the beam 902 once the beam 902 is positioned, in use, at the first beam-locating feature 104. The first beam-locating feature 104 is (preferably) further limits (configured to limit) inadvertent side-to-side horizontal movement and limit inadvertent downward vertical movement of the beam-reference portion 904 of the beam 902 once the beam-reference portion 904 is positioned at the first beam-locating feature 104. The first beam-locating feature 104 is (preferably) further permits (configured to permit) unimpeded upward vertical movement of the beam-reference portion 904 of the beam 902 once the beam-reference portion 904 is positioned at the first beam-locating feature 104.

Referring to the embodiment as depicted in FIG. 20, the first beam-locating feature 104 further supports (is further configured to support), at least in part, the beam-reference portion 904 of the beam 902 once the beam-reference portion 904, in use, is received by the first beam-locating feature 104.

Referring to the embodiment as depicted in FIG. 21, the second beam-locating feature 106 further receives (is further configured to receive), at least in part, the beam-reference portion 904 of the beam 902 once the beam-reference portion 904 is positioned, in use, at the second beam-locating feature 106. The second beam-locating feature 106 is (preferably) further limits (further configured to limit), at least in part, inadvertent upward vertical movement and limit inadvertent downward vertical movement of the beam-reference portion 904 of the beam 902 once the beam-reference portion 904 is positioned at the second beam-locating feature 106. The second beam-locating feature 106 is (preferably) further limits (further configured to limit), at least in part, inadvertent horizontal movement of the beam-reference portion 904 of the beam 902 away from the column 900 once the beam-reference portion 904 is positioned at the second beam-locating feature 106. The second beam-locating feature 106 is (preferably) further permits (configured to permit) unimpeded horizontal movement of the beam-reference portion 904 of the beam 902 toward the column 900 once the beam-reference portion 904 is positioned at the second beam-locating feature 106.cc2

Referring to the embodiment as depicted in FIG. 21, the second beam-locating feature 106 supports (is configured to support), at least in part, the beam-reference portion 904 of the beam 902 once the beam-reference portion 904, in use, is received by the second beam-locating feature 106.

Figure 23:
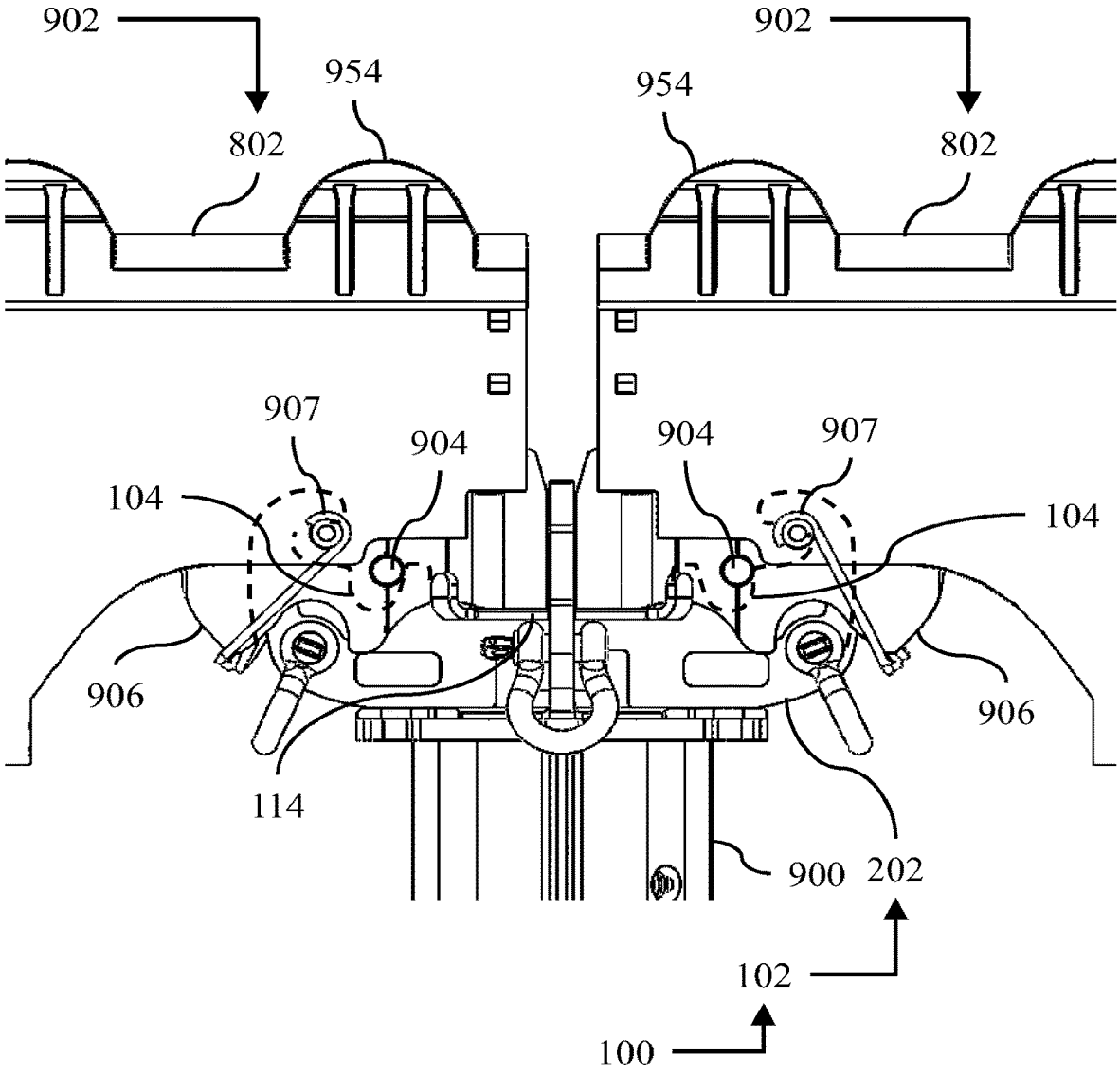

FIG. 23 depicts a cross-sectional view of an embodiment of the prop-head assembly 102 of FIG. 19. The cross-sectional view of FIG. 23 is taken along a cross-sectional line BB-BB of FIG. 18.

Referring to the embodiment as depicted in FIG. 23, the end portions of the primary beam 802 are placed in an end-to-end relationship once the two instances (as depicted) of the primary beam 802 are positioned on the prop-head assembly 102.

FIG. 24 depicts a side view of an embodiment of the prop-head assembly 102 of FIG. 9.

Referring to the embodiment as depicted in FIG. 24, a third deployment scenario is depicted, and includes the case where the prop-head assembly 102 is positioned underneath (and supports) a junction zone (a matrix junction as depicted in the embodiments of FIG. 1 and/or FIG. 2), in which the junction zone is positioned below (and supports) the end portion of the crossbeam 804, and the end portion of the crossbeam 804 is positioned to face a sidewall of the primary beam 802. Preferably, the end portion of the crossbeam 804 is positioned adjacent to the sidewall of the primary beam 802 in a close relationship or a proximate relationship.

Figure 25:
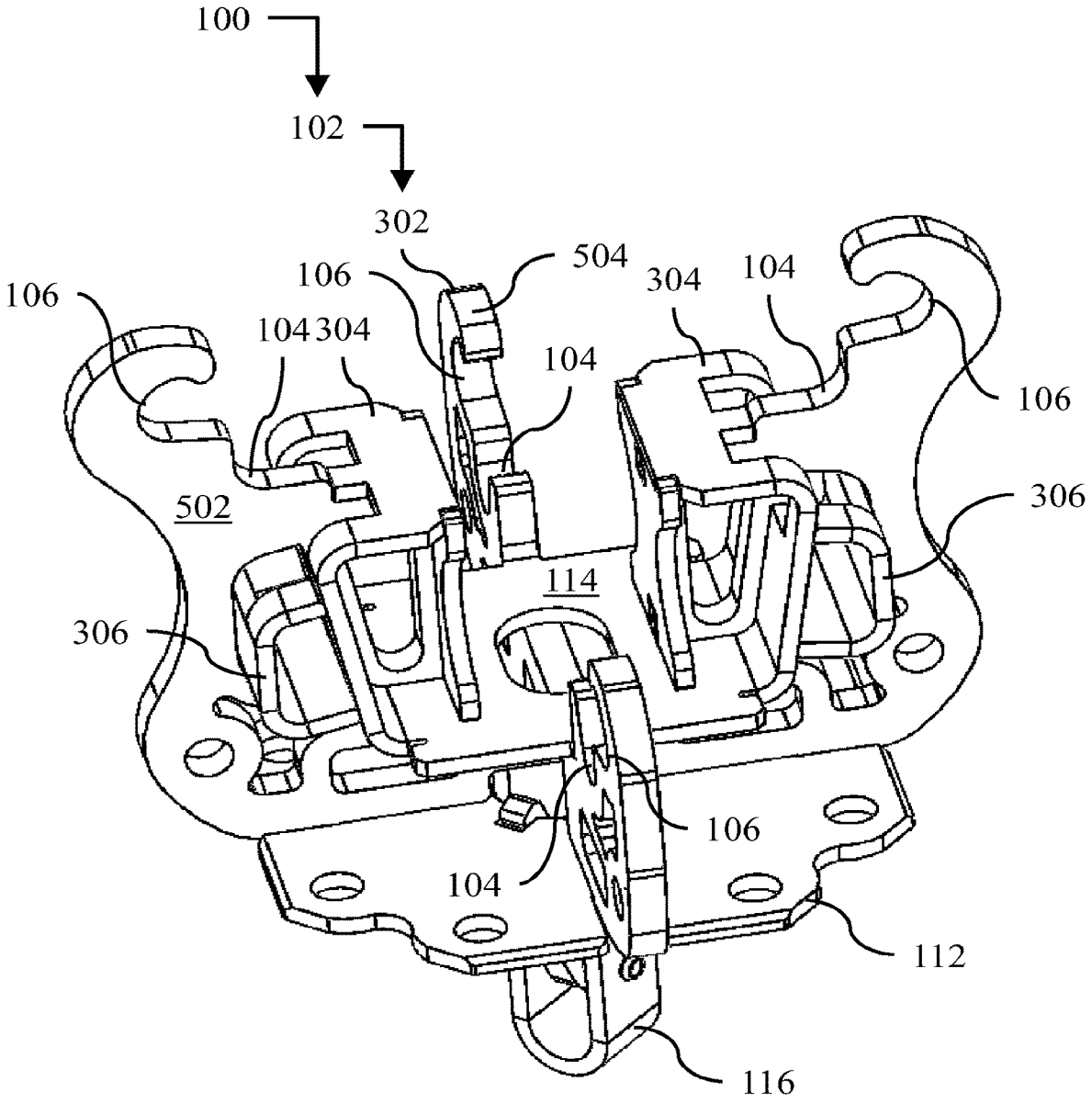

FIG. 25 depicts a perspective view of an embodiment of the prop-head assembly 102 of FIG. 9.

Figure 26:
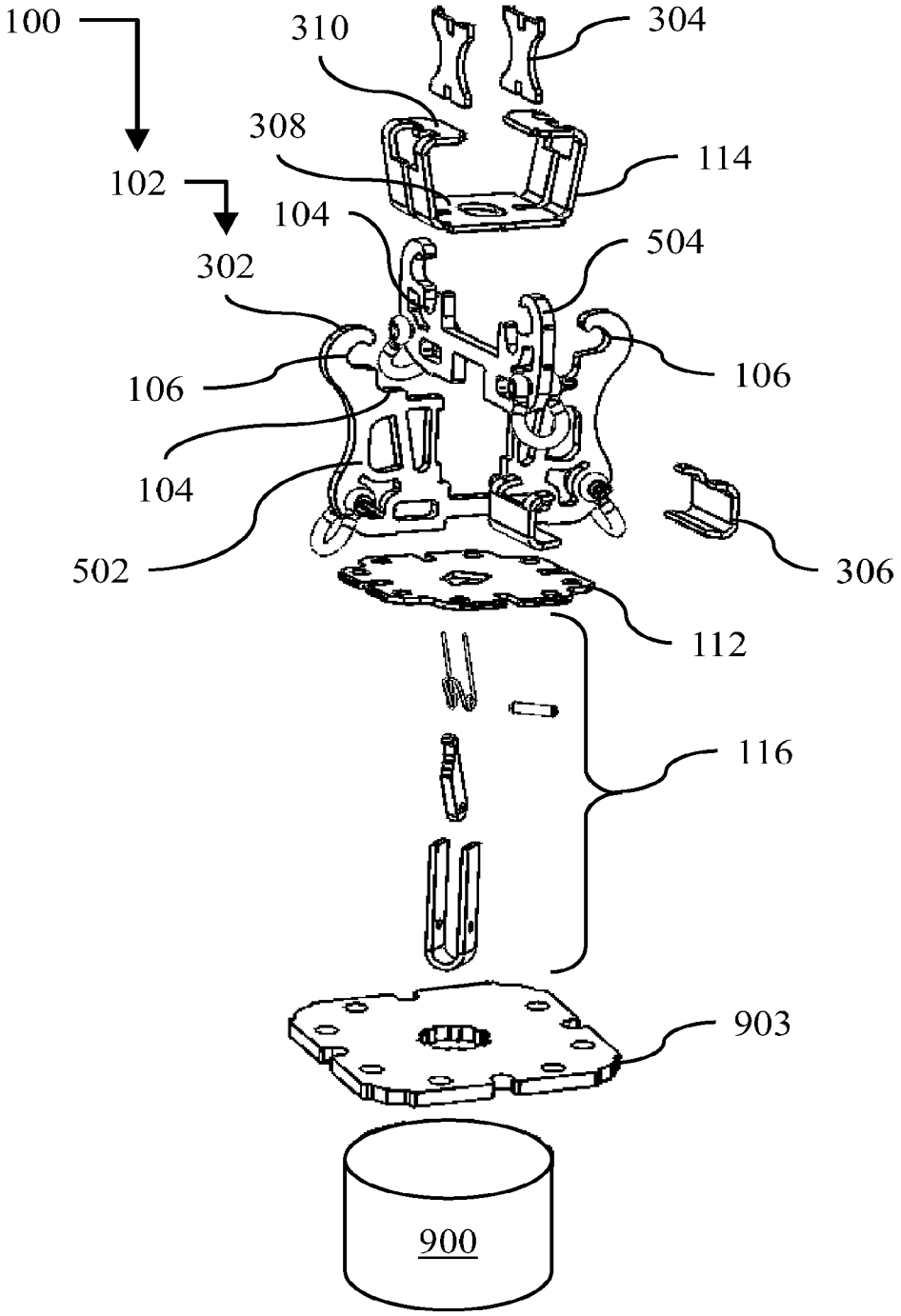

FIG. 26 depicts an exploded perspective view of an embodiment of the prop-head assembly 102 of FIG. 9.

Referring to the embodiments as depicted in FIG. 25 and FIG. 26, the second prop-head assembly 302 includes a first support element 304 and a second support element 306. The first support element 304 reinforces (is configured to reinforce), at least in part, the shape and configuration of the load-receiving feature 114. The second support element 306 reinforces (is configured to reinforce), at least in part, the shape and configuration of the first locator plate assembly 502. The first beam-locating feature 104 and the second beam-locating feature 106 of the first locator plate assembly 502 are spatially positioned higher than the first beam-locating feature 104 and the second beam-locating feature 106 of the second locator plate assembly 504. The prop-head assembly 102 includes a first locator plate assembly 502, and a second locator plate assembly 504. The first beam-locating feature 104 and the second beam-locating feature 106 provided by the first locator plate assembly 502 are positioned higher than the first beam-locating feature 104 and the second beam-locating feature 106 provided by the second locator plate assembly 504.

Figure 29:
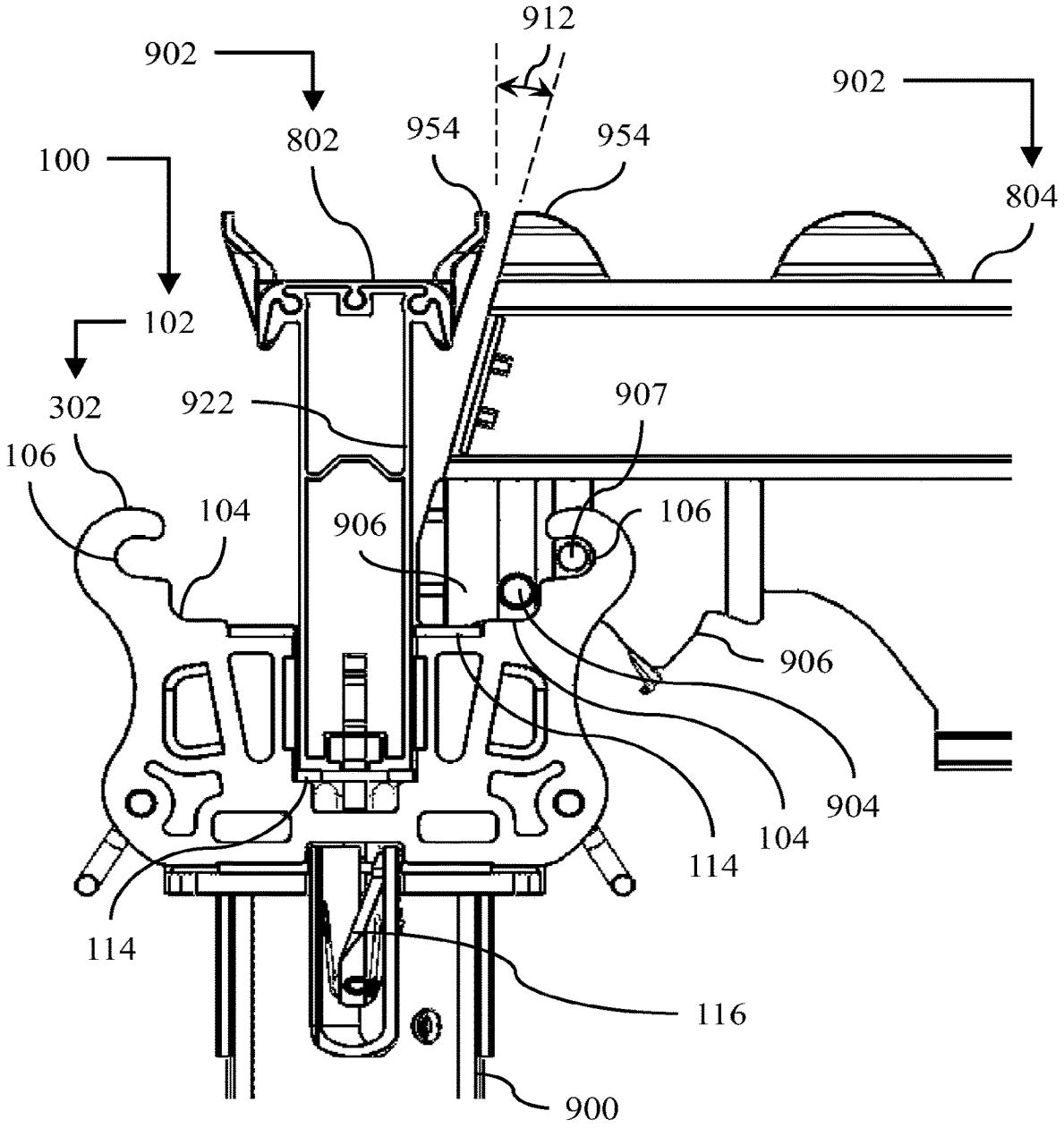
Figure 30:
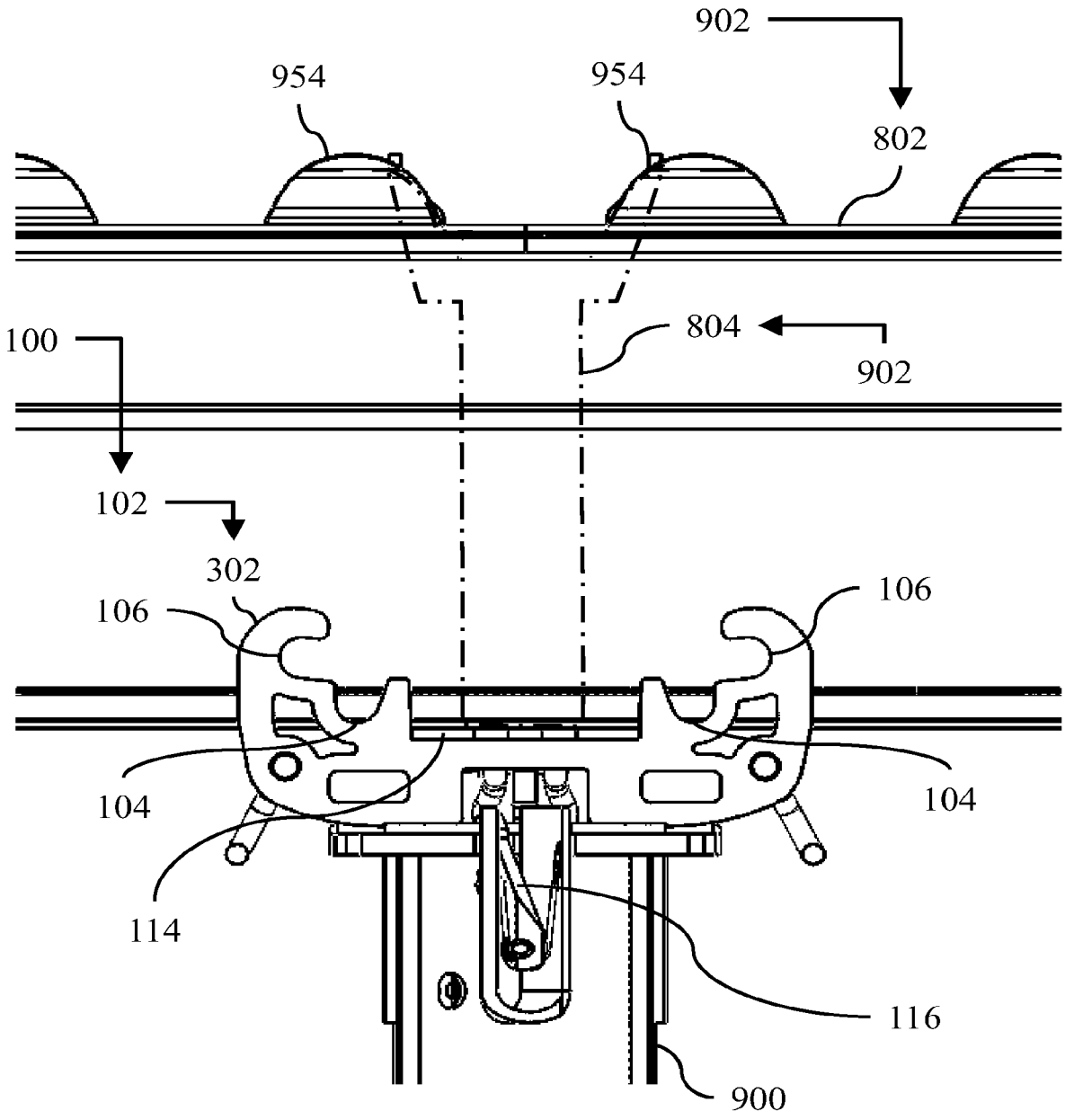

Referring to the embodiment as depicted in FIG. 25 and FIG. 26, the load-receiving feature 114 includes a lower portion 308 and an upper portion 310. Reference is made to FIG. 29 and FIG. 30 for the manner in which the load-receiving feature 114, in use, interacts with the crossbeam 804 and the primary beam 802.

Figure 27:
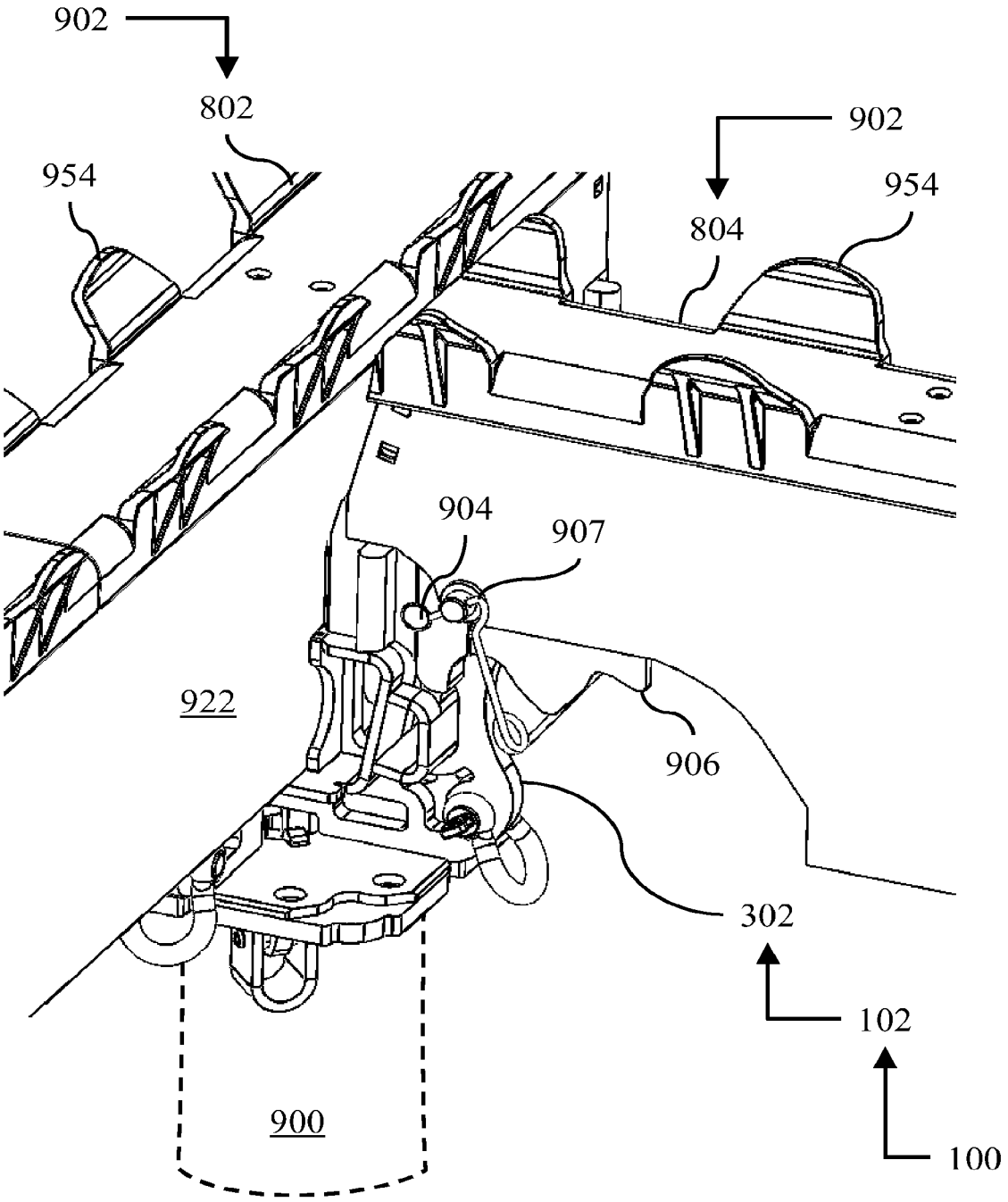
Figure 28:
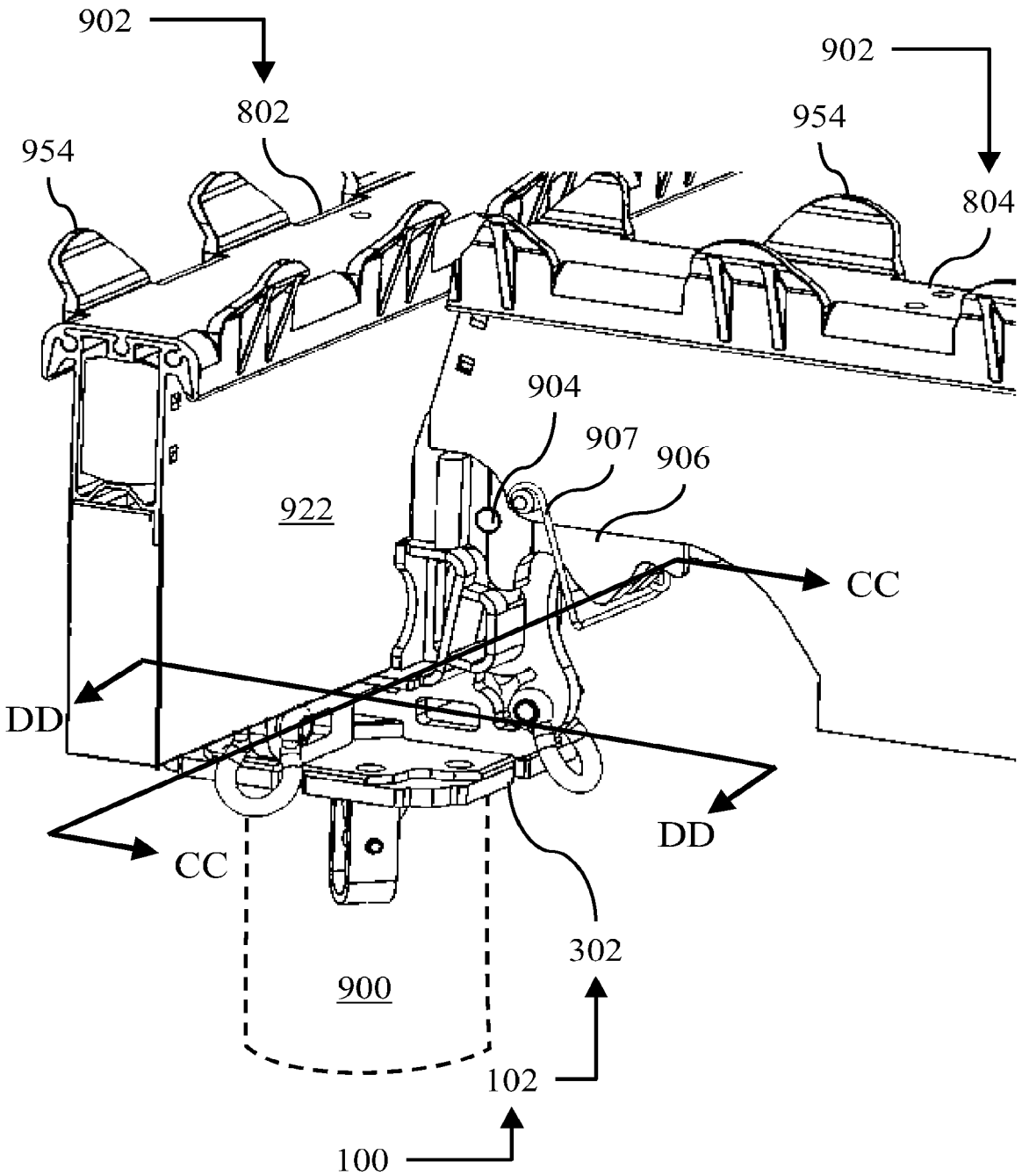

FIG. 27 and FIG. 28 depict perspective views of embodiments of the prop-head assembly 102 of FIG. 25.

Referring to the embodiments as depicted in FIG. 27 and FIG. 28, the primary beam 802 (the bottom section of the primary beam 802) is positioned on the second prop-head assembly 302, between the end portions of the primary beam 802. The sidewall 922 of the primary beam 802 is positioned proximate to the crossbeam 804 once the crossbeam 804 is positioned and located on the second prop-head assembly 302. The crossbeam 804 is orthogonally oriented relative to the sidewall 922 of the primary beam 802.

Referring to the embodiments as depicted in FIG. 27 and FIG. 28, a third deployment scenario is depicted, and includes the case where the prop-head assembly 102 is positioned underneath (and supports) a junction zone (a matrix junction), in which the junction zone is positioned below (and supports) the end portion of the crossbeam 804, and the end portion of the crossbeam 804 is positioned to face a sidewall of the primary beam 802. Preferably, the end portion of the crossbeam 804 is positioned adjacent to the sidewall of the primary beam 802 in a close relationship or a proximate relationship.

FIG. 29 depicts a cross-sectional view of an embodiment of the prop-head assembly 102 of FIG. 28. The cross-sectional view of FIG. 29 is taken along a cross-sectional line DD-DD of FIG. 28.

Referring to the embodiment as depicted in FIG. 29, the beam lock assembly 907 is installed to the second beam-locating feature 106 of the crossbeam 804 so that the beam lock assembly 907, in use, locks the crossbeam 804 to the second prop-head assembly 302. The beam-reference portion 904 of the crossbeam 804 is received by or positioned on the first beam-locating feature 104 of the second prop-head assembly 302.

Referring to the embodiment as depicted in FIG. 29, the lower section of the primary beam 802 is received by the lower portion of the load-receiving feature 114 of the second prop-head assembly 302. The lower portion of the load-receiving feature 114, in use, supports the primary beam 802 (once the primary beam 802 is received by the lower portion of the load-receiving feature 114).

Referring to the embodiment as depicted in FIG. 29, the distal end portion of the beam end support 906 (which is received and held by the crossbeam 804) is received (at least in part) by the upper portion of the load-receiving feature 114 of the second prop-head assembly 302. The upper portion of the load-receiving feature 114 of the second prop-head assembly 302, in use, supports (the weight of) the crossbeam 804 (once the crossbeam 804 is received by the upper portion of the load-receiving feature 114).

FIG. 30 depicts a cross-sectional view of an embodiment of the prop-head assembly 102 of FIG. 28. The cross-sectional view of FIG. 30 is taken along a cross-sectional line CC-CC of FIG. 28.

Referring to the embodiment as depicted in FIG. 30, the lower section of the primary beam 802 is received by the lower portion of the load-receiving feature 114 of the second prop-head assembly 302. The lower portion of the load-receiving feature 114, in use, supports the primary beam 802 (once the primary beam 802 is received by the lower portion of the load-receiving feature 114).

Clauses (Associated with or Relates to Prop-Head Assembly)

The following clauses are offered as further description of the examples of the apparatus. Any one or more of the following clauses may be combinable with (A) any other one or more of the following clauses and/or (B) with any subsection or a portion or portions of any other clause and/or (C) any combination and permutation of clauses and/or (D) as described in this application with or without any description that is not included in any specific clause. Any one of the following clauses may stand on its own merit without having to be combined with any other clause or with any portion of any other clause, etc.

Clause (1): an apparatus, comprising: a prop-head assembly fixedly connects (is fixedly connectable, configured to be fixedly connected) to a vertically-extending construction column; and the prop-head assembly also supports (configured to support), at least in part, a horizontal construction beam assembly once the prop-head assembly is fixedly connected to the vertically-extending construction column, in which the horizontal construction beam assembly has a beam-reference portion; and the prop-head assembly including a first beam-locating feature selectively receiving (selectively receivable, configured to selectively receive), at least in part, the beam-reference portion of the horizontal construction beam assembly; and the prop-head assembly also including a second beam-locating feature spaced apart from the first beam-locating feature, and the second beam-locating feature selectively receiving (selectively receivable, configured to selectively receive), at least in part, the beam-reference portion; and wherein the second beam-locating feature further receives (is further configured to receive), at least in part, the beam-reference portion of the horizontal construction beam assembly (once the beam-reference portion of the horizontal construction beam assembly is inadvertently displaced away from the first beam-locating feature and from the vertically-extending construction column and toward the second beam-locating feature).

Clause (2): an apparatus is provided for a vertically-extending construction column, and for a horizontal construction beam assembly having a beam-reference portion, and the apparatus comprising: a prop-head assembly fixedly connects (is fixedly connectable, is configured to be fixedly connected) to the vertically-extending construction column; and the prop-head assembly also supports (configured to support), at least in part, the horizontal construction beam assembly once the prop-head assembly is fixedly connected to the vertically-extending construction column; and the prop-head assembly including: a first beam-locating feature selectively receiving (selectively receivable of, configured to selectively receive), at least in part, the beam-reference portion of the horizontal construction beam assembly in such a way that the first beam-locating feature, in use, locates the beam-reference portion of the horizontal construction beam assembly at a first stationary position relative to the vertically-extending construction column once the first beam-locating feature, in use, selectively receives the beam-reference portion; and a second beam-locating feature spaced apart from the first beam-locating feature, and the second beam-locating feature selectively receiving (selectively receivable of, configured to selectively receive) the beam-reference portion of the horizontal construction beam assembly in such a way that the second beam-locating feature, in use, locates the beam-reference portion of the horizontal construction beam assembly at a second stationary position relative to the vertically-extending construction column once the second beam-locating feature, in use, selectively receives the beam-reference portion; and wherein the second beam-locating feature further receives (is further configured to receive), at least in part, the beam-reference portion of the horizontal construction beam assembly once the beam-reference portion of the horizontal construction beam assembly is inadvertently displaced away from the first beam-locating feature and also displaced away from the vertically-extending construction column.

Clause (3): the apparatus of Clause (2), wherein: the first beam-locating feature receives (receivable of, is configured to receive), at least in part, the beam-reference portion of the horizontal construction beam assembly once the horizontal construction beam assembly is positioned, in use, at the first beam-locating feature. The first beam-locating feature limits (is configured to limit) inadvertent side-to-side horizontal movement and limit inadvertent downward vertical movement of the beam-reference portion of the horizontal construction beam assembly once the beam-reference portion is positioned at the first beam-locating feature; and (C) permit unimpeded upward vertical movement of the beam-reference portion of the horizontal construction beam assembly once the beam-reference portion is positioned at the first beam-locating feature.

Clause (4): the apparatus of Clause (2), wherein: the first beam-locating feature further supports (is further configured to support) the beam-reference portion of the horizontal construction beam assembly once the beam-reference portion, in use, is received by the first beam-locating feature.

Clause (5): the apparatus of Clause (2), wherein the second beam-locating feature receives (receivable of, is configured to receive) the beam-reference portion of the horizontal construction beam assembly once the beam-reference portion is positioned, in use, at the second beam-locating feature. The second beam-locating feature limits (is configured limit), at least in part, inadvertent upward vertical movement and limit inadvertent downward vertical movement of the beam-reference portion of the horizontal construction beam assembly once the beam-reference portion is positioned at the second beam-locating feature. The second beam-locating feature limits (is configured to limit), at least in part, inadvertent horizontal movement of the beam-reference portion of the horizontal construction beam assembly away from the vertically-extending construction column once the beam-reference portion is positioned at the second beam-locating feature. The second beam-locating feature permits (is configured to permit) unimpeded horizontal movement of the beam-reference portion of the horizontal construction beam assembly toward the vertically-extending construction column once the beam-reference portion is positioned at the second beam-locating feature.

Clause (6): the apparatus of Clause (5), wherein: the second beam-locating feature supports (is configured to support), at least in part, the beam-reference portion of the horizontal construction beam assembly once the beam-reference portion, in use, is received by the second beam-locating feature.

Clause (7): the apparatus of Clause (2), wherein: the horizontal construction beam assembly has opposite end portions; and wherein the opposite end portions of the horizontal construction beam assembly each include: a beam end support affixed to end portions of the horizontal construction beam assembly; and the beam-reference portion is located proximate to (is configured to be selectively spatially located proximate to) any one of the first beam-locating feature and the second beam-locating feature of the prop-head assembly; and wherein the beam-reference portion is located in the beam end support; and wherein the weight of the horizontal construction beam assembly is to be transferred, at least in part, to the opposite ends of the horizontal construction beam assembly to the beam end support that is positioned at the opposite ends of the horizontal construction beam assembly; and wherein the weight of the horizontal construction beam assembly is transferred, at least in part, to the prop-head assembly via the beam end support, in which the beam end support is positioned at the opposite ends of the horizontal construction beam assembly once the beam end support of the horizontal construction beam assembly, in use, contacts, at least in part, the prop-head assembly.

Clause (8): the apparatus of Clause (2), wherein: the horizontal construction beam assembly has an end portion; and the end portion of the horizontal construction beam assembly includes: the beam-reference portion located proximate to (is configured to be selectively spatially located proximate to) any one of the first beam-locating feature and the second beam-locating feature of the prop-head assembly; and a beam end support, in which the beam-reference portion is located in the beam end support.

Clause (9): the apparatus of Clause (2), wherein: the horizontal construction beam assembly includes: a first horizontal construction beam assembly; and a second horizontal construction beam assembly; and wherein the first horizontal construction beam assembly and the second horizontal construction beam assembly are orthogonally positionable relative to each other on a horizontal plane; and wherein the first horizontal construction beam assembly and the second horizontal construction beam assembly, in use, form a matrix pattern on which a horizontal structural floor is securely positionable thereon.

Clause (10): the apparatus of Clause (2), wherein: the horizontal construction beam assembly includes: a frame-engagement device engaging (engagable with, configured to engage) a bottom portion a frame assembly having a concrete slab.

Clause (11): the apparatus of Clause (2), wherein: the horizontal construction beam assembly includes: a beam end support providing a cavity exposing (configured to expose), at least in part, the beam-reference portion once the beam-reference portion is received by the beam end support; and wherein the beam-reference portion, in use, contacts a portion of the prop-head assembly.

Clause (12): the apparatus of Clause (2), wherein: the horizontal construction beam assembly includes: a first horizontal construction beam assembly; and a second horizontal construction beam assembly; and the prop-head assembly includes: a first prop-head assembly; and a second prop-head assembly; and wherein: the first prop-head assembly and the second prop-head assembly are positionable at selected junctions of a matrix pattern formed by the first horizontal construction beam assembly and the second horizontal construction beam assembly, which are positionable orthogonal relative to each other on a horizontal plane forming the matrix pattern, on which a horizontal structural floor, which is formed by a plurality of a frame assembly and a concrete slab, is securely positioned thereon.

Clause (13): the apparatus of Clause (2), wherein: the horizontal construction beam assembly defines a prop receiver; and the prop receiver receives (is configured to receive), at least in part, the prop-head assembly so that the prop-head assembly is positioned between end portions of the horizontal construction beam assembly once the prop receiver, in use, receives, at least in part, the prop-head assembly.

Clause (14): the apparatus of Clause (2), further comprising: a beam lock assembly is installed (installable, configured to be installed) to the second beam-locating feature of the prop-head assembly; and the beam lock assembly securely locks is also configured to selectively securely lock) the horizontal construction beam assembly to the prop-head assembly at the second beam-locating feature; and wherein the beam-reference portion of the horizontal construction beam assembly is located at the first beam-locating feature of the prop-head assembly.

Clause (15): the apparatus of Clause (2), wherein: the prop-head assembly includes: a prop base affixed to (configured to be affixed to), at least in part, a column portion of the horizontal construction beam assembly; and a load-receiving feature; and wherein the load-receiving feature is coupled to the prop base; and wherein the load-receiving feature receives and supports (is configured to receive and support), at least in part, the weight of the horizontal construction beam assembly.

Clause (16): the apparatus of Clause (2), wherein: the prop-head assembly includes: a load-receiving feature receives and supports (configured to receive and support), at least in part, the weight of the horizontal construction beam assembly; and a first locator plate assembly; and a second locator plate assembly positioned relative to the first locator plate assembly; and wherein the first locator plate assembly and the second locator plate assembly are positioned at right angles to each other in an orthogonal relationship relative to each other; and wherein the load-receiving feature is positioned centrally on the first locator plate assembly and the second locator plate assembly.

Clause (17): the apparatus of Clause (2), wherein: the prop-head assembly includes: a first locator plate assembly; and a second locator plate assembly; and wherein the first beam-locating feature and the second beam-locating feature provided by the first locator plate assembly are positioned higher than the first beam-locating feature and the second beam-locating feature provided by the second locator plate assembly.

Clause (18): the apparatus of Clause (2), wherein: the prop-head assembly includes: a first locator plate assembly; and a second locator plate assembly; and wherein the first beam-locating feature and the second beam-locating feature provided by the first locator plate assembly are positioned at the same level as the first beam-locating feature and the second beam-locating feature provided by the second locator plate assembly.

Clause (19): a method of operating a prop-head assembly provided for a vertically-extending construction column, and for a horizontal construction beam assembly having a beam-reference portion, and the method comprising: fixedly connecting the prop-head assembly to the vertically-extending construction column; and using the prop-head assembly to support, at least in part, the horizontal construction beam assembly once the prop-head assembly is fixedly connected to the vertically-extending construction column; and selectively receiving, at least in part, the beam-reference portion at a first beam-locating feature of the prop-head assembly; and selectively receiving, at least in part, the beam-reference portion at a second beam-locating feature, in which the second beam-locating feature is spaced apart from the first beam-locating feature; and receiving the beam-reference portion at the second beam-locating feature once the beam-reference portion is inadvertently displaced away from the first beam-locating feature and from the vertically-extending construction column and toward the second beam-locating feature.

Clause (20): an apparatus, comprising: a structure, including: a vertically-extending construction column positioned (positionable, configured to be positionable or positioned) on a working surface in such a way that the vertically-extending construction column, in use, extends vertically above the working surface once the vertically-extending construction column, in use, is positioned on the working surface; and a horizontal construction beam assembly having a beam-reference portion; and a prop-head assembly fixedly connecting to (configured to be fixedly connected to) the vertically-extending construction column; and the prop-head assembly also supports (also configured to support), at least in part, the horizontal construction beam assembly once the prop-head assembly is fixedly connected to the vertically-extending construction column; and the prop-head assembly includes: a first beam-locating feature selectively receives (configured to selectively receive), at least in part, the beam-reference portion of the horizontal construction beam assembly; this is done in such a way that the first beam-locating feature, in use, locates the beam-reference portion of the horizontal construction beam assembly at a first stationary position relative to the vertically-extending construction column once the first beam-locating feature, in use, selectively receives the beam-reference portion; and a second beam-locating feature spaced apart from the first beam-locating feature, and the second beam-locating feature selectively receiving (selectively receivable of, configured to selectively receive) the beam-reference portion of the horizontal construction beam assembly in such a way that the second beam-locating feature, in use, locates the beam-reference portion of the horizontal construction beam assembly at a second stationary position relative to the vertically-extending construction column once the second beam-locating feature, in use, selectively receives the beam-reference portion; and wherein the second beam-locating feature is further receives (configured to receive) the beam-reference portion of the horizontal construction beam assembly once the beam-reference portion of the horizontal construction beam assembly is inadvertently displaced away from the first beam-locating feature and also displaced away from the vertically-extending construction column.

Concrete-Slab Frame Assembly for Construction Beam Assembly

Figure 81:
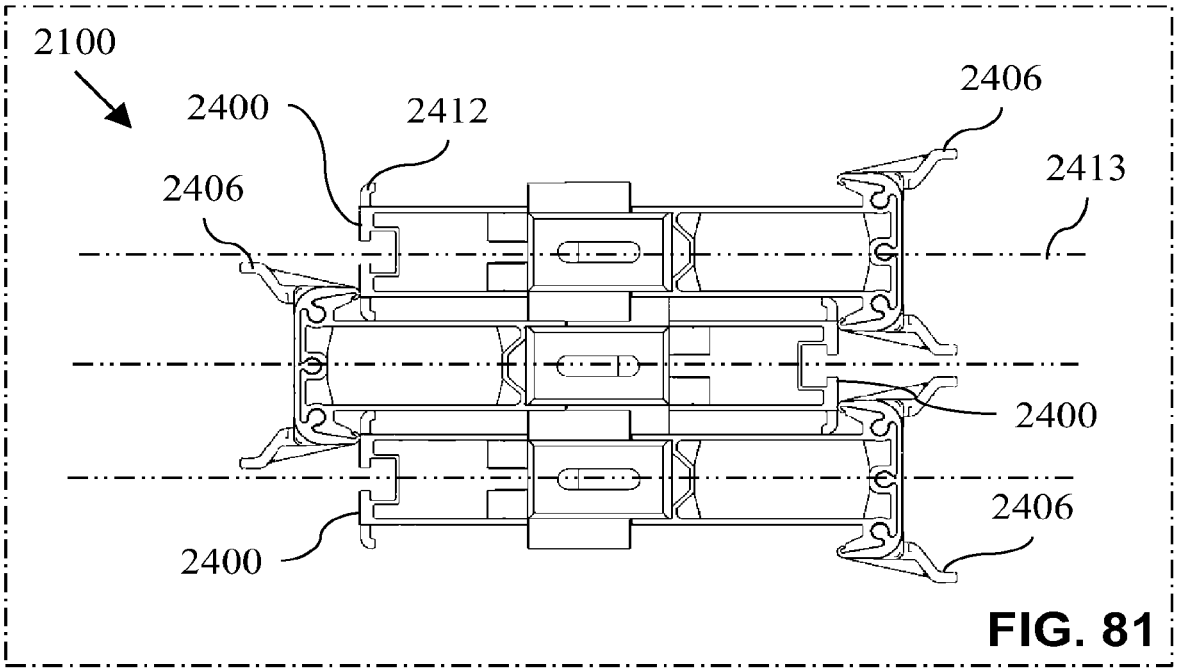

Technical Field (Associated with or Relates to Concrete-Slab Frame Assembly for Construction Beam Assembly This document relates to (and is not limited to) the technical field of a construction component with reference to the embodiments of FIG. 1 to FIG. 81, and the construction component may include and is not limited to (with reference to FIG. 31 to FIG. 53) a concrete-slab frame assembly for a construction beam assembly for utilization with a construction beam assembly (and/or a method associated with a concrete-slab frame assembly for utilization with a construction beam assembly).

Background (Associated with or Relates to Concrete-Slab Frame Assembly for Construction Beam Assembly Shoring is a process of temporarily supporting a structure (such as, a building, a vessel, a trench, etc.) with shores (also called props or supports) when there is a danger of collapse of the structure or during construction, repairs or alterations (of the structure). Shoring may be vertical, angled, or horizontal. For instance, a building component (such as, a prop, a prop assembly, etc.) is an object (also called a support) placed beneath and/or against a structure (or part of the structure) configured to keep (prevent) the structure from falling or shaking, etc.

Summary (Associated with or Relates to Concrete-Slab Frame Assembly for Construction Beam Assembly It will be appreciated that there exists a need to mitigate (at least in part) at least one problem associated with the existing concrete-slab frames utilized with construction beams (also called the existing technology). After much study of the known systems and methods with experimentation, an understanding (at least in part) of the problem and its solution has been identified (at least in part) and is articulated (at least in part) as follows:

Placement of a concrete-slab frame assembly on a construction beam assembly can be a difficult proposition. Typically, the construction beam assembly is connected to a prop-head, and the construction beam assembly is aligned horizontally between prop-heads (once the construction beam assembly is mounted to the prop-heads).

For some cases, the construction beam assembly must be aligned non-horizontally at an angle in which the construction beam assembly is sloped relative to the horizontal (the horizon), and then the concrete-slab frame assembly is placed on the construction beam assembly once the construction beam assembly is aligned non-horizontally. For instance, it may be desired to facilitate drainage of water from the surface of the concrete-slab frame assembly, and so the non-horizontal alignment of the construction beam assembly is required. Placement of the concrete-slab frame assembly on the construction beam assembly that is non-horizontally aligned may be a challenge.

The definition of horizontal is "of or relating to the apparent junction of earth and sky; situated near the horizon".

To mitigate, at least in part, at least one problem associated with the existing technology, there is provided (in accordance with a major aspect) an apparatus. The apparatus is for (is configured for) utilization with a first construction beam assembly, a prop-head assembly, and a vertically-extending construction column. The apparatus includes and is not limited to (comprises) a first concrete-slab frame assembly having synergistic technical features (synergistic configurations). The first concrete-slab frame assembly receives and supports (is configured to receive and support), at least in part, a first formed concrete slab. The first concrete-slab frame assembly, in use, receives and supports the first formed concrete slab. The first concrete-slab frame assembly is slidably positionable on, and movable along, the first construction beam assembly. The first concrete-slab frame assembly has a first frame-abutment feature. The first construction beam assembly is pivotally mountable to the prop-head assembly. The first construction beam assembly has the first beam-abutment feature. The prop-head assembly is affixed to (is affixable to, is configured to be affixed) to the vertically-extending construction column (that is, extend vertically relative to the horizon). The vertically-extending construction column is fixedly positioned (configured to be fixedly positioned, is fixedly positionable) to the working surface. The first frame-abutment feature of the first concrete-slab frame assembly is slide movable relative to the first beam-abutment feature of the first construction beam assembly in response to the pivotal movement of the first construction beam assembly relative to the prop-head assembly. In accordance with an embodiment, the apparatus is adapted such that the first frame-abutment feature of the first concrete-slab frame assembly is slide movable relative (is configured to be slide movable) to the first beam-abutment feature of the first construction beam assembly in response to the pivotal movement of the first construction beam assembly relative to the prop-head assembly. The pivotal movement is done once: (A) the vertically-extending construction column, in use, is fixedly positioned to the working surface; and (B) the prop-head assembly, in use, is affixed to the vertically-extending construction column; and (C) the first construction beam assembly, in use, is pivotally mounted to the prop-head assembly; and (D) the first concrete-slab frame assembly, in use, is positioned on the first construction beam assembly; and (E) the first construction beam assembly, in use, is pivotally moved (pivoted) while being pivotally mounted to the prop-head assembly.

To mitigate, at least in part, at least one problem associated with the existing technology, there is provided (in accordance with a major aspect) an apparatus. The apparatus includes and is not limited to (comprises) a synergistic combination of a vertically-extending construction column, a prop-head assembly, a first construction beam assembly, and a first concrete-slab frame assembly. The vertically-extending construction column is fixedly positioned (is configured to be fixedly positioned, is fixedly positionable) to the working surface. The prop-head assembly is affixed (is configured to be affixed, is affixable) to the vertically-extending construction column. A first construction beam assembly is pivotally mountable (is pivotally mounted, is configured to be pivotally mounted) to the prop-head assembly. The first construction beam assembly has (includes) a first beam-abutment feature. The first concrete-slab frame assembly receives and supports (is configured to receive and support), at least in part, a first formed concrete slab. The first concrete-slab frame assembly, in use, receives and supports the first formed concrete slab. The first concrete-slab frame assembly is slidably positionable on, and movable along, the first construction beam assembly. The first concrete-slab frame assembly is positionable on and movable along (is configured to be slidably positionable on and movable along), at least in part, the first construction beam assembly. The first concrete-slab frame assembly has (includes) a first frame-abutment feature. The first frame-abutment feature of the first concrete-slab frame assembly is slide movable (is configured to be slide movable) relative to the first beam-abutment feature of the first construction beam assembly in response to the pivotal movement of the first construction beam assembly relative to the prop-head assembly. In accordance with an embodiment, the apparatus is adapted such that the first frame-abutment feature of the first concrete-slab frame assembly is slide movable (is configured to be slide movable) relative to the first beam-abutment feature of the first construction beam assembly in response to the pivotal movement of the first construction beam assembly relative to the prop-head assembly. This pivotal movement is done once: (A) the vertically-extending construction column, in use, is fixedly positioned to the working surface; and (B) the prop-head assembly, in use, is affixed to the vertically-extending construction column; and (C) the first construction beam assembly, in use, is pivotally mounted to the prop-head assembly; and (D) the first concrete-slab frame assembly, in use, is positioned on the first construction beam assembly; and (E) the first construction beam assembly, in use, is pivotally moved while being pivotally mounted to the prop-head assembly.

Other aspects are identified in the claims. Other aspects and features of the non-limiting embodiments may now become apparent to those skilled in the art upon review of the following detailed description of the non-limiting embodiments with the accompanying drawings. This Summary is provided to introduce concepts in simplified form that are further described below in the Detailed Description. This Summary is not intended to identify key features or essential features of the disclosed subject matter, and is not intended to describe each disclosed embodiment or every implementation of the disclosed subject matter. Many other novel advantages, features, and relationships will become apparent as this description proceeds. The figures and the description that follow more particularly exemplify illustrative embodiments.

Figure 31:
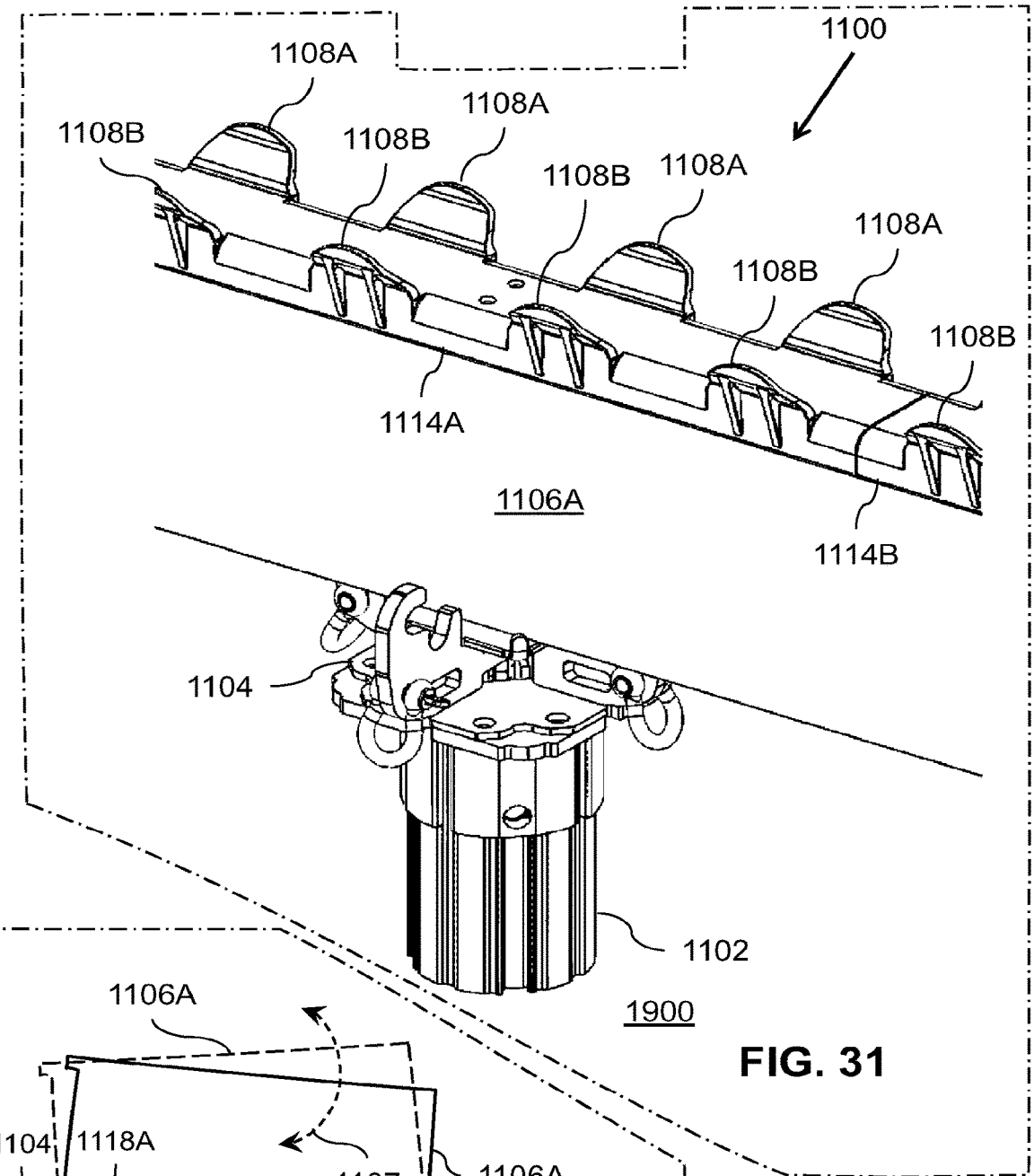
FIG. 31 to FIG. 53 specifically depict (relate to or are associated with) views of embodiments of a construction component including a concrete-slab frame assembly for a construction beam assembly.
Figure 32:
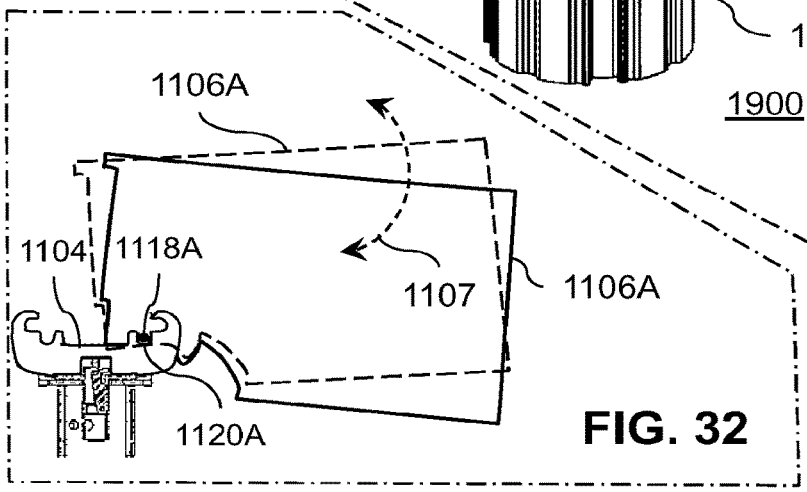
Figure 33:
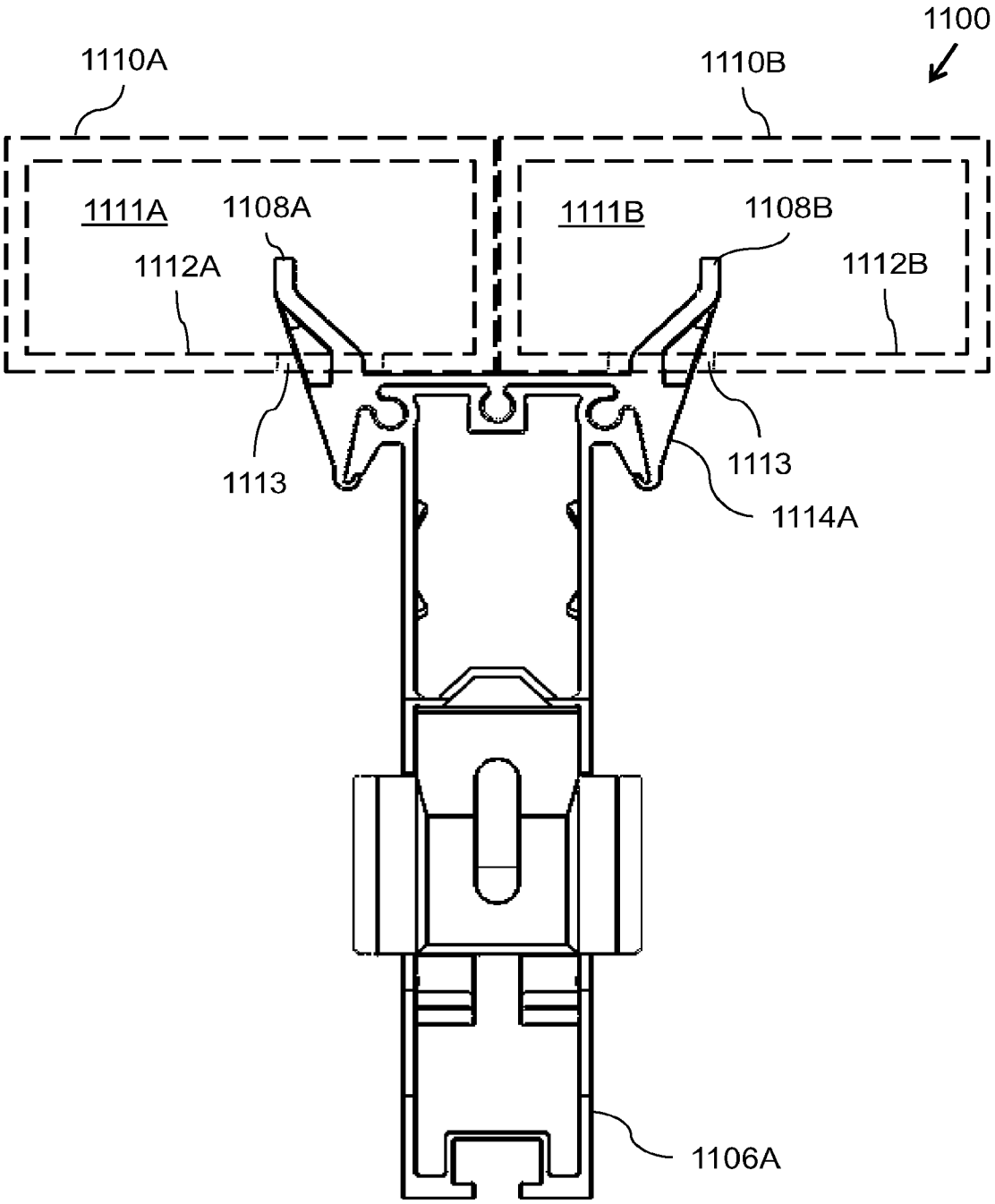
Figure 34:
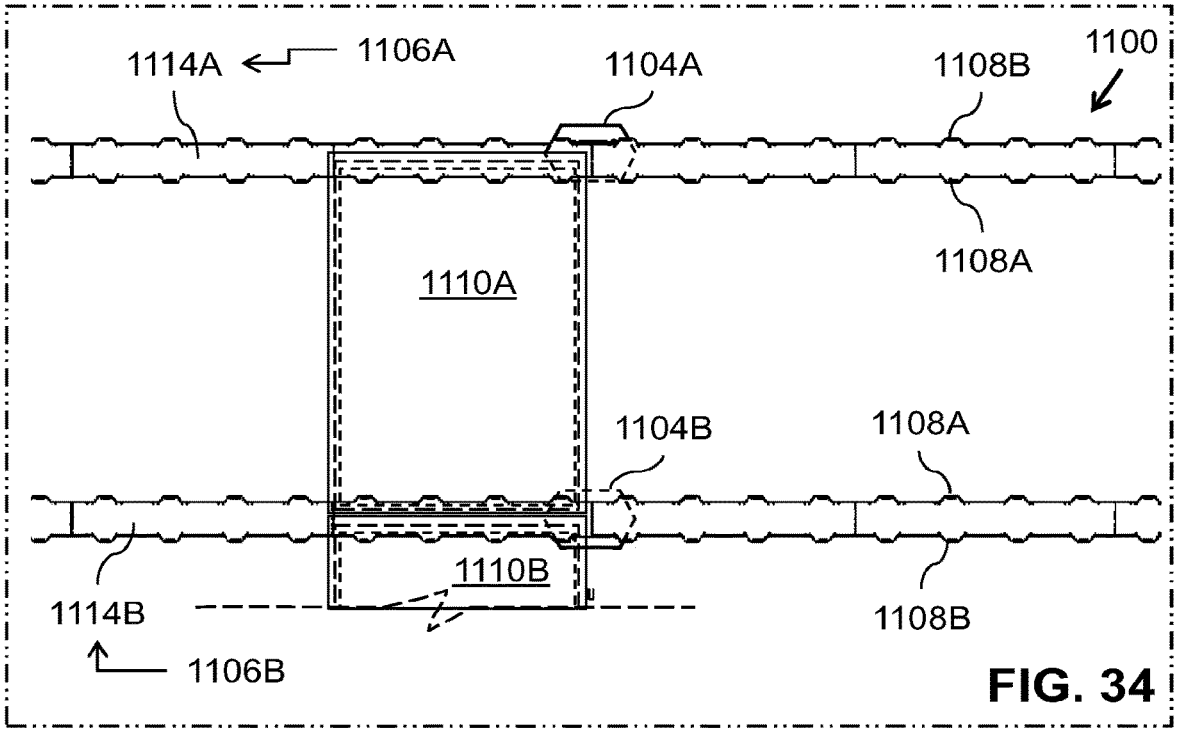
Figure 35:
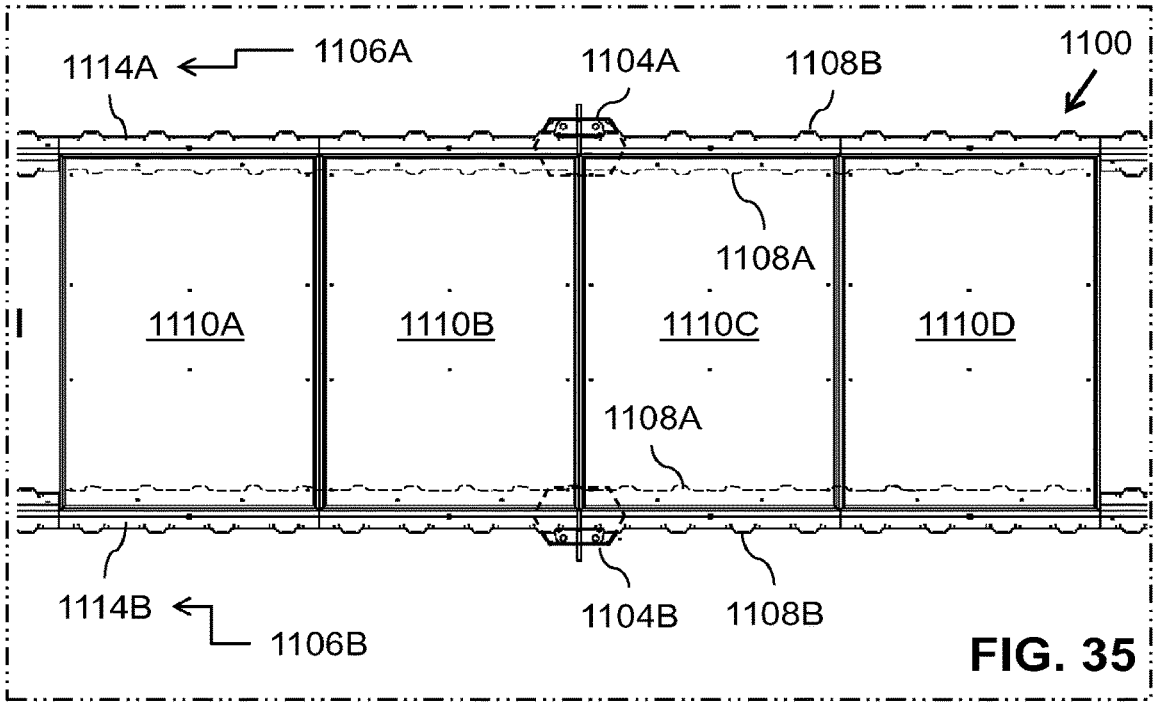

Brief Description of the Drawings (Associated with or Relates to Concrete-Slab Frame Assembly for Construction Beam Assembly The non-limiting embodiments may be more fully appreciated by reference to the following detailed description of the non-limiting embodiments when taken in conjunction with the accompanying drawings, in which:

FIG. 31 and FIG. 32 depict a perspective view (FIG. 31) and a side view (FIG. 32) of embodiments of an apparatus for (configured for) the construction, and support, of a building structure; and FIG. 33 depicts an end view of an embodiment of the apparatus of FIG. 31; and FIG. 34 and FIG. 35 depict top views of embodiments of the apparatus of FIG. 31, in which the apparatus includes a first construction beam assembly, a prop-head assembly, and a first concrete-slab frame assembly; and FIG. 36, FIG. 37, FIG. 38, FIG. 39, FIG. 40 and FIG. 41 depict side views (FIG. 36, FIG. 37, FIG. 40 and FIG. 41), a top view (FIG. 38) and a cross-sectional view (FIG. 39) of embodiments of the apparatus of FIG. 35, in which the first construction beam assembly is horizontally aligned while the first construction beam assembly is pivotally mounted to the prop-head assembly; and FIG. 42, FIG. 43, FIG. 44, FIG. 45, FIG. 46 and FIG. 47 depict side views (FIG. 42, FIG. 43, FIG. 46 and FIG. 47), a top view (FIG. 44) and a cross-sectional view (FIG. 45) of embodiments of the apparatus of FIG. 35, in which the first construction beam assembly is pivoted downwardly relative to the prop-head assembly, and the first construction beam assembly has a non-horizontal alignment while the first construction beam assembly is pivotally mounted to the prop-head assembly; and FIG. 48, FIG. 49, FIG. 50, FIG. 51, FIG. 52 and FIG. 53 depict side views (FIG. 48, FIG. 49, FIG. 52 and FIG. 53), a top view (FIG. 50) and a cross-sectional view (FIG. 51) of embodiments of the apparatus of FIG. 35, in which the first construction beam assembly is pivoted upwardly relative to the prop-head assembly, and the first construction beam assembly has a non-horizontal alignment while the first construction beam assembly is pivotally mounted to the prop-head assembly.

The drawings are not necessarily to scale and may be illustrated by phantom lines, diagrammatic representations and fragmentary views. In certain instances, details unnecessary for an understanding of the embodiments (and/or details that render other details difficult to perceive) may have been omitted. Corresponding reference characters indicate corresponding components throughout the several figures of the drawings. Elements in the several figures are illustrated for simplicity and clarity and have not been drawn to scale. The dimensions of some of the elements in the figures may be emphasized relative to other elements for facilitating an understanding of the various disclosed embodiments. In addition, common, but well-understood, elements that are useful or necessary in commercially feasible embodiments are often not depicted to provide a less obstructed view of the embodiments of the present disclosure.

LISTING OF REFERENCE NUMERALS USED IN THE DRAWINGS (ASSOCIATED WITH OR RELATES TO CONCRETE-SLAB FRAME ASSEMBLY FOR CONSTRUCTION BEAM ASSEMBLY

1100 apparatus
1102 vertically-extending construction column
1104 prop-head assembly
1104A first prop-head assembly
1104B second prop-head assembly
1106 construction beam assembly
1106A first construction beam assembly
1106B second construction beam assembly
1107 pivot angle
1108 beam-abutment feature
1108A first beam-abutment feature
1108B second beam-abutment features
1110 concrete-slab frame assembly
1110A first concrete-slab frame assembly
1110B second concrete-slab frame assembly
1110C third concrete-slab assembly

1110D fourth concrete-slab assembly
1111 formed concrete slab
1111A first formed concrete slab
1111B second formed concrete slab
1112 frame-abutment feature
1112A first frame-abutment feature
1112B second frame-abutment feature
1113 panel slots
1114 top beam portion
1114A first top beam portion
1114B second top beam portion
1116 end section
1116A first end section
1116B second end section
1118 beam-reference portion
1118A first beam-reference portion
1118B second beam-reference portion
1120 beam-locating feature
1120A first beam-locating feature
1120B second beam-locating feature
1122 gap
1122A first gap
1122B second gap
1122C third gap
1122D fourth gap
1124 skim coat
1126 camming surface
1126A first camming surface
1126B second camming surface
1128 contact point
1129 top frame portion
1130 frame edge gap
1132 leakage drop direction
1134 frame gap
1136 top end portion
1136A first top end portion
1136B second top end portion
1138 contact zone
1140 angle
1140A first angle
1140B second angle
1142 pivot direction
1142A first pivot direction
1142B second pivot direction
1144 abutment
1144A first abutment
1144B second abutment
1144C third abutment
1144D fourth abutment
1146 vertical line
1148 angle
1150 horizontal line
1152 angle
1152A first angle
1152B second angle
1900 working surface

Detailed Description of the Non-Limiting Embodiment(s) (Associated with or Relates to Concrete-Slab Frame Assembly for Construction Beam Assembly The following detailed description is merely exemplary and is not intended to limit the described embodiments or the application and uses of the described embodiments. As used, the word "exemplary" or "illustrative" means "serving as an example, instance, or illustration." Any implementation described as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure. The scope of the claim is defined by the claims (in which the claims may be amended during patent examination after the filing of this application). For the description, the terms "upper," "lower," "left," "rear," "right," "front," "vertical," "horizontal," and derivatives thereof shall relate to the examples as oriented in the drawings. There is no intention to be bound by any expressed or implied theory in the preceding Technical Field, Background, Summary or the following detailed description. It is also to be understood that the devices and processes illustrated in the attached drawings, and described in the following specification, are exemplary embodiments (examples), aspects and/or concepts defined in the appended claims. Hence, dimensions and other physical characteristics relating to the embodiments disclosed are not to be considered as limiting, unless the claims expressly state otherwise. It is understood that the phrase "at least one" is equivalent to "a". The aspects (examples, alterations, modifications, options, variations, embodiments and any equivalent thereof) are described regarding the drawings. It should be understood that the invention is limited to the subject matter provided by the claims, and that the invention is not limited to the particular aspects depicted and described. It will be appreciated that the scope of the meaning of a device configured to be coupled to an item (that is, to be connected to, to interact with the item, etc.) is to be interpreted as the device being configured to be coupled to the item, either directly or indirectly. Therefore, "configured to" may include the meaning "either directly or indirectly" unless specifically stated otherwise.

FIG. 31 and FIG. 32 depict a perspective view (FIG. 31) and a side view (FIG. 32) of embodiments of an apparatus 1100 for (configured for) the construction and/or the support of a building structure (for instance as depicted in the embodiment of FIG. 1, such as a building or bridge, etc., and any equivalent thereof).

It will be appreciated that the apparatus 1100 may be utilized as a temporary structure for forming a floor (poured concrete floor) of the structure 700 (depicted in FIG. 1); once the floor is formed, the apparatus 1100 may be removed, and relocated on the newly formed floor, so that, in this manner, the apparatus 1100 may be further utilized in the formation of another new floor to be located over the newly formed floor of the structure 700 (depicted in FIG. 1).

Referring to the embodiment as depicted in FIG. 31, a vertically-extending construction column 1102 is fixedly positioned (is configured to be fixedly positioned, is fixedly positionable) to a working surface 1900 (such as, the ground, etc., and any equivalent thereof). Preferably, the vertically-extending construction column 1102 (that is, extend vertically relative to the horizon) is formed from a metal alloy and/or is extruded or manufactured. A prop-head assembly 1104 is be securely affixable to (is configured to be securely affixable to, is configured to be securely affixed to) (an end section of) the vertically-extending construction column 1102 (once the vertically-extending construction column 1102, in use, is fixedly positioned to the working surface 1900). The prop-head assembly 1104, in use, supports, at least in part, (or receives) the weight of a first construction beam assembly 1106A. The prop-head assembly 1104 supports (is also configured to support), at least in part, (or receive or configured to receive), at least in part, the weight of a first construction beam assembly 1106A (once the vertically-extending construction column 1102 is placed on prop-head assembly 1104).

As depicted in the embodiment of FIG. 31, the first construction beam assembly 1106A spans across the prop-head assembly 1104. As depicted in the embodiment of FIG. 32, the first construction beam assembly 1106A is pivotally mounted to the prop-head assembly 1104.

Referring to the embodiment as depicted in FIG. 31, the first construction beam assembly 1106A is formed from a metal alloy and/or is extruded or manufactured. The first construction beam assembly 1106A has (includes) a first beam-abutment feature 1108A. The first construction beam assembly 1106A has (includes) a first top beam portion 1114A. The first top beam portion 1114A (of the first construction beam assembly 1106A) may be injection moulded (by an injection molding system), and then may be fitted (friction fitted) to a top section of the first construction beam assembly 1106A. The first top beam portion 1114A includes the first beam-abutment feature 1108A. Alternatively, the first construction beam assembly 1106A includes the first beam-abutment feature 1108A. The first top beam portion 1114A extends along a length of the first construction beam assembly 1106A. Preferably, the first construction beam assembly 1106A includes the first beam-abutment feature 1108A. Preferably, the first beam-abutment feature 1108A is affixed to (is configured to be affixed to, mounted to) the first construction beam assembly 1106A.

The first beam-abutment feature 1108A may include upstanding ribs, a row of ribs, a double row of spaced apart upstanding ribs, etc., and any equivalent thereof. A flat linear portion extends between each of the upstanding ribs (between each upstanding rib) of the double row of spaced apart upstanding ribs. The first beam-abutment feature 1108A extends, at least in part, along a length of the top section of the first construction beam assembly 1106A.

Referring to the embodiment as depicted in FIG. 31, a second top beam portion 1114B is positioned to (in use) abut (an end portion of) the first top beam portion 1114A, and the second top beam portion 1114B extends along a length of the first construction beam assembly 1106A. Preferably, the first top beam portion 1114A includes a first row of first beam-abutment features 1108A positioned along a first lateral side edge of the first top beam portion 1114A. The first beam-abutment features 1108A are spaced part from each other along a single file (single row). A flat linear portion extends between each of the first beam-abutment features 1108A. Preferably, the first top beam portion 1114A includes a second row of second beam-abutment features 1108B positioned along a second lateral side edge of the first top beam portion 1114A. The first row of first beam-abutment features 1108A are spaced apart from the second row of second beam-abutment features 1108B. The second beam-abutment features 1108B are spaced part from each other along a single file (single row). Preferably, a flat linear portion extends between each of the second beam-abutment features 1108B.

Referring to the embodiment as depicted in FIG. 32, in general terms, the first construction beam assembly 1106A is pivotally mounted (is configured to be pivotally mounted) to the prop-head assembly 1104. The first construction beam assembly 1106A is pivotally mountable to the prop-head assembly 1104. The first construction beam assembly 1106A, in use, is pivotally mounted to (and supportable, at least in part by) the prop-head assembly 1104. In use, the first construction beam assembly 1106A is pivotally movable along a pivot angle 1107.

Referring to the embodiment as depicted in FIG. 32, more specifically, the prop-head assembly 1104 includes a first beam-locating feature 1120A. The first construction beam assembly 1106A includes a first end section 1116A having a first beam-reference portion 1118A. The first beam-reference portion 1118A (of the first construction beam assembly 1106A) is pivotally mountable to (and supportable, at least in part, by) the first beam-locating feature 1120A of the prop-head assembly 1104.

FIG. 33 depicts an embodiment of an end view of the apparatus 1100 of FIG. 31.

Referring to the embodiment as depicted in FIG. 33, a first concrete-slab frame assembly 1110A receives and supports (is configured to receive and support), at least in part, a first formed concrete slab 1111A. The first concrete-slab frame assembly 1110A is slidably positionable on, and movable along, (the top section of) the first construction beam assembly 1106A. The first concrete-slab frame assembly 1110A has a first frame-abutment feature 1112A makes contact with (is configured to make contact with, abut, in an abutment relationship with), at least in part, the first beam-abutment feature 1108A (once the first concrete-slab frame assembly 1110A is moved along the first top beam portion 1114A).

Referring to the embodiment as depicted in FIG. 33, the first beam-abutment feature 1108A selectively and securely engages (is configured to selectively and securely engage, is engageable with) with a lower section of the first concrete-slab frame assembly 1110A. Preferably, the first concrete-slab frame assembly 1110A defines spaced-apart channels (slots, etc., which are known and not depicted) receives (configured to receive, at least in part, (the ribs of) the first beam-abutment feature 1108A (with reference to FIG. 34, this is done in such a way that the first concrete-slab frame assembly 1110A, in use, securely spans across and between, and selectively engages with, spaced apart instances of the first construction beam assembly 1106A and the second construction beam assembly 1106B (which are aligned parallel with each other); in this way, a horizontal floor section may be constructed or formed for a structure to be built, such as a building, a bridge, etc.). The structure is to be built, at least in part, with the components of the apparatus 1100.

Referring to the embodiment as depicted in FIG. 33, preferably, the first concrete-slab frame assembly 1110A defines panel slots 1113 (also called spaced-apart channels (which are also depicted as panel slots 1113 in FIG. 35, for instance). The panel slots 1113 receive (are configured to receive), at least in part, the first beam-abutment feature 1108A (with reference to FIG. 34); this is done in such a way that the first concrete-slab frame assembly 1110A, in use, securely spans across and between, and selectively engages with, spaced apart instances of the first construction beam assembly 1106A and the second construction beam assembly 1106B (which are aligned parallel with each other); in this way, a horizontal floor section may be constructed for a structure to be built with the components of the apparatus 1100. The panel slots 1113 may have a length that exceeds the lateral width of several instances of the first beam-abutment feature 1108A. For instance, The panel slots 1113 may have a length that exceeds the lateral width of a row of, for instance, any suitable quantity (such as, a quantity of four (4)) of the first beam-abutment feature 1108A positioned along a single file or single row once after the other, etc.

Referring to the embodiment as depicted in FIG. 33, the first frame-abutment feature 1112A is positioned (is positionable) along the lower section of the first concrete-slab frame assembly 1110A.

Referring to the embodiment as depicted in FIG. 33, the first concrete-slab frame assembly 1110A receives and supports (is configured to receive and support), at least in part, a first formed concrete slab 1111A. Preferably, a first formed concrete slab 1111A is formed (and securely positioned in) the first concrete-slab frame assembly 1110A; for instance, this is done by pouring cement into a frame assembly, and allowing the cement to harden within the frame assembly to thereby form the first concrete-slab frame assembly 1110A. A second concrete-slab frame assembly 1110B receives and supports (is configured to receive and support), at least in part, a second formed concrete slab 1111B. The second concrete-slab frame assembly 1110B is slidably positionable on, and movable along, (the top section of) the first construction beam assembly 1106A. The second concrete-slab frame assembly 1110B has a second frame-abutment feature 1112B makes contact (configured to make contact) with the first beam-abutment feature 1108A (once the second concrete-slab frame assembly 1110B is moved along the first top beam portion 1114A). The second frame-abutment feature 1112B is positioned along the lower section of the second concrete-slab frame assembly 1110B.

FIG. 34 and FIG. 35 depict embodiments of top views of the apparatus 1100 of FIG. 31, in which the apparatus 1100 includes a first construction beam assembly 1106A, a prop-head assembly 1104, and a first concrete-slab frame assembly 1110A.

Referring to the embodiment as depicted in FIG. 34, the first construction beam assembly 1106A is supported, at least in part, by the first prop-head assembly 1104A. The second construction beam assembly 1106B is supported, at least in part, (is supportable) by the second prop-head assembly 1104B. The first construction beam assembly 1106A and the second construction beam assembly 1106B are spaced apart from each other (once they are mounted to and supported by the first prop-head assembly 1104A and the second prop-head assembly 1104B, etc.). The first prop-head assembly 1104A and the second prop-head assembly 1104B are spaced apart from each other (once they are securely mounted to their respective instances of the vertically-extending construction column 1102). The first concrete-slab frame assembly 1110A is positioned across (and spans across) the first construction beam assembly 1106A and the second construction beam assembly 1106B. The opposite end edges of the first concrete-slab frame assembly 1110A are positioned (placed) on the middle sections (mid sections) of the first construction beam assembly 1106A and the second construction beam assembly 1106B. The second concrete-slab frame assembly 1110B (shown partially) is positioned to (in use) abut an end edge of the first concrete-slab frame assembly 1110A.

Referring to the embodiment as depicted in FIG. 35, the first concrete-slab frame assembly 1110A is positioned across (and spans across) the first construction beam assembly 1106A and the second construction beam assembly 1106B. The second concrete-slab frame assembly 1110B is positioned across (and spans across) the first construction beam assembly 1106A and the second construction beam assembly 1106B. A lateral edge of the second concrete-slab frame assembly 1110B abuts a lateral edge of the first concrete-slab frame assembly 1110A. The third concrete-slab assembly 1110C is positioned across (and spans across) the first construction beam assembly 1106A and the second construction beam assembly 1106B. A lateral edge of the third concrete-slab assembly 1110C abuts a lateral edge of the second concrete-slab frame assembly 1110B. The fourth concrete-slab assembly 1110D is positioned across (and spans across) the first construction beam assembly 1106A and the second construction beam assembly 1106B. A lateral edge of the fourth concrete-slab assembly 1110D abuts a lateral edge of the third concrete-slab assembly 1110C.

FIG. 36, FIG. 37, FIG. 38, FIG. 39, FIG. 40 and FIG. 41 depict embodiments of side views (FIG. 36, FIG. 37, FIG. 40 and FIG. 41), a top view (FIG. 38) and a cross-sectional view (FIG. 39) of the apparatus 1100 of FIG. 35, in which the first construction beam assembly 1106A is horizontally aligned while the first construction beam assembly 1106A is pivotally mounted to the prop-head assembly 1104.

Referring to the embodiments as depicted in FIG. 35, FIG. 37, FIG. 38, FIG. 39, FIG. 40 and FIG. 41, the first construction beam assembly 1106A and the first concrete-slab frame assembly 1110A are horizontally aligned, and the first concrete-slab frame assembly 1110A is placed on (the top surface of) the first construction beam assembly 1106A.

Figure 36:
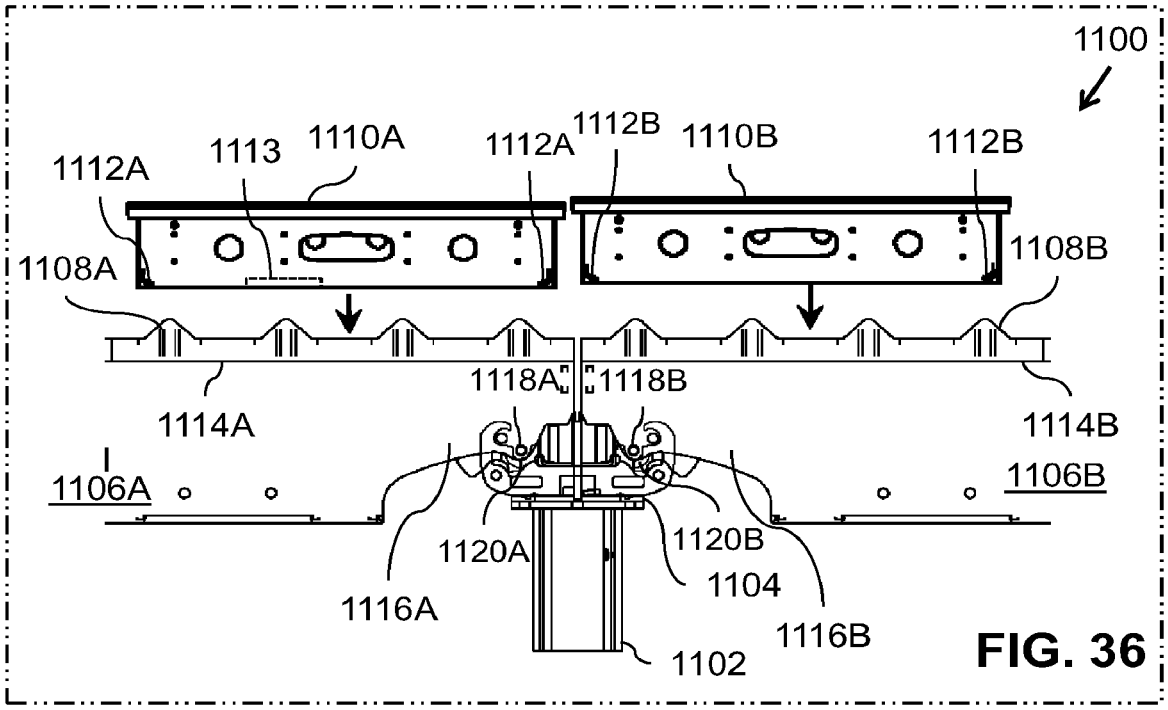

Referring to the embodiment as depicted in FIG. 36, in general terms, the first construction beam assembly 1106A is pivotally mountable (pivotally mounted or is configured to be pivotally mounted) to the prop-head assembly 1104. Preferably, an end section (an end portion) of the first construction beam assembly 1106A is pivotally mountable to the prop-head assembly 1104. The prop-head assembly 1104 includes a first beam-locating feature 1120A. The first construction beam assembly 1106A includes a first end section 1116A having (including) a first beam-reference portion 1118A. The first beam-reference portion 1118A is pivotally mountable to (and supportable by) the first beam-locating feature 1120A of the prop-head assembly 1104. The first beam-reference portion 1118A is pivotally mountable (pivotally mounted, is configured to be pivotally mountable) to (and is supportable by or configured to be supported by) the first beam-locating feature 1120A of the prop-head assembly 1104.

Figure 37:
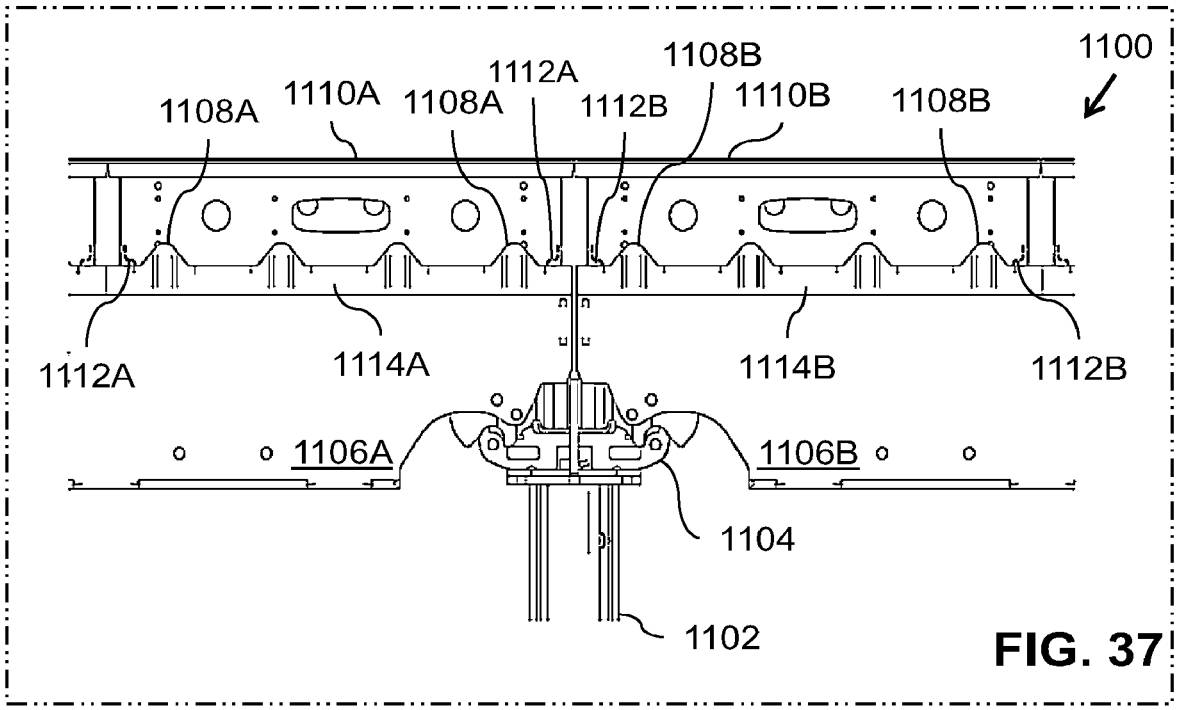

Referring to the embodiment as depicted in FIG. 37, in general terms, the second construction beam assembly 1106B is pivotally mountable (is configured to be pivotally mounted) to the prop-head assembly 1104. Preferably, an end section (an end portion) of the second construction beam assembly 1106B is pivotally mountable to the prop-head assembly 1104. The prop-head assembly 1104 includes a second beam-locating feature 1120B. The second construction beam assembly 1106B includes (has) a second end section 1116B having (including) a second beam-reference portion 1118B. The second beam-reference portion 1118B is pivotally mountable to (and supportable by) the second beam-locating feature 1120B of the prop-head assembly 1104. The second beam-reference portion 1118B is pivotally mountable (pivotally mounted, is configured to be pivotally mountable) to (and supportable by or configured to be supported by) the second beam-locating feature 1120B of the prop-head assembly 1104.

Referring to the embodiment as depicted in FIG. 36, the first beam-abutment feature 1108A (of the first top beam portion 1114A of the first construction beam assembly 1106A) is movable (rotatable or configured to be rotated) in response to the pivotal movement of the first construction beam assembly 1106A relative to the prop-head assembly 1104 (also depicted in the embodiment of FIG. 32); this is done once (A) the first top beam portion 1114A is positioned on, and is supported by, the first construction beam assembly 1106A, and (B) the first construction beam assembly 1106A is pivotally mountable to the prop-head assembly 1104, and (C) the first construction beam assembly 1106A is pivoted relative to the prop-head assembly 1104.

Referring to the embodiment as depicted in FIG. 36, the first frame-abutment feature 1112A (of the first concrete-slab frame assembly 1110A) is movable (is configured to be moved or rotated) in response to the pivotal movement of the first construction beam assembly 1106A relative to the prop-head assembly 1104 (also depicted in the embodiment of FIG. 32); this is done once (A) the first construction beam assembly 1106A is pivotally mountable to the prop-head assembly 1104, and (B) the first concrete-slab frame assembly 1110A is positioned on, and is supported by, the first construction beam assembly 1106A, and (C) the first construction beam assembly 1106A is pivoted relative to the prop-head assembly 1104.

Referring to the embodiment as depicted in FIG. 36, the panels (such as, the first concrete-slab frame assembly 1110A, etc.) have end sections that, preferably, maintain contact (that is, preferably with no gaps if possible) between the end sections of the panels positioned adjacent to the panel (adjacently positioned panels have end sections that (in use) contact each other at least in part). It will be appreciated that there is an allowance for slide movement of the panels (the panels may slide move along a length of the beams) while the panel slots 1113 (of the panels) engage with corresponding tabs (such as, the first beam-abutment feature 1108A, etc.) that extend upwardly (that is, upwardly from the first top beam portion 1114A or the second top beam portion 1114B that are positioned on the beams, such as the first construction beam assembly 1106A). It will be appreciated that a single instance of the panel slot 1113 is depicted (for ease of depiction). It will be appreciated that the panel slots 1113 (are defined or positioned along a bottom section of the panels) are aligned along a common alignment axis in such a way that the panel slots 1113 may be aligned with the corresponding tabs (such as, the first beam-abutment feature 1108A, etc.). The bottom section of the panels define the panel slots 1113 (also called corresponding elongated slots) that receive the tabs (such as, the first beam-abutment feature 1108A, also called the ears of the first top beam portion 1114A). The tabs extend upwardly from the top section of the beams. The elongated slots (such as, the panel slot 1113) of the panels are relatively longer than the width of the tabs (such as, the first beam-abutment feature 1108A, etc.), as depicted in the embodiment of FIG. 36. It will be appreciated that this arrangement is applicable to the embodiments of FIG. 43 and FIG. 49 (and as well as to the other FIGS.).

Referring to the embodiment as depicted in FIG. 37, the first concrete-slab frame assembly 1110A is supported, at least in part, (is configured to be supported) by the first construction beam assembly 1106A. The first construction beam assembly 1106A is horizontally aligned (for this embodiment). The first construction beam assembly 1106A is not pivoted to move away from horizontal alignment while the first concrete-slab frame assembly 1110A is supported, at least in part, by the first construction beam assembly 1106A (for this embodiment). The first construction beam assembly 1106A is locked out (is configured to be locked out) and is not permitted to be (is prevented from being) pivoted away from horizontal alignment (for this embodiment). The first frame-abutment feature 1112A (of the first concrete-slab frame assembly 1110A) and the first beam-abutment feature 1108A of the first construction beam assembly 1106A are spaced apart from each other, for the case where the first construction beam assembly 1106A is horizontally aligned (once the first construction beam assembly 1106A, in use, is locked out and is prevented from being pivoted away from horizontal alignment).

Referring to the embodiment as depicted in FIG. 37, the second concrete-slab frame assembly 1110B is supported, at least in part, (is configured to be supported) by the second construction beam assembly 1106B. Once the second construction beam assembly 1106B is horizontally aligned, the second construction beam assembly 1106B is not pivoted to move away (that is, is locked out or is configured to be locked out) from horizontal alignment while the second concrete-slab frame assembly 1110B is supported, at least in part, by the second construction beam assembly 1106B. The second construction beam assembly 1106B is locked out (is configured to be locked out) and is not permitted to be (is prevented from being) pivoted away from horizontal alignment (for this embodiment). The second frame-abutment feature 1112B (of the second concrete-slab frame assembly 1110B) and the second beam-abutment feature 1108B of the second construction beam assembly 1106B) are spaced apart from each other (once the second construction beam assembly 1106B, in use, is locked out and is prevented from being pivoted away from horizontal alignment).

Figure 38:
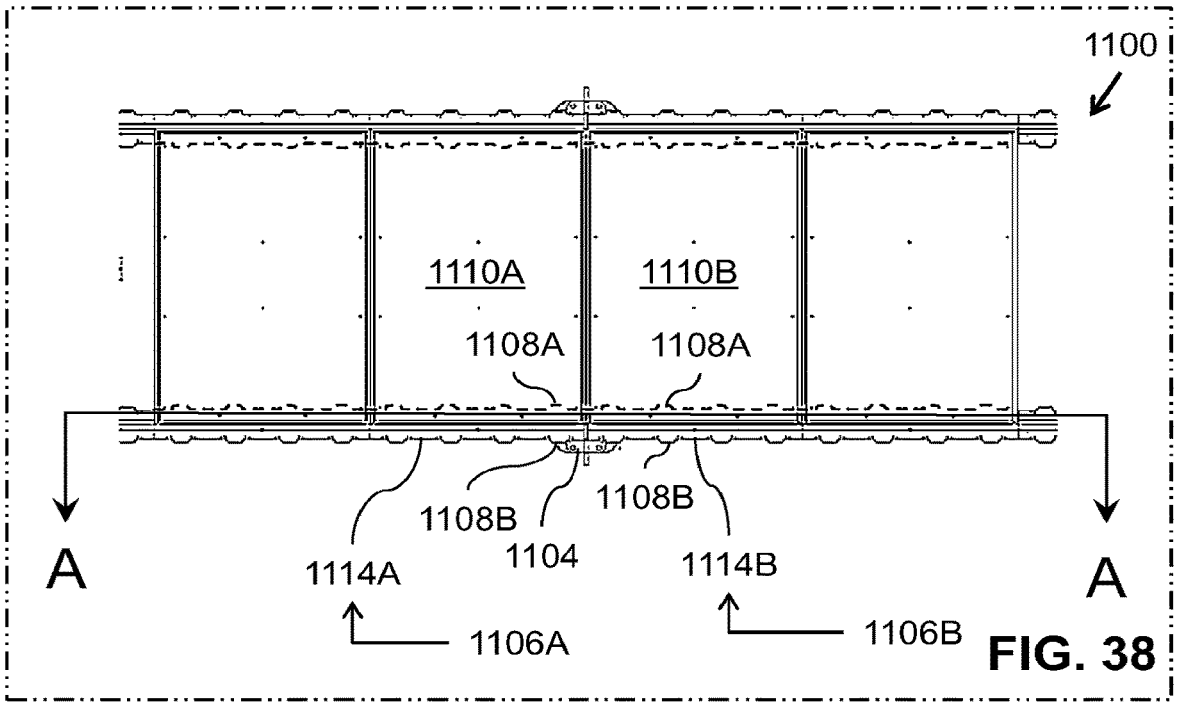

Referring to the embodiment as depicted in FIG. 38, the first beam-abutment feature 1108A and the second beam-abutment feature 1108B are positioned on opposite edges of the first top beam portion 1114A. The first beam-abutment feature 1108A and the second beam-abutment feature 1108B are positioned on opposite edges of the second top beam portion 1114B. The cross-sectional line A-A extends along an end length of the first top beam portion 1114A and the second top beam portion 1114B (between the first beam-abutment feature 1108A and the second beam-abutment feature 1108B).

Figure 39:
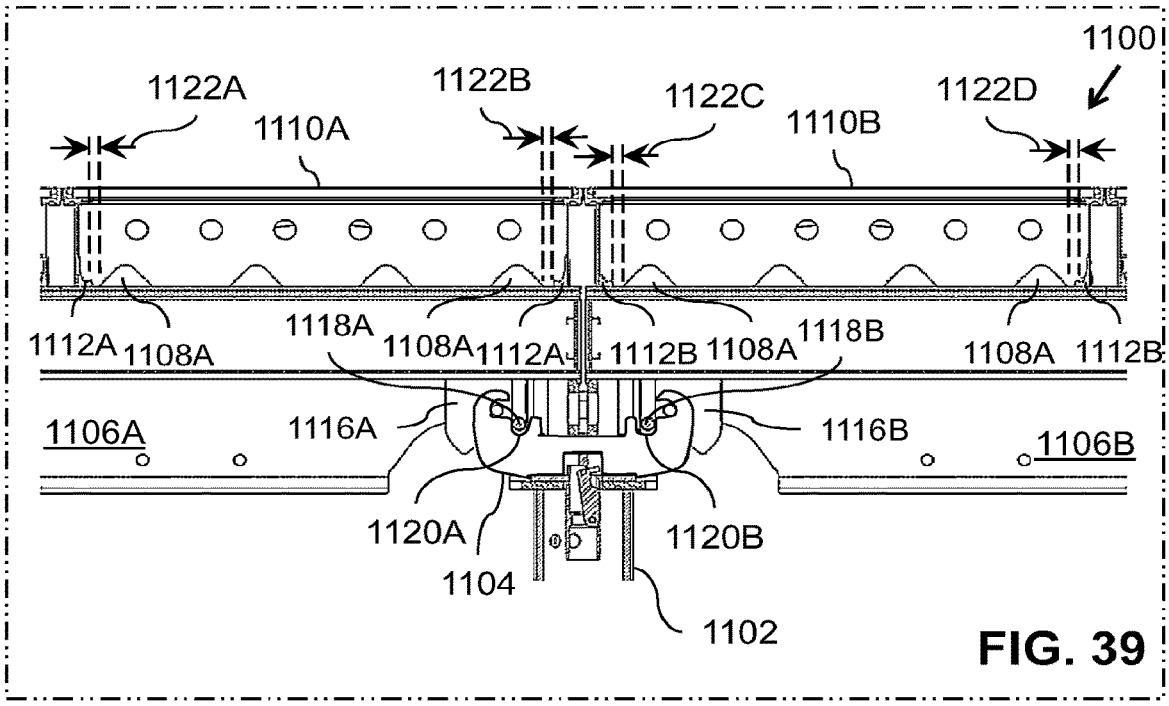

Referring to the embodiment as depicted in FIG. 39, there is depicted a cross-sectional view taken along the cross-sectional line A-A of FIG. 38.

Referring to the embodiment as depicted in FIG. 39, there is depicted, in accordance with a first major aspect (major embodiment), an apparatus 1100, which includes and is not limited to (comprises) a vertically-extending construction column 1102 fixedly positioned (configured to be fixedly positioned, either directly or indirectly) to the working surface 1900. A prop-head assembly 1104 is affixed (is configured to be affixed, either directly or indirectly) to the vertically-extending construction column 1102. A first construction beam assembly 1106A is pivotally mountable to the prop-head assembly 1104. The first construction beam assembly 1106A has a first beam-abutment feature 1108A. The apparatus 1100 further includes a first concrete-slab frame assembly 1110A receiving and supporting (configured to receive and support), at least in part, a first formed concrete slab 1111A; for instance, this is done by pouring cement into the first concrete-slab frame assembly 1110A, and allowing the cement to harden to form the first formed concrete slab 1111A. The first concrete-slab frame assembly 1110A is slidably positionable on, and movable along, the first construction beam assembly 1106A. The first concrete-slab frame assembly 1110A has a first frame-abutment feature 1112A. The first frame-abutment feature 1112A of the first concrete-slab frame assembly 1110A is slide movable relative to the first beam-abutment feature 1108A of the first construction beam assembly 1106A in response to the pivotal movement of the first construction beam assembly 1106A relative to the prop-head assembly 1104. This is done once: (A) the vertically-extending construction column 1102, in use, is fixedly positioned to the working surface 1900, (B) the prop-head assembly 1104, in use, is affixed to the vertically-extending construction column 1102, (C) the first construction beam assembly 1106A, in use, is pivotally mounted to the prop-head assembly 1104, (D) the first concrete-slab frame assembly 1110A, in use, is positioned on the first construction beam assembly 1106A, and (E) the first construction beam assembly 1106A, in use, is pivotally moved while being pivotally mounted to the prop-head assembly 1104.

Referring to the embodiment as depicted in FIG. 39, there is depicted, in accordance with a second major aspect (major embodiment), an apparatus 1100. The apparatus 1100 is for utilization with a first construction beam assembly 1106A, a prop-head assembly 1104, and a vertically-extending construction column 1102. The apparatus 1100 includes and is not limited to (comprises) a first concrete-slab frame assembly 1110A receiving and supporting (configured to receive and support), at least in part, a first formed concrete slab 1111A; for instance, this is done by pouring cement into the first concrete-slab frame assembly 1110A, and allowing the cement to harden to form the first formed concrete slab 1111A. The first concrete-slab frame assembly 1110A is slidably positionable on, and movable along, a first construction beam assembly 1106A. The first concrete-slab frame assembly 1110A has a first frame-abutment feature 1112A. The first construction beam assembly 1106A is pivotally mountable to a prop-head assembly 1104. The first construction beam assembly 1106A has a first beam-abutment feature 1108A. The prop-head assembly 1104 is affixed (is configured to be affixed, either directly or indirectly) to a vertically-extending construction column 1102. The vertically-extending construction column 1102 is fixedly positioned (configured to be fixedly positioned, either directly or indirectly) to the working surface 1900. The first frame-abutment feature 1112A of the first concrete-slab frame assembly 1110A is slide movable relative to the first beam-abutment feature 1108A of the first construction beam assembly 1106A in response to the pivotal movement of the first construction beam assembly 1106A relative to the prop-head assembly 1104. This is done once: (A) the vertically-extending construction column 1102, in use, is fixedly positioned to the working surface 1900, (B) the prop-head assembly 1104, in use, is affixed to the vertically-extending construction column 1102, (C) the first construction beam assembly 1106A, in use, is pivotally mounted to the prop-head assembly 1104, (D) the first concrete-slab frame assembly 1110A, in use, is positioned on the first construction beam assembly 1106A, and (E) the first construction beam assembly 1106A, in use, is pivotally moved while being pivotally mounted to the prop-head assembly 1104.

Referring to the embodiment as depicted in FIG. 39, the first concrete-slab frame assembly 1110A and the second concrete-slab frame assembly 1110B are horizontally aligned; this is done once the first concrete-slab frame assembly 1110A and the second concrete-slab frame assembly 1110B are positioned on top of the first top beam portion 1114A and the second top beam portion 1114B (respectively), or on top of the first construction beam assembly 1106A and the second construction beam assembly 1106B (respectively).

Referring to the embodiment as depicted in FIG. 39, the end sections (respective lateral side sections, such as a first lateral side section, and a second lateral side section) of the first concrete-slab frame assembly 1110A and the second concrete-slab frame assembly 1110B (in use) abut (contact), at least in part, each other, once the first concrete-slab frame assembly 1110A and the second concrete-slab frame assembly 1110B are positioned on the first construction beam assembly 1106A and the second construction beam assembly 1106B (respectively).

Referring to the embodiment as depicted in FIG. 39, a first gap 1122A is formed (set-up) between the first frame-abutment feature 1112A and the first beam-abutment feature 1108A (located at one end section of the first concrete-slab frame assembly 1110A), once the first construction beam assembly 1106A is horizontally aligned (positioned horizontally).

Referring to the embodiment as depicted in FIG. 39, a second gap 1122B is formed (set-up) between the first frame-abutment feature 1112A and the first beam-abutment feature 1108A (located at the opposite end section of the first concrete-slab frame assembly 1110A), once the first construction beam assembly 1106A is horizontally aligned (positioned horizontally).

Referring to the embodiment as depicted in FIG. 39, a third gap 1122C is formed (set-up) between the second frame-abutment feature 1112B and the second beam-abutment feature 1108B (located at one end section of the second concrete-slab frame assembly 1110B), once the second construction beam assembly 1106B is horizontally aligned (positioned horizontally).

Referring to the embodiment as depicted in FIG. 39, a fourth gap 1122D is formed (set-up) between the second frame-abutment feature 1112B and the second beam-abutment feature 1108B (located at the opposite end section of the second concrete-slab frame assembly 1110B), once the second construction beam assembly 1106B is horizontally aligned (positioned horizontally).

Referring to the embodiment as depicted in FIG. 39, the vertically-extending construction column 1102 is fixedly positioned (is configured to be fixedly positioned, either directly or indirectly) to the working surface 1900. The vertically-extending construction column 1102 extends upwardly (is also configured to extend upwardly vertically, is vertically extendable) from the working surface 1900; this is done once the vertically-extending construction column 1102, in use, is fixedly positioned (either directly or indirectly) to the working surface 1900. The vertically-extending construction column 1102 has (includes) an end section that is spaced apart from the working surface 1900; this is done once the vertically-extending construction column 1102, in use, is fixedly positioned (either directly or indirectly) to the working surface 1900. The prop-head assembly 1104 is affixed (is configured to be affixed, either directly or indirectly) to the end section of the vertically-extending construction column 1102. The prop-head assembly 1104 has a first beam-locating feature 1120A. A first construction beam assembly 1106A includes a first end section that has a first beam-reference portion 1118A that is pivotally mountable to the first beam-locating feature 1120A of the prop-head assembly 1104. The first construction beam assembly 1106A has a first top beam portion. The top beam portion of the first construction beam assembly 1106A has a first beam-abutment feature 1108A. A first concrete-slab frame assembly 1110A has a first bottom frame portion positioned (configured to be positioned on, placed on) the top beam portion of the first concrete-slab frame assembly 1110A. The bottom frame portion of the first concrete-slab frame assembly 1110A has a first frame-abutment feature 1112A. The first beam-abutment feature 1108A and the first frame-abutment feature 1112A are movable in response to the pivotal movement of the first construction beam assembly 1106A relative to the prop-head assembly 1104.

Figure 40:
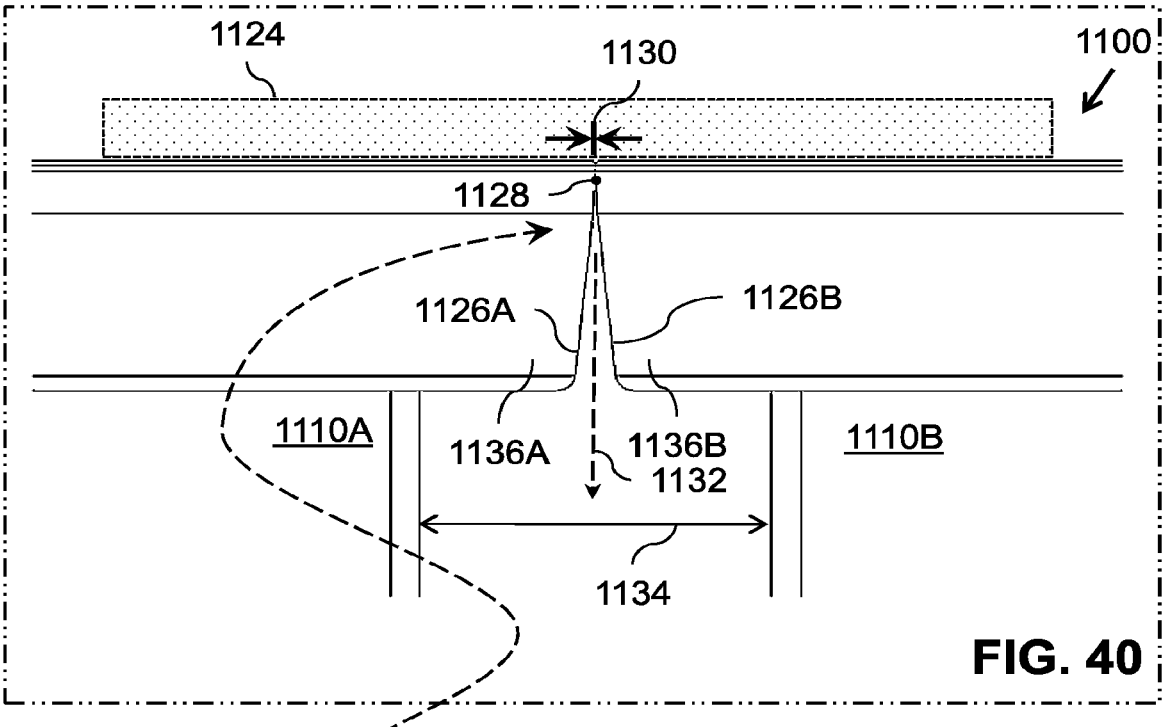
Figure 41:
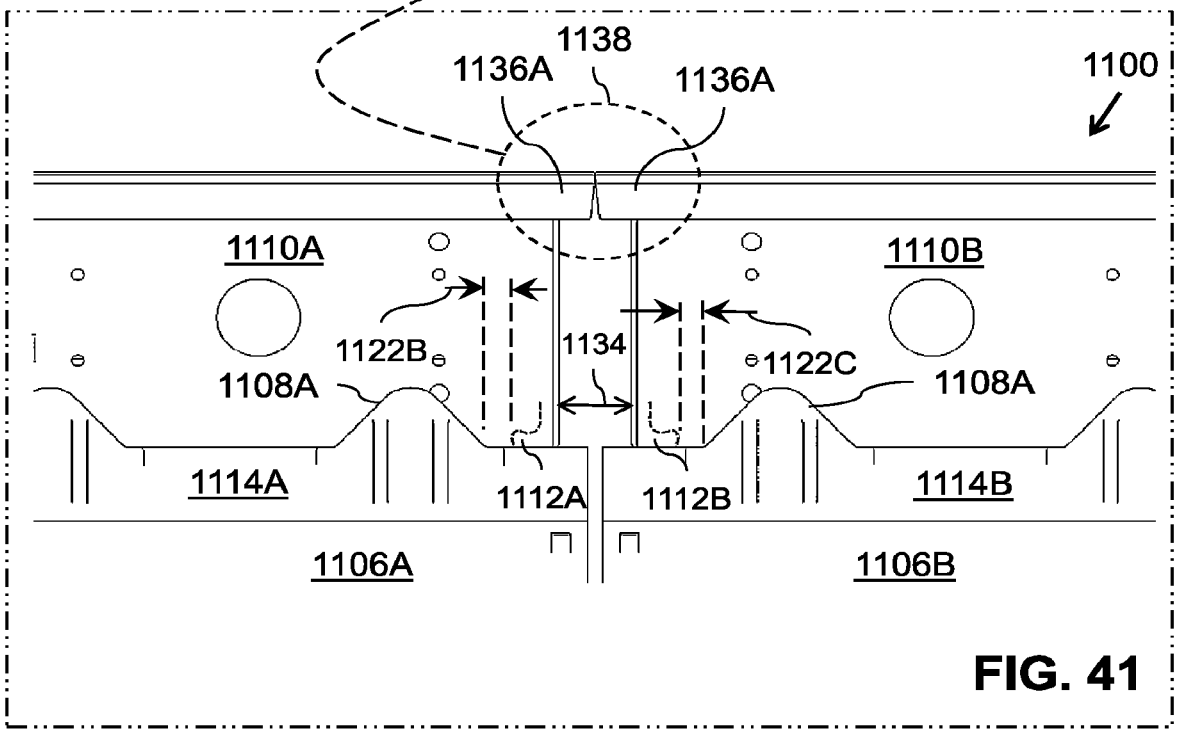

Referring to the embodiments as depicted in FIG. 40 and FIG. 41, in which FIG. 40 depicts a close-up side view of the features depicted in FIG. 41, the first construction beam assembly 1106A and the second construction beam assembly 1106B are mounted (pivotally mounted) to the prop-head assembly 1104. The first construction beam assembly 1106A and the second construction beam assembly 1106B are horizontally aligned (once the first construction beam assembly 1106A and the second construction beam assembly 1106B are mounted to the prop-head assembly 1104, in a coplanar relationship). It will be appreciated that once horizontally aligned, the first construction beam assembly 1106A and the second construction beam assembly 1106B may be locked out (affixed in a horizontal alignment) by utilization of lock-out devices, which are known and not depicted. The first concrete-slab frame assembly 1110A and the second concrete-slab frame assembly 1110B are positioned on a top surface (top section) of the first top beam portion 1114A and the second top beam portion 1114B (respectively), or on top of the first construction beam assembly 1106A and the second construction beam assembly 1106B (respectively). The first concrete-slab frame assembly 1110A and the second concrete-slab frame assembly 1110B are horizontally aligned, once the first concrete-slab frame assembly 1110A and the second concrete-slab frame assembly 1110B are positioned on top of the first top beam portion 1114A and the second top beam portion 1114B (respectively), or on top of the first construction beam assembly 1106A and the second construction beam assembly 1106B (respectively).

Referring to the embodiment as depicted in FIG. 40, lateral side sections of the first concrete-slab frame assembly 1110A and a second concrete-slab frame assembly 1110B abut, at least in part, each other, once the first concrete-slab frame assembly 1110A and the second concrete-slab frame assembly 1110B are positioned on the first construction beam assembly 1106A and a second construction beam assembly 1106B, respectively. A skim coat 1124 of poured concrete (also called, a layer of poured concrete, a skim coat of poured concrete) is applied to the respective top surfaces (such as a first top surface and a second top surface) of the first concrete-slab frame assembly 1110A and a second concrete-slab frame assembly 1110B; this is done once the first concrete-slab frame assembly 1110A and the second concrete-slab frame assembly 1110B are positioned on top of the first top beam portion 1114A and the second top beam portion 1114B (respectively), or on top of the first construction beam assembly 1106A and the second construction beam assembly 1106B (respectively).

Referring to the embodiment as depicted in FIG. 40, lateral side sections of the first concrete-slab frame assembly 1110A and a second concrete-slab frame assembly 1110B abut, at least in part, each other, once the first concrete-slab frame assembly 1110A and the second concrete-slab frame assembly 1110B are positioned on the first construction beam assembly 1106A and a second construction beam assembly 1106B, respectively. The first concrete-slab frame assembly 1110A provides a first camming surface 1126A (a smooth, curved camming surface) positioned along a lateral side section of the first concrete-slab frame assembly 1110A. The second concrete-slab frame assembly 1110B provides a second camming surface 1126B (a smooth, curved camming surface) positioned along a lateral side section of the second concrete-slab frame assembly 1110B. In accordance with an option, the first camming surface 1126A and the second camming surface 1126B contact each other at a contact point 1128 (also called a pivot point). In accordance with another option, a frame edge gap 1130 is formed between the first camming surface 1126A and the second camming surface 1126B. Preferably, the size of the frame edge gap 1130 is zero or may have an acceptable size range (such as, from about 0.0 millimeters to about 0.2 millimeters, etc.). The frame edge gap 1130 is sized (configured) to prevent (substantially prevent) leakage of freshly poured concrete between the first concrete-slab frame assembly 1110A and second concrete-slab frame assembly 1110B, which are adjacently positioned against each other in a contact relationship. In the event of leakage of fresh concrete from the skim coat 1124, the leakage travels along a leakage drop direction 1132 (between the frame edge gap 1130 formed between the lateral side edges of the first concrete-slab frame assembly 1110A and the second concrete-slab frame assembly 1110B).

Figure 46:
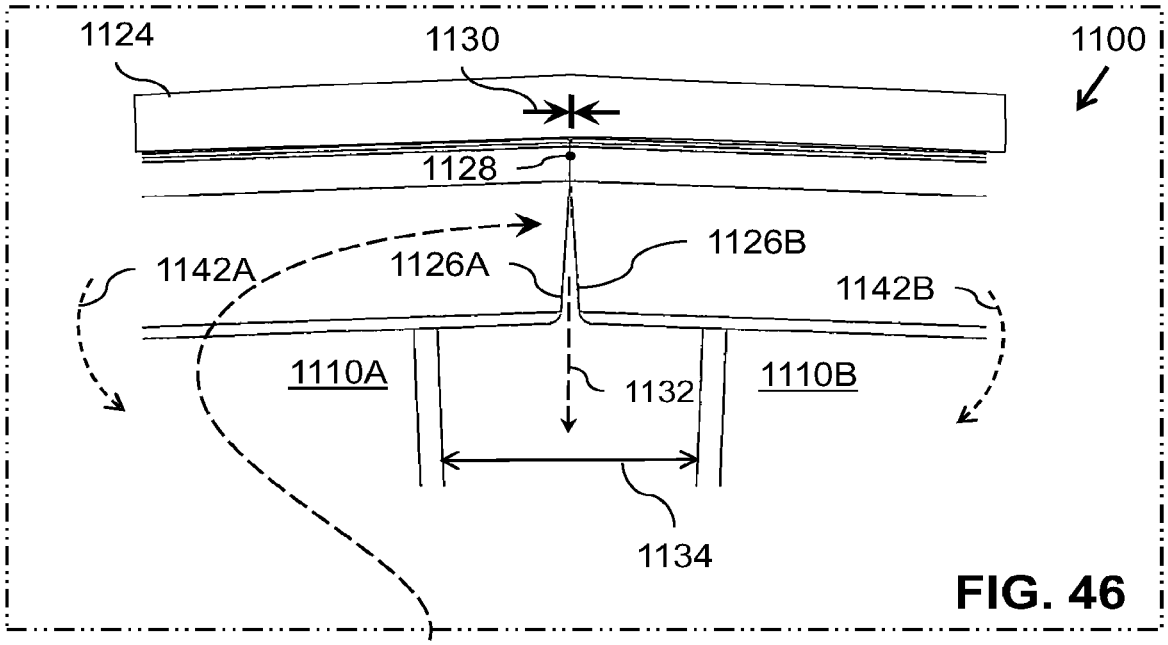
Figure 52:
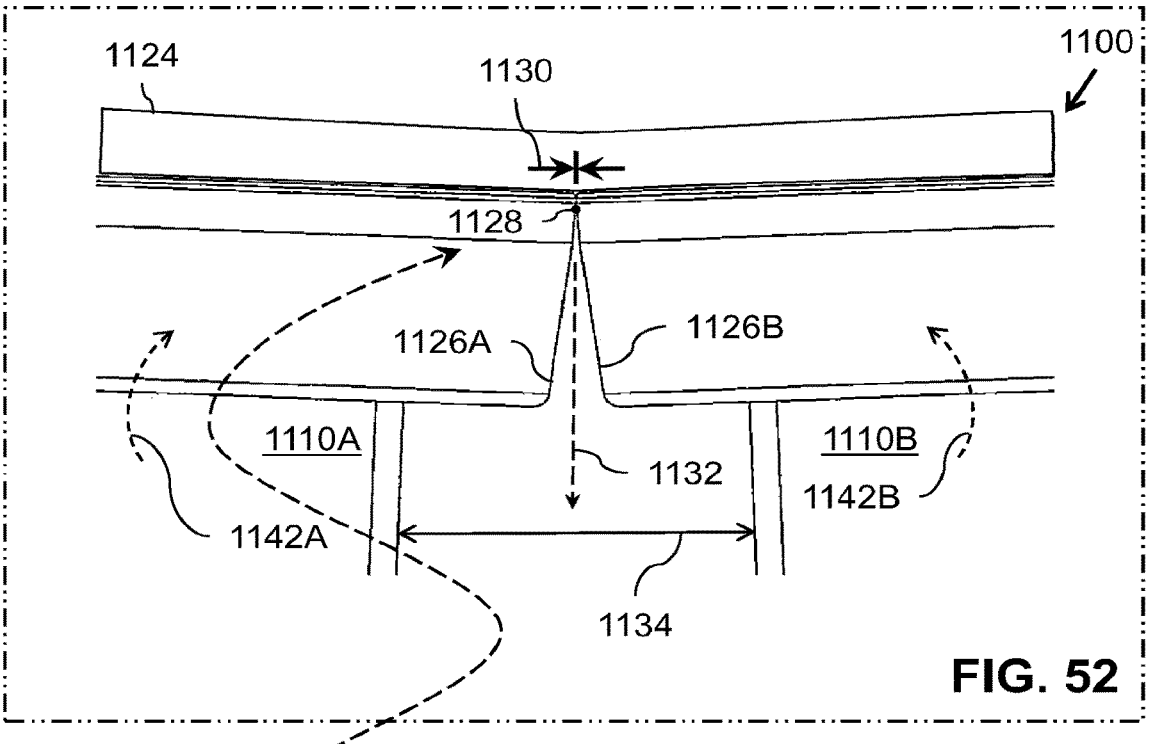

Referring to the embodiment as depicted in FIG. 40, once the first construction beam assembly 1106A and the second construction beam assembly 1106B are pivoted (as depicted in the embodiment of FIG. 46 and FIG. 52), the first camming surface 1126A and the second camming surface 1126B interact (configured to interact) with each other (cam against each other).

Referring to the embodiment as depicted in FIG. 40, a frame gap 1134 is formed between the mid-sections of the first concrete-slab frame assembly 1110A and the second concrete-slab frame assembly 1110B. The first concrete-slab frame assembly 1110A provides a first top end portion 1136A. The second concrete-slab frame assembly 1110B provides a second top end portion 1136B. The first top end portion 1136A and the second concrete-slab frame assembly 1110B contact each other at a contact zone 1138.

FIG. 42, FIG. 43, FIG. 44, FIG. 45, FIG. 46 and FIG. 47 depict embodiments of side views (FIG. 42, FIG. 43, FIG. 46 and FIG. 47), a top view (FIG. 44) and a cross-sectional view (FIG. 45) of the apparatus 1100 of FIG. 35, in which the first construction beam assembly 1106A is pivoted downwardly relative to the prop-head assembly 1104, and the first construction beam assembly 1106A has a non-horizontal alignment while the first construction beam assembly 1106A is pivotally mounted to the prop-head assembly 1104.

Referring to the embodiments as depicted in FIG. 42, FIG. 43, FIG. 44, FIG. 45, FIG. 46 and FIG. 47, the first construction beam assembly 1106A is pivoted downwardly from the horizontal (the horizon). The first construction beam assembly 1106A and the first concrete-slab frame assembly 1110A are non-horizontally aligned. The first concrete-slab frame assembly 1110A is placed on (the top surface of) the first construction beam assembly 1106A.

Figure 42:
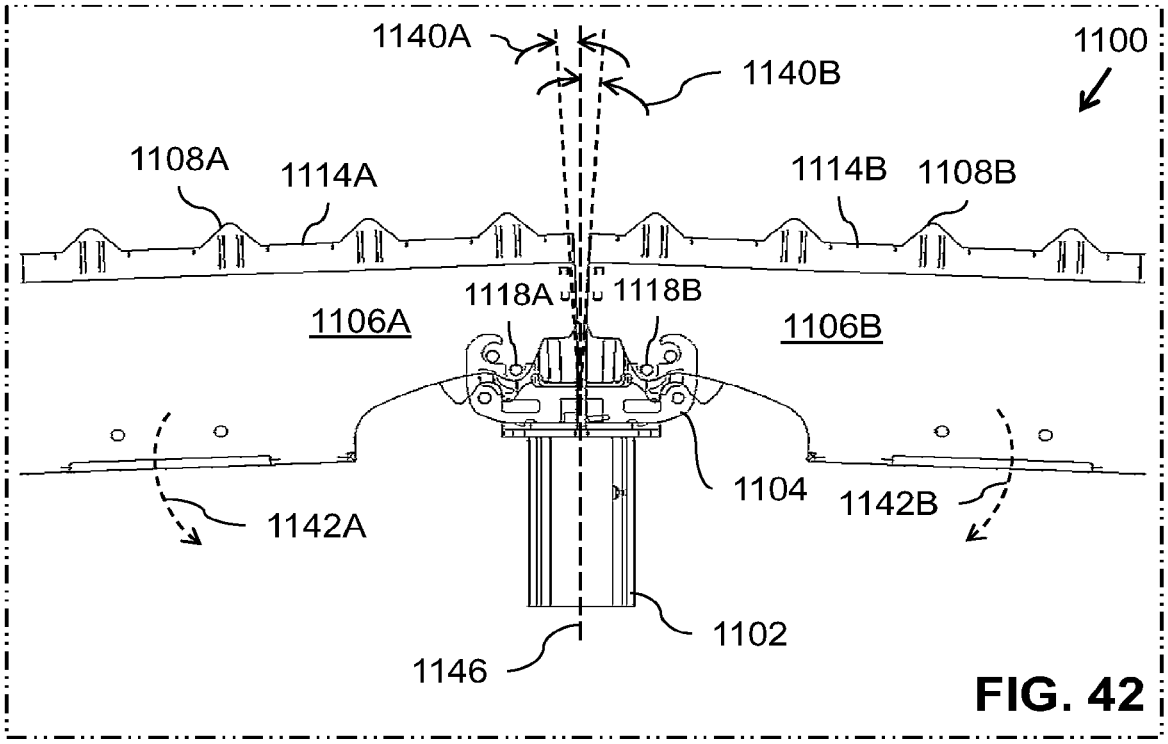

Referring to the embodiment as depicted in FIG. 42, the first construction beam assembly 1106A and the second construction beam assembly 1106B are non-horizontally aligned.

Referring to the embodiment as depicted in FIG. 42, the first construction beam assembly 1106A is pivotally moved (relative to the prop-head assembly 1104) along a first pivot direction 1142A. The first construction beam assembly 1106A is pivotally rotated away from the horizontal (the horizon). Once the first construction beam assembly 1106A is pivotally rotated away from the horizontal (the horizon), the first construction beam assembly 1106A may be locked into a stationary condition (non-pivotal condition) by utilization of locking devices, etc., which are known and not described.

Referring to the embodiment as depicted in FIG. 42, the second construction beam assembly 1106B is pivotally moved (relative to the prop-head assembly 1104) along a second pivot direction 1142B. The second construction beam assembly 1106B is pivotally rotated away from the horizontal (the horizon). Once the second construction beam assembly 1106B is pivotally rotated away from the horizontal (the horizon), the second construction beam assembly 1106B may be locked into a stationary condition (non-pivotal condition) by utilization of locking devices, etc., which are known and not described.

Referring to the embodiment as depicted in FIG. 42, a first face end of the first construction beam assembly 1106A forms a first angle 1140A relative to the vertical line 1146 (once the first construction beam assembly 1106A is pivotally moved or rotated). A second face end of the second construction beam assembly 1106B forms a second angle 1140B relative to the vertical line 1146 (once the first construction beam assembly 1106A is pivotally moved or rotated).

Figure 43:
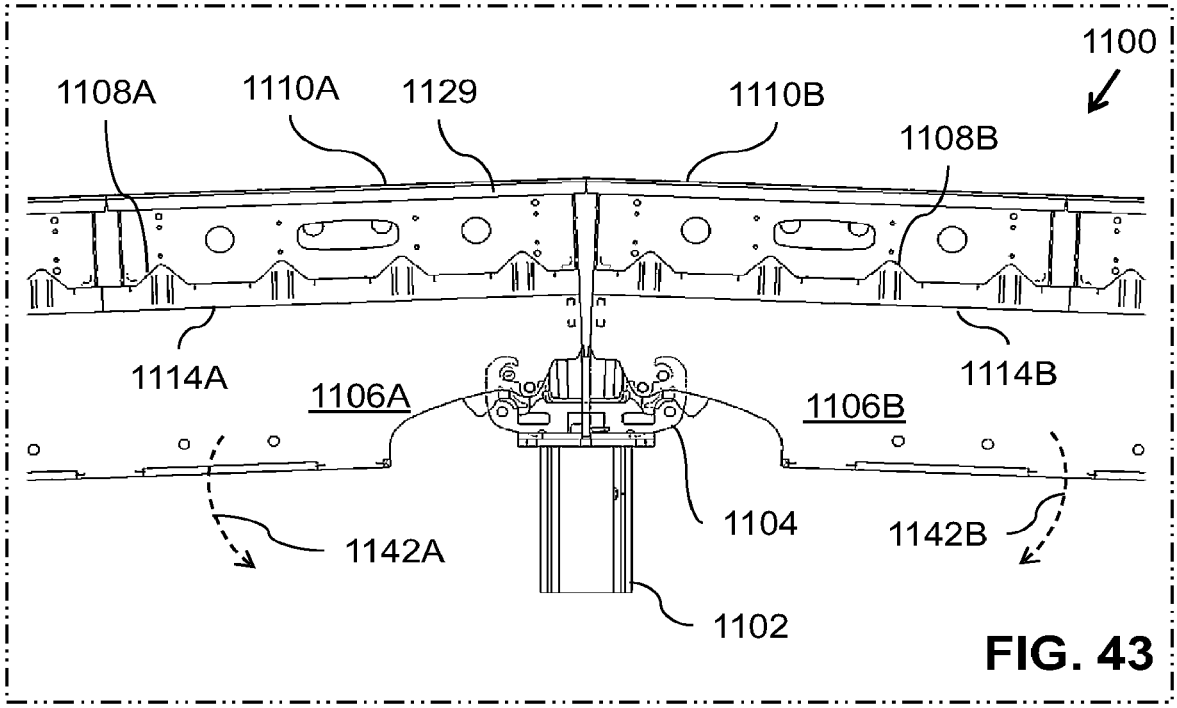
Figure 49:
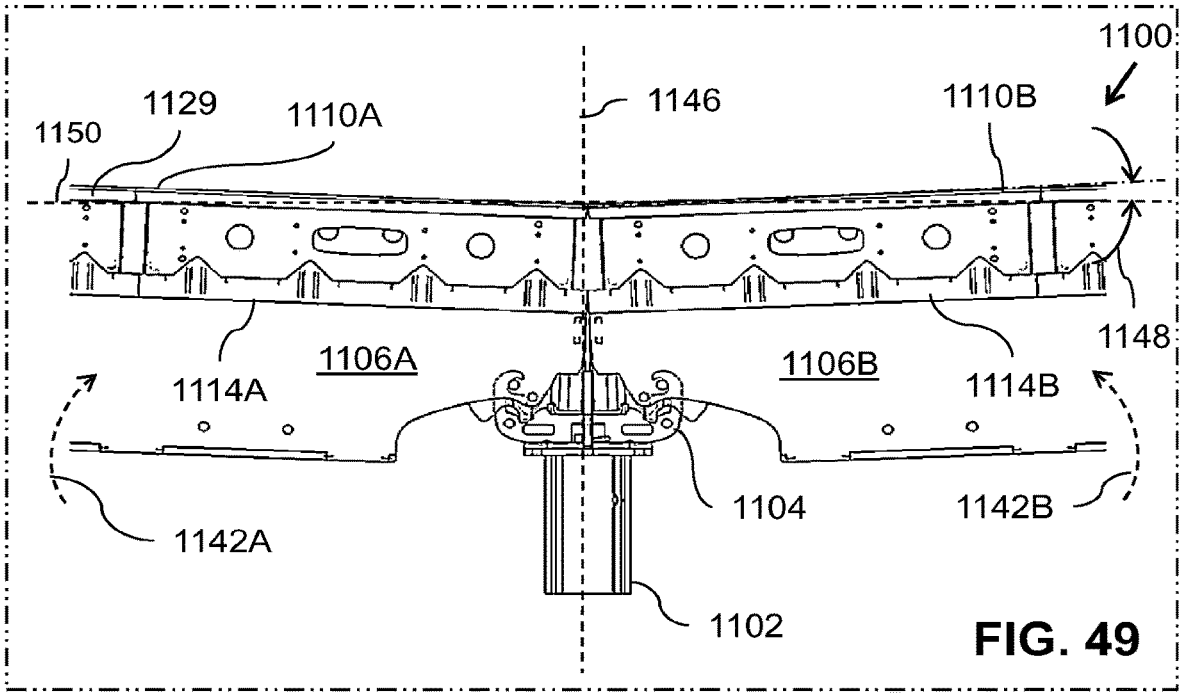

Referring to the embodiments as depicted in FIG. 43 and FIG. 49, the first concrete-slab frame assembly 1110A has a top frame portion 1129. The first concrete-slab frame assembly 1110A is pivotally movable between: (A) a first position in which the top frame portion is aligned along a first angle above the horizontal (the horizon) once the first construction beam assembly 1106A is pivotally moved upwardly; and (B) a second position in which the top frame portion is aligned along a second angle below the horizontal (the horizon) once the first construction beam assembly 1106A is pivotally moved downwardly.

Referring to the embodiment as depicted in FIG. 43, the first concrete-slab frame assembly 1110A is placed on top of the first top beam portion 1114A (or the first construction beam assembly 1106A). The second concrete-slab frame assembly 1110B is placed on top of the second top beam portion 1114B (or the second construction beam assembly 1106B). The first construction beam assembly 1106A is pivotally moved downwardly (relative to the prop-head assembly 1104) along a first pivot direction 1142A. The second construction beam assembly 1106B is pivotally moved downwardly (relative to the prop-head assembly 1104) along a second pivot direction 1142B.

Figure 44:
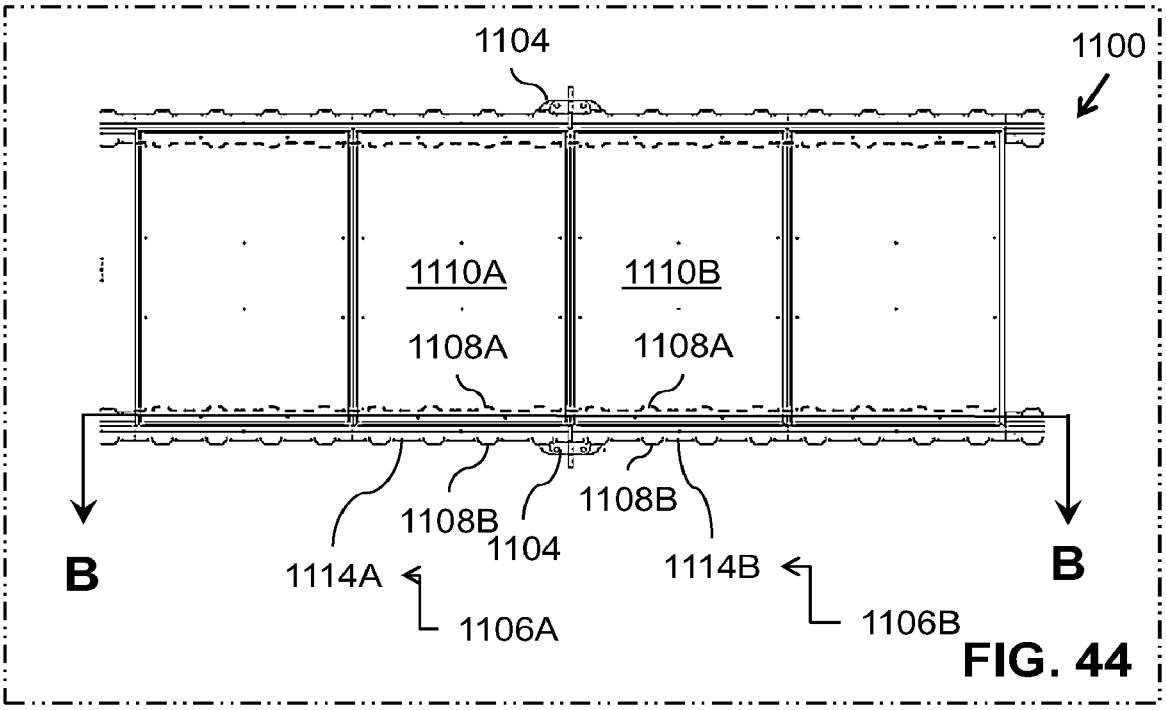

Referring to the embodiment as depicted in FIG. 44 (which depicts a top view), the first beam-abutment feature 1108A and the second beam-abutment feature 1108B are positioned on opposite edges of the first top beam portion 1114A. The first beam-abutment feature 1108A and the second beam-abutment feature 1108B are positioned on opposite edges of the second top beam portion 1114B. The cross-sectional line B-B extends along an end length of the first top beam portion 1114A and the second top beam portion 1114B (between the first beam-abutment feature 1108A and the second beam-abutment feature 1108B).

Figure 45:
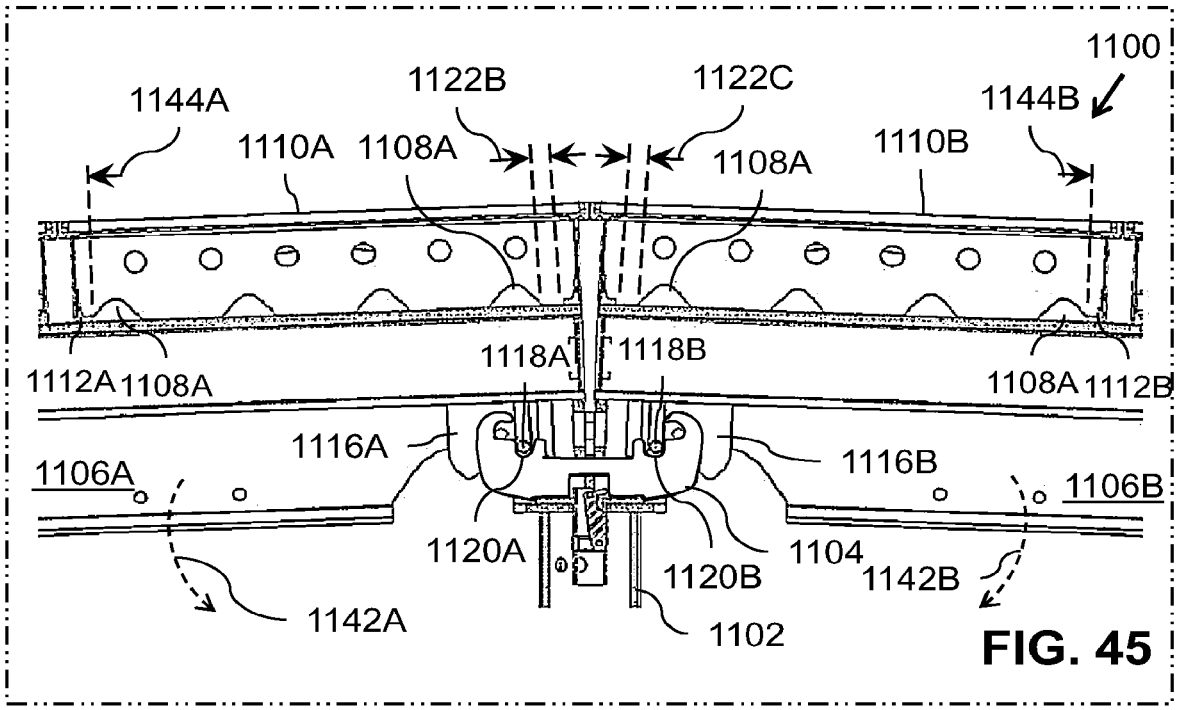

Referring to the embodiment as depicted in FIG. 45 (which depicts a cross-sectional view taken along the cross-sectional line B-B of FIG. 44), the first concrete-slab frame assembly 1110A and the second concrete-slab frame assembly 1110B are placed in an abutment relationship with each other along respective lateral side edges of the first concrete-slab frame assembly 1110A and the second concrete-slab frame assembly 1110B. Each of the first concrete-slab frame assembly 1110A and the second concrete-slab frame assembly 1110B, in use, contacts the first top beam portion 1114A and the second top beam portion 1114B (respectively). It will be appreciated, in general terms, the first beam-abutment feature 1108A makes contact with the first frame-abutment feature 1112A of the first concrete-slab frame assembly 1110A (that is, at an abutment or abutting contact) once the first construction beam assembly 1106A is pivotally rotated to a predetermined angle.

Referring to the embodiment as depicted in FIG. 45, on the right side of FIG. 45, an instance of the first beam-abutment feature 1108A makes contact with (abuts) the second frame-abutment feature 1112B (of the second concrete-slab frame assembly 1110B) at a first abutment 1144A (once the first construction beam assembly 1106A is pivotally rotated to a predetermined angle).

Referring to the embodiment as depicted in FIG. 45, on the left side of FIG. 45, another instance of the first beam-abutment feature 1108A makes contact with (abuts) the second frame-abutment feature 1112B (of the first concrete-slab frame assembly 1110A) at a second abutment 1144B (once the first construction beam assembly 1106A is pivotally rotated to a predetermined angle).

Referring to the embodiment as depicted in FIG. 45, an advantage for the first abutment 1144A and the second abutment 1144B is that the first concrete-slab frame assembly 1110A and the second concrete-slab frame assembly 1110B are secured into position and are further prevented from movement (slide movement) along the top section of the first construction beam assembly 1106A and the second construction beam assembly 1106B (respectively). A construction worker may be able to form a floor surface by placing and positioning another instance of a concrete-slab frame assembly against the first concrete-slab frame assembly 1110A, and carry on to form (position) a floor section with instances of the concrete-slab frame assemblies, etc.

Referring to the embodiment as depicted in FIG. 45, in the middle of FIG. 45, an instance of the first beam-abutment feature 1108A is spaced apart from the second frame-abutment feature 1112B (of the second concrete-slab frame assembly 1110B) at the second gap 1122B (once the first construction beam assembly 1106A is pivotally rotated to a predetermined angle).

Referring to the embodiment as depicted in FIG. 45, in the middle of FIG. 45, an instance of the first beam-abutment feature 1108A is spaced apart from the second frame-abutment feature 1112B (of the second concrete-slab frame assembly 1110B) at the third gap 1122C (once the first construction beam assembly 1106A is pivotally rotated to a predetermined angle).

Figure 51:
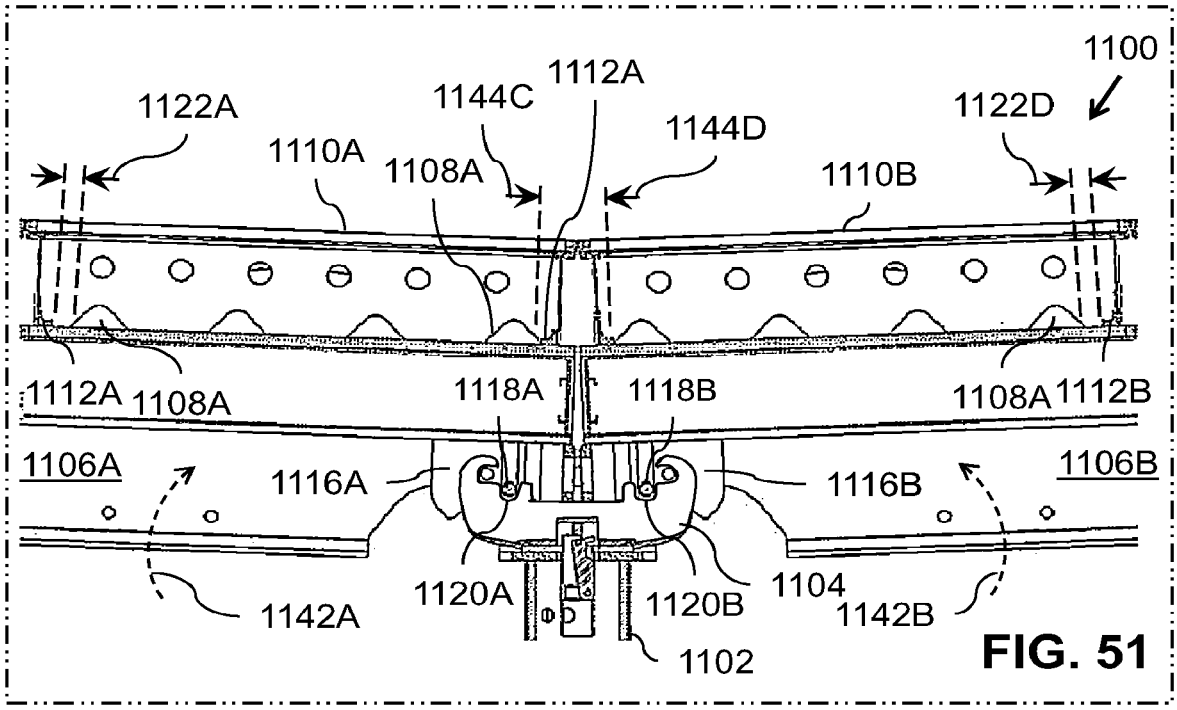

Referring to the embodiments as depicted in FIG. 39, FIG. 45 and FIG. 51, the first beam-abutment feature 1108A and the first frame-abutment feature 1112A are movable relative to each other between: (A) a first position in which the first beam-abutment feature 1108A and the first top beam portion 1114A are spaced apart from each other; and (B) a second position in which the first beam-abutment feature 1108A and the first top beam portion 1114A (in use) abut (at least in part) each other.

Figure 48:
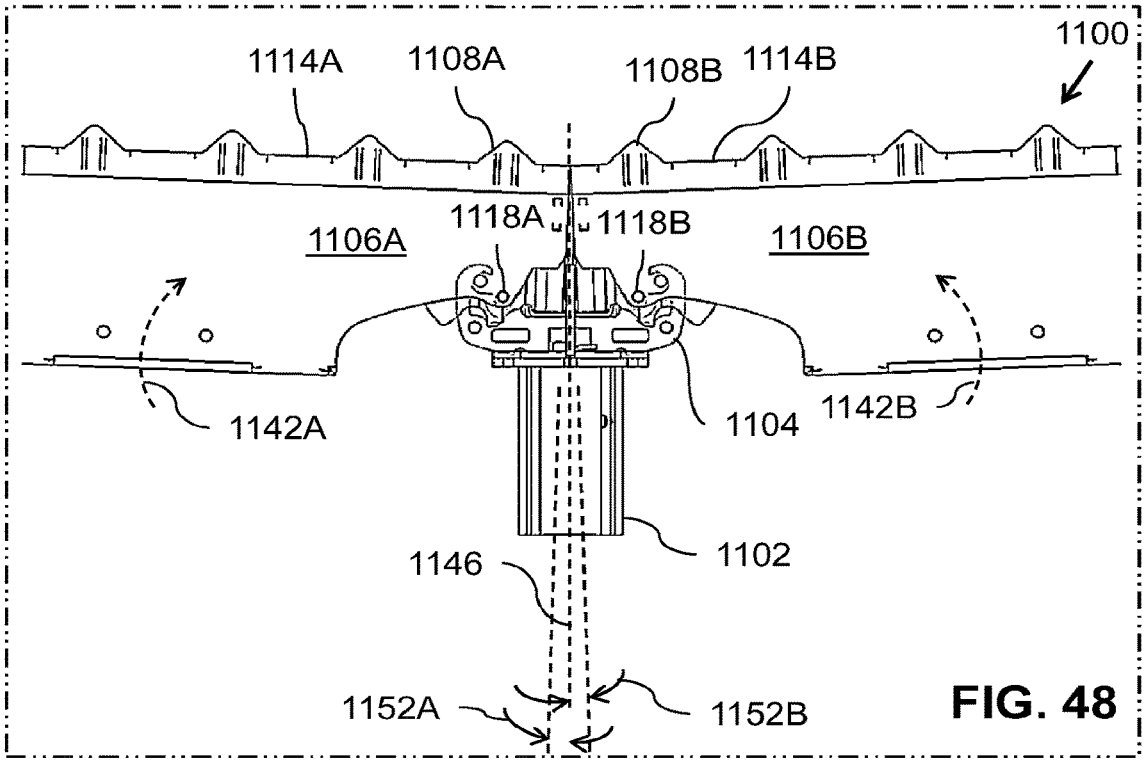

Referring to the embodiments as depicted in FIG. 39, FIG. 45 and FIG. 51, the first beam-abutment feature 1108A (of the first construction beam assembly 1106A) and the first frame-abutment feature 1112A (of the first concrete-slab frame assembly 1110A), in use, abut (contact) each other once the first construction beam assembly 1106A, in use, is pivotally mounted to the prop-head assembly 1104, and once the first construction beam assembly 1106A, in use, is pivotally moved to a predetermined angle (position) relative to a vertical line 1146 (for instance, the vertical line 1146 is depicted in FIG. 48) that extends vertically from the ground.

Figure 47:
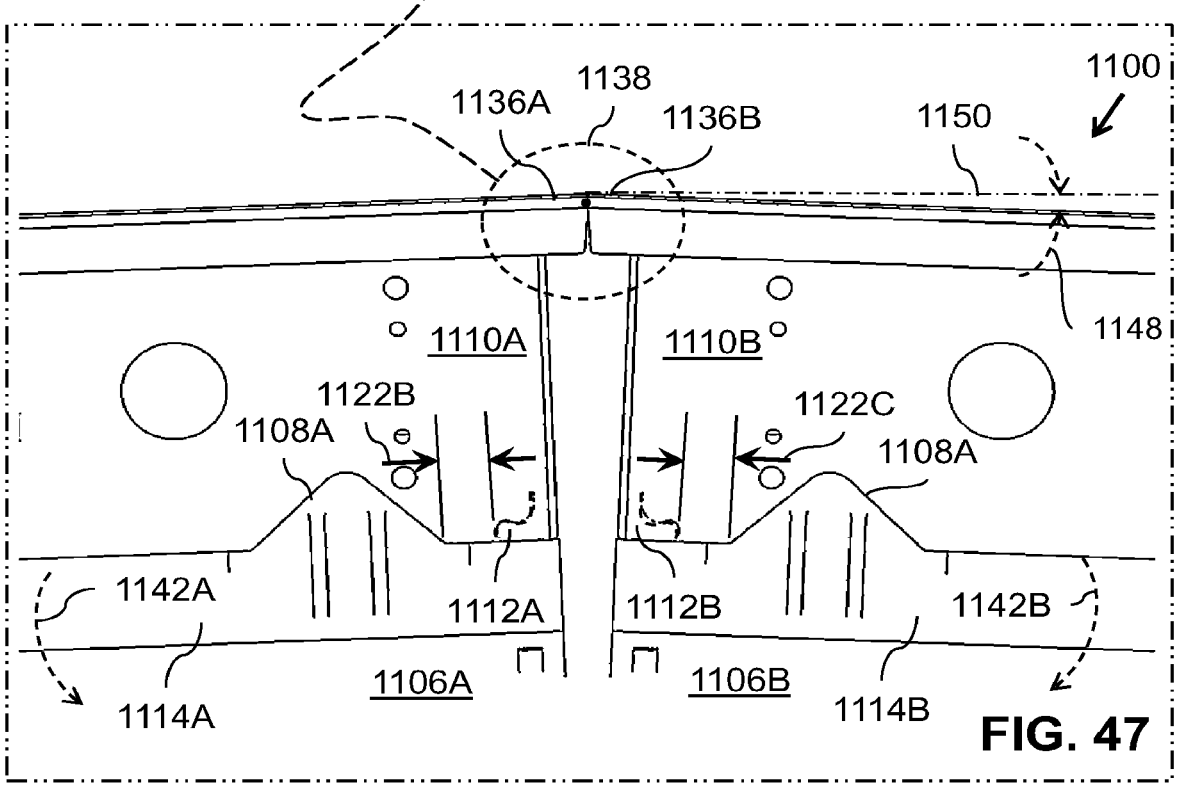

Referring to the embodiments as depicted in FIG. 46 and FIG. 47, in which FIG. 46 depicts a close-up side view of the features depicted in FIG. 47, the first construction beam assembly 1106A and the second construction beam assembly 1106B are mounted (pivotally mounted) to the prop-head assembly 1104. The first construction beam assembly 1106A and the second construction beam assembly 1106B are non-horizontally aligned (once the first construction beam assembly 1106A and the second construction beam assembly 1106B are mounted to the prop-head assembly 1104 and pivoted downwardly). The first construction beam assembly 1106A is pivotally rotated away from the horizontal (that is, after the first construction beam assembly 1106A is pivotally mounted to the prop-head assembly 1104 and pivoted downwardly). The second construction beam assembly 1106B is pivotally rotated away from the horizontal (that is, after the second construction beam assembly 1106B is pivotally mounted to the prop-head assembly 1104 and pivoted downwardly).

Referring to the embodiments as depicted in FIG. 46 and FIG. 47, the first concrete-slab frame assembly 1110A is positioned on top of the first top beam portion 1114A, or on top of the first construction beam assembly 1106A. The second concrete-slab frame assembly 1110B is positioned on top of the second top beam portion 1114B, or on top of the second construction beam assembly 1106B. The first concrete-slab frame assembly 1110A is non-horizontally aligned, once the first concrete-slab frame assembly 1110A is positioned on top of the first top beam portion 1114A, or on top of the first construction beam assembly 1106A. The second concrete-slab frame assembly 1110B is non-horizontally aligned, once the second concrete-slab frame assembly 1110B is positioned on top of the second top beam portion 1114B, or on top of the second construction beam assembly 1106B.

Referring to the embodiment as depicted in FIG. 46, the skim coat 1124 (a layer of poured concrete) is applied to the top surfaces of the first concrete-slab frame assembly 1110A and the second concrete-slab frame assembly 1110B; this is done once the first concrete-slab frame assembly 1110A and the second concrete-slab frame assembly 1110B are positioned on top of the first top beam portion 1114A and the second top beam portion 1114B (respectively), or on top of the first construction beam assembly 1106A and the second construction beam assembly 1106B (respectively).

Referring to the embodiment as depicted in FIG. 46, the first concrete-slab frame assembly 1110A provides a first camming surface 1126A. The second concrete-slab frame assembly 1110B provides a second camming surface 1126B. In accordance with an option, the first camming surface 1126A and the second camming surface 1126B contact each other at the contact point 1128 (also called a pivot point). In accordance with another option, the frame edge gap 1130 is formed between the first camming surface 1126A and the second camming surface 1126B.

Referring to the embodiment as depicted in FIG. 46, the size of the frame edge gap 1130 is zero or may have an acceptable size range (such as, from about 0.0 millimeters to about 0.2 millimeters). The frame edge gap 1130 is sized (configured) to prevent (substantially prevent) leakage of freshly poured concrete between the first concrete-slab frame assembly 1110A and second concrete-slab frame assembly 1110B, which are adjacently positioned against each other in a contact relationship. In the event of leakage of fresh concrete from the skim coat 1124, the leakage travels along the leakage drop direction 1132 (between the frame edge gap 1130 formed between the lateral side edges of the first concrete-slab frame assembly 1110A and the second concrete-slab frame assembly 1110B).

Referring to the embodiment as depicted in FIG. 46, once the first construction beam assembly 1106A and the second construction beam assembly 1106B are pivoted (as depicted in the embodiment of FIG. 46 and FIG. 52), the first camming surface 1126A and the second camming surface 1126B interact with each other (cam against each other).

Referring to the embodiment as depicted in FIG. 46, a frame gap 1134 is formed between the mid-sections of the first concrete-slab frame assembly 1110A and the second concrete-slab frame assembly 1110B.

Referring to the embodiment as depicted in FIG. 47, the first concrete-slab frame assembly 1110A provides a first top end portion 1136A. The second concrete-slab frame assembly 1110B provides a second top end portion 1136B. The first top end portion 1136A and the second concrete-slab frame assembly 1110B contact (at least in part) each other at a contact zone 1138. The first concrete-slab frame assembly 1110A and the second concrete-slab frame assembly 1110B define an angle 1148 (from the horizontal line 1150 or the horizon).

FIG. 48, FIG. 49, FIG. 50, FIG. 51, FIG. 52 and FIG. 53 depict embodiments of side views (FIG. 48, FIG. 49, FIG. 52 and FIG. 53), a top view (FIG. 50) and a cross-sectional view (FIG. 51) of the apparatus 1100 of FIG. 35, in which the first construction beam assembly 1106A is pivoted upwardly relative to the prop-head assembly 1104, and the first construction beam assembly 1106A has a non-horizontal alignment while the first construction beam assembly 1106A is pivotally mounted to the prop-head assembly 1104.

Referring to the embodiments as depicted in FIG. 48, FIG. 49, FIG. 50, FIG. 51, FIG. 52 and FIG. 53, the first construction beam assembly 1106A is pivoted upwardly from the horizontal (the horizon). The first construction beam assembly 1106A and the first concrete-slab frame assembly 1110A are non-horizontally aligned. The first concrete-slab frame assembly 1110A is placed on (the top surface of) the first construction beam assembly 1106A.

Referring to the embodiment as depicted in FIG. 48, the first construction beam assembly 1106A and the second construction beam assembly 1106B are non-horizontally aligned. The first construction beam assembly 1106A is pivotally moved (relative to the prop-head assembly 1104) along a first pivot direction 1142A. The second construction beam assembly 1106B is pivotally moved (relative to the prop-head assembly 1104) along a second pivot direction 1142B. A first face end of the first construction beam assembly 1106A forms a third angle 1152A relative to the vertical line 1146. A second face end of the second construction beam assembly 1106B forms the third angle 1152B relative to the vertical line 1146.

Referring to the embodiment as depicted in FIG. 49, the first concrete-slab frame assembly 1110A is placed (positioned) on the top section (surface) of the first top beam portion 1114A (or the first construction beam assembly 1106A). The second concrete-slab frame assembly 1110B is placed (positioned) on the top section (surface) of the second top beam portion 1114B (or the second construction beam assembly 1106B). The first construction beam assembly 1106A is pivotally moved upwardly (relative to the prop-head assembly 1104) along a first pivot direction 1142A. The second construction beam assembly 1106B is pivotally moved upwardly (relative to the prop-head assembly 1104) along a second pivot direction 1142B.

Figure 50:
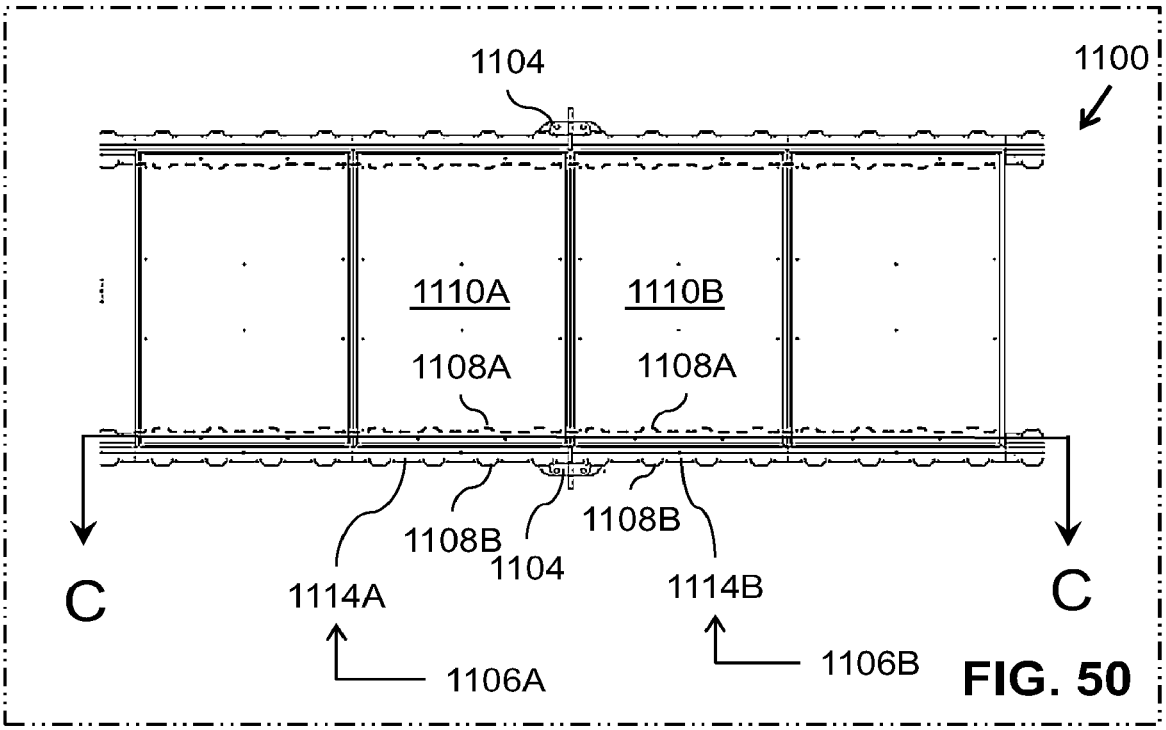

Referring to the embodiment as depicted in FIG. 50 (a top view), the first beam-abutment feature 1108A and the second beam-abutment feature 1108B are positioned on opposite edges of the first top beam portion 1114A. The first beam-abutment feature 1108A and the second beam-abutment feature 1108B are positioned on opposite edges of the second top beam portion 1114B. The cross-sectional line C-C extends along an end length of the first top beam portion 1114A and the second top beam portion 1114B (between the first beam-abutment feature 1108A and the second beam-abutment feature 1108B).

Referring to the embodiment as depicted in FIG. 51, (which depicts a cross-sectional view taken along the cross-sectional line C-C of FIG. 50), the first concrete-slab frame assembly 1110A and the second concrete-slab frame assembly 1110B are placed in an abutment relationship (contact relationship) with the first top beam portion 1114A and the second top beam portion 1114B (respectively).

Referring to the embodiment as depicted in FIG. 51, on the left side of FIG. 45, an instance of the first beam-abutment feature 1108A is spaced apart from the second frame-abutment feature 1112B (of the first concrete-slab frame assembly 1110A) at the first gap 1122A. The first gap 1122A extends between the first beam-abutment feature 1108A and the second frame-abutment feature 1112B.

Referring to the embodiment as depicted in FIG. 51, in the middle of FIG. 45, an instance of the first beam-abutment feature 1108A makes contact, at least in part, with (abuts) the second frame-abutment feature 1112B (of the first concrete-slab frame assembly 1110A) at the third abutment 1144C.

Referring to the embodiment as depicted in FIG. 51, on the right side of FIG. 45, an instance of the first beam-abutment feature 1108A is spaced apart from the second frame-abutment feature 1112B (of the second concrete-slab frame assembly 1110B) at the fourth gap 1122D. The fourth gap 1122D extends between the first beam-abutment feature 1108A and the second frame-abutment feature 1112B.

Referring to the embodiment as depicted in FIG. 51, in the middle of FIG. 45, an instance of the first beam-abutment feature 1108A makes contact with (abuts) the second frame-abutment feature 1112B (of the second concrete-slab frame assembly 1110B) at the fourth abutment 1144D.

Figure 53:
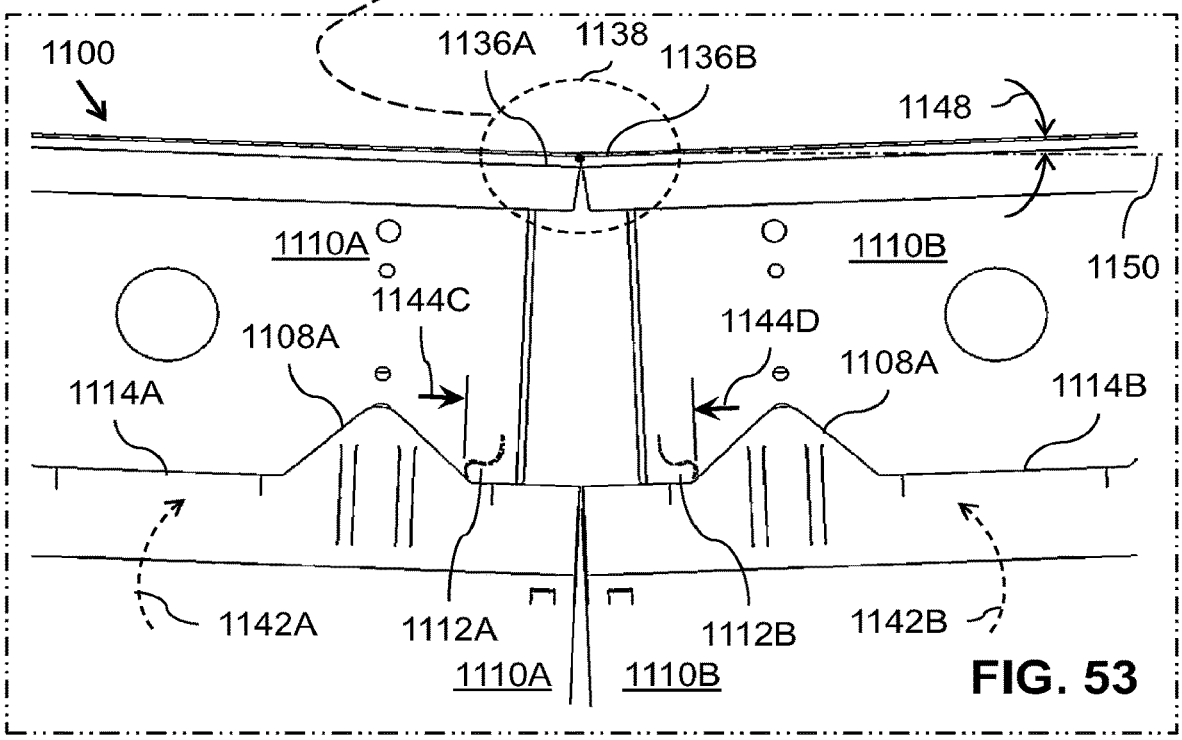

Referring to the embodiments as depicted in FIG. 52 and FIG. 53, in which FIG. 52 depicts a close-up side view of the features depicted in FIG. 53, the first construction beam assembly 1106A and the second construction beam assembly 1106B are mounted (pivotally mounted) to the prop-head assembly 1104. The first construction beam assembly 1106A and the second construction beam assembly 1106B are non-horizontally aligned (once the first construction beam assembly 1106A and the second construction beam assembly 1106B are mounted to the prop-head assembly 1104 and pivoted upwardly). The first construction beam assembly 1106A is aligned (angled) away from the horizontal (the horizon). The second construction beam assembly 1106B is aligned (angled away from the horizontal (the horizon). The first concrete-slab frame assembly 1110A is positioned on the top section of the first top beam portion 1114A, or on the top section of the first construction beam assembly 1106A. The second concrete-slab frame assembly 1110B is positioned on the top section of the second top beam portion 1114B, or on the top section of the second construction beam assembly 1106B. The first concrete-slab frame assembly 1110A is non-horizontally aligned, once the first concrete-slab frame assembly 1110A is positioned on the top section of the first top beam portion 1114A, or on the top section of the first construction beam assembly 1106A. The second concrete-slab frame assembly 1110B is non-horizontally aligned, once the second concrete-slab frame assembly 1110B is positioned on the top section of the second top beam portion 1114B, or on the top section of the second construction beam assembly 1106B.

Referring to the embodiment as depicted in FIG. 52, the skim coat 1124 (a layer of poured concrete) is applied to the top surfaces of the first concrete-slab frame assembly 1110A and the second concrete-slab frame assembly 1110B, once the first concrete-slab frame assembly 1110A and the second concrete-slab frame assembly 1110B are positioned on top of the first top beam portion 1114A and the second top beam portion 1114B (respectively), or on top of the first construction beam assembly 1106A and the second construction beam assembly 1106B (respectively).

Referring to the embodiment as depicted in FIG. 52, the first concrete-slab frame assembly 1110A provides a first camming surface 1126A. The second concrete-slab frame assembly 1110B provides a second camming surface 1126B. In accordance with an option, the first camming surface 1126A and the second camming surface 1126B contact each other at the contact point 1128 (also called a pivot point). In accordance with another option, the frame edge gap 1130 is formed between the first camming surface 1126A and the second camming surface 1126B. Preferably, the size of the frame edge gap 1130 is zero or may have an acceptable size range (such as, from about 0.0 millimeters to about 0.2 millimeters). The frame edge gap 1130 is sized (configured) to prevent (substantially prevent) leakage of freshly poured concrete between the first concrete-slab frame assembly 1110A and second concrete-slab frame assembly 1110B, which are adjacently positioned against each other in a contact relationship. In the event of leakage of fresh concrete from the skim coat 1124, the leakage travels along the leakage drop direction 1132 (between the frame edge gap 1130 formed between the lateral side edges of the first concrete-slab frame assembly 1110A and the second concrete-slab frame assembly 1110B).

Referring to the embodiment as depicted in FIG. 52, once the first construction beam assembly 1106A and the second construction beam assembly 1106B are pivoted (as depicted in the embodiment of FIG. 46 and FIG. 52), the first camming surface 1126A and the second camming surface 1126B interact with each other (cam against each other).

Referring to the embodiment as depicted in FIG. 52, a frame gap 1134 is formed between the mid-sections of the first concrete-slab frame assembly 1110A and the second concrete-slab frame assembly 1110B.

Referring to the embodiment as depicted in FIG. 53, the first concrete-slab frame assembly 1110A provides a first top end portion 1136A. The second concrete-slab frame assembly 1110B provides a second top end portion 1136B. The first top end portion 1136A and the second concrete-slab frame assembly 1110B contact each other at a contact zone 1138. The first concrete-slab frame assembly 1110A and the second concrete-slab frame assembly 1110B define an angle 1148 (relative to or from the horizontal line 1150, or the horizon).

Additional Technical Description (for Concrete-Slab Frame Assembly for Construction Beam Assembly)

Referring to the embodiment as depicted in FIG. 31, there is depicted the beam (support beam) that is supported by the prop-head assembly 1104 (also called, a beam prop-head, a prop-head, and any equivalent thereof) at an intermediate support position.

The first top beam portion 1114A (also called, a plastic runner, a runner, etc., and any equivalent thereof) is positioned on the top section of the beam (also called, the first construction beam assembly 1106A, etc., and any equivalent thereof). The first top beam portion 1114A may be integral to (or may be connected to) the first construction beam assembly 1106A. The tabs (also called the first beam-abutment feature 1108A, or the spaced-apart instances of the first beam-abutment feature 1108A) may be called ears, etc., and any equivalent thereof. The tabs (that is, instances of the first beam-abutment feature 1108A, etc.) are spaced apart from each other in such a way as to allow the panels (not depicted in FIG. 31 but depicted in FIG. 5) to slide by a relatively small amount (between left and right sides of FIG. 36, FIG. 45 and FIG. 51, etc.). While the beams (the first construction beam assembly 1106A, etc.) are pivotally movable (upwardly and/or downwardly) relative to a horizontal position (horizontal alignment), the tabs, in use, maintain engagement with the panel slots of the panels (the first concrete-slab frame assembly 1110A and the second concrete-slab frame assembly 1110B, etc.), while the panels are placed on the beams, as depicted in the embodiments of FIG. 36, FIG. 45 and FIG. 51.

Referring to the embodiment as depicted in FIG. 32, the beam (such as, the first construction beam assembly 1106A) is supported at its end by the prop-head assembly 1104. The beam may rotate or pivoted (upwardly and/or downwardly) while the beam maintains secure contact (pivotal contact or pivotal engagement) with the prop-head assembly 1104.

The hidden line indicates the beam rotated upwardly, and the solid line indicates the beam rotated downwardly.

Referring to the embodiment as depicted in FIG. 33, there is depicted an end view of the beam (the first construction beam assembly 1106A) with the panels (the first concrete-slab frame assembly 1110A or the second concrete-slab frame assembly 1110B) resting on (placed on or positioned on) the top section of the beam, and positioned symmetrically along the center line of the beam. The panels are in contact with each other (side-by-side contact or end-to-end contact), and the panels are placed in the horizontal position (horizontal alignment).

Referring to the embodiment as depicted in FIG. 34, two instances of the beam (the first construction beam assembly 1106A and the second construction beam assembly 1106B) are spaced apart from each other. The beams run (are aligned) parallel with each other, and are spaced at a center-to-center distance equal to a length of the supported panel (such as, the first concrete-slab frame assembly 1110A). The panels may be moved along a length of the beams by a relatively small distance in either direction (such as, to the left side or the right side of FIG. 3) until the panels make contact with the tab (the ear, or the first beam-abutment feature 1108A) of the plastic runner or runner (such as, the first top beam portion 1114A or the second top beam portion 1114B). For further details of this feature, reference is made to FIG. 36. The runner is placed on the top section of the beam (as depicted in FIG. 31 and FIG. 33).

Referring to the embodiment as depicted in FIG. 35, there is depicted a similar arrangement as depicted in FIG. 34, for multiples of (instances of) the panel (panels) sitting (positioned) adjacent to each other while maintaining contact (or side-by-side contact).

It will be appreciated that "contact" may include full contact or partial contact.

Referring to the embodiment as depicted in FIG. 36, the panels (the first concrete-slab frame assembly 1110A and the second concrete-slab frame assembly 1110B) are placed on top of the beam (the first construction beam assembly 1106A and the second construction beam assembly 1106B, respectively) from above (on a top section thereof).

Referring to the embodiment as depicted in FIG. 37, the tabs (such as, the first beam-abutment feature 1108A) of the runner (such as, the first top beam portion 1114A, etc.) are placed on (extend from) the beam (such as the first construction beam assembly 1106A).

The first frame-abutment feature 1112A and the second frame-abutment feature 1112B of the panels enable (are configured to enable) the slide action of the panels along the runner at the base of the runner (while the ears or the tabs engage with the panel slots 1113 defined by the lower section of the panels in, as depicted in FIG. 36).

Referring to the embodiments as depicted in FIG. 38 and FIG. 39, depict the arrangement between the beams (such as the first construction beam assembly 1106A) and the prop-head (the prop-head assembly 1104). The first beam-reference portion 1118A allows the beam to rotate upwardly and/or downwardly from the horizontal position relative to the prop-head assembly 1104. The second gap 1122B and the third gap 1122C (a spacing) exists between (A) the perimeter rail (also called the first frame-abutment feature 1112A or the second frame-abutment feature 1112B, etc., and any equivalent thereof) of the panels and (B) the ears (also called the tabs or the first beam-abutment feature 1108A, etc., and any equivalent thereof) of the runner (the first top beam portion 1114A). The second gap 1122B and the third gap 1122C, in use, allows movement of the panel along the beam whilst maintaining contact at the top of the panels (between the end sections of adjacently positioned panels) through rotation of the beam. Each of the panels provides a perimeter rail or an edge rail, and any equivalent thereof (such as, the first frame-abutment feature 1112A or the second frame-abutment feature 1112B), which is, preferably, positioned along the lower section of the panels.

Referring to the embodiments as depicted in FIG. 40 and FIG. 41, there is depicted a concrete layer (also called, the layer or the skim coat 1124) placed on a top surface of the panels (such as the first concrete-slab frame assembly 1110A). The contact point 1128 is a contact point between adjacently positioned instances of the panels (side-by-side panels, in which the end portions of the panels contact each other at least in part). Preferably, the contact point 1128 provides a relatively minimal distance (within a predetermined tolerance) between adjacently-positioned panels, and in this manner the tolerance substantially prevents (at least in part) the leakage of concrete through (between) the panels via the leakage drop direction 1132. It will be appreciated that FIG. 40 and FIG. 41 depict a close-up view (representation) of the technical features depicted in FIG. 38 and FIG. 39.

Referring to the embodiment as depicted in FIG. 42, the beams (such as, the first construction beam assembly 1106A) are rotated downwardly from the horizontal line (the horizon) while the beams are supported on the prop-head assembly 1104, thus creating a gap (and angled gap) between adjacently-positioned beams (at the top of the beams).

Referring to the embodiment as depicted in FIG. 43, depicts a similar level (degree) of rotation of the beams (such as the first construction beam assembly 1106A) as the embodiment of FIG. 42. The panels (such as, the first concrete-slab frame assembly 1110A) are supported by the beams in position (that is, in a stationary position). The position of the panels are shown such that the end sections (also called edge perimeters) of the panels maintain contact (touch, at least in part) with each other, while the panels are positioned on the top sections of the beams, even though the beams have moved apart (that is, rotated apart or pivoted apart) from each other (as a result of pivotal movement of the beams relative to the prop-head assembly 1104). The panels follow the same rotation as the beams, yet the end sections of the panels maintain contact with each other due to the allowance for slide movement of the panels between the ears (also called the tabs, such as the first beam-abutment feature 1108A) that extend upwardly from the beam.

Referring briefly to the embodiment of FIG. 36, it will be appreciated that the bottom section of the panels define panel slots 1113 (elongated slots) that receive the tabs or the ears of the first top beam portion 1114A (which is placed on the top section of the beams). The elongated slots (such as, the panel slot 1113) of the panels are relatively longer than the width of the tabs (as depicted in the embodiment of FIG. 36). It will be appreciated that the same arrangement is applicable to the embodiment of FIG. 49.

Referring to the embodiments as depicted in FIG. 44 and FIG. 45, there is depicted a similar arrangement between the panel (such as, the first concrete-slab frame assembly 1110A) and the beam (such as, the first construction beam assembly 1106A) but through a section cut through the panel.

Referring to the embodiment as depicted in FIG. 46, there are depicted similar technical features as shown in the embodiment of FIG. 40 (that is, similar structural and/or with functionality), with the panels (such as the first concrete-slab frame assembly 1110A) rotated (pivoted) downwardly from the horizontal (downwardly from the horizon).

Referring to the embodiment as depicted in FIG. 47, there are depicted the distances (such as, the second gap 1122B and the third gap 1122C) between (A) the tab (the ear, such as the first beam-abutment feature 1108A, etc.) and (B) the panel perimeter rail (also called, the first frame-abutment feature 1112A, etc.) have increased, which allow both end sections of the panels (such as, the first concrete-slab frame assembly 1110A, etc.) to maintain contact with each other (preferably, at the top portions of the panels) while the panels remain fully supported by the beam (such as, the first construction beam assembly 1106A, etc.) for load transfer purposes.

Referring to the embodiment as depicted in FIG. 48 (which is similar to the embodiment as depicted in FIG. 42), the beams (such as, the first construction beam assembly 1106A, etc.) are rotated in an upward direction relative to the horizontal, thus (preferably) closing the gap (at least in part) at the top end sections of the beams (between adjacently positioned panels).

Referring to the embodiment as depicted in FIG. 49, the panels (such as, the first concrete-slab frame assembly 1110A, etc.) are in position while maintaining panel-to-panel end contact (outer edge contact) at the top sections of the adjacently positioned panels.

Referring to the embodiments as depicted in FIG. 50 and FIG. 51 (which are similar to the embodiments as depicted in FIG. 44 and FIG. 45). However, for this case, the beams are rotated or pivoted upwardly (relative to the horizontal).

Referring to the embodiments as depicted in FIG. 52 and FIG. 53, there is depicted similar structural and functional features of the beams (such as, the first construction beam assembly 1106A, etc.) and panels (such as the first concrete-slab frame assembly 1110A, etc.) as depicted in the embodiments of FIG. 46 and FIG. 47, but with the panels and beams rotated (pivoted) in the upward direction. FIG. 53 depicts the third abutment 1144C and fourth abutment 1144D as the relationship between the tab (the ear, or the first beam-abutment feature 1108A and the second beam-abutment feature 1108B) and the panel perimeter rail (such as, the first frame-abutment feature 1112A and the second frame-abutment feature 1112B) come into contact (with each other, at least in part).

Clauses (Associated with or Relates to Concrete-Slab Frame Assembly for Construction Beam Assembly)

The following clauses are offered as further description of the examples of the apparatus. Any one or more of the following clauses may be combinable with (A) any other one or more of the following clauses and/or (B) with any subsection or a portion or portions of any other clause and/or (C) any combination and permutation of clauses and/or (D) as described in this application with or without any description that is not included in any specific clause. Any one of the following clauses may stand on its own merit without having to be combined with any other clause or with any portion of any other clause, etc.

Clause (1): with reference to the embodiments as depicted in FIG. 31 to FIG. 53, there is provided an apparatus, either taken alone, or with any apparatus or portion thereof mentioned in this document, in which the apparatus is for utilization with a first construction beam assembly, a prop-head assembly, and a vertically-extending construction column, the apparatus comprising: a first concrete-slab frame assembly receiving and supporting (configured to receive and support), at lease in part, a first formed concrete slab; and the first concrete-slab frame assembly being slidably positionable on, and movable along, the first construction beam assembly, and the first concrete-slab frame assembly having a first frame-abutment feature, and in which the first construction beam assembly is pivotally mountable to the prop-head assembly, and the first construction beam assembly has a first beam-abutment feature, and in which the prop-head assembly is affixed (is configured to be affixed) to the vertically-extending construction column, and in which the vertically-extending construction column is fixedly positioned (is configured to be fixedly positioned) to (on) a working surface; and the first frame-abutment feature of the first concrete-slab frame assembly being slide movable relative to the first beam-abutment feature of the first construction beam assembly in response to pivotal movement of the first construction beam assembly relative to the prop-head assembly.

Clause (2): the apparatus of Clause (1) or any Clause, wherein: the first frame-abutment feature of the first concrete-slab frame assembly is slide movable relative to the first beam-abutment feature of the first construction beam assembly in response to pivotal movement of the first construction beam assembly relative to the prop-head assembly once: (A) the vertically-extending construction column, in use, is fixedly positioned to the working surface; and (B) the prop-head assembly, in use, is affixed to the vertically-extending construction column; and (C) the first construction beam assembly, in use, is pivotally mounted to the prop-head assembly; and (D) the first concrete-slab frame assembly, in use, is positioned on the first construction beam assembly; and (E) the first construction beam assembly, in use, is pivotally moved while being pivotally mounted to the prop-head assembly.

Clause (3): the apparatus of Clause (1) or any Clause, wherein: the first beam-abutment feature includes a double row of spaced apart upstanding ribs; and a flat linear portion extends between each upstanding rib of the double row of spaced apart upstanding ribs.

Clause (4): the apparatus of Clause (1) or any Clause, wherein: the prop-head assembly includes a first beam-locating feature; and the first construction beam assembly includes a first end section having a first beam-reference portion; and the first beam-reference portion of the first construction beam assembly is pivotally mountable to, and supportable, at least in part, by the first beam-locating feature of the prop-head assembly.

Clause (5): the apparatus of Clause (1) or any Clause, wherein: the first formed concrete slab is formed, and securely positioned in, the first concrete-slab frame assembly; and the first concrete-slab frame assembly has the first frame-abutment feature makes contact (configured to make contact) with, and/or abut, in an abutment relationship with, the first beam-abutment feature once the first concrete-slab frame assembly is moved along a first top beam portion.

Clause (6): the apparatus of Clause (1) or any Clause, wherein: the first frame-abutment feature is positionable along a lower section of the first concrete-slab frame assembly.

Clause (7): the apparatus of Clause (1) or any Clause, wherein: the first beam-abutment feature of a first top beam portion of the first construction beam assembly is movable in response to pivotal movement of the first construction beam assembly relative to the prop-head assembly once: (A) the first top beam portion is positioned on, and is supported by, the first construction beam assembly; and (B) the first construction beam assembly is pivotally mountable to the prop-head assembly; and (C) the first construction beam assembly is pivoted relative to the prop-head assembly; and the first frame-abutment feature of the first concrete-slab frame assembly is movable in response to pivotal movement of the first construction beam assembly relative to the prop-head assembly once: (a) the first construction beam assembly is pivotally mountable to the prop-head assembly; and (b) the first concrete-slab frame assembly is positioned on, and is supported by, the first construction beam assembly; and (c) the first construction beam assembly is pivoted relative to the prop-head assembly.

Clause (8): the apparatus of Clause (1) or any Clause, wherein: the first frame-abutment feature of the first concrete-slab frame assembly and the first beam-abutment feature of the first construction beam assembly are spaced apart from each other, once the first construction beam assembly is horizontally aligned once the first construction beam assembly, in use, is locked out and is prevented from being pivoted away from horizontal alignment.

Clause (9): the apparatus of Clause (1) or any Clause, wherein: a first gap is formed between the first frame-abutment feature and the first beam-abutment feature located at a first end section of the first concrete-slab frame assembly, once the first construction beam assembly is horizontally aligned; and a second gap is formed between the first frame-abutment feature and the first beam-abutment feature located at an opposite end section of the first concrete-slab frame assembly, once the first construction beam assembly is horizontally aligned; and a third gap is formed between a second frame-abutment feature and a second beam-abutment feature located at a second end section of a second concrete-slab frame assembly, once a second construction beam assembly is horizontally aligned; and a fourth gap is formed between the second frame-abutment feature and the second beam-abutment feature located at the opposite end section of the second concrete-slab frame assembly, once the second construction beam assembly is horizontally aligned.

Clause (10): The apparatus of Clause (9) or any Clause, wherein: lateral side sections of the first concrete-slab frame assembly and a second concrete-slab frame assembly, in use, abut, at least in part, each other, once the first concrete-slab frame assembly and the second concrete-slab frame assembly are positioned on the first construction beam assembly and the second construction beam assembly, respectively; and a skim coat of poured concrete is applied to a first top surface of the first concrete-slab frame assembly and a second top surface of the second concrete-slab frame assembly and the second concrete-slab frame assembly.

Clause (11): the apparatus of Clause (9) or any Clause, wherein: lateral side sections of the first concrete-slab frame assembly and a second concrete-slab frame assembly, in use, abut, at least in part, each other, once the first concrete-slab frame assembly and the second concrete-slab frame assembly are positioned on the first construction beam assembly and the second construction beam assembly, respectively; and the first concrete-slab frame assembly provides a first camming surface positioned along a first lateral side section of the first concrete-slab frame assembly; and the second concrete-slab frame assembly provides a second camming surface positioned along a second lateral side section of the second concrete-slab frame assembly. The first camming surface and the second camming surface, in use, contact each other at a contact point.

Clause (12): the apparatus of Clause (11) or any Clause, wherein: a frame edge gap is formed between the first camming surface and the second camming surface; and a size of the frame edge gap has a size range.

Clause (13): the apparatus of Clause (12) or any Clause, wherein: the size range of the frame edge gap is from about 0.0 millimeters to about 0.2 millimeters.

Clause (14): the apparatus of Clause (12) or any Clause, wherein: the frame edge gap is sized to substantially prevent leakage of freshly poured concrete between the first concrete-slab frame assembly and the second concrete-slab frame assembly, which are adjacently positioned against each other in a contact relationship; and a skim coat of poured concrete is applied to a first top surface of the first concrete-slab frame assembly and a second top surface of the second concrete-slab frame assembly and the second concrete-slab frame assembly; and in an event of leakage of fresh concrete from the skim coat, the leakage travels along a leakage drop direction between the frame edge gap formed between a first lateral side edge of the first concrete-slab frame assembly and a second lateral side edge the second concrete-slab frame assembly.

Clause (15): the apparatus of Clause (11) or any Clause, wherein: the first camming surface and the second camming surface interact (are configured to interact) with each other once the first construction beam assembly and the second construction beam assembly are pivoted.

Clause (16): the apparatus of Clause (11) or any Clause, wherein: the first construction beam assembly is non-horizontally aligned; and the first construction beam assembly is pivotally moved relative to the prop-head assembly along a first pivot direction away from the horizon; and the first construction beam assembly is locked into a stationary condition; and the first concrete-slab frame assembly is placed on top of the first construction beam assembly.

Clause (17): the apparatus of Clause (16) or any Clause, wherein: the first concrete-slab frame assembly is secured into position and is further prevented from slide movement along a top section of the first construction beam assembly.

Clause (18): with reference to the embodiments as depicted in FIG. 31 to FIG. 53, there is provided an apparatus, comprising: a vertically-extending construction column being configured to be fixedly positioned to a working surface; and a prop-head assembly fixedly positioned (configured to be affixed) to the vertically-extending construction column; and a first construction beam assembly being pivotally mountable to the prop-head assembly, and the first construction beam assembly having a first beam-abutment feature; and a first concrete-slab frame assembly receiving and supporting (configured to receive and support), at least in part, a first formed concrete slab; and the first concrete-slab frame assembly being slidably positionable on, and movable along, the first construction beam assembly, and the first concrete-slab frame assembly having a first frame-abutment feature; and the first frame-abutment feature of the first concrete-slab frame assembly being slide movable relative to the first beam-abutment feature of the first construction beam assembly in response to pivotal movement of the first construction beam assembly relative to the prop-head assembly.

Clause (19): the apparatus of Clause (18) or any Clause, wherein: the first frame-abutment feature of the first concrete-slab frame assembly is slide movable relative to the first beam-abutment feature of the first construction beam assembly in response to pivotal movement of the first construction beam assembly relative to the prop-head assembly once: (A) the vertically-extending construction column, in use, is fixedly positioned to the working surface; and (B) the prop-head assembly, in use, is affixed to the vertically-extending construction column; and (C) the first construction beam assembly, in use, is pivotally mounted to the prop-head assembly; and (D) the first concrete-slab frame assembly, in use, is positioned on the first construction beam assembly; and (E) the first construction beam assembly, in use, is pivotally moved while being pivotally mounted to the prop-head assembly.

Clause (20): the apparatus of Clause (19) or any Clause, wherein: the first construction beam assembly is non-horizontally aligned; and the first construction beam assembly is pivotally moved relative to the prop-head assembly along a first pivot direction away from the horizon; and the first construction beam assembly is locked into a stationary condition; and the first concrete-slab frame assembly is placed on top of the first construction beam assembly; and the first concrete-slab frame assembly is secured into position and is further prevented from slide movement along a top section of the first construction beam assembly.

Abstract (Associated with or Relates to Concrete-Slab Frame Assembly for Construction Beam Assembly)

Apparatus includes a construction component. With reference to the embodiments as depicted in FIG. 31 to FIG. 53, there is provided a construction component including a concrete-slab frame assembly for a construction beam assembly. The apparatus may be for utilization with a first construction beam assembly, a prop-head assembly, and a vertically-extending construction column. The apparatus includes a first concrete-slab frame assembly receiving and supporting (configured to receive and support) a first formed concrete slab. The first concrete-slab frame assembly is slidably positionable on, and movable along, the first construction beam assembly. The first concrete-slab frame assembly has a first frame-abutment feature. The first construction beam assembly is pivotally mountable to the prop-head assembly. The first construction beam assembly has the first beam-abutment feature. The prop-head assembly is affixed (is configured to be affixed) to the vertically-extending construction column. The vertically-extending construction column is fixedly positioned (is configured to be fixedly positioned) to (on) the working surface. The first frame-abutment feature is slide movable relative to the first beam-abutment feature in response to pivotal movement of the first construction beam assembly.

Infill Beam and/or Other Construction Components

Technical Field (Associated with or Relates to Infill Beam and/or Other Construction Components This document relates to (and is not limited to) the technical field of a construction component with reference to the embodiments of FIG. 1 to FIG. 81, and the construction component may include and is not limited to (with reference to FIG. 54 to FIG. 81) any one or more of (A) an infill beam 2102; (B) a prop-head assembly 2200 (preferably, for use with, and not limited to, an infill beam 2102); (C) a beam-end-support bracket 2300 (preferably, for use with, and not limited to, an infill beam 2102); (D) a construction beam 2400 (preferably, for use with, and not limited to, an infill beam 2102); (E) a premade panel 2500 (preferably, for use with, and not limited to, a construction beam 2400 and/or an infill beam 2102); (F) a panel-frame assembly 2501 (preferably, for use with, and not limited to, a premade panel 2500); (G) a beam-safety feature 2600 (preferably, for use with, and not limited to, a construction beam 2400); and/or (H) a structure (such as a building, a bridge, etc.) having any one or more of the above listed items (and/or methods associated therewith).

Background (Associated with or Relates to Infill Beam and/or Other Construction Components Shoring is a process of temporarily supporting a structure (such as, a building, a vessel, a trench, etc.) with shores (also called props or supports) when there is a danger of collapse of the structure or during construction, repairs or alterations (of the structure). Shoring may be vertical, angled, or horizontal. For instance, a building component (such as, a prop, a prop assembly, etc.) is an object (also called a support) placed beneath and/or against a structure (or part of the structure), and is configured to keep (for preventing) the structure from falling or shaking, etc.

Summary (Associated with or Relates to Infill Beam and/or Other Construction Components It will be appreciated that there exists a need to mitigate (at least in part) at least one problem associated with the existing construction beams (also called the existing technology). After much study of the known systems and methods with experimentation, an understanding (at least in part) of the problem and its solution has been identified (at least in part) and is articulated (at least in part) as follows:

Existing systems configured for shoring (temporarily supporting a structure) are difficult to utilize. What is needed are components that improve existing systems configured for shoring, such as (A) an infill beam, (B) a prop-head assembly, (C) a beam-end-support bracket, (D) a construction beam, (E) a premade panel, (F) a panel-frame assembly, (G) a beam-safety feature, and/or a structure (such as a building, a bridge, etc.) having any one or more of the above listed items.

To mitigate, at least in part, at least one problem associated with the existing technology, there is provided various solutions described below in detail.

For instance, the infill beam is supportive of (configured to support, at least in part) a floor component, in which the floor component is extendable (is configured to fill in) over a gap (a space) formed between a construction component and a feature (such as a wall) of a structure.

For instance, the prop-head assembly is cooperative with (is configured to cooperate with) the infill beam.

For instance, the beam-end-support bracket is cooperative with (is configured to cooperate with) the infill beam.

For instance, the construction beam is cooperative with (is configured to cooperate with) the infill beam.

For instance, the construction beam includes a beam-safety feature, in which the beam-safety feature is positionable (configured to be positioned or located) along a bottom section of the construction beam.

For instance, the premade panel includes the panel-frame assembly.

For instance, the panel-frame assembly is provided for the formation of the premade panel (preferably, concrete is poured into the panel-frame assembly, and solidifies to form the premade panel).

For instance, the structure (such as a building, a bridge, etc.) has any one or more of the above listed items.

Other aspects are identified in the claims. Other aspects and features of the non-limiting embodiments may now become apparent to those skilled in the art upon review of the following detailed description of the non-limiting embodiments with the accompanying drawings. This Summary is provided to introduce concepts in simplified form that are further described below in the Detailed Description. This Summary is not intended to identify potentially key features or possible essential features of the disclosed subject matter, and is not intended to describe each disclosed embodiment or every implementation of the disclosed subject matter. Many other novel advantages, features, and relationships will become apparent as this description proceeds. The figures and the description that follow more particularly exemplify illustrative embodiments.

Figure 54:
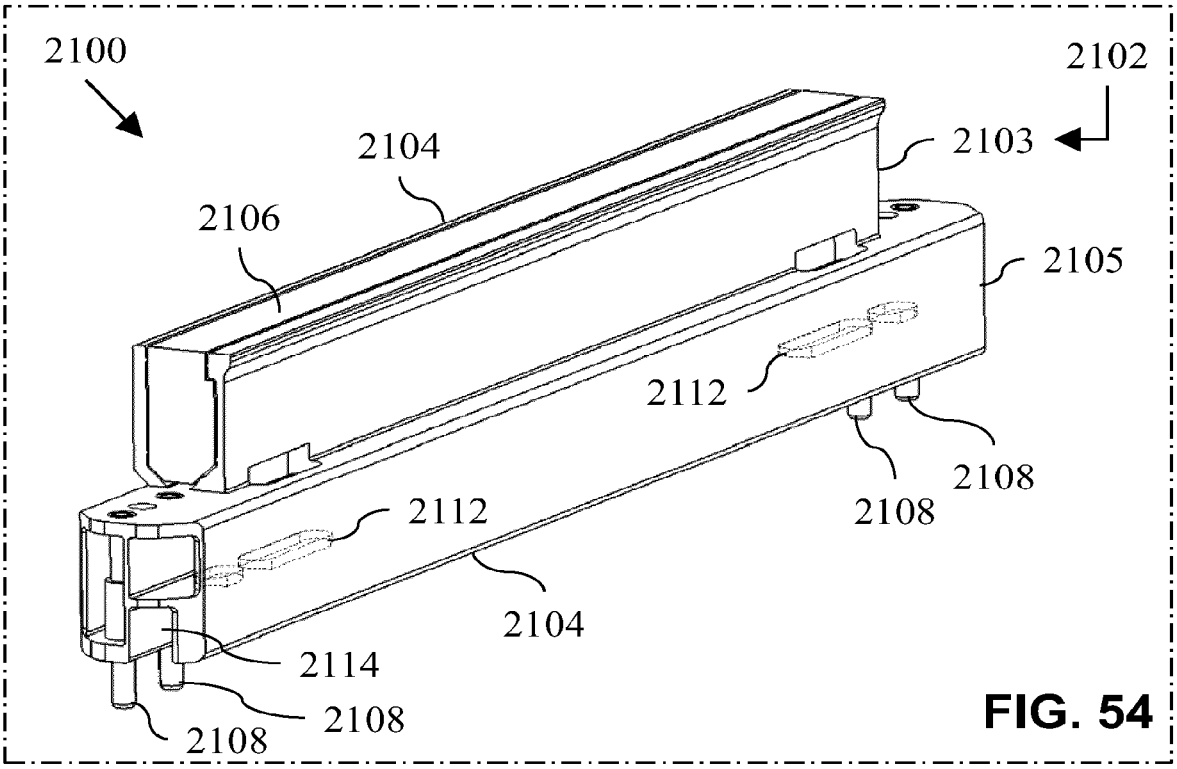
Figure 55:
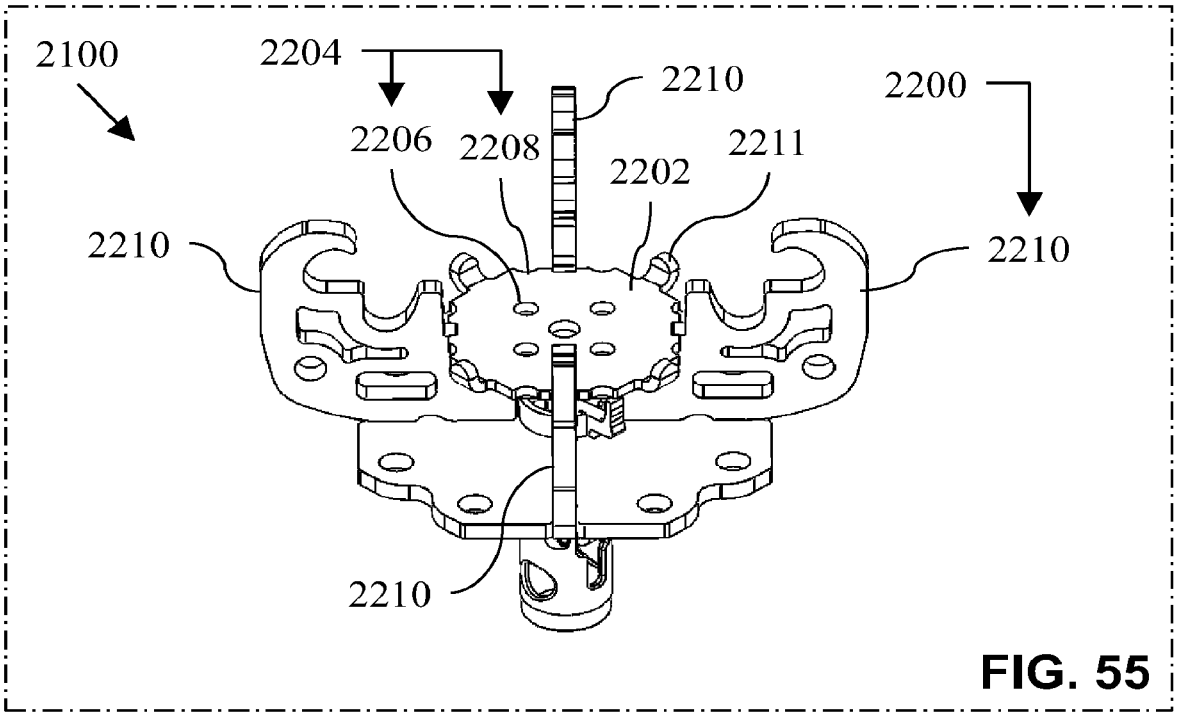
Figure 56:
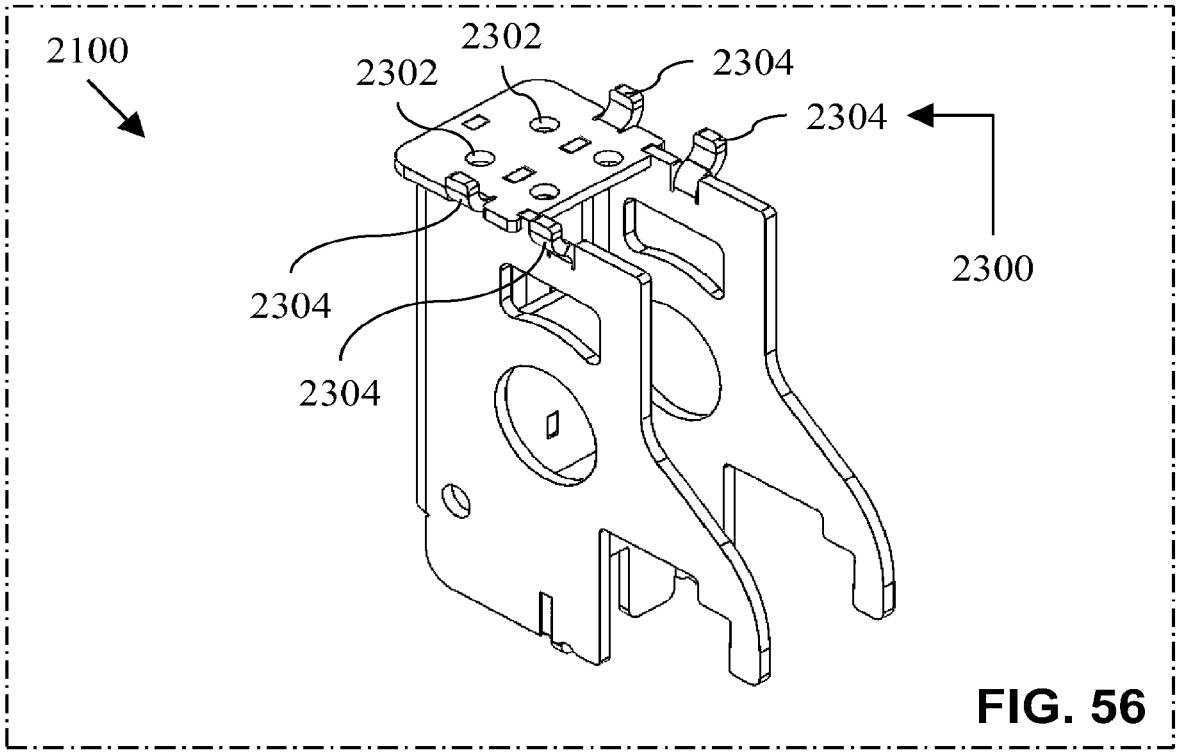
Figure 57:
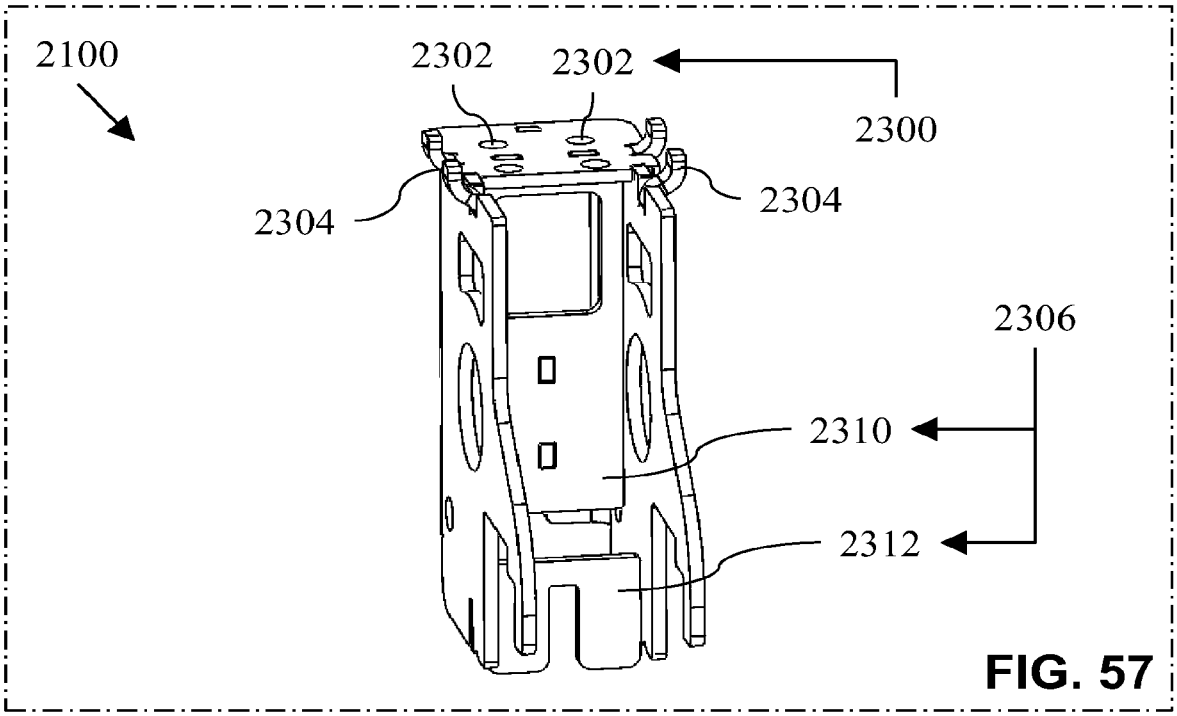
Figure 58:
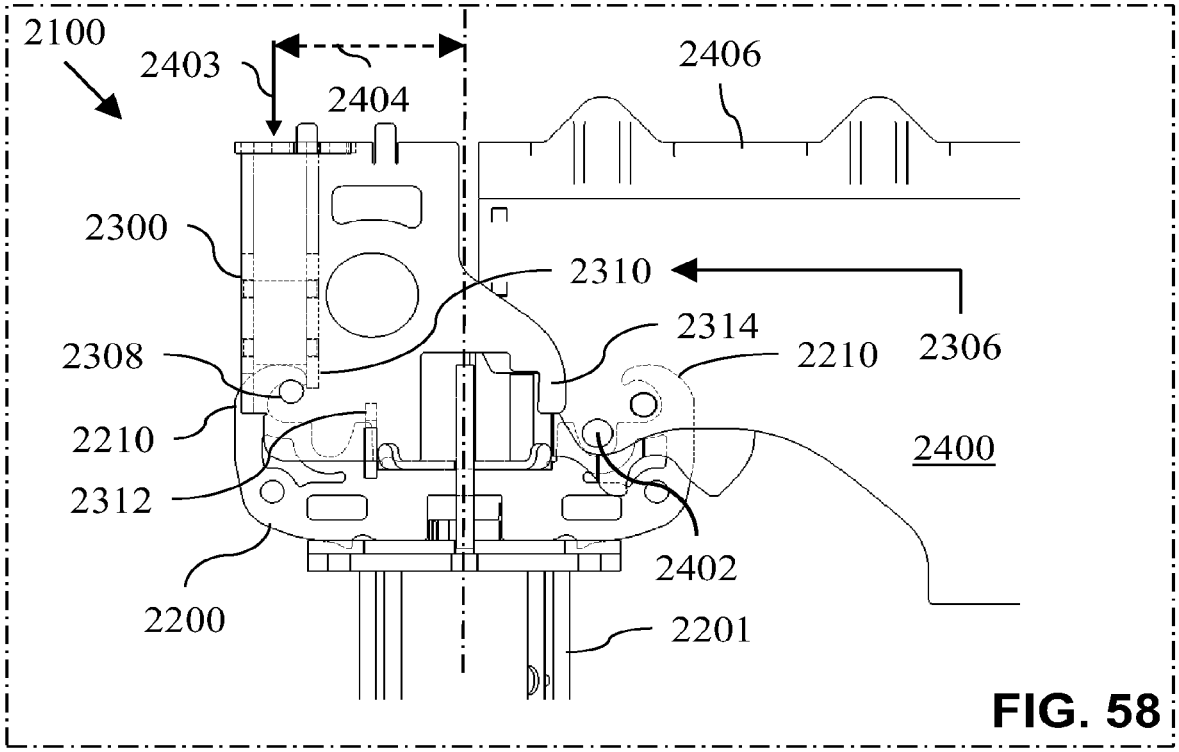
Figure 59:
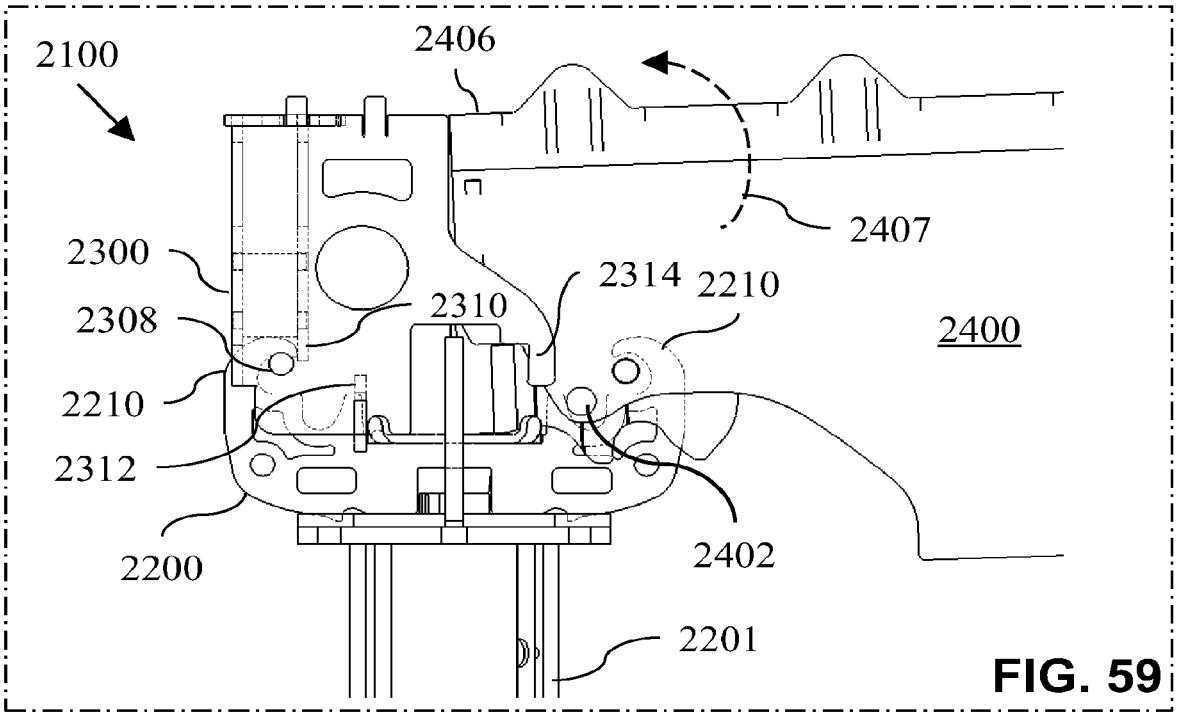
Figure 60:
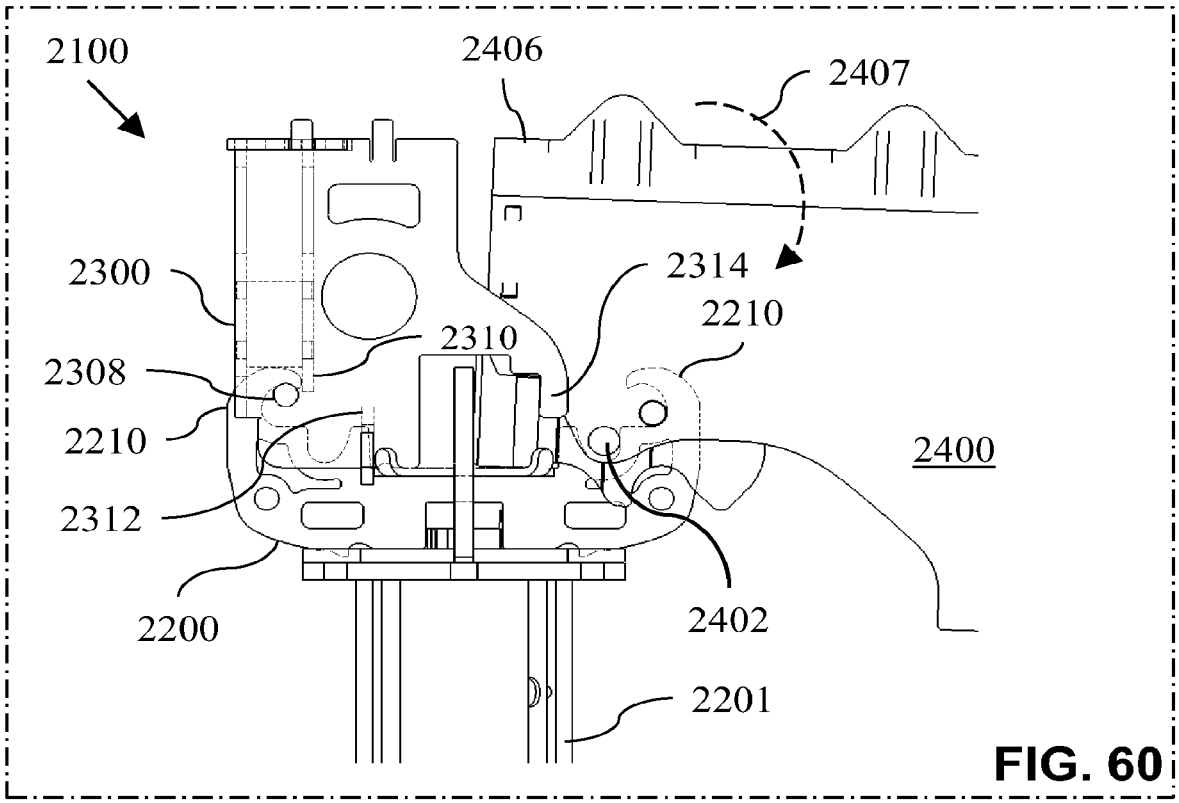
Figure 61:
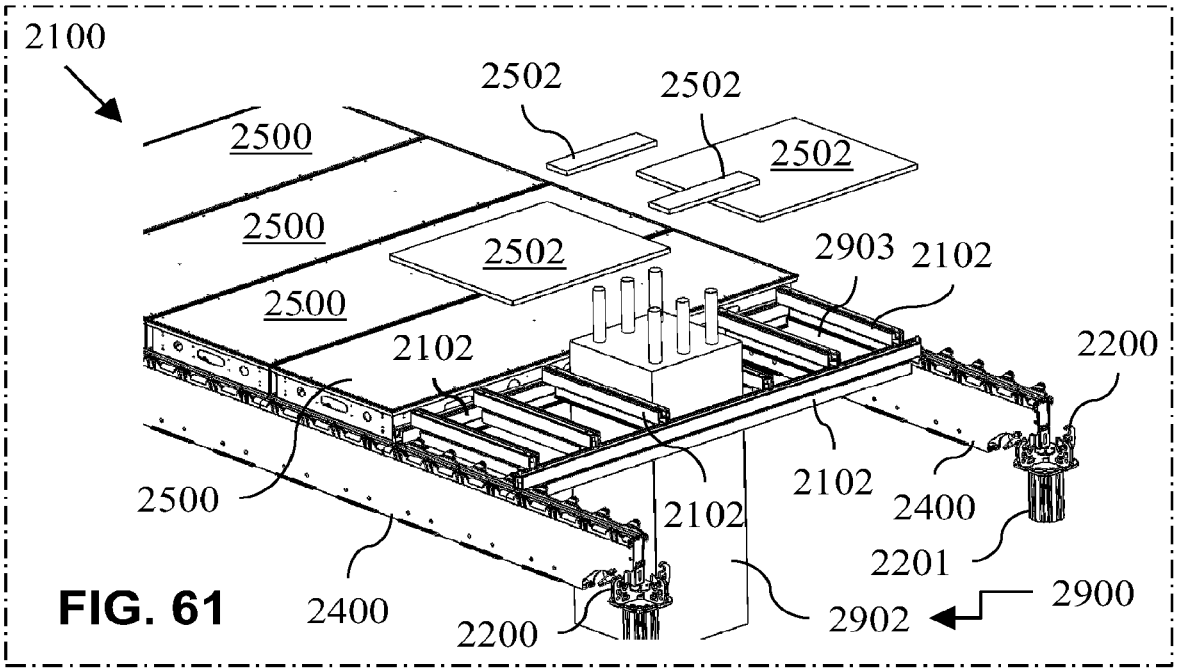
Figure 62:
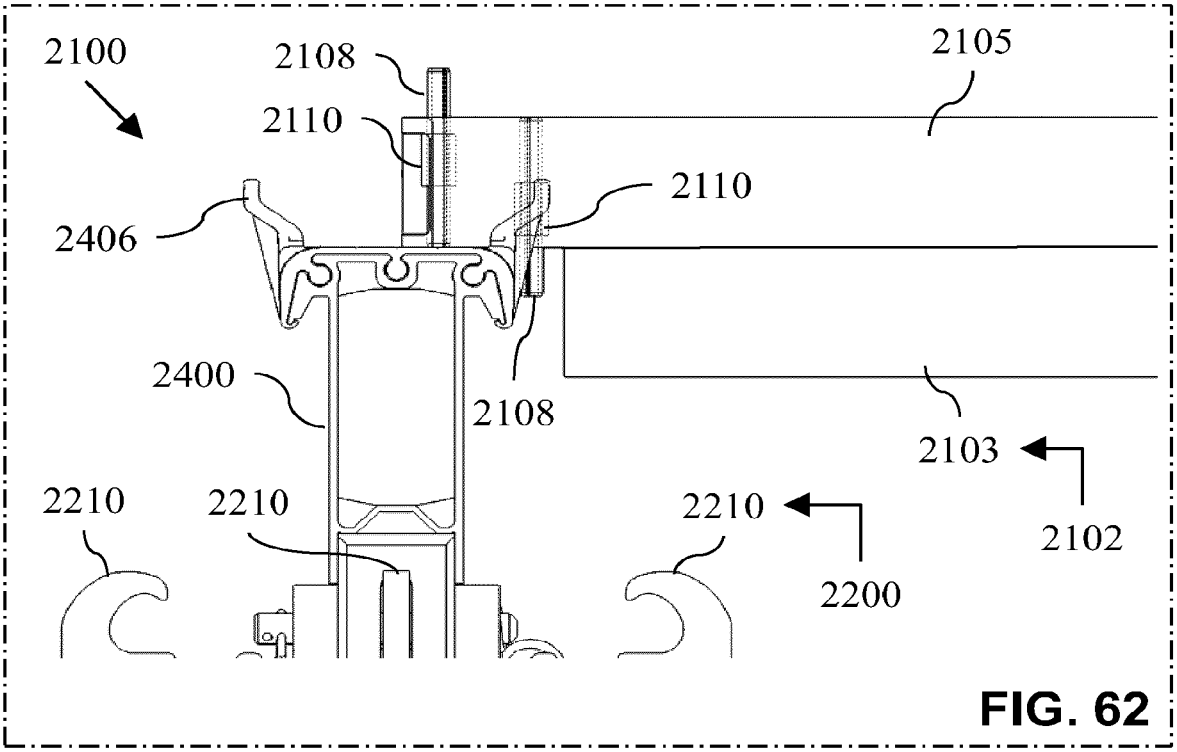
Figure 63:
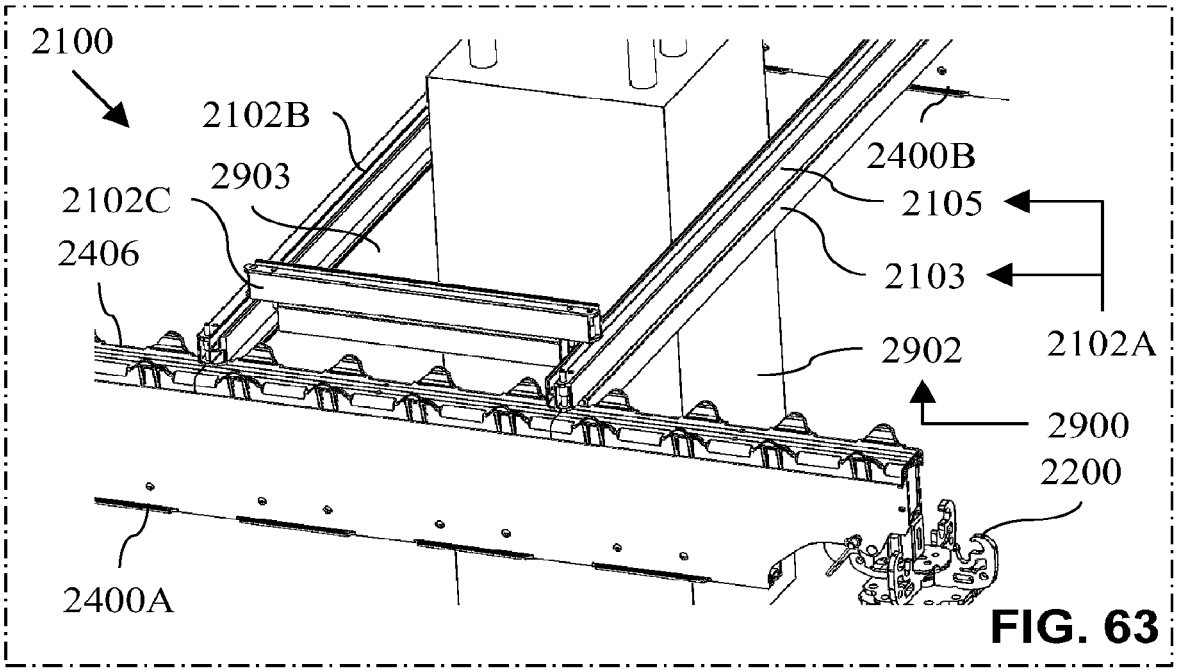
Figure 64:
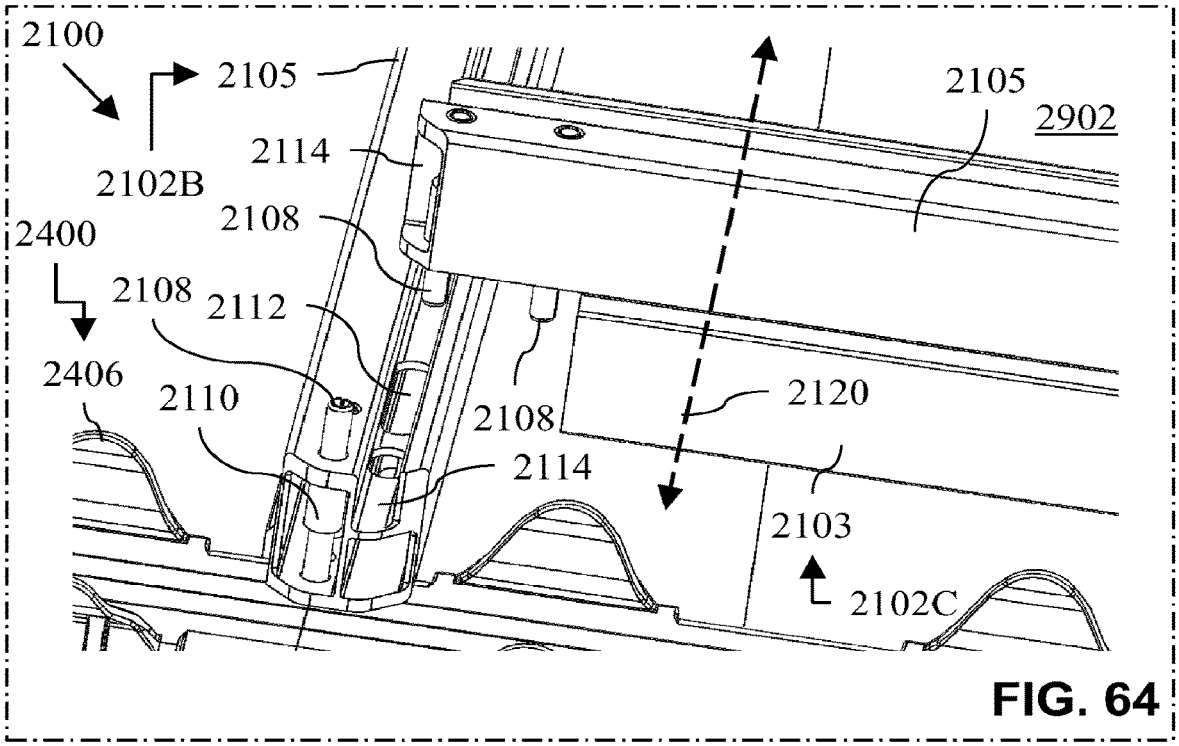
Figure 65:
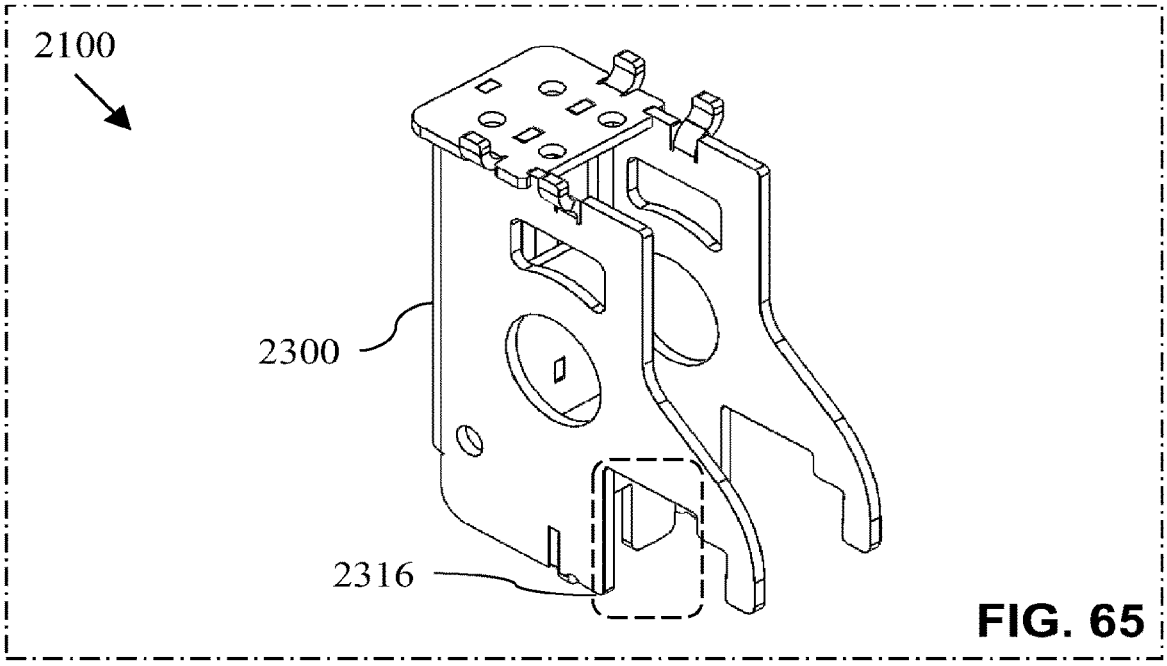
Figure 66:
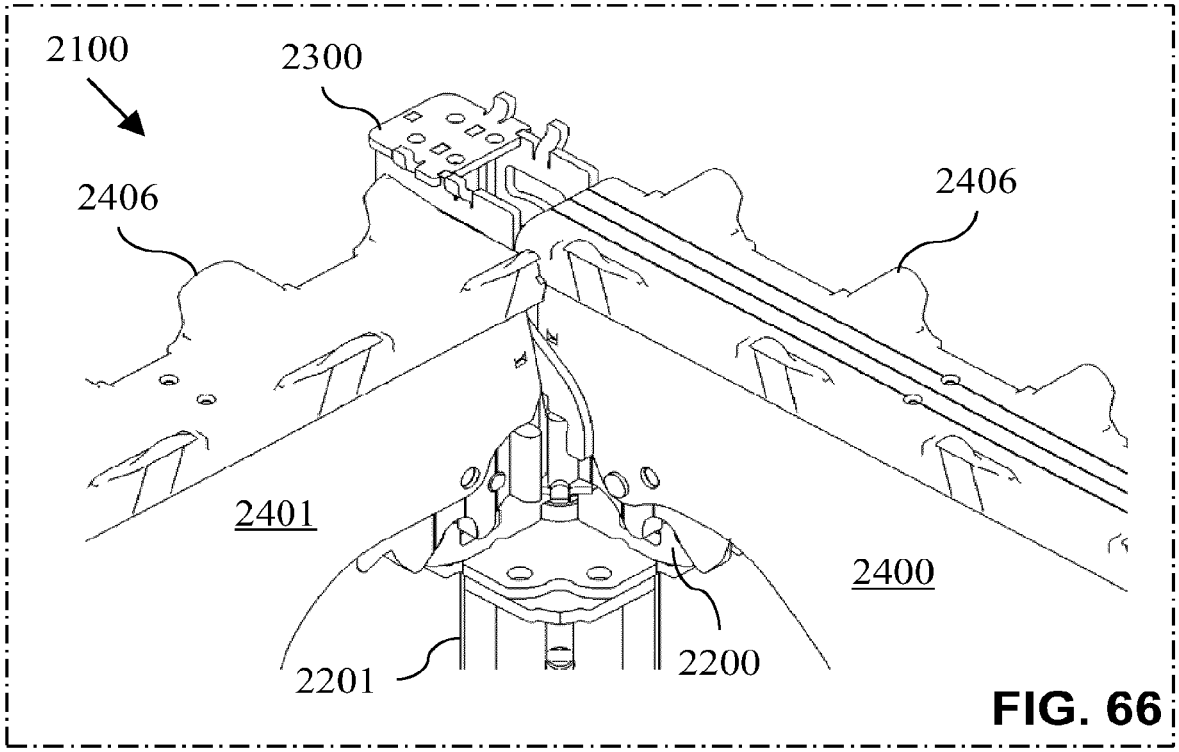
Figure 67:
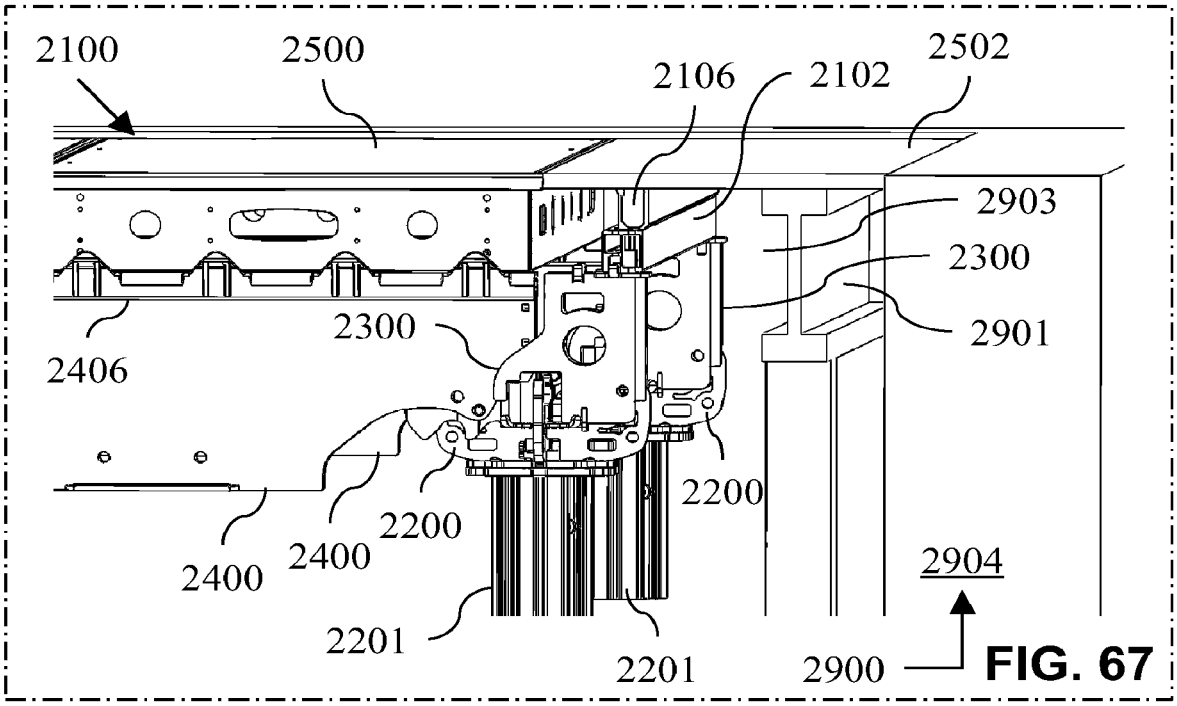
Figure 68:
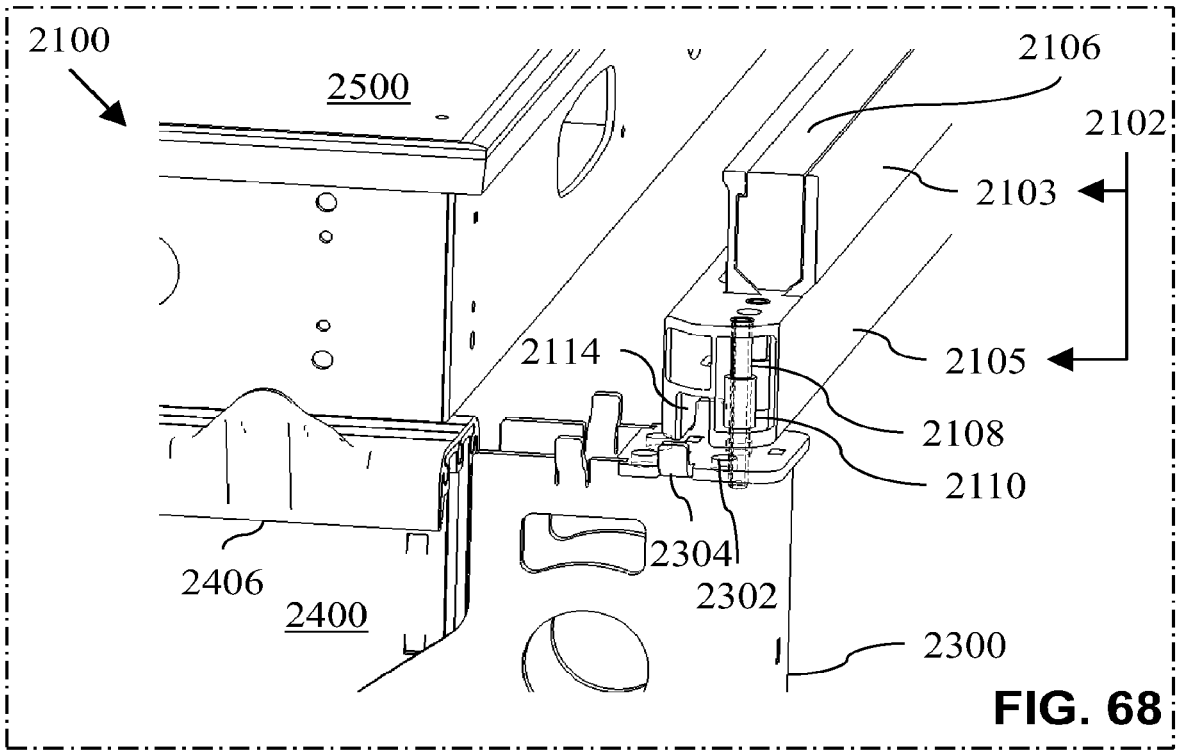
Figure 69:
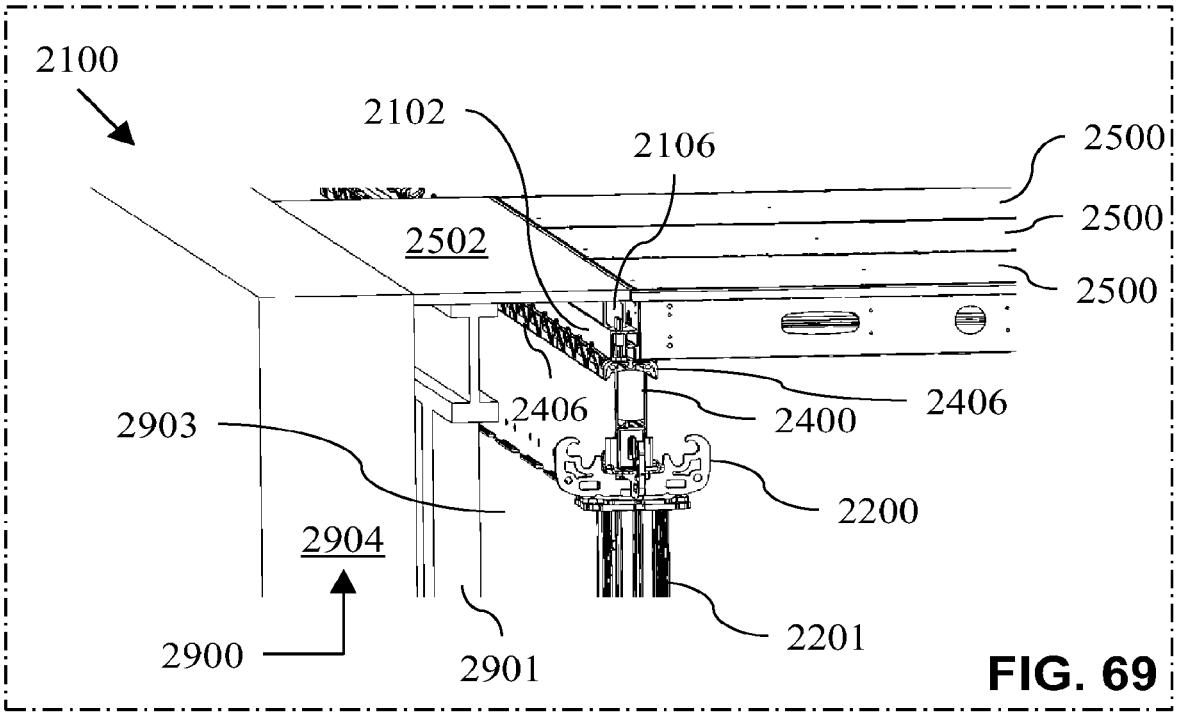
Figure 70:
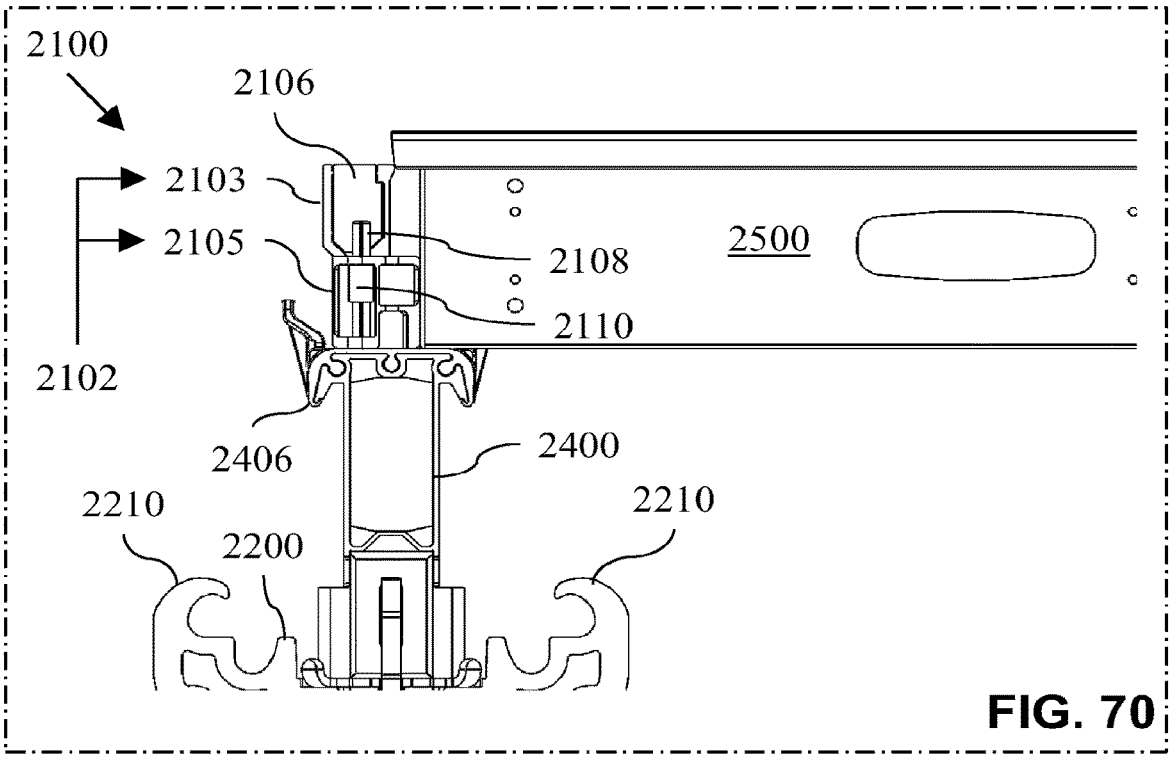
Figure 71:
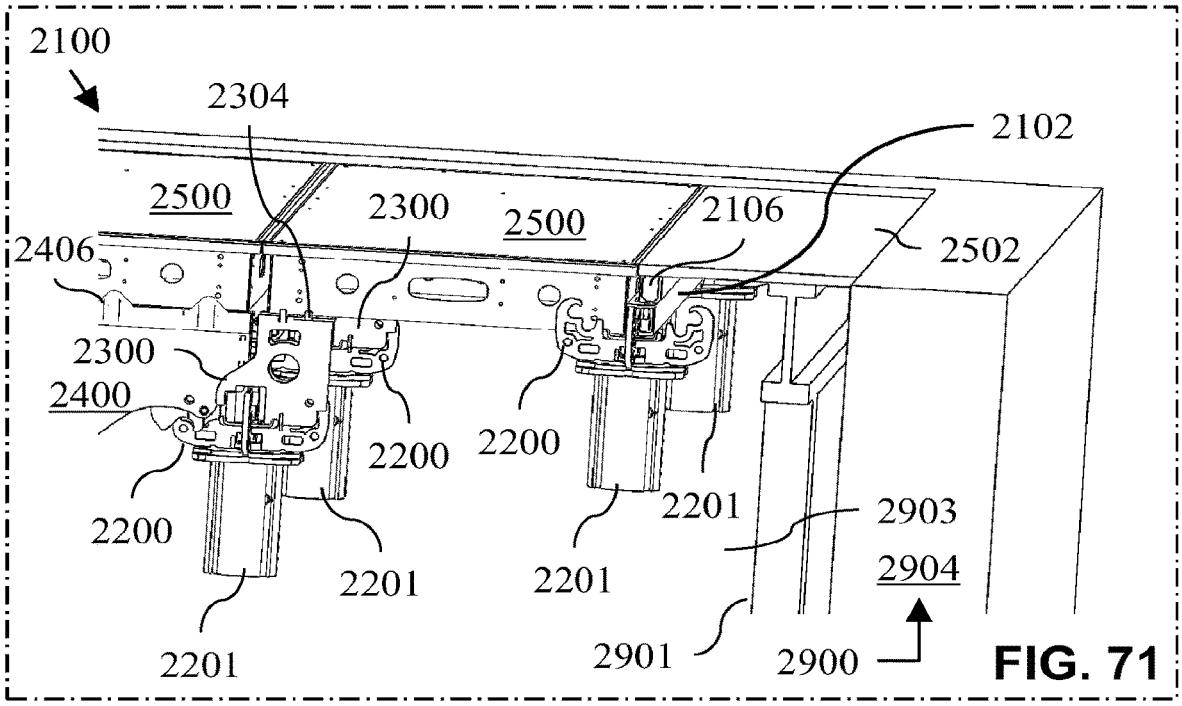
Figure 72:
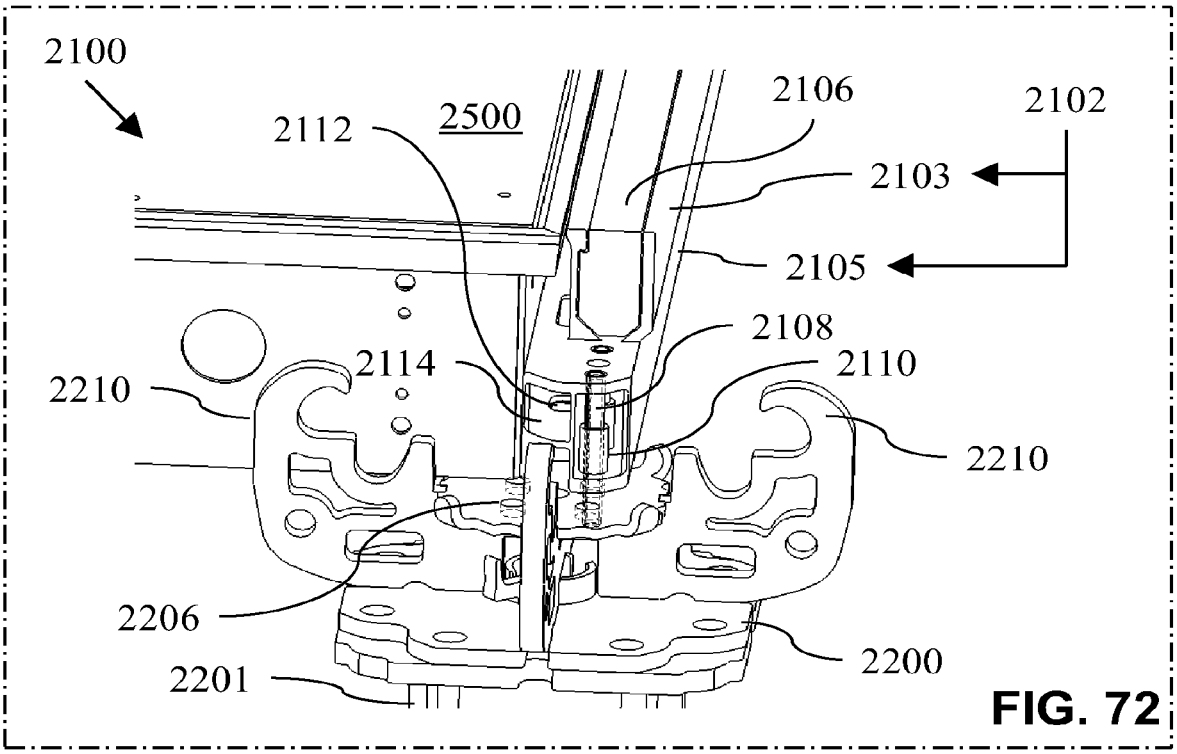
Figure 73:
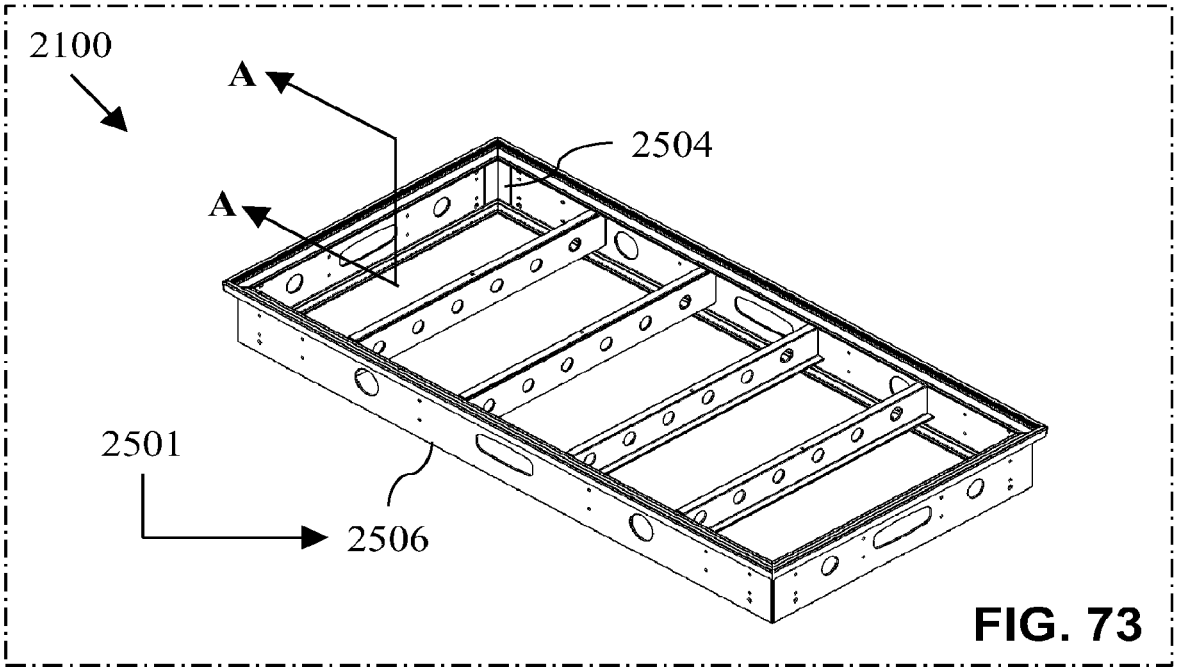
Figure 74:
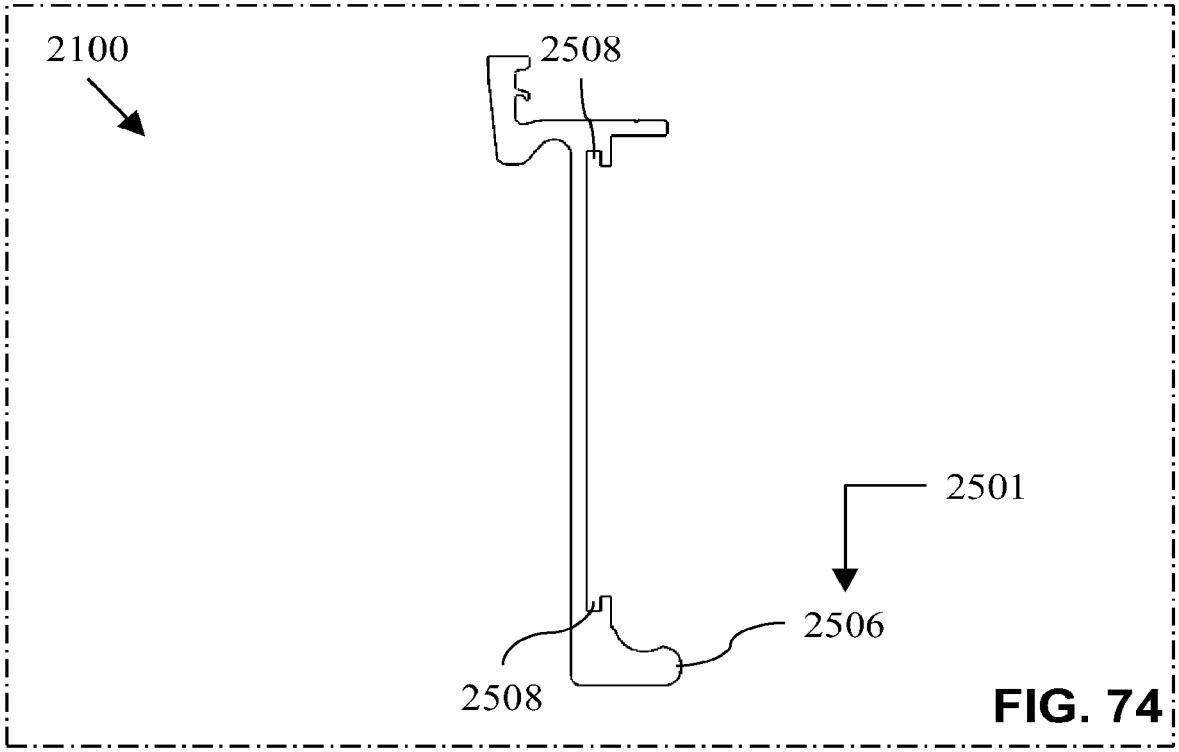
Figure 75:
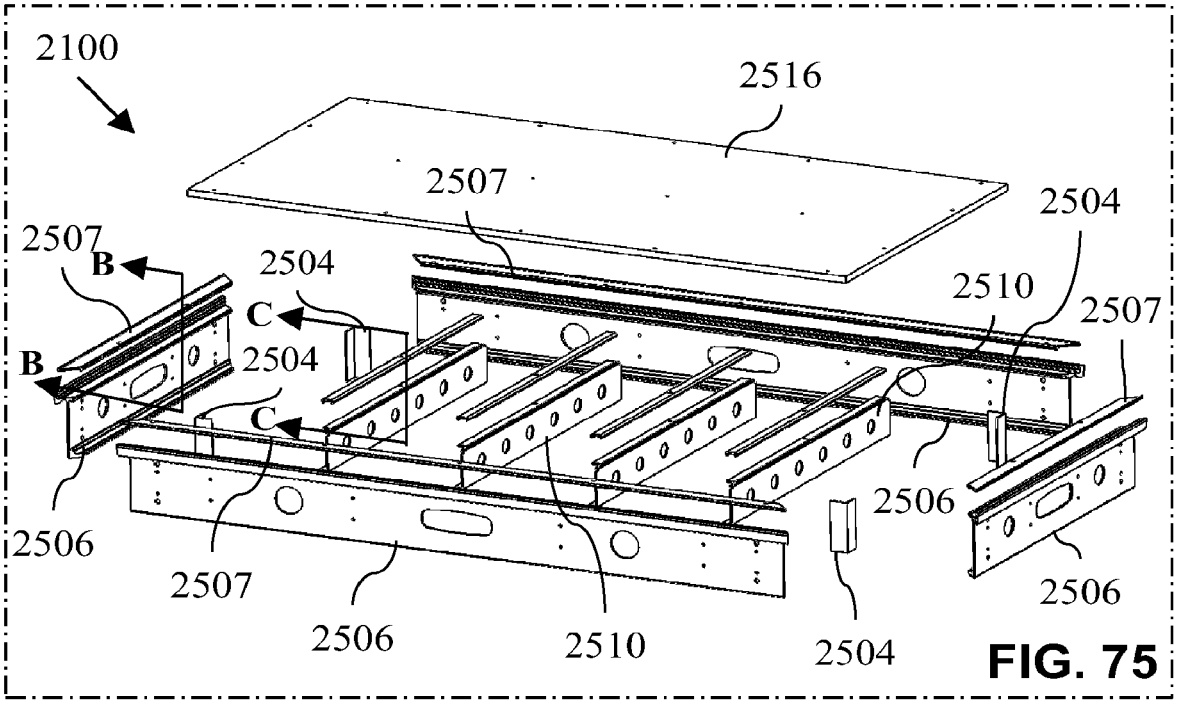
Figure 76:
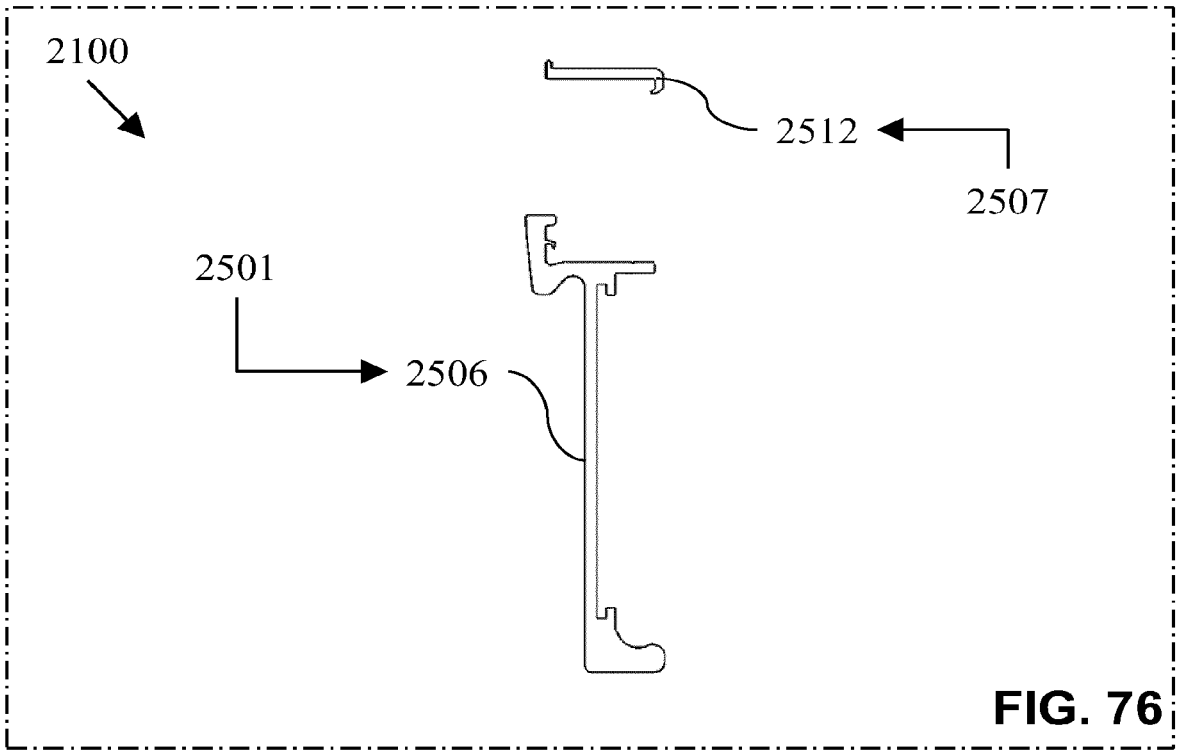
Figure 77:
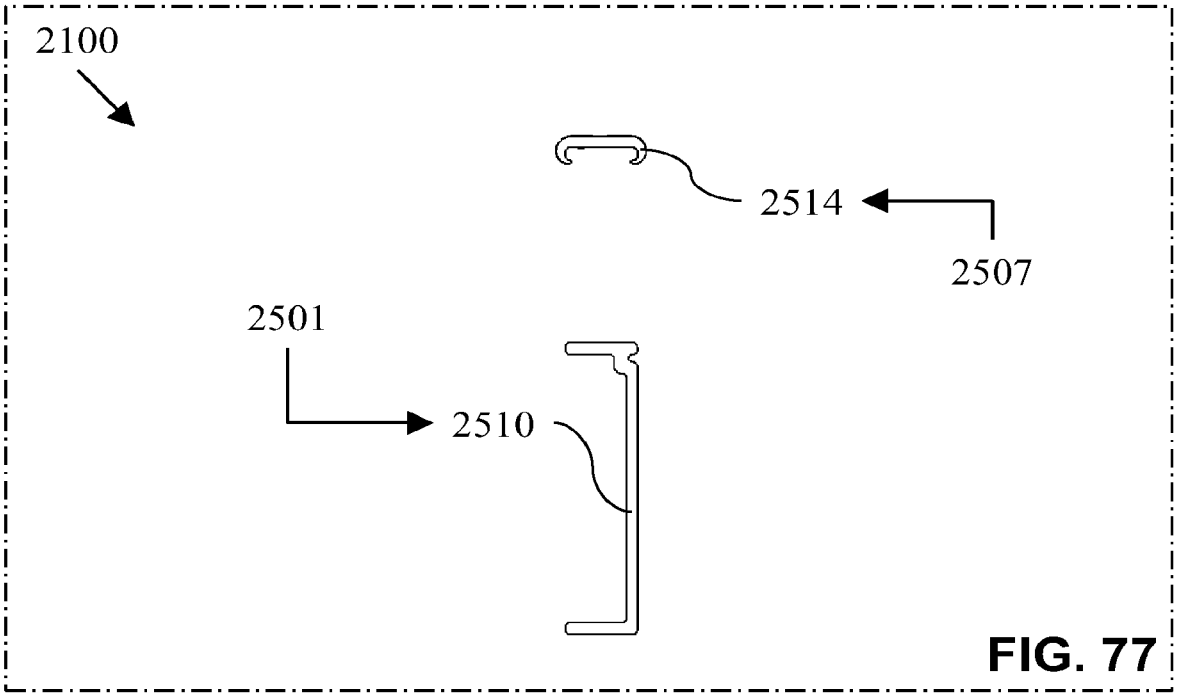
Figure 78:
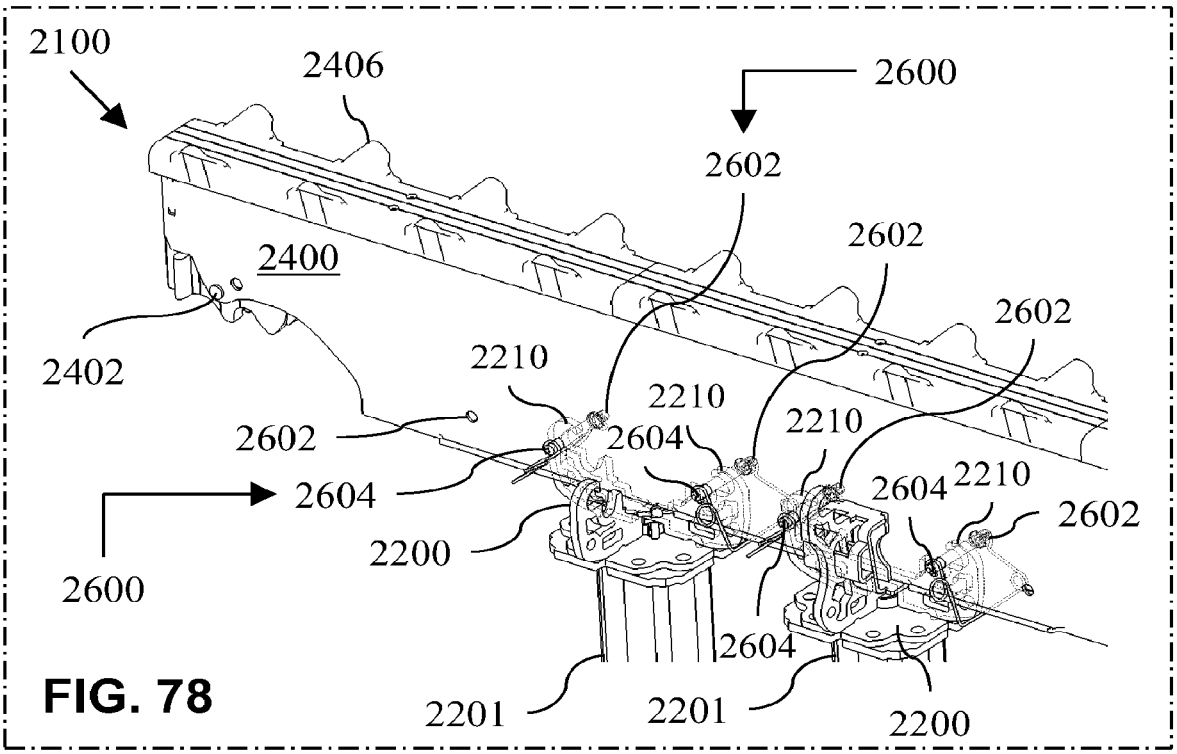
Figure 79:
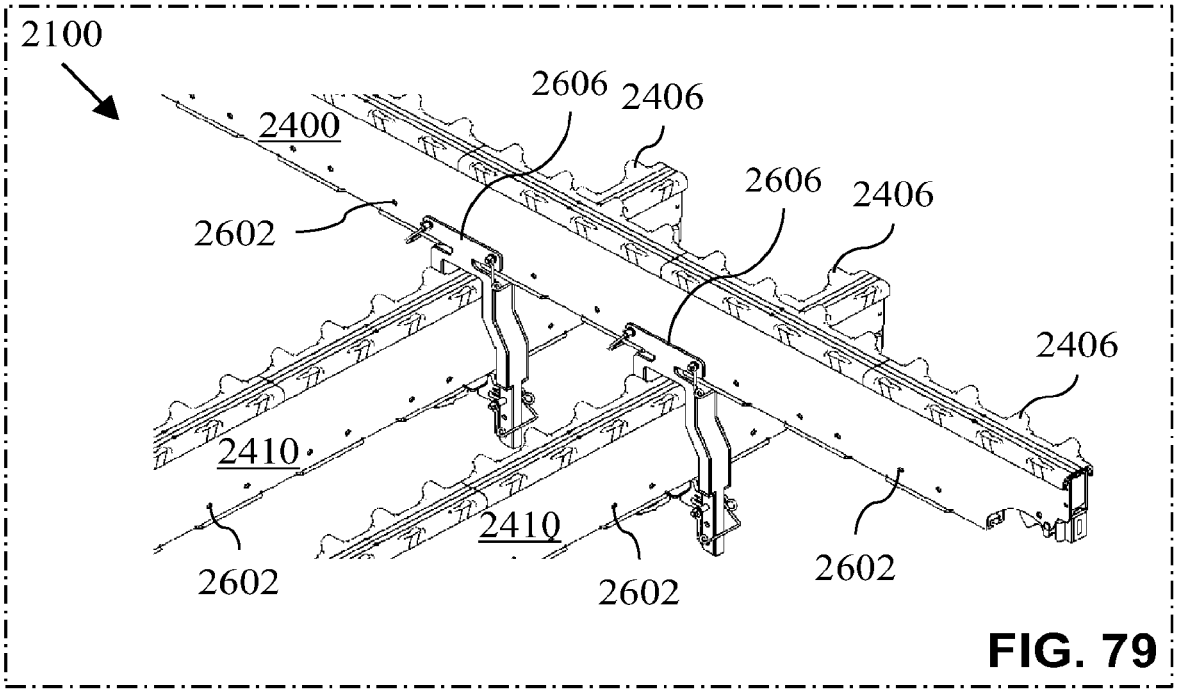
Figure 80:
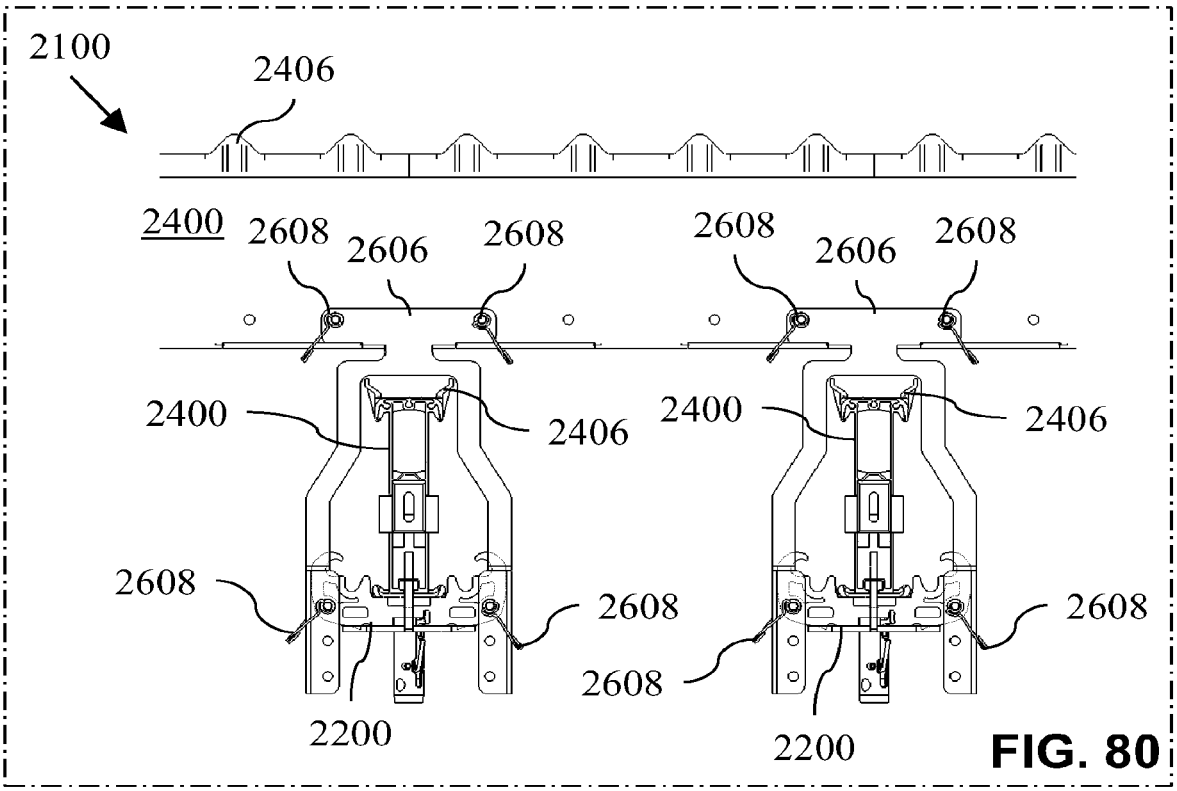

Brief Description of the Drawings (Associated with or Relates to Infill Beam and/or Other Construction Components The non-limiting embodiments may be more fully appreciated by reference to the following detailed description of the non-limiting embodiments when taken in conjunction with the accompanying drawings, in which:

FIG. 54 to FIG. 81, in general terms, relate to (are associated with) depictions of various views of embodiments of any one of (A) an infill beam; (B) a prop-head assembly; (C) a beam-end-support bracket; (D) a construction beam; (E) a premade panel; (F) a panel-frame assembly; (G) a beam-safety feature; and/or (H) a structure (such as a building, a bridge, etc.) having any one or more of the above listed items; and FIG. 54 depicts a perspective view of an embodiment of the apparatus including an infill beam; and FIG. 55 depicts a perspective view of an embodiment of a prop-head assembly, which may be used with the infill beam of FIG. 54; and FIG. 56 and FIG. 57 depict perspective views of embodiments of a beam-end-support bracket, which may be used with the infill beam of FIG. 54; and FIG. 58, FIG. 59 and FIG. 60 depict side views (side elevation views) of embodiments of the beam-end-support bracket of FIG. 56, which may be used with the prop-head assembly of FIG. 55; and FIG. 61 depicts a perspective view of an embodiment of the infill beam of FIG. 54; and FIG. 62 depicts a side view (side elevation view) of an embodiment of the infill beam of FIG. 54; and FIG. 63 depicts a perspective view of an embodiment of the infill beam of FIG. 54; and FIG. 64 depicts a perspective view (close-up perspective view) of an embodiment of the infill beam of FIG. 63; and FIG. 65 and FIG. 66 depict perspective views of embodiments of the beam-end-support bracket of FIG. 56; and FIG. 67 depicts a perspective view of an embodiment of the infill beam of FIG. 54; and FIG. 68 depicts a close-up perspective view of an embodiment of the infill beam of FIG. 67; and FIG. 69 and FIG. 70 depict a perspective view (FIG. 69) and a side view (FIG. 70) of an embodiment of the infill beam of FIG. 54; and FIG. 71 and FIG. 72 depict a perspective view (FIG. 71) and a close-up perspective view (FIG. 72) of embodiments of the infill beam of FIG. 54; and FIG. 73 depicts a perspective view (isometric view) of an embodiment of a panel-frame assembly (which may be utilized with, for instance, the infill beam depicted in FIG. 54, if so desired); and FIG. 74 depicts a cross-sectional view of a perimeter wall of the panel-frame assembly of FIG. 73; and FIG. 75 depicts an exploded view of the panel-frame assembly of FIG. 73; and FIG. 76 and FIG. 77 depict cross-sectional views of the panel-frame assembly of FIG. 75; and FIG. 78, FIG. 79 and FIG. 80 depict perspective views (FIG. 78 and FIG. 79) and a side elevation view (FIG. 80) of embodiments of a beam-safety feature of a construction beam; and FIG. 81 depicts a side view of an embodiment of the construction beam arranged in a vertically-stacked formation, one beam positioned over another.

The drawings are not necessarily to scale and may be illustrated by phantom lines, diagrammatic representations and fragmentary views. In certain instances, details unnecessary for an understanding of the embodiments (and/or details that render other details difficult to perceive) may have been omitted. Corresponding reference characters indicate corresponding components throughout the several figures of the drawings. Elements in the several figures are illustrated for simplicity and clarity and have not been drawn to scale. The dimensions of some of the elements in the figures may be emphasized relative to other elements for facilitating an understanding of the various disclosed embodiments. In addition, common, and well-understood, elements that are useful in commercially feasible embodiments are often not depicted to provide a less obstructed view of the embodiments of the present disclosure.

LISTING OF REFERENCE NUMERALS USED IN THE DRAWINGS (ASSOCIATED WITH OR RELATES TO INFILL BEAM AND/OR OTHER CONSTRUCTION COMPONENTS

2100 apparatus
2102 infill beam
2103 first elongated section
2104 beam-support surface
2105 second elongated section
2106 connection strip
2108 free-floating pins
2110 pin sleeve
2112 claw slot
2114 lengthwise channel
2120 linear direction
2200 prop-head assembly
2201 vertically-extending column
2202 beam-interaction member
2204 infill-beam interfacing feature
2206 pin receiver
2208 relief feature
2210 claw
2211 prop tab
2300 beam-end-support bracket

2302 beam-locating feature
2304 positioning feature
2306 anti-tipping feature
2308 lock-receiving feature
2310 first plate
2312 second plate
2314 separation feature
2316 location feature
2400 construction beam
2401 cross beam
2402 beam-engagement feature
2403 load
2404 distance
2406 rack
2407 rotation direction
2410 suspended construction beam
2412 flanges
2500 premade panel
2501 panel-frame assembly
2502 floor component
2504 corner reinforcement
2506 perimeter wall
2507 spacer elements
2508 opposite-wall channels
2510 intermediate walls
2512 perimeter-spacer element
2514 intermediate-spacer element
2516 panel
2600 beam-safety feature
2602 through-hole
2604 safety pin
2606 hanging-support bracket
2608 clamp assembly
2900 structure
2901 temporary support
2902 vertically-extending column
2903 gap
2904 vertically-extending wall

Detailed Description of the Non-Limiting Embodiment(s) (Associated with or Relates to Infill Beam and/or Other Construction Components The following detailed description is merely exemplary and is not intended to limit the described embodiments or the application and uses of the described embodiments. As used, the word "exemplary" or "illustrative" means "serving as an example, instance, or illustration." Any implementation described as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure. The scope of the claim is defined by the claims (in which the claims may be amended during patent examination after the filing of this application). For the description, the terms "upper," "lower," "left," "rear," "right," "front," "vertical," "horizontal," and derivatives thereof shall relate to the examples as oriented in the drawings. There is no intention to be bound by any expressed or implied theory in the preceding Technical Field, Background, Summary or the following detailed description. It is also to be understood that the devices and processes illustrated in the attached drawings, and described in the following specification, are exemplary embodiments (examples), aspects and/or concepts defined in the appended claims. Hence, dimensions and other physical characteristics relating to the embodiments disclosed are not to be considered as limiting, unless the claims expressly state otherwise. It is understood that the phrase "at least one" is equivalent to "a". The aspects (examples, alterations, modifications, options, variations, embodiments and any equivalent thereof) are described regarding the drawings. It should be understood that the invention is limited to the subject matter provided by the claims, and that the invention is not limited to the particular aspects depicted and described. It will be appreciated that the scope of the meaning of a device configured to be coupled to an item (that is, to be connected to, to interact with the item, etc.) is to be interpreted as the device being configured to be coupled to the item, either directly or indirectly. Therefore, "configured to" may include the meaning "either directly or indirectly" unless specifically stated otherwise.

FIG. 54 to FIG. 81, in general terms, relate to (are associated with) depictions of various views (such as perspective views, etc., and described in greater detail) of embodiments of any one of (A) an infill beam 2102; (B) a prop-head assembly 2200; (C) a beam-end-support bracket 2300; (D) a construction beam 2400; (E) a premade panel 2500; (F) a panel-frame assembly 2501; (G) a beam-safety feature 2600; and/or (H) a structure (such as a building, a bridge, etc.) having any one or more of the above listed items.

FIG. 54 depicts a perspective view of an embodiment of the apparatus 2100 including an infill beam 2102.

Referring to the embodiment as depicted in FIG. 54, the infill beam 2102 is cooperative with (configured to cooperate with, installable in cooperation with) at least one or more construction components. For instance, the construction component may include a construction beam 2400 (depicted in FIG. 58, FIG. 61 to FIG. 64 and FIG. 67 to FIG. 72), etc., and any equivalent thereof.

Referring to the embodiment as depicted in FIG. 54, the infill beam 2102 is cooperative with (configured to cooperate with, installable in cooperation with, span across, extend between) at least one construction component. The infill beam 2102 is cooperative with (configured to cooperate with, span across, extend between, above and/or below, at least in part) at least two or more construction components. In accordance with an embodiment, the infill beam 2102 is supportive of (configured to support, supports once installed accordingly, at least in part) a floor component 2502 (depicted in FIG. 61). The floor component 2502 is usable for filling in (configured to fill in, at least in part) a gap (space) formed between a construction component (such as, the infill beam 2102) and a structural feature (such as, a wall, a column, etc.) of a structure 2900 (depicted in FIG. 61). The floor component 2502 fills in, at least in part, the gap once the floor component 2502 is installed accordingly. The structure 2900 (such as, a building) is to undergo construction, on a floor-by-floor basis. It will be appreciated that the definition of the structure 2900 is be equivalent with, at least in part, the definition of the structure 700, etc., and any equivalent thereof.

Referring to the embodiments as depicted in FIG. 54, FIG. 61 and FIG. 63, the infill beam 2102 is installable (configured to be installed) relative to (under and/or adjacent to) at least one or more construction components (such as, a construction beam 2400 as depicted in FIG. 63). For instance, the construction component may include any one or more of a prop-head assembly 2200 (depicted in FIG. 55 and in other FIGS), a beam-end-support bracket 2300 (depicted in FIG. 56 and in other FIGS) and/or a construction beam 2400 (depicted in FIG. 58 and in other FIGS), etc., and any equivalent thereof.

Referring to the embodiment as depicted in FIG. 54 (and FIG. 61), the infill beam 2102 is supportive of (configured to support, at least in part) a floor component 2502 (depicted in FIG. 61). This is done once the infill beam 2102 is installed relative to at least one or more construction components. Preferably, the floor component 2502 includes a piece of plywood, filler plywood, a loose piece of filler plywood, a floor panel, a horizontal floor panel, a panel, etc., and any equivalent thereof. The floor component 2502 is utilized for the formation of a new floor of a structure 2900 (the structure 2900 is to be built or constructed, with reference to FIG. 61). Preferably, once the new floor is built (formed), and is safe to use, the floor component 2502 is removed (accordingly, along with other construction components). Once removed from the newly-formed floor, the floor component 2502 may be placed on (secured to and/or coupled to) another infill beam 2102, and then a new floor may be formed for the structure 2900, etc.

Referring to the embodiments as depicted in FIG. 54 and FIG. 61, the infill beam 2102 includes (provides or defines, and is not limited to) a beam-support surface 2104, and any equivalent thereof. The infill beam 2102 includes opposite lateral elongated sides (side sections). The beam-support surfaces 2104 are positioned on the opposite lateral sides of the infill beam 2102. The beam-support surfaces 2104 face away from each other. Any one of the beam-support surfaces 2104 is supportive of (is configured to support) the floor component 2502 (depicted in FIG. 61), etc. Once the floor component 2502 is positioned on the beam-support surface 2104, concrete may be poured on the floor component 2502. The concrete is poured, accordingly, for the purpose of forming, or the construction of, a new floor for the structure 2900, as depicted in FIG. 61.

Referring to the embodiments as depicted in FIG. 54 and FIG. 61, the floor component 2502 is utilized (deployed) for the case where it is required to cover (temporarily cover, or cover at least in part) an open area or a gap 2903 (depicted in FIG. 61) for the case where a premade panel 2500 cannot fit over (at least in part), cover (at least in part) and/or be positioned over (at least in part) the gap 2903. It will be appreciated that the premade panel 2500 includes (or is equivalent to, at least in part) the concrete slab 950 (depicted in FIG. 1), the first concrete-slab frame assembly 1110A (depicted in FIG. 33), etc. It will be appreciated that the premade panel 2500 (depicted in FIG. 61), the concrete slab 950 (depicted in FIG. 1), or the first concrete-slab frame assembly 1110A (depicted in FIG. 33) are treated as regular panels (that is, standard panels having a predetermined size) or premade panels that may not be suitably sized to fit over (at least in part) and/or cover (at least in part) the gap 2903. The gap 2903 is depicted in the embodiment of FIG. 61 and FIG. 63. Once the gap 2903 is covered by the floor component 2502, the construction of (formation of) a new floor may proceed. The new floor may be formed by pouring concrete over any one or more of the floor component 2502, the premade panel 2500, the concrete slab 950, or the first concrete-slab frame assembly 1110A, etc.). Preferably, once the new floor is formed, solidifies, and is safe to use, the floor component 2502, the premade panel 2500, the concrete slab 950, or the first concrete-slab frame assembly 1110A, are removed (along with other construction components, and a new floor may be then formed, etc.).

Referring to the embodiments as depicted in FIG. 61 and FIG. 66, for instance, the gap 2903 may span (extend) between the infill beam 2102 and (A) a vertically-extending wall 2904 (depicted in FIG. 67), and/or (B) a vertically-extending column 2902 (depicted in FIG. 61), etc.

Referring to the embodiment as depicted in FIG. 54, the infill beam 2102 is positionable (configured to be positioned) in specific spatial arrangements (orientations or configurations, etc.) relative to other construction components (and/or relative to a working surface). For instance, the infill beam 2102 is extendable (configured to span) between (across) adjacently-positioned construction beams 2400 (spaced-apart construction beams 2400), as depicted in FIG. 61 and FIG. 63. It will be appreciated that the construction beam 2400 may include (or is equivalent to, at least in part) the primary beam 802 (first horizontal construction beam assembly, as depicted in FIG. 3), the crossbeam 804 (also called the second horizontal construction beam assembly, as depicted in FIG. 4), and/or the first construction beam assembly 1106A (depicted in FIG. 31), etc.

Referring to the embodiment as depicted in FIG. 54, the infill beam 2102 provides technical features are connectable with (configured to couple, securely couple, loosely couple, etc.) the infill beam 2102 to at least one or more construction components. In accordance with an embodiment, the infill beam 2102 is extendable (configured to span between or across) adjacently-positioned infill beams 2102 (depicted in FIG. 63). In accordance with an embodiment, the infill beam 2102 is extendable (configured to span or extend between or across) adjacently-positioned beam-end-support brackets 2300 (as depicted in FIG. 67). In accordance with an embodiment, the infill beam 2102 is positionable (configured to be seated, fully seated or seated at least in part) on a top surface (top flat surface) of a construction beam 2400 (depicted in FIG. 69). In accordance with an embodiment, the infill beam 2102 is extendable (configured to span) between or across adjacently-positioned prop-head assemblies 2200 (depicted in FIG. 71).

Referring to the embodiment as depicted in FIG. 54, the infill beam 2102, preferably, includes a connection strip 2106. The connection strip 2106 includes an elongated connection strip, etc. The connection strip 2106 includes, preferably, a nailing section or a nailing strip, and any equivalent thereof. The connection strip 2106 includes a connectable material, such as wood, etc., and any equivalent thereof. The connectable material is reusable (configured to be reusable).

Referring to the embodiment as depicted in FIG. 54, the infill beam 2102 further includes a first elongated section 2103. The infill beam 2102 also includes a second elongated section 2105. The first elongated section 2103 and the second elongated section 2105 are attached (affixed to each other lengthwise from end-to-end). The infill beam 2102 may be spatially oriented and installed such that the first elongated section 2103 is located (positioned) vertically over the second elongated section 2105. Alternatively, the infill beam 2102 may be spatially oriented and installed such that the second elongated section 2105 is located (positioned) vertically over the first elongated section 2103 (where needed).

Referring to the embodiment as depicted in FIG. 54, the infill beam 2102 further includes free-floating pins 2108 (also called, beam-engagement members or spaced-apart free-floating pins). The free-floating pins 2108 are movable (configured to move, slidably movable) relative to the outer surfaces of the infill beam 2102 responsive to (in response to) the action of gravity acting on (urging movement of) the free-floating pins 2108 (depending on the spatial orientation of the infill beam 2102). The infill beam 2102 retains (is configured to retain) the free-floating pins 2108 within a limited range of movement while the free-floating pins 2108 are free to be movable (within a limited range of movement) in response to (responsive to) the action of gravity (depending on the spatial orientation of the infill beam 2102) acting on (pulling) the free-floating pins 2108. The infill beam 2102 houses (is configured to house) and retains (configured to retain) the free-floating pins 2108. The free-floating pins 2108 have a limited travel distance relative to the outer surfaces of the infill beam 2102. At one extent of travel (movement), the free-floating pins 2108 may extend, at least in part, beyond an exterior of the infill beam 2102 (depending on the spatial orientation of the infill beam 2102) to a first predetermined travel limit. The free-floating pins 2108 may retract, at least in part or fully, into the interior of the infill beam 2102 (depending on the spatial orientation of the infill beam 2102) so that the ends of the free-floating pins 2108 are at or below the exterior surface of the infill beam 2102. The interior of the infill beam 2102 is accommodates (is configured to accommodate or receive) a length of the free-floating pins 2108. The interior of the infill beam 2102 permits (is configured to permit) limited travel movement of the free-floating pins 2108 (between an extended position and a retracted position, as depicted in the embodiment of FIG. 62, for instance). The free-floating pins 2108 are spaced-apart from each other. The free-floating pins 2108 are adjacently-positioned. The free-floating pins 2108 are movable independently of each other. The free-floating pins 2108 are aligned parallel to each other. The free-floating pins 2108 are aligned 90 degrees relative to an elongated length of the infill beam 2102. A first pair of free-floating pins 2108 are positioned at (and mounted to) a first end of the infill beam 2102. A second pair of free-floating pins 2108 are positioned at (and mounted to) a second end of the infill beam 2102. The first pair of free-floating pins 2108 are spaced apart from the second pair of free-floating pins 2108. The free-floating pins 2108 are located on each of the opposite end sections of the infill beam 2102. The free-floating pins 2108 are movable (slide movable) independently of each other (depending on the spatial orientation or spatial movement of the infill beam 2102). For instance, the free-floating pins 2108 are freely movable once the infill beam 2102 is flipped over (that is, gravity is utilized to pull the free-floating pins 2108 according to the spatial orientation of the infill beam 2102).

Referring to the embodiment as depicted in FIG. 54, the free-floating pin 2108 includes a pin sleeve 2110. The pin sleeve 2110 is positioned (located) mid-section of the opposite end portions of the free-floating pin 2108. The infill beam 2102 defines (provides) corresponding pin holes (also called pin guideways) permits (configured to permit) the free-floating pin 2108 to freely move. The internal diameter of the corresponding pin hole (of the infill beam 2102) is larger than the external diameter of the free-floating pin 2108. The external diameter of the pin sleeve 2110 is larger than the external diameter of the free-floating pin 2108. The external diameter of the pin sleeve 2110 is larger than the internal diameter of the corresponding pin hole (of the infill beam 2102) thereby the pin sleeve 2110 is prevented from moving beyond a pin hole (of the infill beam 2102). The pin sleeve 2110 is sized (dimensioned) such that the pin sleeve 2110 cannot travel past the corresponding pin hole of the infill beam 2102. In this manner, the free-floating pin 2108 is slidably retained by the infill beam 2102. The free-floating pin 2108 may travel between two travel limits: an outer travel limit and an inner travel limit. The pin sleeve 2110 limits (is configured to limit) the vertical travel of the free-floating pins 2108 (this is done such that an end portion of the free-floating pin 2108 is positioned to become flush with an external surface (a beam extrusion surface) of the infill beam 2102 once the infill beam 2102 is spatially oriented accordingly). Once the infill beam 2102 is spatially oriented accordingly, the free-floating pin 2108 may freely travel to extend outwardly, to a predetermined limit of extent, from the exterior of the infill beam 2102, so that the retracted free-floating pin 2108 may interact with any other building component. Once the infill beam 2102 is spatially oriented accordingly, the free-floating pin 2108 may freely travel to extend inwardly, to a predetermined depth within the infill beam 2102 (away from the exterior of the infill beam 2102), so that the retracted free-floating pin 2108 does not interact with any other building component. The free-floating pin 2108 is interactable (is configured to interact) with other system components once the infill beam 2102 is spatially oriented accordingly. Preferably, the free-floating pin 2108 is interactable (is configured to interact) with other system components for the purpose of positioning, coupling or securing the infill beam 2102 with other construction components (once the infill beam 2102 is spatially oriented accordingly).

Referring to the embodiments as depicted in FIG. 54, FIG. 55 and FIG. 72, the infill beam 2102 further includes (defines) a claw slot 2112. The claw slot 2112 is receivable of (is configured to receive) a claw 2210 (depicted in FIG. 55) of the prop-head assembly 2200 (depicted in FIG. 55 and FIG. 72). For instance, the infill beam 2102 may be positioned to span between adjacently-positioned prop-head assemblies 2200 (as depicted in FIG. 72), thereby positioning (securely positioning) the infill beam 2102 on (with) the prop-head assembly 2200 (when desired or needed).

Referring to the embodiment as depicted in FIG. 54, the infill beam 2102 includes (defines) a lengthwise channel 2114 that extends between opposite end portions of the infill beam 2102. Preferably, the lengthwise channel 2114 extends along the entire length of the infill beam 2102 from end to end, and opens to the exterior of the infill beam 2102 (at the end sections of the infill beam 2102).

Referring to the embodiment as depicted in FIG. 54 and FIG. 63, for instance, the lengthwise channel 2114 is receivable of (configured to receive) (and to allow free movement of) the free-floating pin 2108 of another infill beam 2102 (as depicted in FIG. 63). This is done in such a way that the free-floating pin 2108 may move, at least in part, along a length of the lengthwise channel 2114.

Referring to the embodiment as depicted in FIG. 54 and FIG. 68, the lengthwise channel 2114, for instance, is also receivable of (configured to receive) a positioning feature 2304 of the beam-end-support bracket 2300 (as depicted in FIG. 68). The positioning feature 2304 may be called an extending tab, etc.

Referring to the embodiment as depicted in FIG. 54 and FIG. 72, for instance, the lengthwise channel 2114 is also receivable of (configured to receive) a claw 2210 (depicted in FIG. 55) of the prop-head assembly 2200 (depicted in FIG. 72).

FIG. 55 depicts a perspective view of an embodiment of a prop-head assembly 2200 for utilization with (cooperative with or configured to cooperate with) the infill beam 2102 of FIG. 54.

Referring to the embodiment as depicted in FIG. 55, the prop-head assembly 2200 includes a beam-interaction member 2202. The beam-interaction member 2202 may include a plate or an upper plate (and any equivalent thereof). The beam-interaction member 2202 is interactable with (configured to interact with) an infill beam 2102. It will be appreciated that the prop-head assembly 2200 may include (is similar to, or is equivalent to, at least in part) the prop-head assembly 102 (depicted in FIG. 2 or FIG. 8), and/or the prop-head assembly 1104 (depicted in FIG. 31).

Referring to the embodiment as depicted in FIG. 55, the beam-interaction member 2202 defines (provides) an infill-beam interfacing feature 2204. The infill-beam interfacing feature 2204 is interfaces (configured to interface) the prop-head assembly 2200 with an aspect of the infill beam 2102 (such as the free-floating pin 2108, etc.). For instance, the infill-beam interfacing feature 2204 may include any one or more of a pin receiver 2206. The pin receiver 2206 may include, for instance, a pin hole formed on a plate surface and/or a relief feature 2208, etc., and any equivalent thereof. The relief feature 2208 may include a plate relief, and/or a rounded relief. Preferably, the relief feature 2208 is formed on a peripheral edge of the beam-interaction member 2202. The pin receiver 2206 is spaced apart from the relief feature 2208. The relief feature 2208 is located (positioned) along the outer peripheral edge of beam-interaction member 2202. The pin receiver 2206 is receivable of (configured to receive), at least in part, the free-floating pin 2108 (FIG. 54) of the infill beam 2102 (once the free-floating pin 2108 is positioned and moved accordingly). The relief feature 2208 abuts (is configured to abut, at least in part) an outer diameter (outer shaft surface) of the free-floating pin 2108 of the infill beam 2102 (once the free-floating pin 2108 is positioned and moved accordingly).

Referring to the embodiment as depicted in FIG. 55, FIG. 71 and FIG. 72, for the case where it is required for the infill beam 2102 to span between (extend between) adjacently-positioned prop-head assemblies 2200 (depicted in FIG. 71 and FIG. 72), the infill-beam interfacing features 2204 are utilized to couple (locate) the free-floating pins 2108 of the infill beam 2102 with the prop-head assembly 2200, thereby the infill beam 2102 becomes secured (connected or coupled) to the prop-head assembly 2200 (once the infill-beam interfacing features 2204 locate the free-floating pins 2108. Preferably, the free-floating pin 2108 drops (via gravity) into the pin receiver 2206, etc., once the infill beam 2102 is suitably oriented to permit such action by gravity. The infill-beam interfacing feature 2204 is connectable (configured to couple or to locate) the free-floating pin 2108 of the infill beam 2102 with the prop-head assembly 2200.

Referring to the embodiment as depicted in FIG. 55, the prop-head assembly 2200 further includes a claw 2210. The claw 2210 extends outwardly and upwardly from a lower section of the prop-head assembly 2200. Preferably, the prop-head assembly 2200 includes a quantity of four (4) of the claws 2210 that are positioned at about ninety (90) degrees apart from each other (at right angles, or relative to each other). Each of the claws 2210 extend (upwardly) from the prop-head assembly 2200 (once the prop-head assembly 2200 is installed accordingly, as depicted).

Referring to the embodiment as depicted in FIG. 55, the prop-head assembly 2200 further includes a prop tab 2211 (also called a prop engagement feature or an extending tab). The prop tab 2211 is interactable with (configured to interact with) an aspect of (a technical feature of) the infill beam 2102 (depicted in FIG. 54), and/or to contact the side wall of the infill beam 2102 (if so desired), etc.

FIG. 56 and FIG. 57 depict perspective views of embodiments of a beam-end-support bracket 2300 for utilization with (configured to cooperate with) the infill beam 2102 of FIG. 54.

Referring to the embodiment as depicted in FIG. 56, the beam-end-support bracket 2300 is installable at (configured to be installed at, proximate to) a section (a portion) of the construction beam 2400 (as depicted in FIG. 58, FIG. 59, FIG. 60, FIG. 67 and FIG. 68). The beam-end-support bracket 2300 is installable at (configured to be installed at, proximate to) a section of a prop-head assembly 2200 (as depicted in FIG. 58, FIG. 59, FIG. 60 and FIG. 71).

Referring to the embodiment as depicted in FIG. 56, the infill beam 2102 is extendable (configured to span across or between) adjacently-positioned beam-end-support brackets 2300. Once the infill beam 2102 spans across (between) adjacently-positioned beam-end-support brackets 2300, the premade panel 2500 may be placed, at least in part, on a top surface of the infill beam 2102 (as depicted in FIG. 71). Preferably, the corner sections of the premade panel 2500 are placed at their respective beam-end-support bracket 2300.

Referring to the embodiment as depicted in FIG. 56, the beam-end-support bracket 2300 includes a beam-locating feature 2302. The beam-locating feature 2302 is connectable (configured to couple with, engage with) the infill beam 2102. Preferably, the beam-locating feature 2302 is receivable of (configured to receive, at least in part) at least one of the free-floating pins 2108 of the infill beam 2102 (once the infill beam 2102 is spatially oriented to permit gravity to pull the free-floating pins 2108 accordingly). Preferably, the beam-locating feature 2302 (of the beam-end-support bracket 2300) includes (defines) a locating hole formed in a plate. The locating hole is receivable of (is configured to receive, at least in part) the free-floating pin 2108 of the infill beam 2102.

Referring to the embodiment as depicted in FIG. 56 and FIG. 67, for the case where the infill beam 2102 is positioned to span across adjacently-positioned beam-end-support brackets 2300 (as depicted in FIG. 67), at least one of the free-floating pins 2108 of the infill beam 2102 is received into (is dropped into) the beam-locating feature 2302 of the beam-end-support bracket 2300. The free-floating pins 2108 are receivable by (configured to be received by or dropped into) the beam-locating feature 2302 of the beam-end-support bracket 2300. Preferably, the beam-locating feature 2302 includes at least one locating hole formed in (provided by) a plate of the beam-end-support bracket 2300. In this manner, the infill beam 2102 may be securely positioned to (coupled to) the beam-end-support brackets 2300, and thereby the infill beam 2102 is prevented from tipping over (from becoming inadvertently tipped over) (before a load is placed on the infill beam 2102). For instance, the infill beam 2102 may be deployed for the purpose of filling in the gap 2903 located proximate to the vertically-extending wall 2904 (also called a wall, etc.). The vertically-extending wall 2904 may be oriented parallel to a length of the infill beam 2102 (as depicted in FIG. 67). A longitudinal length of the vertically-extending wall 2904 is spaced apart from a longitudinal length of the infill beam 2102.

Referring to the embodiment as depicted in FIG. 56, the beam-end-support bracket 2300 further includes a positioning feature 2304. The positioning feature 2304 may include, for instance, a tab, an extended tab, etc., and any equivalent thereof. The positioning feature 2304 is fitted into (configured to fit into, engage with) the lengthwise channel 2114 of the infill beam 2102 (depicted in FIG. 54). The positioning feature 2304 locates (configured to locate or position) the infill beam 2102 (once the infill beam 2102 is installed to the beam-end-support bracket 2300). The positioning feature 2304 prevents (is configured to prevent) tipping of the infill beam 2102 once the infill beam 2102 is installed to the beam-end-support bracket 2300.

Referring to the embodiments as depicted in FIG. 56 and FIG. 71, the positioning feature 2304 is receivable of (is configured to receive), and spatially position, the premade panel 2500 for the case where a panel corner of the premade panel 2500 is required to be placed on the beam-end-support bracket 2300 (depicted in FIG. 71).

Referring to the embodiment as depicted in FIG. 57, the beam-end-support bracket 2300 includes an anti-tipping feature 2306. The construction beam 2400 is interactable with (configured to interact with) the infill beam 2102 (depicted in FIG. 54). The anti-tipping feature 2306 may include, for instance, at least one plate extending vertically (once the beam-end-support bracket 2300 is installed accordingly). It will be appreciated that several plates for the anti-tipping feature 2306 may be utilized if so desired.

Referring to the embodiment as depicted in FIG. 57 and FIG. 58, the anti-tipping feature 2306 is contactable with (is configured to contact, at least in part) the prop-head assembly 2200 (as depicted in FIG. 58). The anti-tipping feature 2306 may include an anti-tipping plate extending vertically (once the beam-end-support bracket 2300 is installed to the prop-head assembly 2200). Preferably, the anti-tipping feature 2306 includes a first plate 2310 (also called a first anti-tipping plate) and a second plate 2312 (also called a second anti-tipping plate) that is spaced apart from the first plate 2310 (depicted in FIG. 58). The anti-tipping feature 2306 prevents (is configured to prevent) tipping of the beam-end-support bracket 2300 relative to the prop-head assembly 2200 (once the beam-end-support bracket 2300 and the prop-head assembly 2200 are accordingly installed as depicted). In general terms, the anti-tipping feature 2306 facilitates (is configured to facilitate) spatial positioning of the beam-end-support bracket 2300 relative to the prop-head assembly 2200.

FIG. 58, FIG. 59 and FIG. 60 depict side views (side elevation views) of embodiments of the beam-end-support bracket 2300 of FIG. 56 utilized with the prop-head assembly 2200 of FIG. 55.

Referring to the embodiment as depicted in FIG. 58, it will be appreciated that the beam-end-support bracket 2300 of FIG. 56 may be utilized with (configured for utilization with) any type of prop-head assembly 102 associated, for instance, with the apparatus 100 (as depicted in FIG. 1) and/or the prop-head assembly 1104 the apparatus 1100 (as depicted in FIG. 31), and/or the prop-head assembly 2200 of FIG. 55, etc., and any equivalent thereof.

Referring to the embodiment as depicted in FIG. 58, a vertically-extending column 2201 is installed. Preferably, the vertically-extending column 2201 is installed to a working surface, which is known and not depicted in FIG. 58. The working surface is horizontally aligned (generally). Preferably, the vertically-extending column 2201 remains stationary (and extends vertically upward) once the vertically-extending column 2201 is fixedly installed to the working surface. The prop-head assembly 2200 is fixedly installed (configured to be fixedly installed, connected) to an upper end section of the vertically-extending column 2201 (preferably, once the vertically-extending column 2201 is fixedly installed to the working surface). The prop-head assembly 2200 is spaced apart from the working surface once the prop-head assembly 2200 is fixedly installed to the upper end section of the vertically-extending column 2201.

Referring to the embodiment as depicted in FIG. 58, a construction beam 2400 is placed (configured to be placed on, located on) a portion of (upper section of) the prop-head assembly 2200. The construction beam 2400 includes a beam-engagement feature 2402. The beam-engagement feature 2402 includes, for instance, a beam pin that extends from opposite lateral side surfaces (external surfaces of the opposite side walls) of the construction beam 2400, etc., and any equivalent thereof. The beam-engagement feature 2402 is placed on (configured to be placed on, located on) a portion (upper section) of the prop-head assembly 2200. The prop-head assembly 2200 and the vertically-extending column 2201, in combination, support (at least in part) the weight of the construction beam 2400 once the beam-engagement feature 2402 contacts (at least in part) a beam-locating feature of the prop-head assembly 2200. Preferably, the construction beam 2400 is aligned horizontally (preferably, at a zero-slope condition) (as depicted in the embodiment of FIG. 58) once the construction beam 2400 is installed, as depicted. It will be appreciated that the construction beam 2400 may be aligned non-horizontally (at a non-zero slope condition) once the construction beam 2400 is installed and is rotated (tilted, pivoted) accordingly.

Referring to the embodiment as depicted in FIG. 58, the beam-end-support bracket 2300 is positioned on (placed on) an upper section of the prop-head assembly 2200 so that the beam-end-support bracket 2300 extends upwardly from the prop-head assembly 2200 (once the beam-end-support bracket 2300 is positioned on and installed to the prop-head assembly 2200). The beam-end-support bracket 2300 may be fixedly connected to the prop-head assembly 2200 (if so desired) for improved security. The beam-end-support bracket 2300 is positioned adjacent to an end section of a construction beam 2400 (and the construction beam 2400 is positioned on the prop-head assembly 2200). In accordance with the embodiment of FIG. 58, the construction beam 2400 is aligned horizontally (preferably, at a zero-slope condition). It will be appreciated that the construction beam 2400 may be rotated so that the construction beam 2400 may be sloping upwardly (as depicted in FIG. 59) or may be sloping downwardly (as depicted in FIG. 60) by up to a predetermined value. The predetermined value may include a maximum permitted value, such as four (4) percent, etc.

Referring to the embodiment as depicted in FIG. 58, for the case where a load 2403 (also called an applied force) is applied to a section (such as, a back section) of the beam-end-support bracket 2300, the first plate 2310 and the second plate 2312 of the beam-end-support bracket 2300, in use, transfer the load 2403 to portions of the claw 2210 of the prop-head assembly 2200. In this manner or arrangement, the first plate 2310 and the second plate 2312 prevent (are configured to prevent) tipping of the beam-end-support bracket 2300 that may be caused by the application of the load 2403 to the back section of the beam-end-support bracket 2300. In this manner, the beam-end-support bracket 2300 is prevented from tipping over due to the eccentricity or a distance 2404 between (A) the center line extending through the prop-head assembly 2200, and (B) the position where the load 2403 is applied to the beam-end-support bracket 2300.

Referring to the embodiment as depicted in FIG. 58, the beam-end-support bracket 2300 further includes a lock-receiving feature 2308. Preferably, the lock-receiving feature 2308 includes a lock hole defined in (provided by) a portion of (a wall element, a side wall, etc.) of the beam-end-support bracket 2300. The lock-receiving feature 2308 is receivable of (is configured to receive, at least in part) a snap-lock spring device (known and not depicted). The lock-receiving feature 2308 may be utilized (installed to the lock-receiving feature 2308) for the case where it is required to fully secure (affix) the beam-end-support bracket 2300 against unwanted disengagement from the claw 2210 of the prop-head assembly 2200.

Referring to the embodiment as depicted in FIG. 58, the beam-end-support bracket 2300 further includes the anti-tipping feature 2306. Preferably, the anti-tipping feature 2306 has a first plate 2310 and a second plate 2312 that is spaced apart from the first plate 2310. The first plate 2310 contacts (is configured to contact) a first portion (such as, a higher portion or the claw 2210) of the prop-head assembly 2200 (once the beam-end-support bracket 2300 is installed to the prop-head assembly 2200). The second plate 2312 contacts (is configured to contact) a second portion (such as a, lower portion or a tab extending from a base plate) of the prop-head assembly 2200 (that is, once the beam-end-support bracket 2300 is installed to the prop-head assembly 2200). The second portion is spaced apart from the first portion of the prop-head assembly 2200. The first plate 2310 and the second plate 2312 prevent (are configured to prevent) lateral movement of the beam-end-support bracket 2300 (once the beam-end-support bracket 2300 is installed to the prop-head assembly 2200). The first plate 2310 and the second plate 2312, in combination, prevent (are configured to prevent) the beam-end-support bracket 2300 from moving (tipping, rotating, being kicked off) relative to the prop-head assembly 2200 (that is, once the beam-end-support bracket 2300 is installed to the prop-head assembly 2200).

Referring to the embodiment as depicted in FIG. 58, the beam-end-support bracket 2300 further includes a separation feature 2314. Preferably, the separation feature 2314 includes a shaped portion, an angled leg extension, an arm extension, etc., and any equivalent thereof. The separation feature 2314 separates (is configured to allow separation, movement or tilting) between the beam-end-support bracket 2300 and the construction beam 2400 (as further depicted in FIG. 59 and FIG. 60) for the case where the construction beam 2400 is required to be installed in a sloped condition (relative to the horizontal installation condition, as depicted in FIG. 58). It will be appreciated that the construction beam 2400 may be installed within a predetermined range of slopes, such as at a slope of about plus or minus four (4) percent (%) relative to the horizon (or horizontal).

Referring to the embodiment as depicted in FIG. 59, the construction beam 2400 is installed and is sloped upwardly (is rotated to slope upwardly). Preferably, the beam-engagement feature 2402 (also called a pin) includes a curved surface (such as, a curved outer surface of a pin, etc.,) that permits (is configured to permit) rotation of the construction beam 2400 relative to the prop-head assembly 2200 (once the pin is placed on a corresponding curved surface of a beam-locating feature and the construction beam 2400 is rotated accordingly). The construction beam 2400 is positioned on the prop-head assembly 2200, and is then rotated upwardly along a rotation direction 2407. The construction beam 2400 and the beam-end-support bracket 2300 do not interfere with each other once the construction beam 2400 is rotated upwardly along the rotation direction 2407. The construction beam 2400 is installed at (or is rotated to) a predetermined angle relative to the horizon, so that the construction beam 2400 may slope upwardly. For instance, the predetermined angle may include 2.3 degrees relative to the horizon. It will be appreciated that the beam-end-support bracket 2300 is not required for the purpose of tilting the construction beam 2400 (either upwardly or downwardly). The beam-end-support bracket 2300 is utilized (configured to be utilized) with the construction beam 2400 for the case where installing the construction beam 2400 is required at an aligned slope relative to the horizon. Preferably, the beam-engagement feature 2402 includes a beam pin extending from opposite sides (opposite lateral side walls) of the construction beam 2400, and any equivalent thereof. Preferably, the beam-engagement feature 2402 has a beam-engagement axis which is aligned perpendicularly to the construction-beam axis extending along a longitudinal length of the construction beam 2400. Preferably, the beam-engagement feature 2402 (the beam pin) includes a curved outer surface that is aligned orthogonally to the outer lateral side surfaces of the outer side walls of the construction beam 2400. Preferably, the beam-engagement feature 2402 of the construction beam 2400 contacts (is configured to contact, at least in part) the claw 2210 of the prop-head assembly 2200 (for the case where rotation of the construction beam 2400 is required beyond a predetermined sloped condition). The claw 2210 is a safety feature. The claw 2210 prevents (is configured to prevent) the construction beam 2400 from (A) inadvertently disengaging from (decoupling from) the prop-head assembly 2200 altogether, and (B) falling (downwardly) away from the prop-head assembly 2200. It will be appreciated that the beam-engagement feature 2402 contacts (is configured to contact, engage) with the claw 2210 of the prop-head assembly 2200 (once the construction beam 2400 is rotated or tilted beyond a predetermined condition or orientation). Preferably, contact between the beam-engagement feature 2402 and the claw 2210 prevent (are configured to prevent, at least in part) further rotation of the construction beam 2400 beyond a predetermined rotation condition.

Referring to the embodiment as depicted in FIG. 60, the construction beam 2400 is installed to the upper section of the prop-head assembly 2200, and is sloped downwardly (or is rotated or pivoted downwardly, etc., as the case may be). The construction beam 2400 may be rotated downwardly along a rotation direction 2407. The construction beam 2400 and the beam-end-support bracket 2300 do not interfere with each other once the construction beam 2400 is rotated downwardly along the rotation direction 2407.

FIG. 61 depicts a perspective view of an embodiment of the infill beam 2102 of FIG. 54.

Referring to the embodiment as depicted in FIG. 61, the infill beam 2102 is positioned proximate to a vertically-extending column 2902 of a structure 2900.

Referring to the embodiment as depicted in FIG. 61, it will be appreciated that, in accordance with a preferred embodiment, the apparatus 2100 is utilized as a temporary structure for the purpose of forming a floor (such as, a poured concrete floor) of the structure 2900. Once the floor is formed (by pouring concrete on the premade panel 2500, etc.), the apparatus 2100 (and/or the construction components) may be removed, and then relocated for the purpose of forming a new floor on the newly formed floor. In this manner, once the apparatus 2100 is deployed or installed on the newly formed floor, the structure 2900 is then further utilized in the formation of another new floor to be located over (above) the newly formed floor of the structure 2900, etc. It will be appreciated that the structure 2900 is similar to (or part of) the structure 700 of FIG. 1.

Referring to the embodiment as depicted in FIG. 61, the infill beam 2102 is deployed (positioned, installed or utilized) around a vertically-extending column 2902 of a structure 2900. The structure 2900 may include a building to be built, a bridge, etc., and any equivalent thereof. The vertically-extending column 2902 may include a supported structure, a horizontally aligned surface, a vertically aligned surface, a floor, an elevator shaft, etc., and any equivalent thereof. It will be appreciated that the vertically-extending column 2902 may include a solid structure (a solid wall), and/or may include a hollow structure (such as, an elevator shaft, etc.). A premade panel 2500 is positioned across (spans across) adjacently-positioned construction beams 2400. The premade panel 2500 is positionable (is configured to be positioned) across (to span across) adjacently-positioned construction beams 2400 (once positioned or placed on the adjacently-positioned construction beams 2400). The premade panel 2500 rests on the adjacently-positioned construction beams 2400. The adjacently-positioned construction beams 2400 support the weight of the premade panel 2500.

Referring to the embodiment as depicted in FIG. 61, for some cases, the premade panel 2500 is sized in such a way that the premade panel 2500 cannot be utilized for the purpose of placement over or spanning over a gap 2903. For instance, the gap 2903 is formed between (A) an outer edge (peripheral edge) of the premade panel 2500, and (B) an outer wall of the vertically-extending column 2902. The gap 2903 is sized (dimensioned) so that there is no way to accommodate placement of another premade panel 2500 in (over) the gap 2903 (thereby completing the formation of a floor surface on which poured concrete may be placed thereon for the purpose of forming a floor of the structure 2900). For this case, the infill beam 2102 may be utilized (installed or utilized) for the purpose of utilizing the premade panel 2500 that may fill in (cover) the gap 2903 (since the gap 2903 cannot be filled in or covered by placement of the premade panel 2500 over the gap 2903).

Referring to the embodiment as depicted in FIG. 61 and FIG. 67, it will be appreciated that for some cases, the premade panel 2500 is sized (dimensioned or has a foot print) in such a way that the premade panel 2500 cannot be placed or located for the purpose of spanning (covering) the gap 2903 (a space) that is formed between construction components. For instance, the gap 2903 may be formed up to the vertically-extending column 2902 (as depicted in FIG. 61), and/or up to a vertically-extending wall 2904 (as depicted in FIG. 67).

Referring to the embodiment as depicted in FIG. 61, the floor component 2502 may be used to fill in (cover) the gap 2903. For instance, the floor component 2502 is used to fill or cover (is configured to fill or cover), at least in part, in the gap 2903 (a space) located around a vertically-extending column 2902 of the structure 2900. The floor component 2502 may include loose, filler plywood pieces, etc., and any equivalent thereof. The floor component 2502 is placed onto an underlying network formed by the infill beams 2102 and/or other construction components.

Referring to the embodiment as depicted in FIG. 61, the infill beam 2102 may span between adjacently-positioned construction beams 2400. The infill beam 2102 may span between adjacently-positioned infill beams 2102, in which the adjacently-positioned infill beams 2102 span (extend) between the adjacently-positioned construction beams 2400. The free-floating pins 2108 of the infill beam 2102 may interact (couple) with the pin-compatible features located on other infill beams 2102 and/or other construction components (such as the construction beam 2400, etc.). The free-floating pin 2108 of the infill beam 2102 may drop (by gravity feed or by insertion into) into a pin-compatible feature located on other infill beams 2102 and/or other construction components. The free-floating pin 2108 of the infill beam 2102 may abut a pin-compatible feature located on other infill beams 2102 and/or other construction components.

FIG. 62 depicts a side view (side elevation view) of an embodiment of the infill beam 2102 of FIG. 54.

Referring to the embodiment as depicted in FIG. 62, the infill beam 2102 is interactable with (configured to interact with, couple to, connect to) the construction beam 2400. The infill beam 2102 is extended (configured to span) between (extend across) adjacently-positioned construction beams 2400 (once positioned accordingly). The construction beam 2400 may include any type of construction beam, such as a main beam and/or a cross beam, etc., and any equivalent thereof. The end section of the infill beam 2102 rests (is configured to rest or sit) on a top surface (such as, a rack 2406) of the construction beam 2400. Alternatively, a length of the infill beam 2102 may be positioned on a length of the rack 2406 of the construction beam 2400, etc.

Referring to the embodiment as depicted in FIG. 62, the rack 2406 is connectable (configured to be connected to, snap fit to) a top surface section of the construction beam 2400. The rack 2406 may include a plastic material formed by an extrusion process, etc., and any equivalent thereof. It will be appreciated that the rack 2406 includes (or is equivalent, at least in part to) (A) the frame-engagement device 954 (depicted in FIG. 3), and/or (B) the first beam-abutment feature 1108A (depicted in FIG. 31). The outer positioned free-floating pin 2108 (of the infill beam 2102) is raised (pushed) upwardly in response to the outer positioned free-floating pin 2108 making physical contact with the rack 2406 (such as, the top surface) of the construction beam 2400. The pin sleeve 2110 is movable for the purpose of contacting an upper interior edge surface of the infill beam 2102. The upper interior edge surface limits (stops) an upper movement (upward travel limit or travel) of the outer positioned free-floating pin 2108. The pin sleeve 2110 is movable (configured to be movable, slide movable, preferably by gravity feed) between two interior travel limits or interior stops, in which the interior stops are provided in the interior cavity of the infill beam 2102.

Referring to the embodiment as depicted in FIG. 62, the inner positioned free-floating pin 2108 of the infill beam 2102 is lowered (by gravity feed) downwardly (to a predetermined travel limit) since there is nothing to interfere with the limited free movement of the inner positioned free-floating pin 2108 (while the free-floating pin 2108 is moved to the predetermined travel limit). The pin sleeve 2110 (of the inner positioned free-floating pin 2108) contacts a lower interior edge (a travel limit) of the infill beam 2102. The lower interior edge of the infill beam 2102 limits (provides a travel limit) for the lower movement of the inner positioned free-floating pins 2108. The pin sleeve 2110 is movable (configured to be movable, slide movable, preferably by gravity feed) between the spaced-apart interior travel limits or spaced-apart stops, in which the spaced-apart stops are provided in the interior cavity of the infill beam 2102.

Referring to the embodiment as depicted in FIG. 62, the inner positioned free-floating pin 2108 of the infill beam 2102 limits (is configured to limit) the movement (provide a travel limit), such as left-to-right movement, of the infill beam 2102, etc. The inner positioned free-floating pin 2108 of the infill beam 2102 (along with the corresponding free-floating pin 2108 located on the other far end of the infill beam 2102 that is not shown in FIG. 62) are used for laterally positioning (locating) the infill beam 2102 between the two adjacently-positioned construction beams 2400. It will be appreciated that some left-to-right movement is permitted (allowed for tolerances). The inner positioned free-floating pins 2108 of the infill beam 2102 may sufficiently contact an aspect of (portion of) the construction beam 2400 (such as, the rack 2406) to limit the side-to-side movement of the infill beam 2102.

FIG. 63 depicts a perspective view of an embodiment of the infill beam 2102 of FIG. 54.

Referring to the embodiment as depicted in FIG. 63, the infill beam 2102 is interactable (is configured to interact with, couple to) the construction beam 2400. The infill beam 2102 and the construction beam 2400 are positioned proximate to the vertically-extending column 2902 of the structure 2900.

Referring to the embodiment as depicted in FIG. 63, two adjacently-positioned construction beams 2400A, 2400B (or the spaced-apart construction beams 2400A, 2400B) are aligned longitudinally parallel to each other. Two adjacently-positioned infill beams 2102A, 2102B are aligned longitudinally parallel to each other. Two adjacently-positioned infill beams 2102A, 2102B are mounted to, or positioned to, (span across) the two adjacently-positioned construction beams 2400A, 2400B. The infill beam 2102A spans across the construction beams 2400A, 2400B. The infill beam 2102B spans across the construction beams 2400A, 2400B. The lengthwise channels 2114 of the spaced-apart infill beams 2102A, 2102B are oriented to face upwardly (once the spaced-apart infill beams 2102A, 2102B are oriented for this purpose). The free-floating pins of the infill beam 2102A engage with (couple) the construction beams 2400A, 2400B. The free-floating pins of the infill beam 2102B engage with (couple) the construction beams 2400A, 2400B.

Referring to the embodiment as depicted in FIG. 63, the infill beam 2102C is also called a cross infill beam. The infill beam 2102C is positioned to span between (and contact and/or couple) the spaced-apart infill beams 2102A, 2102B. The lengthwise channel 2114 of the infill beam 2102C (cross infill beam) is oriented to face upwardly (once the infill beam 2102C is accordingly spatially oriented). The lengthwise channel 2114 of the two adjacently-positioned infill beams 2102A, 2102B receive (are configured to receive) respective free-floating pins 2108 of the infill beam 2102C (the cross infill beam).

FIG. 64 depicts a perspective view (close-up perspective view) of an embodiment of the infill beam 2102C of FIG. 63.

Referring to the embodiment as depicted in FIG. 64, the infill beam 2102C is interactable with (is configured to interact with, couple to) a neighboring infill beam 2102B (also called an adjacently-positioned infill beam). The neighboring infill beam 2102B is interactable with (configured to interact with, couple to) the construction beam 2400A (as depicted in FIG. 63).

Referring to the embodiment as depicted in FIG. 64, the free-floating pin 2108 (of the upper infill beam 2102C) is inserted (is dropped via gravity feed) into the lengthwise channel 2114 of the underlying infill beam 2102B (so that the free-floating pin 2108 thereby couples and positions the upper infill beam 2102C with the underlying infill beam 2102B). The upper infill beam 2102C may slide engage (back and forth) along a length of the lengthwise channel 2114 of the underlying infill beam 2102B. The upper infill beam 2102C may slide along a linear direction 2120 (as depicted in FIG. 64). The free-floating pin 2108 (of the upper infill beam 2102C) permits the upper infill beam 2102C to rotate by a limited amount of rotation (once the free-floating pin 2108 of the upper infill beam 2102C is coupled to the underlying infill beam 2102B) while the upper infill beam 2102C is moved (back and forth) along the linear direction 2120.

FIG. 65 and FIG. 66 depict perspective views of embodiments of the beam-end-support bracket 2300 of FIG. 56.

Referring to the embodiments as depicted in FIG. 65 and FIG. 66, the beam-end-support bracket 2300 is positioned (configured to be positioned) on the prop-head assembly 2200 (depicted in FIG. 66).

Referring to the embodiment as depicted in FIG. 65, the beam-end-support bracket 2300 further includes (provides) a location feature 2316. The location feature 2316 includes, for instance, a notch, an opening, and any equivalent thereof.

Referring to the embodiment as depicted in FIG. 65 and FIG. 66, the location feature 2316 (depicted in FIG. 65) facilitates (is configured to facilitate) positioning of the cross beam 2401 at right angles relative to the construction beam 2400; this is done once (A) the cross beam 2401 and the construction beam 2400 are positioned on, or mounted to, the prop-head assembly 2200, and (B) the beam-end-support bracket 2300 is installed to the prop-head assembly 2200. Preferably, the location feature 2316 (depicted in FIG. 65) ensures (is configured to ensure or facilitate) that the cross beam 2401 may cross the construction beam 2400 at the prop-head assembly 2200 (for the case where it is required to install the beam-end-support bracket 2300 to the prop-head assembly 2200).

FIG. 67 depicts a perspective view of an embodiment of the infill beam 2102 of FIG. 54.

Referring to the embodiment as depicted in FIG. 67, an end section of the infill beam 2102 is positioned on the beam-end-support bracket 2300 of FIG. 56. The beam-end-support bracket 2300 is positioned on a top section of the prop-head assembly 2200. The infill beam 2102 is also positioned proximate to (adjacent to) the vertically-extending wall 2904 of the structure 2900.

Referring to the embodiment as depicted in FIG. 67, the infill beam 2102 may be used (positioned, installed or utilized) for the case where the premade panel 2500 cannot be deployed or installed for the purpose of spanning (covering, at least in part) a gap 2903 (a space). The gap 2903 is located adjacent to, or proximate to, the vertically-extending wall 2904. For instance, the gap 2903 may be located (positioned) between the longitudinal edge of the infill beam 2102 and the longitudinal edge of the vertically-extending wall 2904. The vertically-extending wall 2904 is aligned parallel to the infill beam 2102. The floor component 2502 is placed or positioned on (at least in part) the infill beam 2102. The floor component 2502 extends toward the vertically-extending wall 2904 (once the floor component 2502 is positioned on (at least in part) the infill beam 2102). For instance, the floor component 2502 may be secured in place by nailing the floor component 2502 to the connection strip 2106 of the infill beam 2102 (if so desired).

Referring to the embodiment as depicted in FIG. 67, the infill beam 2102 spans between (extends between and contacts) the top sections of the adjacently-positioned beam-end-support brackets 2300. The adjacently-positioned beam-end-support brackets 2300 are positioned on respective adjacently-positioned prop-head assemblies 2200.

Referring to the embodiment as depicted in FIG. 67, a temporary support 2901 is installed to support at least one side of the floor component 2502 at a position located adjacent to (proximate to) the vertically-extending wall 2904, while another side of the floor component 2502 is supported, at least in part, by the infill beam 2102. Once a floor (formed with poured concrete, not depicted) is formed on the top surface of the floor component 2502, the temporary support 2901 is removed and redeployed for the purpose of forming another new floor, etc. In accordance with a preferred embodiment, once a new floor (formed with poured concrete) is formed on the top surface of the floor component 2502, and the new floor is safe to use, the floor component 2502 is removed and then redeployed for the purpose of forming another floor, etc.

FIG. 68 depicts a close-up perspective view of an embodiment of the infill beam 2102 of FIG. 67.

Referring to the embodiment as depicted in FIG. 68, the free-floating pins 2108 of the infill beam 2102 slide to engage with the beam-locating feature 2302 of the adjacently-positioned beam-end-support brackets 2300. The infill beam 2102 is positioned, with secured, or coupled placement, to adjacently-positioned beam-end-support brackets 2300 (to prevent tipping, or unwanted movement, of the infill beam 2102 once the infill beam 2102 is coupled to the adjacently-positioned beam-end-support brackets 2300). Preferably, the free-floating pins 2108 of the infill beam 2102 are dropped (slide moved), by gravity feed, into the beam-locating feature 2302 of the beam-end-support bracket 2300. The beam-locating feature 2302 may include, for instance, a locating hole formed in the plate of the beam-end-support bracket 2300. The lengthwise channel 2114 of the infill beam 2102 engages (couples) with the positioning feature 2304 of the beam-end-support bracket 2300. Preferably, the positioning feature 2304 includes, for instance, an extended tab extends (configured to extend), at least in part, into the lengthwise channel 2114 of the infill beam 2102 (once the infill beam 2102 is spatially positioned accordingly).

FIG. 69 and FIG. 70 depict a perspective view (FIG. 69) and a side view (FIG. 70) of an embodiment of the infill beam 2102 of FIG. 54.

FIG. 70 is a close-up side view of FIG. 69.

Referring to the embodiment as depicted in FIG. 69, the infill beam 2102 is positioned along a length of a top surface of the construction beam 2400. The infill beam 2102 is also positioned proximate to the vertically-extending wall 2904 of the structure 2900. The infill beam 2102 and the construction beam 2400 are aligned (parallel, at least in part) relative to the vertically-extending wall 2904.

Referring to the embodiment as depicted in FIG. 69, one side section of the floor component 2502 is placed (at least in part) on a top surface of the infill beam 2102. Preferably, one side section of the floor component 2502 is secured (that is, nailed) to the connection strip 2106 of the infill beam 2102. The infill beam 2102 rests fully on (is positioned on) the rack 2406 of the construction beam 2400. The infill beams 2102 are aligned parallel, spaced-apart, and coaxially with each other (once the infill beams 2102 are positioned on the construction beam 2400). Preferably, the construction beam 2400 receives the full weight of the infill beam 2102 (for this case).

Referring to the embodiment as depicted in FIG. 70, FIG. 70 depicts a close-up side view of FIG. 69. The infill beam 2102 is arranged (shaped) such that the first elongated section 2103 has a first side-profile that is positioned off-axis (vertically off-axis) relative to a second side-profile of the second elongated section 2105. The infill beam 2102 forms an overall side-profile having an asymmetrical arrangement (also called an asymmetrically shaped side-profile).

The asymmetrically shaped side-profile includes a combination of the first side-profile positioned adjacent to the second side-profile. Preferably, the first elongated section 2103 and the second elongated section 2105 are formed as a single extrusion. The asymmetrically shaped side-profile of the infill beam 2102 permits (is configured to permit) placement of the infill beam 2102 onto the top surface of the rack 2406 (preferably, placement between oppositely-located portions that extend from opposite sides of the rack 2406). The oppositely-located portions may be called ear portions, etc., and any equivalent thereof. The asymmetrically shaped side-profile of the infill beam 2102 is also permits (configured to permit) the placement of the infill beam 2102 against (at least in part) an outer peripheral edge section of the premade panel 2500. In this arrangement, the asymmetrically shaped side-profile of the infill beam 2102 permits the side-profile of the infill beam 2102 to fit within the available space and/or volume located above the rack 2406 and the premade panel 2500 (preferably, without interference from (or between) the infill beam 2102 and neighboring construction components).

FIG. 71 and FIG. 72 depict a perspective view (FIG. 71) and a close-up perspective view (FIG. 72) of embodiments of the infill beam 2102 of FIG. 54. FIG. 72 is a close-up side view of FIG. 71.

Referring to the embodiment as depicted in FIG. 71, the infill beam 2102 is positioned on a prop-head assembly 2200 of FIG. 55. The infill beam 2102 may be utilized for the case where (A) it is required to position or place the premade panel 2500 on a portion of the prop-head assembly 2200, and (B) a gap 2903 requires filling or covering. The gap 2903 may be formed and positioned between the premade panel 2500 and the vertically-extending wall 2904.

Referring to the embodiment as depicted in FIG. 71, a linear side of the premade panel 2500 is positioned to span across (between) the spaced-apart beam-end-support brackets 2300. A pair of corners of the premade panel 2500 are positioned on (at least in part) the spaced-apart beam-end-support brackets 2300. Another linear side (opposite linear side) of the premade panel 2500 is positioned to span across (between, at least in part) the spaced-apart prop-head assemblies 2200. Another pair of corners of the premade panel 2500 are positioned on the spaced-apart prop-head assemblies 2200. The infill beam 2102 is positioned to span across (between, at least in part) spaced-apart prop-head assemblies 2200. The infill beam 2102 is positioned proximate to the other linear side of the premade panel 2500. The infill beam 2102 is aligned (at least in part) parallel to the other linear side of the premade panel 2500. The gap 2903 is formed or located adjacent to a peripheral side of the premade panel 2500. Since the premade panel 2500 cannot be deployed to fill in the gap 2903, then (A) the infill beam 2102 may be installed (to span between the prop-head assemblies 2200), and (B) the floor component 2502 is positioned (at least in part) on the top surface of the infill beam 2102 to fill in (cover), at least in part, the gap 2903. The floor component 2502 is positioned to fill in (at least in part) the gap 2903 once the floor component spans from the infill beam 2102 to (toward) the vertically-extending wall 2904. The floor component 2502 may be affixed to the connection strip 2106 of the infill beam 2102 (if so desired, for added security).

Referring to the embodiment as depicted in FIG. 72, FIG. 72 depicts a close-up view of FIG. 71. The underside claw slots 2112 (the underside slots) of the infill beam 2102 receive (at least in part) the claw 2210 of the prop-head assembly 2200. In this manner, the infill beam 2102 engages (is configured to engage, couple), at least in part, with the prop-head assembly 2200. The lengthwise channel 2114 of the infill beam 2102 may receive (is configured to receive, at least in part) the claw 2210 of the prop-head assembly 2200. The free-floating pin 2108 of the infill beam 2102 is received (slide interested) into the pin receiver 2206 of the prop-head assembly 2200. Preferably, the free-floating pin

2108 of the infill beam 2102 is dropped (moved), via gravity feed, into the pin receiver 2206 of the prop-head assembly 2200.

Referring to the embodiment as depicted in FIG. 72, for the case where it is required to span (position), at least in part, the infill beam 2102 between adjacently-positioned prop-head assemblies 2200, the outer most positioned free-floating pins 2108 are inserted into the respective pin receivers 2206 formed in respective features (such as, plates) of the respective prop-head assemblies 2200. The outer most positioned free-floating pins 2108 are positioned on opposite sides of the infill beam 2102. It will be appreciated that the inner most positioned free-floating pins 2108 (positioned on opposite sides of the infill beam 2102) clear the respective plates of the prop-head assemblies 2200 (once the infill beam 2102 is mounted to or positioned on the respective plates of the prop-head assemblies 2200).

Referring to the embodiment as depicted in FIG. 72, for the case where it is required to span (position) the infill beam 2102 between adjacently-positioned prop-head assemblies 2200, the upper parts of the respective claws 2210 of the prop-head assemblies 2200 fit (at least in part) into (appropriately sized and positioned) underside claw slots 2112 formed in (provided by) the infill beam 2102. The upper parts of the respective claws 2210 of the prop-head assemblies 2200 fit (are configured to fit) into (at least in part) the underside claw slots 2112 formed in the infill beam 2102. This arrangement secures the infill beam 2102 from lateral movement and/or from tipping (relative to the prop-head assemblies 2200). The asymmetrically shaped side-profile (profile or extruded profile) of the infill beam 2102 ensures that the infill beam 2102 fits, without interference, into the available space located above the prop-head assembly 2200 and located adjacent to the premade panel 2500. The asymmetrically shaped side-profile of the infill beam 2102 clears the outer peripheral edge of the premade panel 2500 (once the infill beam 2102 is positioned on the prop-head assembly 2200).

FIG. 73 depicts a perspective view (isometric view) of an embodiment of a panel-frame assembly 2501. It will be appreciated that the panel-frame assembly 2501 may be utilized with, for instance, the infill beam 2102 depicted in FIG. 54, if so desired).

Referring to the embodiment as depicted in FIG. 73, preferably, the panel-frame assembly 2501 is utilized (at least in part) for forming (A) the concrete slab 950 (as depicted in FIG. 1), (B) the first concrete-slab frame assembly 1110A (as depicted in FIG. 33), (C) the premade panel 2500 (depicted in FIG. 61), and/or any equivalents thereof. It will be appreciated that the concrete slab 950 (as depicted in FIG. 1), the first concrete-slab frame assembly 1110A (as depicted in FIG. 33), and the premade panel 2500 (depicted in FIG. 61) are equivalent to each other. The panel-frame assembly 2501 is depicted with a top panel removed from a top section of the panel-frame assembly 2501 to improve the view of the interior aspects of the panel-frame assembly 2501. The top panel may include any suitable material, such as a plywood layer, and any equivalent thereof. The top panel is to be positioned at (and preferably secured to) the top section of the panel-frame assembly 2501. The panel-frame assembly 2501 includes a corner reinforcement 2504 (also called an inner corner reinforcement, etc., and any equivalent thereof). The corner reinforcement 2504 is positioned at (in) the respective corners (the four corners) of the panel-frame assembly 2501. Preferably, the corner reinforcement 2504 includes an angled L-bracket forming a ninety (90) degree interior angle between two panel sections extending from a merge line formed in the middle thereof. The panel-frame assembly 2501 includes inter-connectable structural members forming a peripheral rectangular-shaped frame with cross-frame members spanning opposite sides of (and securely connecting to) the peripheral rectangular-shaped frame. Preferably, the structural components of the panel-frame assembly 2501 are made (formed) with an aluminum alloy (for light weighting purposes), and any equivalent thereof (such as a composite material). The panel-frame assembly 2501 includes a perimeter wall 2506 extending along a length of the panel-frame assembly 2501.

FIG. 74 depicts a cross-sectional view of a perimeter wall 2506 of the panel-frame assembly 2501 of FIG. 73. The cross-sectional view is taken through a cross-sectional line A-A through the perimeter wall 2506 of the panel-frame assembly 2501 of FIG. 73.

Referring to the embodiment as depicted in FIG. 74, the panel-frame assembly 2501 includes a perimeter wall 2506. The perimeter wall 2506 may be called a perimeter rail, etc., and any equivalent thereof. The perimeter wall 2506 may be formed by an extrusion process, and may include a metal alloy, such as aluminum, or a light-weight material, and any equivalent thereof. The perimeter wall 2506 forms (provides) the opposite-wall channels 2508 each having an open mouth section facing each other. The opposite-wall channels 2508 are configured to slideably receive the opposite outer edges of the corner reinforcement 2504. A blade section of the corner reinforcement 2504 (also depicted in FIG. 75) is receivable into the opposite-wall channels 2508 of the perimeter wall 2506. Once the blade section of the corner reinforcement 2504 is received into the opposite-wall channels 2508, the corner reinforcement 2504 may be secured or attached to the perimeter wall 2506 of the panel-frame assembly 2501.

FIG. 75 depicts an exploded view of the panel-frame assembly 2501 of FIG. 73.

Referring to the embodiment as depicted in FIG. 75, a panel 2516 may include composite-wood material, a plywood material, and any equivalent thereof. Preferably, the panel 2516 has a thickness of about 12.0 millimeters (mm), etc. (within an acceptable degree of tolerance). The panel 2516 is positionable to (preferably, securable to) the top section of the panel-frame assembly 2501. The panel 2516 may be securely affixed to a top section of the panel-frame assembly 2501.

Referring to the embodiment as depicted in FIG. 75, for the case where the panel 2516 has a thickness of about 10.0 millimeters (mm), the panel 2516 may be accommodated (that is, fitted to the panel-frame assembly 2501) by the utilization of spacer elements 2507. The spacer elements 2507 are positioned between the panel 2516 (having a thickness of about 10.0 millimeters) and the upper section of the panel-frame assembly 2501. The spacer elements 2507 may include a plastic material, wood, metal, etc., and any equivalent thereof. The spacer elements 2507 may be positioned and connected (preferably, snap fitted for convenience) to top sections of the perimeter walls 2506 and/or the intermediate walls 2510 of the panel-frame assembly 2501. The intermediate walls 2510 may be called walls, rails, extruded walls, extruded rails, etc. Preferably, the spacer elements 2507 are snap fitted to the top portions of the perimeter walls 2506 of the panel-frame assembly 2501.

FIG. 76 and FIG. 77 depict cross-sectional views of the panel-frame assembly 2501 of FIG. 75.

FIG. 76 depicts a cross-sectional view of the perimeter wall 2506 of the panel-frame assembly 2501 of FIG. 75 (the cross-sectional view is taken through a cross-sectional line B-B through the perimeter wall 2506 of the panel-frame assembly 2501 of FIG. 75). FIG. 77 depicts a cross-sectional view of the intermediate wall 2510 of the panel-frame assembly 2501 of FIG. 75 (the cross-sectional view is taken through a cross-sectional line C-C through the intermediate wall 2510 of the panel-frame assembly 2501 of FIG. 75).

Referring to the embodiment as depicted in FIG. 76, the spacer element 2507 includes a perimeter-spacer element 2512. The perimeter-spacer element 2512 includes a snap-in plastic spacer, etc., and any equivalent thereof. The perimeter-spacer element 2512 is connectable to (configured to be connectable to, snap connected to) the top section of the perimeter wall 2506 of the panel-frame assembly 2501.

Referring to the embodiment as depicted in FIG. 77, the spacer element 2507 includes an intermediate-spacer element 2514. The intermediate-spacer element 2514 includes a snap-in plastic spacer, etc., and any equivalent thereof. The intermediate-spacer element 2514 is connectable (configured to be connectable to, snap connected to) a top section of the intermediate wall 2510 (also called intermediate rail) of the panel-frame assembly 2501.

FIG. 78, FIG. 79 and FIG. 80 depict perspective views (FIG. 78 and FIG. 79) and a side elevation view (FIG. 80) of embodiments of a beam-safety feature 2600 of a construction beam 2400.

Referring to the embodiment as depicted in FIG. 78, it will be appreciated that the combination of the beam-safety feature 2600 with the construction beam 2400 may be utilized with, for instance, the infill beam 2102 depicted in FIG. 54, if so desired).

Referring to the embodiment as depicted in FIG. 78, the construction beam 2400 includes, for instance, a main beam and/or a cross beam (any type of construction beam), and any equivalent thereof. The construction beam 2400 includes a beam-safety feature 2600. The beam-safety feature 2600 is positioned (configured to be positioned) along a bottom section of the construction beam 2400. The beam-safety feature 2600 is positioned (configured to be positioned) at a spaced-apart relationship from a top section of the construction beam 2400 (for instance, the top section of the construction beam 2400 receives the rack 2406). Preferably, the beam-safety feature 2600 includes a through-hole 2602 formed in the construction beam 2400. The through-hole 2602 extends between the opposite side walls of the construction beam 2400, and extends to the exterior of the construction beam 2400. The beam-safety feature 2600 includes a through-hole 2602 formed to pass through the vertically-extending side wall or walls of the construction beam 2400. Preferably, the beam-safety feature 2600 includes a series of through-holes 2602 (linearly aligned through-holes). The series of through-hole 2602 extends along a lower section of the construction beam 2400 (and extends between the opposite end sections of the construction beam 2400). The through-holes 2602 of the series are formed to pass through (between) the opposite side walls of the construction beam 2400. The series of through-holes 2602 is formed along a lateral length (along the bottom section) of the construction beam 2400.

Referring to the embodiment as depicted in FIG. 78, the beam-safety feature 2600 is configured to receive a safety pin 2604 (also called a snap lock pin). The beam-safety feature 2600 facilitates (is configured to facilitate, enable) engagement of the safety pin 2604 (also called a snap lock pin) through the construction beam 2400 and the claw 2210 of the prop-head assembly 2200. In this manner, the beam-safety feature 2600 may selectively lock the construction beam 2400 with the claw 2210 of the prop-head assembly 2200 (when desired). For instance, the beam-safety feature 2600 may selectively lock the construction beam 2400 with the claw 2210 of the prop-head assembly 2200 (when desired) at a position located between the end sections of the construction beam 2400. The beam-safety feature 2600 facilitate (is configured to facilitate) securement of the construction beam 2400 to the prop-head assembly 2200 that is situated underneath the construction beam 2400.

Referring to the embodiment as depicted in FIG. 79, the beam-safety feature 2600 is configured to receive and support a hanging-support bracket 2606 of any suitable shape and/or configuration. Preferably, the through-hole 2602 is configured to receive and support the hanging-support bracket 2606 from a pin that is received in the through-hole 2602. The through-holes 2602 are configured to receive respective pins for selectively connecting (coupling) the hanging-support brackets 2606 to (from) respective through-holes 2602. The hanging-support bracket 2606 supports (is configured to support) a weight, such as the weight of a suspended construction beam 2410. For instance, the suspended construction beam 2410 may run (be aligned) at about ninety (90) degrees to the alignment of the construction beam 2400 (if so desired). The hanging-support bracket 2606 may be used for the casting of concrete beams and/or concrete slab thickenings that sometimes exist as part of a building design (if so desired).

Referring to the embodiment as depicted in FIG. 80, the beam-safety feature 2600 further includes a clamp assembly 2608. The clamp assembly 2608 connects (is configured to selectively securely connect, clamp) the hanging-support bracket 2606 to a side wall of the construction beam 2400.

FIG. 81 depicts a side view of an embodiment of the construction beam 2400.

Referring to the embodiment as depicted in FIG. 81, the construction beams 2400 are configured to be arranged in (stacked in) a vertically-stacked formation, one construction beam 2400 positioned over another construction beam 2400. The vertically-stacked formation permits (facilitates) the transport of the construction beams 2400 to a construction site. The construction beam 2400 includes opposite flanges 2412 positioned on, and extending from, opposite lateral side walls of the construction beam 2400. A lateral axis 2413 extends from side to side of each (for each) construction beam 2400; each respective lateral axis 2413 is aligned parallel to each other once the construction beams 2400 are placed one over the other in the vertically-stacked formation (stacked transport formation).

Clauses (Associated with or Relates to Infill Beam and/or Other Construction Components)

The following clauses are offered as further description of the examples of the apparatus. Any one or more of the following clauses may be combinable with (A) any other one or more of the following clauses, and/or (B) with any subsection or a portion or portions of any other clause, and/or (C) any combination and permutation of clauses, and/or (D) as described in this application with or without any description that is not included in any specific clause. Any one of the following clauses may stand on its own merit without having to be combined with any other clause or with any portion of any other clause, etc. Clause (1): an apparatus, comprising an infill beam 2102 cooperative (configured to cooperate, at least in part) with at least one construction component, in which the construction component includes any one or more of a floor component 2502, a prop-head assembly 2200, a beam-end-support bracket 2300, and a construction beam 2400. Clause (2): the apparatus of Clause (1), wherein the infill beam 2102 includes: opposite lateral elongated sides; and beam-support surfaces 2104 positioned on the opposite lateral sides; and the beam-support surfaces 2104 face away from each other; and the beam-support surfaces 2104 supportive of (configured to support) a floor component 2502. Clause (3): the apparatus of Clause (1), wherein the infill beam 2102 is extendable (configured to span) between adjacently-positioned construction beams 2400. Clause (4): the apparatus of Clause (1), wherein the infill beam 2102 is extendable (configured to span) between, at least in part, (A) adjacently-positioned infill beams 2102; and (B) adjacently-positioned beam-end-support brackets 2300; and (C) adjacently-positioned prop-head assemblies. Clause (5): the apparatus of Clause (1), wherein the infill beam 2102 is positionable (seatable, is configured to be seated) on a top surface of a construction beam 2400. Clause (6): the apparatus of Clause (1), wherein the infill beam 2102 includes a connection strip 2106, a first elongated section 2103, and a second elongated section 2105 in which (A) the infill beam 2102 is spatially oriented and installed such that the first elongated section 2103 is located vertically over the second elongated section 2105, and in which (B) the infill beam 2102 is spatially oriented and installed such that the second elongated section 2105 is located vertically over the first elongated section 2103. Clause (7): the apparatus of Clause (1), wherein the infill beam 2102 includes free-floating pins 2108. Clause (8): the apparatus of Clause (1), wherein the infill beam 2102 includes free-floating pin 2108 including a pin sleeve 2110 having an outer diameter that is larger than the outer diameter of the free-floating pin 2108 (the pin sleeve 2110 may be positioned mid-section of the opposite end portions of the free-floating pin 2108). Clause (9): the apparatus of Clause (1), wherein the infill beam 2102 further includes a claw slot 2112 sized to receive (configured to receive) a claw 2210 of a prop-head assembly 2200. Clause (10): the apparatus of Clause (1), wherein the infill beam 2102 includes a lengthwise channel 2114 that extends between opposite end portions of the infill beam 2102, and the lengthwise channel 2114 is sized to receive (configured to receive) the free-floating pin 2108 of another infill beam 2102. Clause (11): the apparatus of Clause (1), wherein the infill beam 2102 includes a lengthwise channel 2114 sized to receive (configured to receive) a positioning feature 2304 of the beam-end-support bracket 2300. Clause (12): an apparatus, comprising a prop-head assembly 2200 including an infill-beam interfacing feature 2204 interactable (configured to interact) with an infill beam 2102. Clause (13): an apparatus, comprising a beam-end-support bracket 2300 installable (configured to be installed) (A) proximate to a section of a construction beam 2400, and/or (B) at a section of a prop-head assembly 2200.

Clause (14): an apparatus, comprising a construction beam 2400 interactable with (configured to interact with) an infill beam 2102. Clause (15): a construction beam 2400 includes a beam-safety feature 2600, in which the beam-safety feature 2600 is positionable (configured to be positioned) along a bottom section of the construction beam 2400. Clause (16): an apparatus, comprising a panel-frame assembly 2501 usable (configured to be utilized) with a construction beam 2400. Clause (17): an apparatus, comprising a panel-frame assembly 2501 usable (configured to be utilized) with an infill beam 2102. Clause (18): an apparatus, comprising a panel-frame assembly 2501 useable (configured to be utilized, at least in part) for forming a premade panel 2500. Clause (19): a premade panel 2500 includes a panel-frame assembly 2501. Clause (20): an apparatus, comprising a beam-safety feature 2600 of a construction beam 2400. Clause (21): an apparatus, comprising a construction beam 2400 having a beam-safety feature 2600. Clause (22): an apparatus, comprising a construction beam 2400 arrangeable (configured to be arranged in, stackable, stacked in) a vertically-stacked formation, one construction beam 2400 positioned over another construction beam 2400. Clause (23): an apparatus, comprising a structure (such as a building, a bridge, etc.) has any one or more of the items of the above clauses. Clause (24): an infill beam 2102 is supportive of (configured to support, at least in part) a floor component 2502, in which the floor component 2502 is extendable (configured to fill in) over a gap (space) formed between a construction component and a feature (such as a wall) of a structure.

Abstract (Associated with or Relates to Infill Beam and/or Other Construction Components)

Apparatus includes a construction component. With reference to the embodiments as depicted in FIG. 54 to FIG. 81, the construction component including any one or more of (A) an infill beam; (B) a prop-head assembly; (C) a beam-end-support bracket; (D) a construction beam; (E) a premade panel; (F) a panel-frame assembly; (G) a beam-safety feature; and/or (H) a structure (such as a building, a bridge, etc.) having any one or more of the above listed items; and, there is provided: (A) an infill beam 2102; (B) a prop-head assembly 2200; (C) a beam-end-support bracket 2300; (D) a construction beam 2400; (E) a premade panel 2500; (F) a panel-frame assembly 2501; (G) a beam-safety feature 2600; and/or (H) a structure (such as a building, a bridge, etc.) having any one or more of the above listed items.

Conclusion for all Detailed Descriptions

The following is offered as further description of the embodiments, in which any one or more of any technical feature (described in the detailed description, the summary and the claims) may be combinable with any other one or more of any technical feature (described in the detailed description, the summary and the claims). It is understood that each claim in the claims section is an open ended claim unless stated otherwise. Unless otherwise specified, relational terms used in these specifications should be construed to include certain tolerances that the person skilled in the art would recognize as providing equivalent functionality. By way of example, the term perpendicular is not necessarily limited to 90.0 degrees, and may include a variation thereof that the person skilled in the art would recognize as providing equivalent functionality for the purposes described for the relevant member or element. Terms such as "about" and "substantially", in the context of configuration, relate generally to disposition, location, or configuration that are either exact or sufficiently close to the location, disposition, or configuration of the relevant element to preserve operability of the element within the invention which does not materially modify the invention. Similarly, unless specifically made clear from its context, numerical values should be construed to include certain tolerances that the person skilled in the art would recognize as having negligible importance as they do not materially change the operability of the invention. It will be appreciated that the description and/or drawings identify and describe embodiments of the apparatus (either explicitly or inherently). The apparatus may include any suitable combination and/or permutation of the technical features as identified in the detailed description, as may be required and/or desired to suit a particular technical purpose and/or technical function. It will be appreciated that, where possible and suitable, any one or more of the technical features of the apparatus may be combined with any other one or more of the technical features of the apparatus (in any combination and/or permutation). It will be appreciated that persons skilled in the art would know that the technical features of each embodiment may be deployed (where possible) in other embodiments even if not expressly stated as such above. It will be appreciated that persons skilled in the art would know that other options would be possible for the configuration of the components of the apparatus to adjust to manufacturing requirements and still remain within the scope as described in at least one or more of the claims. This written description provides embodiments, including the best mode, and also enables the person skilled in the art to make and use the embodiments. The patentable scope may be defined by the claims. The written description and/or drawings may help to understand the scope of the claims. It is believed that all the crucial aspects of the disclosed subject matter have been provided in this document. It is understood, for this document, that the word "includes" is equivalent to the word "comprising" in that both words are used to signify an open-ended listing of assemblies, components, parts, etc. The term "comprising", which is synonymous with the terms "including," "containing," or "characterized by," is inclusive or open-ended and does not exclude additional, unrecited elements or method steps. Comprising (comprised of) is an "open" phrase and allows coverage of technologies that employ additional, unrecited elements. When used in a claim, the word "comprising" is the transitory verb (transitional term) that separates the preamble of the claim from the technical features of the invention. The foregoing has outlined the non-limiting embodiments (examples). The description is made for particular non-limiting embodiments (examples). It is understood that the non-limiting embodiments are merely illustrative as examples.

What is claimed is:

1. A structure for forming a floor of a construction component, the structure comprising:

a panel-frame assembly including:

a frame including:

a first structural member having opposing first and second ends; and a second structural member having opposing first and second ends, the first and second structural members being connected to one another at a junction formed between the first ends of the first and second structural members, the first ends of the first and second structural members being positioned at an angle relative to one another; and a first corner reinforcement bracket secured to the junction, wherein the first end of the first structural member includes:

a top end portion defining an upper channel configured for receipt of a top end portion of the first corner reinforcement bracket; and a bottom end portion defining a lower channel configured for receipt of a bottom end portion of the first corner reinforcement bracket;

a top panel supported on the frame of the panel-frame assembly; and a concrete slab supported on the top panel.

2. The structure according to claim 1, wherein the first corner reinforcement bracket is L-shaped and devoid of fastener holes.

3. The structure according to claim 1, wherein the first corner reinforcement bracket has a height that extends from an upper end section of the frame to a lower end section of the frame.

4. The structure according to claim 1, wherein the first corner reinforcement bracket includes a pair of first and second panel sections merged with one another to form a ninety-degree angle therebetween.

5. The structure according to claim 1, wherein the first reinforcement bracket is slidably received in the upper and lower channels.

6. The structure according to claim 1, wherein the first end of the second structural member includes:

a top end portion defining an upper channel; and a bottom end portion defining a lower channel.

7. The structure according to claim 6, wherein the first corner reinforcement bracket includes a pair of first and second panel sections merged with one another to form a ninety-degree angle therebetween, the first panel section being received in the upper and lower channels of the first end of the first structural member, and the second panel section being received in the upper and lower channels of the first end of the second structural member.

8. The structure according to claim 1, wherein the first corner reinforcement bracket is in flush engagement with an inner-facing side of each of the first ends of the first and second structural members.

9. The structure assembly according to claim 1, wherein the frame includes:

a third structural member positioned parallel with the first structural member and having opposing first and second ends, the first end of the third structural member connected to the second end of the second structural member; and a fourth structural member positioned parallel with the second structural member and having opposing first and second ends, the first end of the fourth structural member being connected to the second end of the first structural member and the second end of the fourth structural member being connected to the second end of the third structural member.

10. The structure according to claim 9, further comprising:

a second corner reinforcement bracket secured to a junction between the second end of the second structural member and the first end of the third structural member;

a third corner reinforcement bracket secured to a junction between the second end of the third structural member and the second end of the fourth structural member; and a fourth corner reinforcement bracket secured to a junction between the second end of the first structural member and the first end of the fourth structural member.

11. The structure according to claim 9, further comprising a plurality of cross-frame members extending between the first and third structural members.

12. The structure according to claim 1, further comprising a plurality of spacer elements snap-fitted to an upper end section of the frame, wherein the plurality of spacer elements are configured to support the top panel above the upper end section of the frame.

13. A structure for forming a floor of a construction component, the structure comprising:

a pair of adjacently-positioned construction beams;

a panel-frame assembly positioned across the pair of adjacently-positioned construction beams, the panel-frame assembly including:

a plurality of perimeter walls interconnected to one another, the plurality of perimeter walls including a pair of first and second adjacent perimeter walls connected to one another to form a corner, the first and second perimeter walls each defining an upper channel and a lower channel, the upper and lower channels of each of the first and second perimeter walls being positioned at an inner-facing side of the first and second perimeter walls; and a corner reinforcement bracket having an L-shape and received in the upper and lower channels of the first and second perimeter walls, the corner reinforcement bracket being devoid of fastener holes;

a top panel supported on an upper end section of the plurality of perimeter walls; and a concrete slab supported on the top panel.

14. The structure according to claim 13, wherein the corner reinforcement bracket has a height that extends from the upper end section of the plurality of perimeter walls to a lower end section of the plurality of perimeter walls.

15. The structure according to claim 13, wherein the corner reinforcement bracket includes a pair of first and second panel sections merged with one another to form a ninety-degree angle therebetween.

16. The structure according to claim 13, wherein the corner reinforcement bracket is slidably received in the upper and lower channels of each of the first and second perimeter walls.

17. The structure according to claim 13, wherein the corner reinforcement bracket is in abutment with the inner-facing side of the first and second perimeter walls.

18. The structure according to claim 13, further comprising a plurality of cross-frame members extending between the first perimeter wall and a third perimeter wall of the plurality of perimeter walls, the third perimeter wall being spaced apart from and parallel with the first perimeter wall.

19. The structure according to claim 13, further comprising a plurality of spacer elements snap-fitted to the upper end section of the plurality of perimeter walls, wherein the top panel is supported on the plurality of spacer elements.

* * * * *